US007900444B1

(12) United States Patent
McBride et al.

(10) Patent No.: US 7,900,444 B1
(45) Date of Patent: Mar. 8, 2011

(54) SYSTEMS AND METHODS FOR ENERGY STORAGE AND RECOVERY USING COMPRESSED GAS

(75) Inventors: Troy O. McBride, West Lebanon, NH (US); Benjamin R. Bollinger, West Lebanon, NH (US)

(73) Assignee: SustainX, Inc., West Lebanon, NH (US)

( * ) Notice: Subject to any disclaimer, the term of this patent is extended or adjusted under 35 U.S.C. 154(b) by 0 days.

(21) Appl. No.: 12/945,398

(22) Filed: Nov. 12, 2010

Related U.S. Application Data

(63) Continuation of application No. 12/421,057, filed on Apr. 9, 2009, now Pat. No. 7,832,207.

(60) Provisional application No. 61/043,630, filed on Apr. 9, 2008, provisional application No. 61/148,691, filed on Jan. 30, 2009.

(51) Int. Cl.
*F04B 49/00* (2006.01)
*F15B 1/02* (2006.01)

(52) U.S. Cl. ..... 60/410; 60/415; 60/416

(58) Field of Classification Search ..... 60/405, 60/407, 408, 410, 418, 459
See application file for complete search history.

(56) References Cited

U.S. PATENT DOCUMENTS

| | | | |
|---|---|---|---|
| 114,297 | A | 5/1871 | Ivens et al. |
| 224,081 | A | 2/1880 | Eckart |
| 233,432 | A | 10/1880 | Pitchford |
| 1,635,524 | A | 7/1927 | Aikman |
| 1,681,280 | A | 8/1928 | Bruckner |
| 2,025,142 | A | 12/1935 | Zahm et al. |
| 2,042,991 | A | 6/1936 | Harris, Jr. |
| 2,141,703 | A | 12/1938 | Bays |
| 2,280,100 | A | 4/1942 | SinQleton |
| 2,280,845 | A | 4/1942 | Parker |
| 2,404,660 | A | 7/1946 | Rouleau |
| 2,420,098 | A | 5/1947 | Rouleau |
| 2,539,862 | A | 1/1951 | Rushing |
| 2,628,564 | A | 2/1953 | Jacobs |
| 2,712,728 | A | 7/1955 | Lewis et al. |
| 2,813,398 | A | 11/1957 | Wilcox |
| 2,829,501 | A | 4/1958 | Walls |
| 2,880,759 | A | 4/1959 | Wisman |
| 3,041,842 | A | 7/1962 | Heinecke |
| 3,236,512 | A | 2/1966 | Caslav et al. |

(Continued)

FOREIGN PATENT DOCUMENTS

BE 898225 3/1984

(Continued)

OTHER PUBLICATIONS

"Hydraulic Transformer Supplies Continuous High Pressure," Machine Design, Penton Media, vol. 64, No. 17, (Aug. 1992), 1 page.

(Continued)

*Primary Examiner* — Thomas E Lazo
(74) *Attorney, Agent, or Firm* — Bingham McCutchen LLP

(57) ABSTRACT

The invention relates to methods and systems for the storage and recovery of energy using open-air hydraulic-pneumatic accumulator and intensifier arrangements that combine at least one accumulator and at least one intensifier in communication with a high-pressure gas storage reservoir on a gas-side of the circuits and a combination fluid motor/pump, coupled to a combination electric generator/motor on the fluid side of the circuits.

23 Claims, 82 Drawing Sheets

U.S. PATENT DOCUMENTS

| | | | |
|---|---|---|---|
| 3,269,121 | A | 8/1966 | Ludwig |
| 3,538,340 | A | 11/1970 | Lanq |
| 3,608,311 | A | 9/1971 | Roesel, Jr. |
| 3,648,458 | A | 3/1972 | McAlister |
| 3,650,636 | A | 3/1972 | Eskeli |
| 3,672,160 | A | 6/1972 | Kim |
| 3,677,008 | A | 7/1972 | Koutz |
| 3,704,079 | A | 11/1972 | Berlyn |
| 3,757,517 | A | 9/1973 | RiQollot |
| 3,793,848 | A | 2/1974 | Eskeli |
| 3,801,793 | A | 4/1974 | Goebel |
| 3,839,863 | A | 10/1974 | Frazier |
| 3,847,182 | A | 11/1974 | Greer |
| 3,895,493 | A | 7/1975 | Rigollot |
| 3,903,696 | A | 9/1975 | Carman |
| 3,935,469 | A | 1/1976 | Haydock |
| 3,939,356 | A | 2/1976 | Loane |
| 3,945,207 | A | 3/1976 | Hyatt |
| 3,948,049 | A | 4/1976 | Ohms et al. |
| 3,952,516 | A | 4/1976 | Lapp |
| 3,952,723 | A | 4/1976 | Browning |
| 3,958,899 | A | 5/1976 | Coleman, Jr. et al. |
| 3,986,354 | A | 10/1976 | Erb |
| 3,988,592 | A | 10/1976 | Porter |
| 3,988,897 | A | 11/1976 | Strub |
| 3,990,246 | A | 11/1976 | Wilmers |
| 3,991,574 | A | 11/1976 | Frazier |
| 3,996,741 | A | 12/1976 | Herberq |
| 3,998,049 | A | 12/1976 | McKinley et al. |
| 4,008,006 | A | 2/1977 | Bea |
| 4,027,993 | A | 6/1977 | Wolff |
| 4,030,303 | A | 6/1977 | Kraus et al. |
| 4,031,702 | A | 6/1977 | Burnett et al. |
| 4,031,704 | A | 6/1977 | Moore et al. |
| 4,041,708 | A | 8/1977 | Wolff |
| 4,050,246 | A | 9/1977 | Bourquardez |
| 4,055,950 | A | 11/1977 | Grossman |
| 4,058,979 | A | 11/1977 | Germain |
| 4,089,744 | A | 5/1978 | Cahn |
| 4,095,118 | A | 6/1978 | Rathbun |
| 4,100,745 | A | 7/1978 | Gyarmathy et al. |
| 4,108,077 | A | 8/1978 | Laing |
| 4,109,465 | A | 8/1978 | Plen |
| 4,110,987 | A | 9/1978 | Cahn et al. |
| 4,112,311 | A | 9/1978 | Theyse |
| 4,117,342 | A | 9/1978 | Melley, Jr. |
| 4,117,696 | A | 10/1978 | Fawcett et al. |
| 4,118,637 | A | 10/1978 | Tackett |
| 4,124,182 | A | 11/1978 | Loeb |
| 4,126,000 | A | 11/1978 | Funk |
| 4,136,432 | A | 1/1979 | Melley, Jr. |
| 4,142,368 | A | 3/1979 | Mantegani |
| 4,147,204 | A | 4/1979 | Pfenninger |
| 4,149,092 | A | 4/1979 | Cros |
| 4,150,547 | A | 4/1979 | Hobson |
| 4,154,292 | A | 5/1979 | Herrick |
| 4,167,372 | A | 9/1979 | Tackett |
| 4,170,878 | A | 10/1979 | Jahnig |
| 4,173,431 | A | 11/1979 | Smith |
| 4,189,925 | A | 2/1980 | Long |
| 4,197,700 | A | 4/1980 | Jahnig |
| 4,197,715 | A | 4/1980 | Fawcett et al. |
| 4,201,514 | A | 5/1980 | Huetter |
| 4,204,126 | A | 5/1980 | Diggs |
| 4,206,608 | A | 6/1980 | Bell |
| 4,209,982 | A | 7/1980 | Pitts |
| 4,220,006 | A | 9/1980 | Kindt |
| 4,229,143 | A | 10/1980 | Pucher et al. |
| 4,229,661 | A | 10/1980 | Mead et al. |
| 4,232,253 | A | 11/1980 | Mortelmans |
| 4,237,692 | A | 12/1980 | Ahrens et al. |
| 4,242,878 | A | 1/1981 | Brinkerhoff |
| 4,246,978 | A | 1/1981 | Schulz et al. |
| 4,262,735 | A | 4/1981 | Courrege et al. |
| 4,273,514 | A | 6/1981 | Shore et al. |
| 4,274,010 | A | 6/1981 | Lawson-Tancred |
| 4,275,310 | A | 6/1981 | Summers et al. |
| 4,281,256 | A | 7/1981 | Ahrens et al. |
| 4,293,323 | A | 10/1981 | Cohen |
| 4,299,198 | A | 11/1981 | Woodhull |
| 4,302,684 | A | 11/1981 | Gogins |
| 4,304,103 | A | 12/1981 | Hamrick |
| 4,311,011 | A | 1/1982 | Lewis |
| 4,316,096 | A | 2/1982 | Syverson |
| 4,317,439 | A | 3/1982 | Emmerling |
| 4,335,867 | A | 6/1982 | Bihlmaier |
| 4,340,822 | A | 7/1982 | Gregg |
| 4,341,072 | A | 7/1982 | Clyne |
| 4,348,863 | A | 9/1982 | Taylor et al. |
| 4,353,214 | A | 10/1982 | Gardner |
| 4,354,420 | A | 10/1982 | Bianchetta |
| 4,355,956 | A | 10/1982 | Ringrose et al. |
| 4,358,250 | A | 11/1982 | Payne |
| 4,367,786 | A | 1/1983 | Hafner et al. |
| 4,368,692 | A | 1/1983 | Kita |
| 4,368,775 | A | 1/1983 | Ward |
| 4,370,559 | A | 1/1983 | Langley, Jr. |
| 4,372,114 | A | 2/1983 | Burnham |
| 4,375,387 | A | 3/1983 | deFilippi et al. |
| 4,380,419 | A | 4/1983 | Morton |
| 4,393,752 | A | 7/1983 | Meier |
| 4,411,136 | A | 10/1983 | Funk |
| 4,421,661 | A | 12/1983 | Claar et al. |
| 4,428,711 | A | 1/1984 | Archer |
| 4,435,131 | A | 3/1984 | Ruben |
| 4,444,011 | A | 4/1984 | Kolin |
| 4,446,698 | A | 5/1984 | Benson |
| 4,447,738 | A | 5/1984 | Allison |
| 4,449,372 | A | 5/1984 | Rilett |
| 4,452,046 | A | 6/1984 | Valentin |
| 4,454,429 | A | 6/1984 | Buonome |
| 4,454,720 | A | 6/1984 | Leibowitz |
| 4,455,834 | A | 6/1984 | Earle |
| 4,462,213 | A | 7/1984 | Lewis |
| 4,474,002 | A | 10/1984 | Perry |
| 4,476,851 | A | 10/1984 | Brugger et al. |
| 4,478,553 | A | 10/1984 | Leibowitz et al. |
| 4,489,554 | A | 12/1984 | Otters |
| 4,491,739 | A | 1/1985 | Watson |
| 4,492,539 | A | 1/1985 | Specht |
| 4,493,189 | A | 1/1985 | Slater |
| 4,496,847 | A | 1/1985 | Parkings |
| 4,498,848 | A | 2/1985 | Petrovsky |
| 4,502,284 | A | 3/1985 | Chrisoghilos |
| 4,503,673 | A | 3/1985 | Schachle |
| 4,515,516 | A | 5/1985 | Perrine et al. |
| 4,520,840 | A | 6/1985 | Michel |
| 4,525,631 | A | 6/1985 | Allison |
| 4,530,208 | A | 7/1985 | Sato |
| 4,547,209 | A | 10/1985 | Netzer |
| 4,585,039 | A | 4/1986 | Hamilton |
| 4,589,475 | A | 5/1986 | Jones |
| 4,593,202 | A | 6/1986 | Dickinson |
| 4,619,225 | A | 10/1986 | Lowther |
| 4,624,623 | A | 11/1986 | Wagner |
| 4,648,801 | A | 3/1987 | Wilson |
| 4,651,525 | A | 3/1987 | Cestero |
| 4,653,986 | A | 3/1987 | Ashton |
| 4,671,742 | A | 6/1987 | Gyimesi |
| 4,676,068 | A | 6/1987 | Funk |
| 4,679,396 | A | 7/1987 | Heggie |
| 4,691,524 | A | 9/1987 | Holscher |
| 4,693,080 | A | 9/1987 | Van Hooff |
| 4,706,456 | A | 11/1987 | Backe |
| 4,707,988 | A | 11/1987 | Palmers |
| 4,710,100 | A | 12/1987 | Laing et al. |
| 4,735,552 | A | 4/1988 | Watson |
| 4,739,620 | A | 4/1988 | Pierce |
| 4,760,697 | A | 8/1988 | Heggie |
| 4,761,118 | A | 8/1988 | Zanarini et al. |
| 4,765,142 | A | 8/1988 | Nakhamkin |
| 4,765,143 | A | 8/1988 | Crawford et al. |
| 4,767,938 | A | 8/1988 | Bervig |
| 4,792,700 | A | 12/1988 | Ammons |
| 4,849,648 | A | 7/1989 | Longardner |
| 4,870,816 | A | 10/1989 | Nakhamkin |
| 4,872,307 | A | 10/1989 | Nakhamkin |

4,873,828 A 10/1989 Laing et al.
4,873,831 A 10/1989 Dehne
4,876,992 A 10/1989 Sobotowski
4,877,530 A 10/1989 Moses
4,885,912 A 12/1989 Nakhamkin
4,886,534 A 12/1989 Castan
4,907,495 A 3/1990 Sugahara
4,936,109 A 6/1990 Longardner
4,942,736 A 7/1990 Bronicki
4,955,195 A 9/1990 Jones et al.
4,984,432 A 1/1991 Corey
5,056,601 A 10/1991 Grimmer
5,058,385 A 10/1991 Everett, Jr.
5,062,498 A 11/1991 Tobias
5,107,681 A 4/1992 Wolfbauer, III
5,133,190 A 7/1992 Abdelmalek
5,138,838 A 8/1992 Crosser
5,140,170 A 8/1992 Henderson
5,152,260 A 10/1992 Erickson et al.
5,161,449 A 11/1992 Everett, Jr.
5,169,295 A 12/1992 Stogner et al.
5,182,086 A 1/1993 Henderson et al.
5,203,168 A 4/1993 Oshina
5,209,063 A 5/1993 Shirai et al.
5,213,470 A 5/1993 Lundquist
5,239,833 A 8/1993 Fineblum
5,259,345 A 11/1993 Richeson
5,271,225 A 12/1993 Adamides
5,279,206 A 1/1994 Krantz
5,296,799 A 3/1994 Davis
5,309,713 A 5/1994 Vassallo
5,321,946 A 6/1994 Abdelmalek
5,327,987 A 7/1994 Abdelmalek
5,339,633 A 8/1994 Fujii et al.
5,341,644 A 8/1994 Nelson
5,344,627 A 9/1994 Fujii et al.
5,364,611 A 11/1994 Iijima et al.
5,365,980 A 11/1994 Deberardinis
5,375,417 A 12/1994 Barth
5,379,589 A 1/1995 Cohn et al.
5,384,489 A 1/1995 Bellac
5,387,089 A 2/1995 Stogner et al.
5,394,693 A 3/1995 Plyter
5,427,194 A 6/1995 Miller
5,436,508 A 7/1995 Sorensen
5,448,889 A 9/1995 Bronicki
5,454,408 A 10/1995 DiBella et al.
5,454,426 A 10/1995 Moseley
5,467,722 A 11/1995 Meratla
5,477,677 A 12/1995 Krnavek
5,491,969 A 2/1996 Cohn et al.
5,491,977 A 2/1996 Cho
5,524,821 A 6/1996 Yie et al.
5,537,822 A 7/1996 Shnaid et al.
5,561,978 A 10/1996 Buschur
5,562,010 A 10/1996 McGuire
5,579,640 A 12/1996 Gray, Jr. et al.
5,584,664 A 12/1996 Elliott et al.
5,592,028 A 1/1997 Pritchard
5,598,736 A 2/1997 Erskine
5,599,172 A 2/1997 McCabe
5,600,953 A 2/1997 Oshita et al.
5,616,007 A 4/1997 Cohen
5,634,340 A 6/1997 Grennan
5,641,273 A 6/1997 Moseley
5,674,053 A 10/1997 Paul et al.
5,685,155 A 11/1997 Brown
5,768,893 A 6/1998 Hoshino et al.
5,769,610 A 6/1998 Paul et al.
5,771,693 A 6/1998 Coney
5,775,107 A 7/1998 Sparkman
5,778,675 A 7/1998 Nakhamkin
5,794,442 A 8/1998 Lisniansky
5,797,980 A 8/1998 Fillet
5,819,533 A 10/1998 Moonen
5,819,635 A 10/1998 Moonen
5,831,757 A 11/1998 DiFrancesco
5,832,728 A 11/1998 Buck
5,832,906 A 11/1998 Douville et al.
5,839,270 A 11/1998 Jirnov et al.
5,845,479 A 12/1998 Nakhamkin
5,873,250 A 2/1999 Lewis
5,901,809 A 5/1999 Berkun
5,924,283 A 7/1999 Burke, Jr.
5,934,063 A 8/1999 Nakhamkin
5,937,652 A 8/1999 Abdelmalek
5,971,027 A 10/1999 Beachley et al.
6,012,279 A 1/2000 Hines
6,023,105 A 2/2000 Youssef
6,026,349 A 2/2000 Heneman
6,029,445 A 2/2000 Lech
6,073,445 A 6/2000 Johnson
6,073,448 A 6/2000 Lozada
6,085,520 A 7/2000 Kohno
6,090,186 A 7/2000 Spencer
6,119,802 A 9/2000 Puett, Jr.
6,132,181 A 10/2000 McCabe
6,145,311 A 11/2000 Cyphelly
6,148,602 A 11/2000 Demetri
6,153,943 A 11/2000 Mistr, Jr.
6,158,499 A 12/2000 Rhodes
6,170,443 B1 1/2001 Hofbauer
6,178,735 B1 1/2001 Frutschi
6,179,446 B1 1/2001 Sarmadi
6,188,182 B1 2/2001 Nickols et al.
6,202,707 B1 3/2001 Woodall et al.
6,206,660 B1 3/2001 Coney et al.
6,210,131 B1 4/2001 Whitehead
6,216,462 B1 4/2001 Gray, Jr.
6,225,706 B1 5/2001 Keller
6,276,123 B1 8/2001 Chen et al.
6,327,858 B1 12/2001 Negre et al.
6,327,994 B1 12/2001 Labrador
6,349,543 B1 2/2002 Lisniansky
6,352,576 B1 3/2002 Spencer et al.
6,360,535 B1 3/2002 Fisher
6,367,570 B1 4/2002 Long, III
6,372,023 B1 4/2002 Kiyono et al.
6,389,814 B2 5/2002 Viteri et al.
6,397,578 B2 6/2002 Tsukamoto
6,401,458 B2 6/2002 Jacobson
6,407,465 B1 6/2002 Peltz et al.
6,419,462 B1 7/2002 Horie et al.
6,422,016 B2 7/2002 Alkhamis
6,478,289 B1 11/2002 Trewin
6,512,966 B2 1/2003 Lof
6,513,326 B1 2/2003 Maceda et al.
6,516,615 B1 2/2003 Stockhausen et al.
6,516,616 B2 2/2003 Carver
6,598,392 B2 7/2003 Majeres
6,598,402 B2 7/2003 Kataoka et al.
6,606,860 B2 8/2003 McFarland
6,612,348 B1 9/2003 Wiley
6,619,930 B2 9/2003 Jansen et al.
6,626,212 B2 9/2003 Morioka et al.
6,629,413 B1 10/2003 Wendt et al.
6,637,185 B2 10/2003 Hatamiya et al.
6,652,241 B1 11/2003 Alder
6,652,243 B2 11/2003 Krasnov
6,666,024 B1 12/2003 Moskal
6,670,402 B1 12/2003 Lee et al.
6,672,056 B2 1/2004 Roth et al.
6,675,765 B2 1/2004 Endoh et al.
6,688,108 B1 2/2004 Van Liere
6,698,472 B2 3/2004 Camacho et al.
6,711,984 B2 3/2004 Tagge et al.
6,712,166 B2 3/2004 Rush et al.
6,715,514 B2 4/2004 Parker, III
6,718,761 B2 4/2004 Merswolke et al.
6,739,131 B1 5/2004 Kershaw
6,745,569 B2 6/2004 Gerdes
6,745,801 B1 6/2004 Cohen et al.
6,748,737 B2 6/2004 Lafferty
6,762,926 B1 7/2004 Shiue et al.
6,786,245 B1 9/2004 Eichelberger et al.
6,789,387 B2 * 9/2004 Brinkman ..... 60/414
6,789,576 B2 9/2004 Umetsu et al.
6,797,039 B2 9/2004 Spencer 6,815,840 B1 11/2004 Aldendeshe
6,817,185 B2 11/2004 Coney et al.
6,834,737 B2 12/2004 Bloxham
6,848,259 B2 2/2005 Keller-Sornig
6,857,450 B2 2/2005 Rupp
6,886,326 B2 5/2005 Holtzapple et al.
6,900,556 B2 5/2005 Provanzana
6,922,991 B2 8/2005 Polcuch
6,925,821 B2 8/2005 Sienel
6,927,503 B2 8/2005 Enish et al.
6,931,848 B2 8/2005 Maceda et al.
6,935,096 B2 8/2005 Haiun
6,938,415 B2 9/2005 Last
6,938,654 B2 9/2005 Gershtein et al.
6,946,017 B2 9/2005 Leppin et al.
6,948,328 B2 9/2005 Kidwell
6,952,058 B2 10/2005 Mccoin
6,959,546 B2 11/2005 Corcoran
6,963,802 B2 11/2005 Enis
6,964,165 B2 11/2005 Uhl et al.
6,964,176 B2 11/2005 Kidwell
6,974,307 B2 12/2005 Antoune et al.
7,000,389 B2 2/2006 Lewellin
7,007,474 B1 3/2006 Ochs et al.
7,017,690 B2 3/2006 Burke
7,028,934 B2 4/2006 Burynski, Jr.
7,040,083 B2 5/2006 Horii et al.
7,040,108 B1 5/2006 Flammang
7,040,859 B2 5/2006 Kane
7,043,920 B2 5/2006 Viteri et al.
7,047,744 B1 5/2006 Robertson et al.
7,055,325 B2 6/2006 Wolken
7,067,937 B2 6/2006 Enish et al.
7,075,189 B2 7/2006 Heronemus
RE39,249 E 8/2006 Link, Jr.
7,084,520 B2 8/2006 Zambrano
7,086,231 B2 8/2006 Pinkerton
7,093,450 B2 8/2006 Jimenez Haertel et al.
7,093,626 B2 8/2006 Li et al.
7,098,552 B2 8/2006 Mccoin
7,107,766 B2 9/2006 Zacche'et al.
7,107,767 B2 9/2006 Frazer et al.
7,116,006 B2 10/2006 Mccoin
7,124,576 B2 10/2006 Cherney et al.
7,124,586 B2 10/2006 Negre et al.
7,127,895 B2 10/2006 Pinkerton et al.
7,128,777 B2 10/2006 Spencer
7,134,279 B2 11/2006 White
7,155,912 B2 1/2007 Enis et al.
7,168,928 B1 1/2007 West
7,168,929 B2 1/2007 Siegel et al.
7,169,489 B2 1/2007 Redmond
7,177,751 B2 2/2007 Froloff
7,178,337 B2 2/2007 Pflanz
7,191,603 B2 3/2007 Taube
7,197,871 B2 4/2007 Yoshino
7,201,095 B2 4/2007 Hughey
7,218,009 B2 5/2007 Hendrickson et al.
7,219,779 B2 5/2007 Bauer et al.
7,225,762 B2 6/2007 Mahlanen
7,228,690 B2 6/2007 Barker
7,230,348 B2 6/2007 Poole
7,231,998 B1 6/2007 Schechter
7,240,812 B2 7/2007 Kamikozuru
7,249,617 B2 7/2007 Musselman et al.
7,254,944 B1 8/2007 Goetzinger et al.
7,273,122 B2 9/2007 Rose
7,281,371 B1 10/2007 Heidenreich et al.
7,308,361 B2 12/2007 Enis et al.
7,317,261 B2 1/2008 Rolt
7,322,377 B2 1/2008 Baltes
7,325,401 B1 2/2008 Kesseli et al.
7,328,575 B2 2/2008 Hedman
7,329,099 B2 2/2008 Hartman
7,347,049 B2 3/2008 Rajendran et al.
7,353,845 B2 4/2008 Underwood et al.
7,354,252 B2 4/2008 Baatrup et al.
7,364,410 B2 4/2008 Link, Jr.
7,392,871 B2 7/2008 Severinsky et al.
7,406,828 B1 8/2008 Nakhamkin
7,407,501 B2 8/2008 Zvuloni
7,415,835 B2 8/2008 Cowans et al.
7,415,995 B2 8/2008 Plummer et al.
7,417,331 B2 8/2008 de la Torre et al.
7,418,820 B2 9/2008 Harvey et al.
7,436,086 B2 10/2008 Mcclintic
7,441,399 B2 10/2008 Utamura
7,448,213 B2 11/2008 Mitani
7,453,164 B2 11/2008 Borden et al.
7,469,527 B2 12/2008 Negre et al.
7,471,010 B1 12/2008 Fingersh
7,481,337 B2 1/2009 Luharuka et al.
7,488,159 B2 2/2009 Bhatt et al.
7,527,483 B1 5/2009 Glauber
7,579,700 B1 8/2009 Meller
7,603,970 B2 10/2009 Scuderi et al.
7,607,503 B1 10/2009 Schechter
7,693,402 B2 4/2010 Hudson et al.
7,802,426 B2 9/2010 Bollinger
7,827,787 B2 * 11/2010 Cherney et al. ..... 60/459
2001/0045093 A1 11/2001 Jacobson
2003/0131599 A1 7/2003 Gerdes
2003/0145589 A1 8/2003 Tillyer
2003/0177767 A1 9/2003 Keller-Sornig et al.
2003/0180155 A1 9/2003 Coney et al.
2004/0050042 A1 3/2004 Frazer
2004/0050049 A1 3/2004 Wendt et al.
2004/0146406 A1 7/2004 Last
2004/0146408 A1 7/2004 Anderson
2004/0148934 A1 8/2004 Pinkerton et al.
2004/0211182 A1 10/2004 Gould
2004/0244580 A1 12/2004 Coney et al.
2004/0261415 A1 12/2004 Negre et al.
2005/0016165 A1 1/2005 Enis et al.
2005/0028529 A1 2/2005 Bartlett et al.
2005/0047930 A1 3/2005 Schmid
2005/0072154 A1 4/2005 Frutschi
2005/0115234 A1 6/2005 Asano et al.
2005/0155347 A1 7/2005 Lewellin
2005/0166592 A1 8/2005 Larson et al.
2005/0274334 A1 12/2005 Warren
2005/0275225 A1 12/2005 Bertolotti
2005/0279086 A1 12/2005 Hoos
2005/0279292 A1 12/2005 Hudson et al.
2006/0055175 A1 3/2006 Grinblat
2006/0059936 A1 3/2006 Radke et al.
2006/0059937 A1 3/2006 Perkins et al.
2006/0075749 A1 4/2006 Cherney et al.
2006/0090467 A1 5/2006 Crow
2006/0090477 A1 5/2006 Rolff
2006/0107664 A1 5/2006 Hudson et al.
2006/0162543 A1 7/2006 Abe et al.
2006/0175337 A1 8/2006 Defosset
2006/0201148 A1 9/2006 Zabtcioglu
2006/0248886 A1 11/2006 Ma
2006/0248892 A1 11/2006 Ingersoll
2006/0254281 A1 11/2006 Badeer et al.
2006/0260311 A1 11/2006 Ingersoll
2006/0260312 A1 11/2006 Ingersoll
2006/0262465 A1 11/2006 Wiederhold
2006/0266034 A1 11/2006 Ingersoll
2006/0266035 A1 11/2006 Ingersoll et al.
2006/0266036 A1 11/2006 Ingersoll
2006/0266037 A1 11/2006 Ingersoll
2006/0280993 A1 12/2006 Keefer et al.
2006/0283967 A1 12/2006 Cho et al.
2007/0006586 A1 1/2007 Hoffman et al.
2007/0022754 A1 2/2007 Perkins et al.
2007/0022755 A1 2/2007 Pinkerton et al.
2007/0062194 A1 3/2007 Ingersoll
2007/0074533 A1 4/2007 Hugenroth et al.
2007/0095069 A1 5/2007 Joshi et al.
2007/0113803 A1 5/2007 Froloff et al.
2007/0116572 A1 5/2007 Barbu et al.
2007/0137595 A1 6/2007 Greenwell
2007/0151528 A1 7/2007 Hedman
2007/0158946 A1 7/2007 Annen et al.
2007/0181199 A1 8/2007 Weber

| | | | |
|---|---|---|---|
| 2007/0182160 | A1 | 8/2007 | Enis et al. |
| 2007/0205298 | A1 | 9/2007 | Harrison et al. |
| 2007/0234749 | A1 | 10/2007 | Enis et al. |
| 2007/0243066 | A1 | 10/2007 | Baron |
| 2007/0245735 | A1 | 10/2007 | Ashikian |
| 2007/0258834 | A1 | 11/2007 | Froloff et al. |
| 2008/0000436 | A1 | 1/2008 | Goldman |
| 2008/0016868 | A1 | 1/2008 | Ochs et al. |
| 2008/0047272 | A1 | 2/2008 | Schoell |
| 2008/0050234 | A1 | 2/2008 | Ingersoll et al. |
| 2008/0072870 | A1 | 3/2008 | Chomyszak et al. |
| 2008/0087165 | A1 | 4/2008 | Wright et al. |
| 2008/0104939 | A1 | 5/2008 | Hoffmann et al. |
| 2008/0112807 | A1 | 5/2008 | Uphues et al. |
| 2008/0127632 | A1 | 6/2008 | Finkenrath et al. |
| 2008/0138265 | A1 | 6/2008 | Lackner et al. |
| 2008/0155975 | A1 | 7/2008 | Brinkman |
| 2008/0155976 | A1 | 7/2008 | Smith et al. |
| 2008/0157528 | A1 | 7/2008 | Wang et al. |
| 2008/0157537 | A1 | 7/2008 | Richard |
| 2008/0164449 | A1 | 7/2008 | Gray et al. |
| 2008/0185194 | A1 | 8/2008 | Leone |
| 2008/0202120 | A1 | 8/2008 | Karyambas |
| 2008/0211230 | A1 | 9/2008 | Gurin |
| 2008/0228323 | A1 | 9/2008 | Laumer et al. |
| 2008/0233029 | A1 | 9/2008 | Fan et al. |
| 2008/0238105 | A1 | 10/2008 | Ortiz et al. |
| 2008/0238187 | A1 | 10/2008 | Garnett et al. |
| 2008/0250788 | A1 | 10/2008 | Nuel et al. |
| 2008/0251302 | A1 | 10/2008 | Lynn et al. |
| 2008/0272597 | A1 | 11/2008 | Althaus |
| 2008/0272598 | A1 | 11/2008 | Nakhamkin |
| 2008/0272605 | A1 | 11/2008 | Borden et al. |
| 2008/0308168 | A1 | 12/2008 | O'Brien, II et al. |
| 2008/0308270 | A1 | 12/2008 | Wilson |
| 2008/0315589 | A1 | 12/2008 | Malmrup |
| 2009/0000290 | A1 | 1/2009 | Brinkman |
| 2009/0007558 | A1 | 1/2009 | Hall et al. |
| 2009/0008173 | A1 | 1/2009 | Hall et al. |
| 2009/0010772 | A1 | 1/2009 | Siemroth |
| 2009/0020275 | A1 | 1/2009 | Neher et al. |
| 2009/0021012 | A1 | 1/2009 | Stull et al. |
| 2009/0056331 | A1 | 3/2009 | Zhao et al. |
| 2009/0071153 | A1 | 3/2009 | Boyapati et al. |
| 2009/0107784 | A1 | 4/2009 | Gabriel et al. |
| 2009/0145130 | A1 | 6/2009 | Kaufman |
| 2009/0158740 | A1 | 6/2009 | Littau et al. |
| 2009/0178409 | A1 | 7/2009 | Shinnar |
| 2009/0200805 | A1 | 8/2009 | Kim et al. |
| 2009/0229902 | A1 | 9/2009 | Stansbury, III |
| 2009/0249826 | A1 | 10/2009 | Hugelman |
| 2009/0282822 | A1 | 11/2009 | McBride et al. |
| 2009/0282840 | A1 | 11/2009 | Chen et al. |
| 2009/0294096 | A1 | 12/2009 | Mills et al. |
| 2009/0301089 | A1 | 12/2009 | Bollinger |
| 2009/0317267 | A1 | 12/2009 | Gill et al. |
| 2009/0322090 | A1 | 12/2009 | Wolf |
| 2010/0077765 | A1 | 4/2010 | Japikse |
| 2010/0089063 | A1 | 4/2010 | McBride et al. |
| 2010/0139277 | A1 | 6/2010 | McBride et al. |
| 2010/0193270 | A1 | 8/2010 | Deshaies et al. |
| 2010/0205960 | A1 | 8/2010 | McBride et al. |
| 2010/0229544 | A1 | 9/2010 | Bollinger et al. |

FOREIGN PATENT DOCUMENTS

| | | | |
|---|---|---|---|
| BE | 1008885 | | 8/1996 |
| CN | 1061262 | | 5/1992 |
| CN | 1171490 | | 1/1998 |
| CN | 1276308 | | 12/2000 |
| CN | 1277323 | | 12/2000 |
| CN | 1412443 | | 4/2003 |
| CN | 1743665 | | 3/2006 |
| CN | 2821162 | | 9/2006 |
| CN | 2828319 | | 10/2006 |
| CN | 2828368 | | 10/2006 |
| CN | 1884822 | | 12/2006 |
| CN | 1888328 | | 1/2007 |
| CN | 1967091 | | 5/2007 |
| CN | 101033731 | | 9/2007 |
| CN | 101042115 | | 9/2007 |
| CN | 101070822 | | 11/2007 |
| CN | 101149002 | | 3/2008 |
| CN | 101162073 | | 4/2008 |
| CN | 201103518 | | 8/2008 |
| CN | 201106527 | | 8/2008 |
| CN | 101289963 | | 10/2008 |
| CN | 201125855 | | 10/2008 |
| CN | 101377190 | | 4/2009 |
| CN | 101408213 | | 4/2009 |
| CN | 101435451 | | 5/2009 |
| DE | 25 38 870 | | 6/1977 |
| DE | 19530253 | | 11/1996 |
| DE | 19903907 | | 8/2000 |
| DE | 19911534 | | 9/2000 |
| DE | 10042020 | | 5/2001 |
| DE | 20118183 | | 3/2003 |
| DE | 20120330 | | 4/2003 |
| DE | 10147940 | | 5/2003 |
| DE | 10205733 | | 8/2003 |
| DE | 10212480 | | 10/2003 |
| DE | 20312293 | | 12/2003 |
| DE | 10220499 | | 4/2004 |
| DE | 10334637 | | 2/2005 |
| DE | 10 2005 047622 | | 4/2007 |
| EP | 0204748 | | 3/1981 |
| EP | 0091801 | | 10/1983 |
| EP | 0097002 | | 12/1983 |
| EP | 0196690 | | 10/1986 |
| EP | 0212692 | | 3/1987 |
| EP | 0364106 | | 4/1990 |
| EP | 0507395 | | 10/1992 |
| EP | 0821162 | | 1/1998 |
| EP | 0 857 877 | | 8/1998 |
| EP | 1 388 442 | | 2/2004 |
| EP | 1405662 | | 4/2004 |
| EP | 1726350 | | 11/2006 |
| EP | 1741899 | | 1/2007 |
| EP | 1 780 058 | | 5/2007 |
| EP | 1988294 | | 11/2008 |
| EP | 2014896 | | 1/2009 |
| EP | 2078857 | | 7/2009 |
| FR | 2816993 | | 5/2002 |
| FR | 2829805 | | 3/2003 |
| GB | 722524 | | 11/1951 |
| GB | 772703 | | 4/1957 |
| GB | 1449076 | | 9/1976 |
| GB | 1479940 | | 7/1977 |
| GB | 2106992 | | 4/1983 |
| GB | 2223810 | | 4/1990 |
| GB | 2 300 673 | | 11/1996 |
| GB | 2373546 | | 9/2002 |
| GB | 2403356 | | 12/2004 |
| JP | 57010778 | | 1/1982 |
| JP | 57070970 | | 5/1982 |
| JP | 57120058 | | 7/1982 |
| JP | 58183880 | | 10/1982 |
| JP | 58150079 | | 9/1983 |
| JP | 58192976 | | 11/1983 |
| JP | 60206985 | | 10/1985 |
| JP | 62101900 | | 5/1987 |
| JP | 63227973 | | 9/1988 |
| JP | 2075674 | | 3/1990 |
| JP | 2247469 | | 10/1990 |
| JP | 3009090 | | 1/1991 |
| JP | 3281984 | | 12/1991 |
| JP | 4121424 | | 4/1992 |
| JP | 6185450 | | 7/1994 |
| JP | 8145488 | | 6/1996 |
| JP | 9166079 | | 6/1997 |
| JP | 11351125 | | 12/1999 |
| JP | 2000166128 | | 6/2000 |
| JP | 200346093 | | 12/2000 |
| JP | 2000346093 | A * | 12/2000 |
| JP | 2002127902 | | 5/2002 |
| JP | 2003083230 | | 3/2003 |
| JP | 2005023918 | | 1/2005 |
| JP | 2005036769 | | 2/2005 |
| JP | 2005068963 | | 3/2005 |

| | | |
|---|---|---|
| JP | 2006220252 | 8/2006 |
| JP | 2007001872 | 1/2007 |
| JP | 2007145251 | 6/2007 |
| JP | 2007211730 | 8/2007 |
| JP | 2008038658 | 2/2008 |
| KR | 840000180 | 2/1984 |
| KR | 2004004637 | 1/2004 |
| RU | 2101562 | 1/1998 |
| RU | 2169857 | 6/2001 |
| RU | 2213255 | 9/2003 |
| SU | 800438 | 1/1981 |
| UA | 69030 | 8/2004 |
| WO | WO-82/00319 | 2/1982 |
| WO | WO-8802818 | 4/1988 |
| WO | WO-99/41498 | 8/1990 |
| WO | WO-92/22741 | 12/1992 |
| WO | WO-93/06367 | 4/1993 |
| WO | WO-93/11363 | 6/1993 |
| WO | WO-93/24754 | 12/1993 |
| WO | WO 199412785 | 6/1994 |
| WO | WO-95/25381 | 9/1995 |
| WO | WO-96/01942 | 1/1996 |
| WO | WO-96/22456 | 7/1996 |
| WO | WO-96/34213 | 10/1996 |
| WO | WO-97/01029 | 1/1997 |
| WO | WO-97/17546 | 5/1997 |
| WO | WO-98/02818 | 1/1998 |
| WO | WO-98/17492 | 4/1998 |
| WO | WO-00/01945 | 1/2000 |
| WO | WO-00/37800 | 6/2000 |
| WO | WO-00/65212 | 11/2000 |
| WO | WO-00/68578 | 11/2000 |
| WO | WO 200175290 | 10/2001 |
| WO | WO-02/25083 | 3/2002 |
| WO | WO-02/46621 | 6/2002 |
| WO | WO-02/103200 | 12/2002 |
| WO | WO-03/078812 | 9/2003 |
| WO | WO-2004/034391 | 5/2004 |
| WO | WO-2004/059155 | 7/2004 |
| WO | WO-2004/072452 | 8/2004 |
| WO | WO-2004/074679 | 9/2004 |
| WO | WO-2004/109172 | 12/2004 |
| WO | WO-2005/044424 | 5/2005 |
| WO | WO-2005/062969 | 7/2005 |
| WO | WO-2005/067373 | 7/2005 |
| WO | WO-2005/079461 | 9/2005 |
| WO | WO-2005/088131 | 9/2005 |
| WO | WO-2005/095155 | 10/2005 |
| WO | WO-2006/029633 | 3/2006 |
| WO | WO-2006/058085 | 6/2006 |
| WO | WO-2006/124006 | 11/2006 |
| WO | WO-2007/002094 | 1/2007 |
| WO | WO-2007/003954 | 1/2007 |
| WO | WO-2007/012143 | 2/2007 |
| WO | WO-2007/035997 | 4/2007 |
| WO | WO-2007/051034 | 5/2007 |
| WO | WO-2007/066117 | 6/2007 |
| WO | WO-2007-086792 | 8/2007 |
| WO | WO-2007/089872 | 8/2007 |
| WO | WO-2007/096656 | 8/2007 |
| WO | WO-2007/111839 | 10/2007 |
| WO | WO-2007/136765 | 11/2007 |
| WO | WO-2008/003950 | 1/2008 |
| WO | WO-2008/014769 | 2/2008 |
| WO | WO-2008023901 | 2/2008 |
| WO | WO-2008/027259 | 3/2008 |
| WO | WO-2008/028881 | 3/2008 |
| WO | WO-2008/039725 | 4/2008 |
| WO | WO-2008/045468 | 4/2008 |
| WO | WO-2009045468 | 4/2008 |
| WO | WO-2008/051427 | 5/2008 |
| WO | WO-2008/074075 | 6/2008 |
| WO | WO-2008/084507 | 7/2008 |
| WO | WO-2008/091373 | 7/2008 |
| WO | WO 2008102292 | 8/2008 |
| WO | WO-2008/106967 | 9/2008 |
| WO | WO-2008/108870 | 9/2008 |
| WO | WO-2008/109006 | 9/2008 |
| WO | WO-2008/110018 | 9/2008 |
| WO | WO-2008/115479 | 9/2008 |
| WO | WO-2008/121378 | 10/2008 |
| WO | WO-2008139267 | 11/2008 |
| WO | WO-2008/152432 | 12/2008 |
| WO | WO-2008/153591 | 12/2008 |
| WO | WO-2008/157327 | 12/2008 |
| WO | WO-2009/034548 | 3/2009 |
| WO | WO-2009/038973 | 3/2009 |
| WO | WO-2009/045110 | 4/2009 |
| WO | WO-2009/114205 | 9/2009 |
| WO | WO-2009/126784 | 10/2009 |
| WO | WO-2010/006319 | 1/2010 |
| WO | WO-2010/009053 | 1/2010 |

OTHER PUBLICATIONS

Lemofouet, "Investigation and Optimisation of Hybrid Electricity Storage Systems Based on Compressed Air and Supercapacitors," (Oct. 20, 2006), 250 pages.

Cyphelly et al., "Usage of Compressed Air Storage Systems," BFE-Program "Electricity," Final Report, May 2004, 14 pages.

Lemofouet et al., "A Hybrid Energy Storage System Based on Compressed Air and Supercapacitors with Maximum Efficiency Point Tracking (MEPT)," IEEE Transactions on Industrial Electron, vol. 53, No. 4, (Aug. 2006) pp. 1105-1115.

International Search Report and Written Opinion issued Sep. 15, 2009 for International Application No. PCT/US2009/040027, 8 pages.

International Search Report and Written Opinion issued Aug. 30, 2010 for International Application No. PCT/US2010/029795, 9 pages.

International Search Report and Written Opinion issued Dec. 3, 2009 for International Application No. PCT/US2009/046725, 9 pages.

* cited by examiner

| DEVICE | TIME INSTANCE | | | | | |
|---|---|---|---|---|---|---|
| | 1 | 2 | 3 | 4 | 5 | 6 |
| A1 | A1 drive | A1 drive | A1 drive | Drive I1 | A1 fill | A1 fill x2 |
| A2 | A2 fill | A2 fill x2 | A2 drive | A2 drive | A2 drive | Drive I1 |
| A3 | A3 drive | Drive I1 | A3 fill | A3 fill x2 | A3 drive | A3 drive |
| I1 | I1 fill | I1 drive | I1 fill | I1 drive | I1 fill | I1 drive |

FIG. 8

| DEVICE | TIME INSTANCE | | | | | | | |
|---|---|---|---|---|---|---|---|---|
| | 1 | 2 | 3 | 4 | 5 | 6 | 7 | 8 |
| A1 | A1 drive | A1 drive | A1 drive | Drive I1 | Drive I1 | A1 fill | A1 fill | A1 fill |
| A2 | A2 fill | A2 fill | A2 drive | A2 drive | A2 drive | Drive I2 | Drive I2 | A2 fill |
| A3 | Drive I1 | A3 fill | A3 fill | A3 fill | A3 drive | A3 drive | A3 drive | Drive I1 |
| A4 | A4 drive | Drive I2 | Drive I2 | A4 fill | A4 fill | A4 fill | A4 drive | A4 drive |
| I1 | I1 drive | I1 fill | I1 fill | I1 drive | I1 drive | I1 fill | I1 fill | I1 drive |
| I2 | I2 fill | I2 drive | I2 drive | I2 fill | I2 fill | I2 drive | I2 drive | I2 fill |

FIG. 10

Adiabatic Cycle — Expansion

Alabama CAES: Diabatic Compression cycle

In practice, no compressed air energy storage (CAES) facility uses pure adiabatic compression or expansion due to the energy losses and temperatures involved.

The McIntosh Alabama CAES plant, for example, uses four turbo-compressors with intercoolers (heat exchangers) to reduce maximum gas temperatures, thereby moving the compression line below the pure adiabatic case and closer to the purely isothermal case, increasing thermal efficiency.

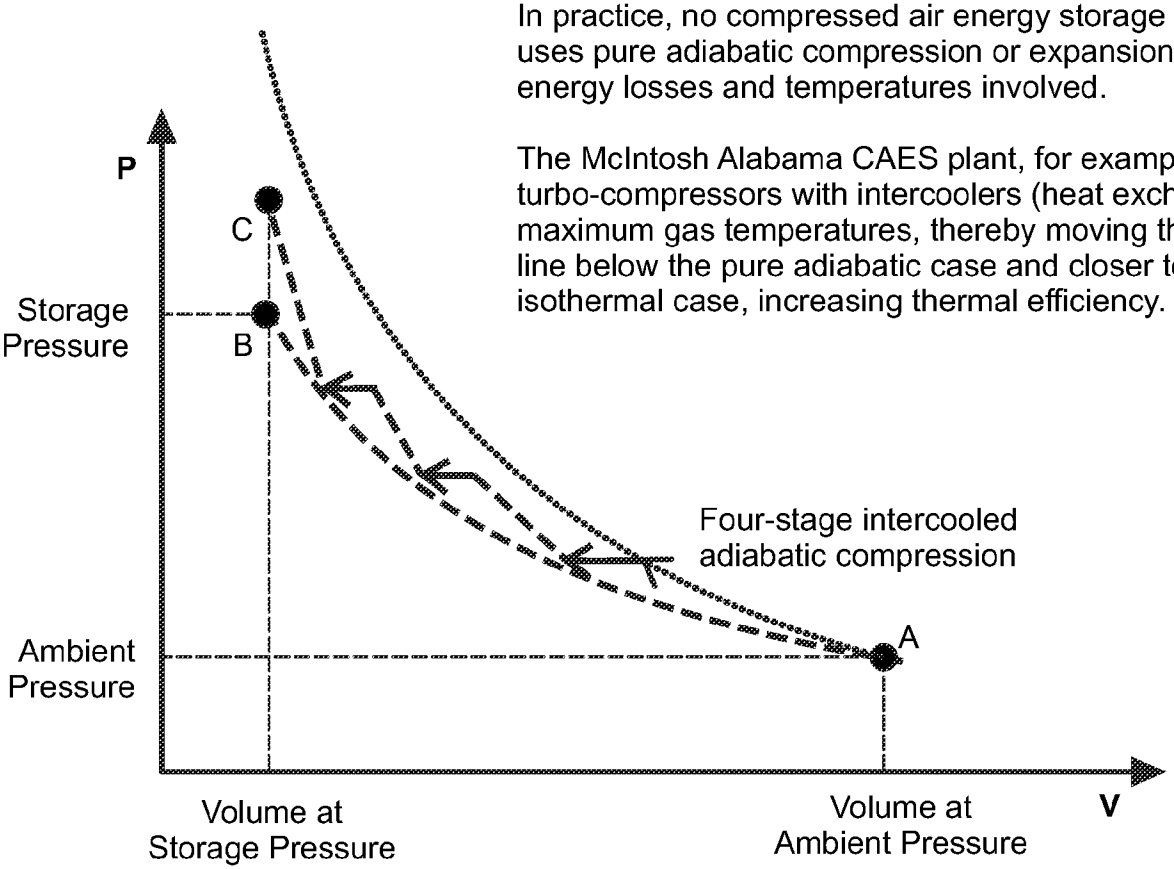

FIG. 15M

Alabama CAES: Aftercooler and gas storage

However, a good deal of heat energy is still lost in the compression process (shaded area).

While additional turbocompressors and intercoolers do make the process more thermally efficiency by allowing it to be closer to the isothermal case, there are drawbacks. The additional turbocompressors means additional mechanical and volumetric efficiency losses. The additional intercoolers result in greater pressure-drop losses. Furthermore, the added components result in a significant additional capital cost.

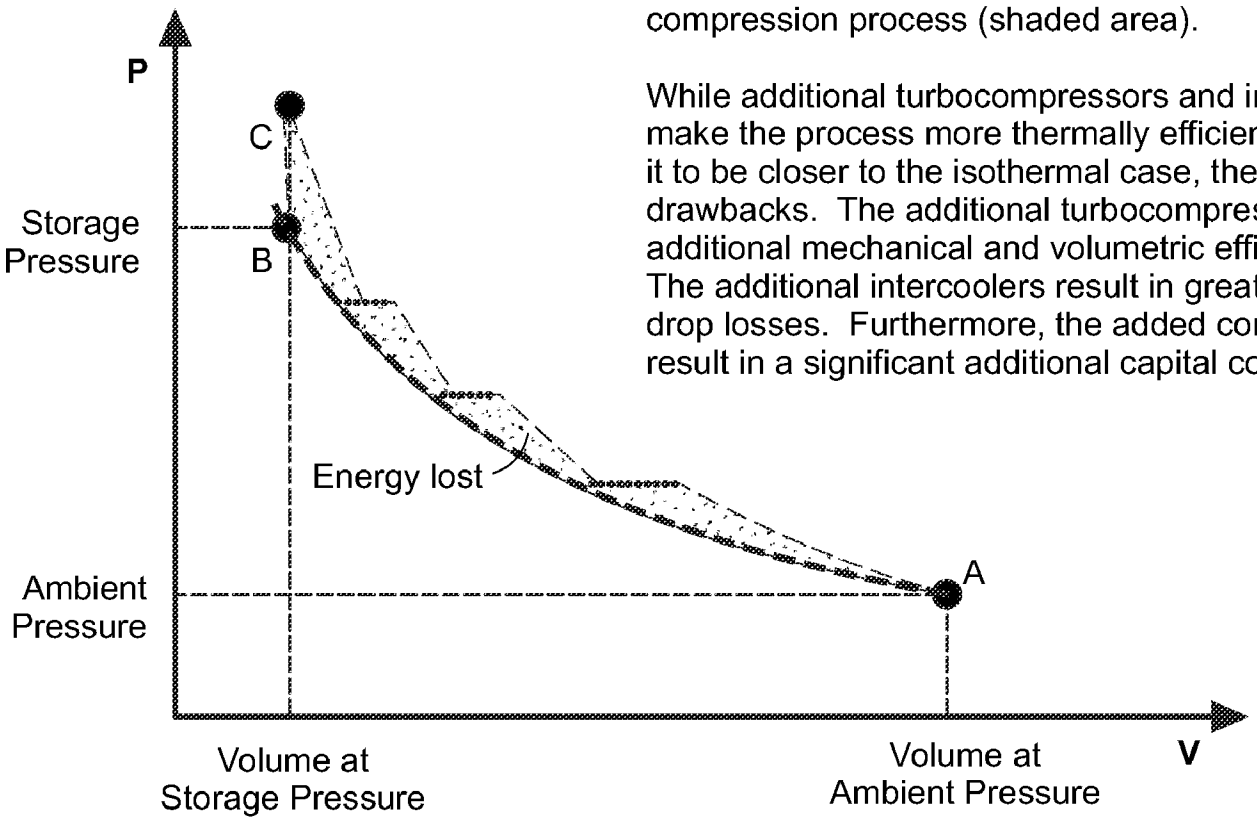

FIG. 15N

Alabama CAES: Recuperator Preheating

In the Alabama plant, natural gas combustion is used to heat the expanding gas to prevent the gas from cooling down to very cold temperatures (as in slide 13). The first stage of the expansion process uses waste heat from the combustion in gas at the end of the cycle (line IA) to preheat the at the gas at the beginning of the cycle (line BE)

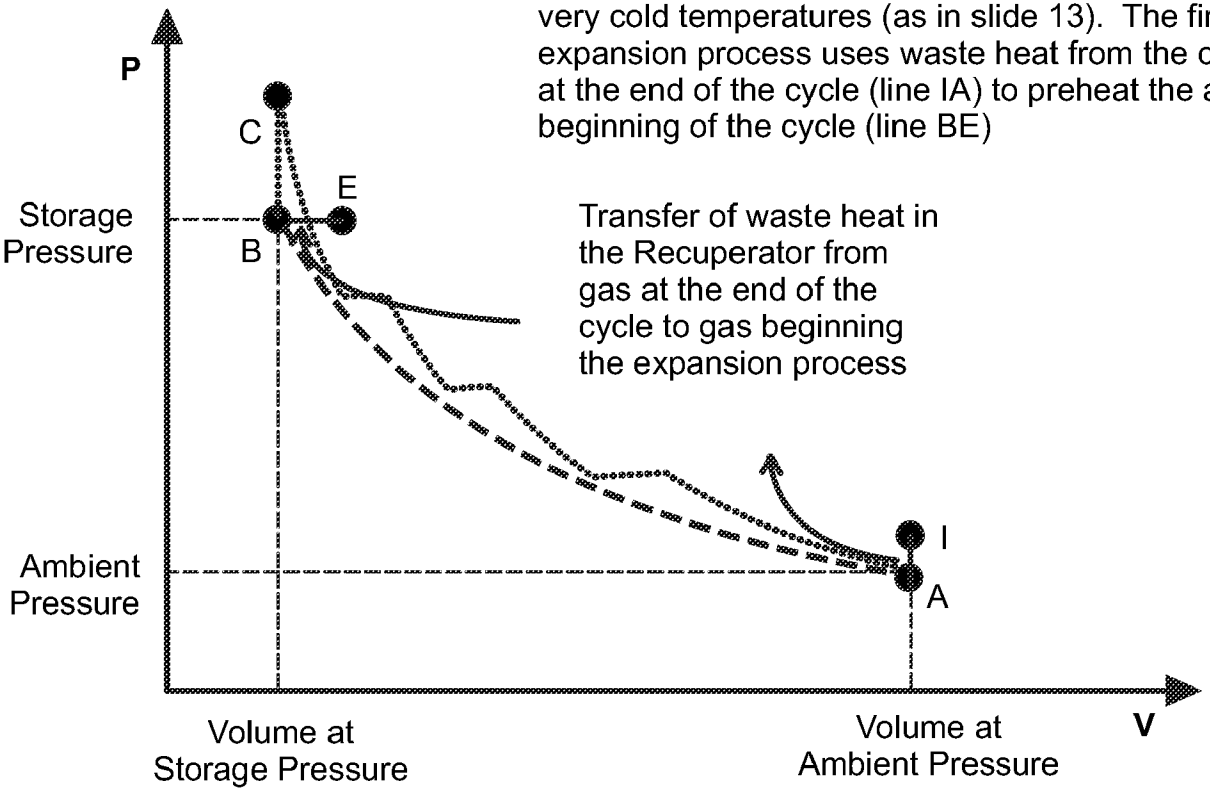

FIG. 15O

Alabama CAES: Combustion and Expansion

ESS-Compression cycle

The hydraulic-pneumatic conversion system uses a completely different approach to compressed air energy storage. Rather than compressing and expanding the air in turbocompressors and turbines, in which the process is inherently adiabatic, the Inventive system instead compresses and expands the gas within hydraulic cylinders (accumulators and intensifiers), which allows for controlled heat transfer with the ambient surroundings during compression and expansion. The result is a near-isothermal compression process (dotted line) in which the gas temperature is only slightly above ambient.

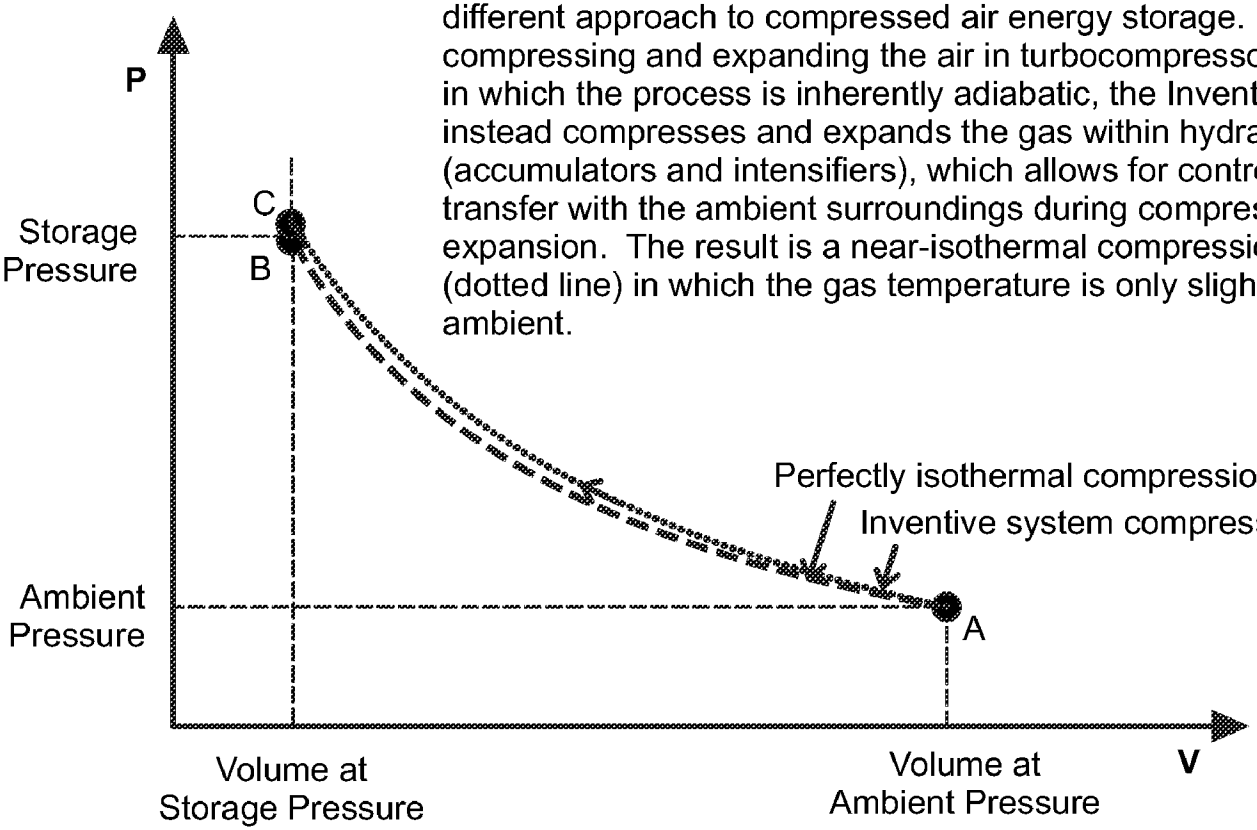

FIG. 15Q

ESS-Expansion cycle

Similarly to compression the result of the design is a near-isothermal expansion process (double dot and dash line) in which the gas temperature is only slightly below ambient. The controlled rate of gas expansion allows time for heat energy to be recovered from the surroundings, maintaining the gas temperature at only slightly below ambient. The result is a very high thermal efficiencies.

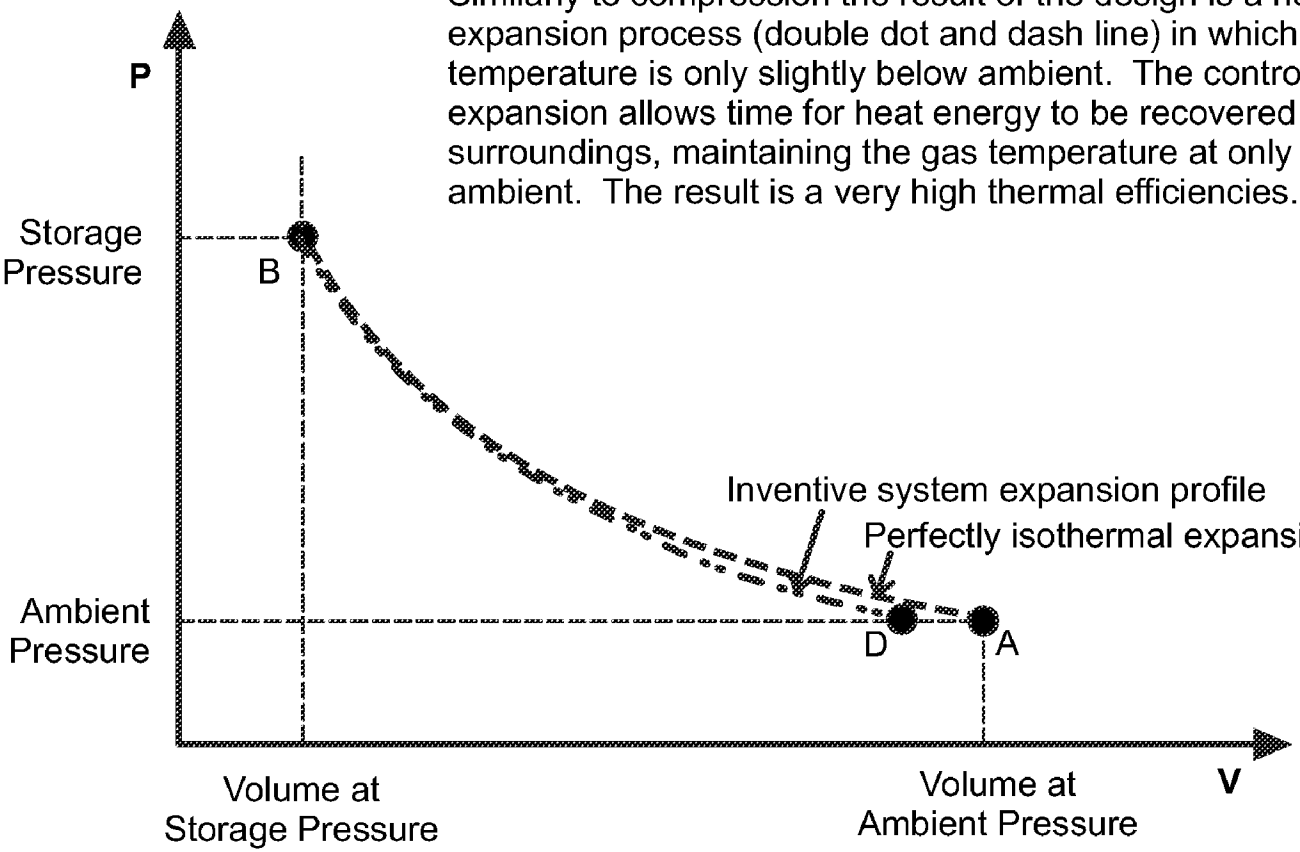

FIG. 15R

ESS-Effect of ambient temperature swing

On the other hand, if the ambient temperature increases after the gas is compressed, then the pressure in the gas in the storage tank will increase (arrow) from B to B'. This would be the case during the daytime, for example, if the gas was originally compressed during a cold night, a typical situation for energy arbitrage, buying cheap energy at night, storing it, and returning it during the daytime. If the gas is then expanded (curve), more energy will be recovered from the surroundings and the thermal efficiency will be higher.

As a point of reference, a 30° increase in ambient temperature between the time of compression and the time of expansion will result in a 6% increase in thermal efficiency.

This has the potential to result in a greater than 100% thermal efficiency for the expansion due to the heat added by the increase in ambient temperature.

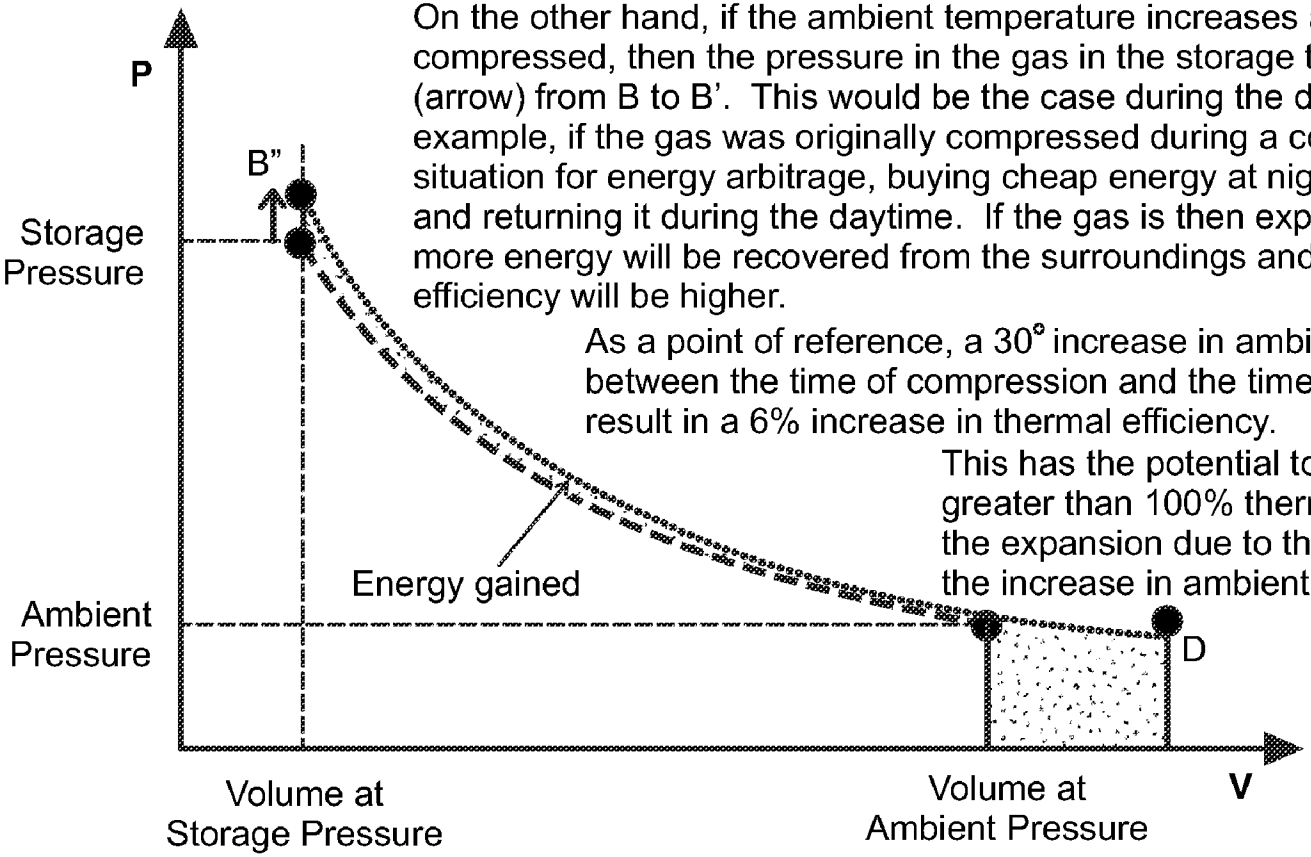

FIG. 15U

ESS-Cogeneration potential

An even greater efficiency gain can be realized by pairing the Inventive system (ESS) with a process that generates waste heat. One example situation would be pairing the system with a nuclear power plant, storing energy off-peak. When the stored gas is expanded, waste heat from the nuclear cooling tower can be used to pre-heat the gas to higher temperature, moving it from B to D'.

Following the pre-heating of the compressed air, the air will expand in the pneumatic-hydraulic energy conversion system, whose heat exchange subcircuit will be able to continue providing heat energy from the waste heat cooling tower to the expanding air, allowing the gas to expand near-isothermally at the higher temperature

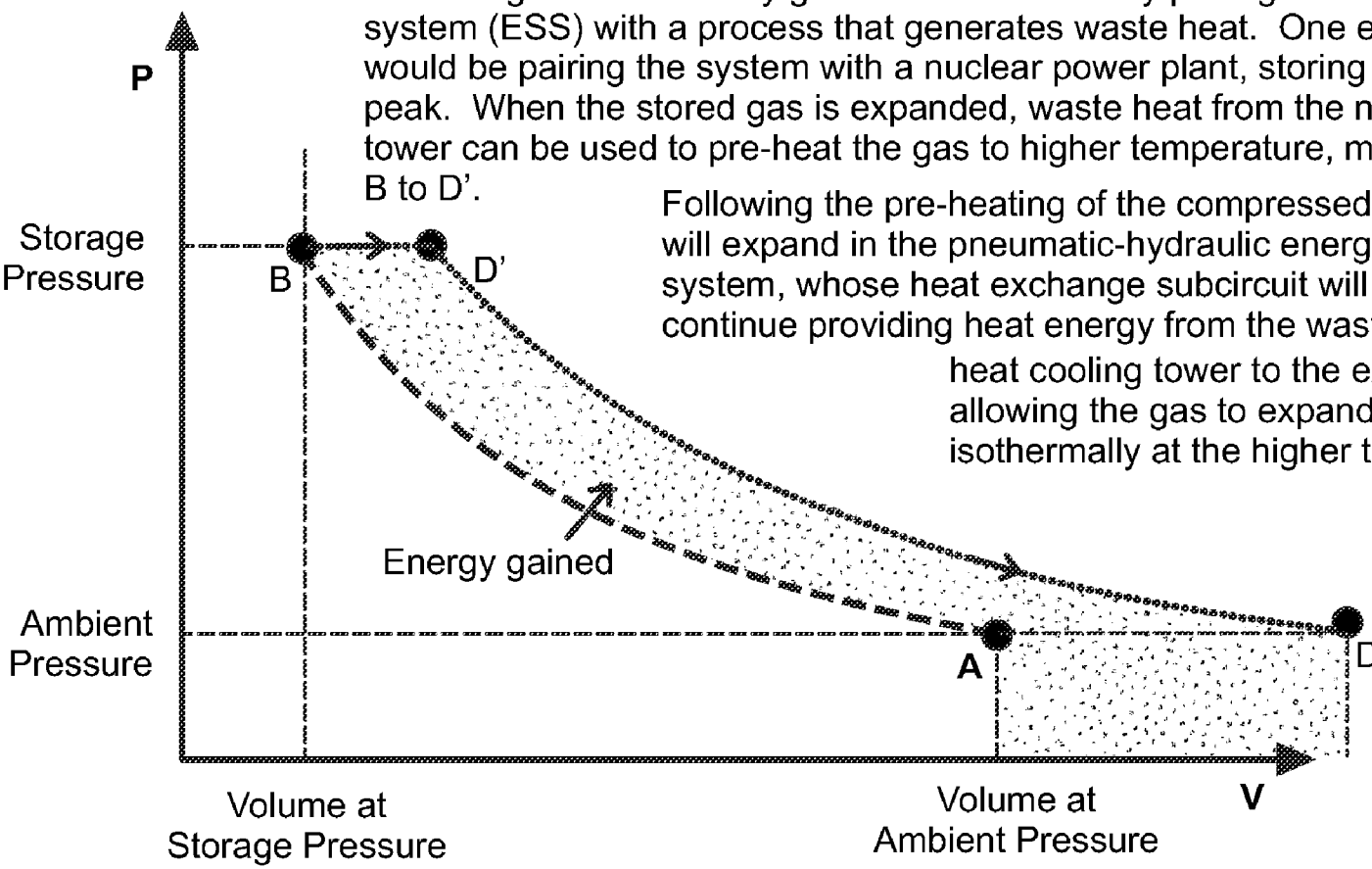

FIG. 15V

ESS-Cogeneration potential

For example, if a power plant produces 100°C waste steam, the heat provided by condensing the waste steam will allow the ESS to expand the stored air isothermally at 100°C rather than the ambient 25°C. The result is a 25% increase in output energy.

SYSTEMS AND METHODS FOR ENERGY STORAGE AND RECOVERY USING COMPRESSED GAS

CROSS-REFERENCE TO RELATED APPLICATIONS

This application is a continuation of U.S. patent application Ser. No. 12/421,057, filed on Apr. 9, 2009, which claims priority to U.S. Provisional Patent Application Ser. Nos. 61/043,630, filed on Apr. 9, 2008, and 61/148,091, filed on Jan. 30, 2009, the disclosures of which are hereby incorporated herein by reference in their entireties.

STATEMENT REGARDING FEDERALLY SPONSORED RESEARCH

This invention was made with government support under IIP-0810590 awarded by the NSF. The government has certain rights in the invention.

FIELD OF THE INVENTION

The invention relates to energy storage, and more particularly, to systems that store and recover electrical energy using compressed fluids.

BACKGROUND OF THE INVENTION

As the world's demand for electric energy increases, the existing power grid is being taxed beyond its ability to serve this demand continuously. In certain parts of the United States, inability to meet peak demand has led to inadvertent brownouts and blackouts due to system overload and deliberate "rolling blackouts" of non-essential customers to shunt the excess demand. For the most part, peak demand occurs during the daytime hours (and during certain seasons, such as summer) when business and industry employ large quantities of power for running equipment, heating, air conditioning, lighting, etc. During the nighttime hours, thus, demand for electricity is often reduced significantly, and the existing power grid in most areas can usually handle this load without problem.

To address the lack of power at peak demand, users are asked to conserve where possible. Power companies often employ rapidly deployable gas turbines to supplement production to meet demand. However, these units burn expensive fuel sources, such as natural gas, and have high generation costs when compared with coal-fired systems, and other large-scale generators. Accordingly, supplemental sources have economic drawbacks and, in any case, can provide only a partial solution in a growing region and economy. The most obvious solution involves construction of new power plants, which is expensive and has environmental side effects. In addition, because most power plants operate most efficiently when generating a relatively continuous output, the difference between peak and off-peak demand often leads to wasteful practices during off-peak periods, such as over-lighting of outdoor areas, as power is sold at a lower rate off peak. Thus, it is desirable to address the fluctuation in power demand in a manner that does not require construction of new plants and can be implemented either at a power-generating facility to provide excess capacity during peak, or on a smaller scale on-site at the facility of an electric customer (allowing that customer to provide additional power to itself during peak demand, when the grid is over-taxed).

Another scenario in which the ability to balance the delivery of generated power is highly desirable is in a self-contained generation system with an intermittent generation cycle. One example is a solar panel array located remotely from a power connection. The array may generate well for a few hours during the day, but is nonfunctional during the remaining hours of low light or darkness.

In each case, the balancing of power production or provision of further capacity rapidly and on-demand can be satisfied by a local back-up generator. However, such generators are often costly, use expensive fuels, such as natural gas or diesel fuel, and are environmentally damaging due to their inherent noise and emissions. Thus, a technique that allows storage of energy when not needed (such as during off-peak hours), and can rapidly deliver the power back to the user is highly desirable.

A variety of techniques is available to store excess power for later delivery. One renewable technique involves the use of driven flywheels that are spun up by a motor drawing excess power. When the power is needed, the flywheels' inertia is tapped by the motor or another coupled generator to deliver power back to the grid and/or customer. The flywheel units are expensive to manufacture and install, however, and require a degree of costly maintenance on a regular basis.

Another approach to power storage is the use of batteries. Many large-scale batteries use a lead electrode and acid electrolyte, however, and these components are environmentally hazardous. Batteries must often be arrayed to store substantial power, and the individual batteries may have a relatively short life (3-7 years is typical). Thus, to maintain a battery storage system, a large number of heavy, hazardous battery units must be replaced on a regular basis and these old batteries must be recycled or otherwise properly disposed of.

Energy can also be stored in ultracapacitors. A capacitor is charged by line current so that it stores charge, which can be discharged rapidly when needed. Appropriate power-conditioning circuits are used to convert the power into the appropriate phase and frequency of AC. However, a large array of such capacitors is needed to store substantial electric power. Ultracapacitors, while more environmentally friendly and longer lived than batteries, are substantially more expensive, and still require periodic replacement due to the breakdown of internal dielectrics, etc.

Another approach to storage of energy for later distribution involves the use of a large reservoir of compressed air. By way of background, a so-called compressed-air energy storage (CAES) system is shown and described in the published thesis entitled "Investigation and Optimization of Hybrid Electricity Storage Systems Based Upon Air and Supercapacitors," by Sylvain Lemofouet-Gatsi, Ecole Polytechnique Federale de Lausanne (20 Oct. 2006), Section 2.2.1, incorporated herein by reference in its entirety. As stated by Lemofouet-Gatsi," the principle of CAES derives from the splitting of the normal gas turbine cycle-where roughly 66% of the produced power is used to compress air-into two separated phases: The compression phase where lower-cost energy from off-peak base-load facilities is used to compress air into underground salt caverns and the generation phase where the pre-compressed air from the storage cavern is preheated through a heat recuperator, then mixed with oil or gas and burned to feed a multistage expander turbine to produce electricity during peak demand. This functional separation of the compression cycle from the combustion cycle allows a CAES plant to generate three times more energy with the same quantity of fuel compared to a simple cycle natural gas power plant.

"CAES has the advantages that it doesn't involve huge, costly installations and can be used to store energy for a long time (more than one year). It also has a fast start-up time (9 to 12 minutes), which makes it suitable for grid operation, and the emissions of greenhouse gases are lower than that of a normal gas power plant, due to the reduced fuel consumption. The main drawback of CAES is probably the geological structure reliance, which substantially limits the usability of this storage method. In addition, CAES power plants are not emission-free, as the pre-compressed air is heated up with a fossil fuel burner before expansion. Moreover, [CAES plants] are limited with respect to their effectiveness because of the loss of the compression heat through the inter-coolers, which must be compensated during expansion by fuel burning. The fact that conventional CAES still rely on fossil fuel consumption makes it difficult to evaluate its energy round-trip efficiency and to compare it to conventional fuel-free storage technologies."

A number of variations on the above-described compressed air energy storage approach have been proposed, some of which attempt to heat the expanded air with electricity, rather than fuel. Others employ heat exchange with thermal storage to extract and recover as much of the thermal energy as possible, therefore attempting to increase efficiencies. Still other approaches employ compressed gas-driven piston motors that act both as compressors and generator drives in opposing parts of the cycle. In general, the use of highly compressed gas as a working fluid for the motor poses a number of challenges due to the tendency for leakage around seals at higher pressures, as well as the thermal losses encountered in rapid expansion. While heat exchange solutions can deal with some of these problems, efficiencies are still compromised by the need to heat compressed gas prior to expansion from high pressure to atmospheric pressure.

It has been recognized that gas is a highly effective medium for storage of energy. Liquids are incompressible and flow efficiently across an impeller or other moving component to rotate a generator shaft. One energy storage technique that uses compressed gas to store energy, but which uses a liquid, for example, hydraulic fluid, rather than compressed gas to drive a generator is a so-called closed-air hydraulic-pneumatic system. Such a system employs one or more high-pressure tanks (accumulators) having a charge of compressed gas, which is separated by a movable wall or flexible bladder membrane from a charge of hydraulic fluid. The hydraulic fluid is coupled to a bi-directional impeller (or other hydraulic motor/pump), which is itself coupled to a combined electric motor/generator. The other side of the impeller is connected to a low-pressure reservoir of hydraulic fluid. During a storage phase, the electric motor and impeller force hydraulic fluid from the low-pressure hydraulic fluid reservoir into the high-pressure tank(s), against the pressure of the compressed air. As the incompressible liquid fills the tank, it forces the air into a smaller space, thereby compressing it to an even higher pressure. During a generation phase, the fluid circuit is run in reverse and the impeller is driven by fluid escaping from the high-pressure tank(s) under the pressure of the compressed gas.

This closed-air approach has an advantage in that the gas is never expanded to or compressed from atmospheric pressure, as it is sealed within the tank. An example of a closed-air system is shown and described in U.S. Pat. No. 5,579,640, which is hereby incorporated herein by reference in its entirety, in which this principle is used to hydraulically store braking energy in a vehicle. This system has limitations in that its energy density is low. That is, the amount of compression possible is limited by the size of the tank space. In addition, since the gas does not completely decompress when the fluid is removed, there is still additional energy in the system that cannot be tapped. To make a closed air system desirable for large-scale energy storage, many large accumulator tanks would be needed, increasing the overall cost to implement the system and requiring more land to do so.

Another approach to hybrid hydraulic-pneumatic energy storage is the open-air system. In this system, compressed air is stored in a large, separate high-pressure tank (or plurality of tanks). A pair of accumulators is provided, each having a fluid side separated from a gas side by a movable piston wall. The fluid sides of a pair (or more) of accumulators are coupled together through an impeller/generator/motor combination. The air side of each of the accumulators is coupled to the high pressure air tanks, and also to a valve-driven atmospheric vent. Under expansion of the air chamber side, fluid in one accumulator is driven through the impeller to generate power, and the spent fluid then flows into the second accumulator, whose air side is now vented to atmospheric, thereby allowing the fluid to collect in the second accumulator. During the storage phase, electrical energy can used to directly recharge the pressure tanks via a compressor, or the accumulators can be run in reverse to pressurize the pressure tanks. A version of this open-air concept is shown and described in U.S. Pat. No. 6,145,311, which is hereby incorporated herein by reference in its entirety. This patent provides a pair of two-stage accumulator arranged in an opposed coaxial relation. In the '311 patent, the seals of its moving parts separate the working gas chambers. Thus, large pressure differentials can exist between these working gas chambers, resulting in a pressure differential across the seals of the moving parts up to the maximum pressure of the system. This can result in problematic gas leakage, as it is quite difficult to completely seal a moving, high-pressure piston against gas leakage. In addition, the '311 patent proposes a complex, difficult to manufacture and maintain accumulator structure that may be impractical for a field implementation. Likewise, recognizing that isothermal compression and expansion is critical to maintaining high round-trip system efficiency, especially if the compressed gas is stored for long periods of time, the '311 patent proposes a complex heat-exchange structure within the internal cavities of the accumulators. This complex structure adds expense and potentially compromises the gas and fluid seals of the system.

SUMMARY OF THE INVENTION

In various embodiments, the invention provides an energy storage system, based upon an open-air hydraulic-pneumatic arrangement, using high-pressure gas in tanks that is expanded in small batches from a high pressure of several hundred atmospheres to atmospheric pressure. The systems may be sized and operated at a rate that allows for near isothermal expansion and compression of the gas. The systems may also be scalable through coupling of additional accumulator circuits and storage tanks as needed. Systems and methods in accordance with the invention may allow for efficient near-isothermal high compression and expansion to/from high pressure of several hundred atmospheres down to atmospheric pressure to provide a much higher energy density.

Embodiments of the invention overcome the disadvantages of the prior art by providing a system for storage and recovery of energy using an open-air hydraulic-pneumatic accumulator and intensifier arrangement implemented in at least one circuit that combines an accumulator and an intensifier in communication with a high-pressure gas storage reservoir on the gas-side of the circuit, and a combination fluid motor/pump coupled to a combination electric generator/motor on the fluid side of the circuit. In a representative embodiment, an expansion/energy recovery mode, the accumulator of a first circuit is first filled with high-pressure gas from the reservoir, and the reservoir is then cut off from the air chamber of the accumulator. This gas causes fluid in the accumulator to be driven through the motor/pump to generate electricity. Exhausted fluid is driven into either an opposing intensifier or an accumulator in an opposing second circuit, whose air chamber is vented to atmosphere. As the gas in the accumulator expands to mid-pressure, and fluid is drained, the mid-pressure gas in the accumulator is then connected to an intensifier with a larger-area air piston acting on a smaller area fluid piston. Fluid in the intensifier is then driven through the motor/pump at still-high fluid pressure, despite the mid-pressure gas in the intensifier air chamber. Fluid from the motor/pump is exhausted into either the opposing first accumulator or an intensifier of the second circuit, whose air chamber may be vented to atmosphere as the corresponding fluid chamber fills with exhausted fluid. In a compression/energy storage stage, the process is reversed and the fluid motor/pump is driven by the electric component to force fluid into the intensifier and the accumulator to compress gas and deliver it to the tank reservoir under high pressure.

In one aspect, the invention relates to a compressed gas-based energy storage system that includes a staged hydraulic-pneumatic energy conversion system. The staged hydraulic-pneumatic system may include a compressed gas storage system and an accumulator having a hydraulic side and a pneumatic side separated by an accumulator boundary mechanism. The accumulator is desirably configured to transfer mechanical energy from the pneumatic side to the hydraulic side at a first pressure ratio. An intensifier having a hydraulic side and a pneumatic side is separated by an intensifier boundary mechanism, and the intensifier is configured to transfer mechanical energy from the pneumatic side to the hydraulic side at a second pressure ratio greater than the first pressure ratio. A control system operates the compressed gas storage system, the accumulator, and the intensifier in a staged manner to provide a predetermined pressure profile at least one outlet.

In various embodiments, the system further includes a control valve arrangement responsive to the control system. The control valve arrangement interconnects the compressed gas storage system, the accumulator, the intensifier, and the outlet(s). The control valve arrangement can include a first arrangement providing controllable fluid communication between the accumulator pneumatic side and the compressed gas storage system, a second arrangement providing controllable fluid communication between the accumulator pneumatic side and the intensifier pneumatic side, a third arrangement providing controllable fluid communication between the accumulator hydraulic side and outlet(s), and a fourth arrangement providing controllable fluid communication between the intensifier hydraulic side and outlet(s). The compressed gas storage system can include one or more pressurized gas vessels.

Furthermore, the staged hydraulic-pneumatic energy conversion system can also include a second intensifier having a hydraulic side and a pneumatic side separated by a second intensifier boundary mechanism. The second intensifier may be configured to transfer mechanical energy from the pneumatic side to the hydraulic side at a third pressure ratio greater than the second pressure ratio. The system can also include a second accumulator having a hydraulic side and a pneumatic side separated by a second accumulator boundary mechanism. The second accumulator may be configured to transfer mechanical energy from the pneumatic side to the hydraulic side at the first pressure ratio, and can be connected in parallel with the first accumulator.

In additional embodiments, the system includes a hydraulic motor/pump having an input side in fluid communication with outlet(s) and having an output side in fluid communication with at least one inlet that is itself in fluid communication with the control valve arrangement. The system can also include an electric generator/motor mechanically coupled to the hydraulic motor/pump. The control system can include a sensor system that monitors at least one of (a) a fluid state related to the accumulator pneumatic side, the intensifier pneumatic side, the accumulator hydraulic side and the intensifier hydraulic side (b) a flow in hydraulic fluid, or (c) a position of the accumulator boundary mechanism and intensifier boundary mechanism.

During operation of the system, the control valve arrangement may be operated in a staged manner to allow gas from the compressed gas storage system to expand first within the accumulator pneumatic side and then from the accumulator pneumatic side into the intensifier pneumatic side. The gas expansion may occur substantially isothermally. The substantially isothermal gas expansion can be free of the application of any external heating source other than thermal exchange with the system's surroundings. In one embodiment, the substantially isothermal gas expansion is achieved via heat transfer from outside the accumulator and the intensifier therethrough, and to the gas within the accumulator pneumatic side and the intensifier pneumatic side.

In addition, the control system can open and close each of the control valve arrangements so that, when gas expands in the accumulator pneumatic side, the intensifier pneumatic side is vented by the gas vent to low pressure. In this way, fluid is driven from the accumulator hydraulic side by the expanding gas through the motor/pump and into the intensifier hydraulic side. In addition, the control system can open and close each of the control valve arrangements so that, when gas expands in the intensifier pneumatic side, fluid is driven from the intensifier hydraulic side by the expanding gas through the motor/pump, and into the accumulator hydraulic side; the accumulator pneumatic side is in fluid communication with the intensifier pneumatic side.

In another aspect, the invention relates to a compressed gas-based energy storage system including a staged hydraulic-pneumatic energy conversion system. In various embodiments, the staged hydraulic-pneumatic system includes a compressed gas storage system and at least one accumulator having an accumulator pneumatic side and an accumulator hydraulic side. The accumulator pneumatic side may be in fluid communication with the compressed gas storage system via a first control valve arrangement. The system may further include at least one intensifier having an intensifier pneumatic side and an intensifier hydraulic side, where the intensifier pneumatic side is in fluid communication with the accumulator pneumatic side and a gas vent via a second control valve arrangement. The accumulator pneumatic side and the accumulator hydraulic side may be separated by an accumulator boundary mechanism that transfers mechanical energy therebetween. The intensifier pneumatic side and the intensifier hydraulic side may be separated by an intensifier boundary mechanism that transfers mechanical energy therebetween. Embodiments in accordance with this aspect of the invention may include a hydraulic motor/pump having (i) an input side in fluid communication via a third control valve arrangement with the accumulator hydraulic side and the intensifier hydraulic side, and (ii) an output side in fluid communication via a fourth control valve arrangement with the accumulator hydraulic side and the intensifier hydraulic side. In various embodiments, the system includes an electric generator/motor mechanically coupled to the hydraulic motor/pump, and a control system for actuating the control valve arrangements in a staged manner to provide a predetermined pressure profile to the hydraulic motor input side.

In various embodiments of the foregoing aspect, the control system includes a sensor system that monitors at least one of (a) a fluid state related to the accumulator pneumatic side, the intensifier pneumatic side, the accumulator hydraulic side and the intensifier hydraulic side (b) a flow in hydraulic fluid, or (c) a position of the accumulator boundary mechanism and intensifier boundary mechanism. The system can use the sensed parameters to control, for example, the various control valve arrangements, the motor/pump, and the generator/motor. The accumulator(s) can transfer mechanical energy at a first pressure ratio and the intensifier(s) can transfer mechanical energy at a second pressure ratio greater than the first pressure ratio. The compressed gas storage system can include one or more pressurized gas vessels.

In one embodiment, the system includes a second accumulator having a second accumulator pneumatic side and a second accumulator hydraulic side. The second accumulator pneumatic side and the second accumulator hydraulic side are separated by a second accumulator boundary mechanism that transfers mechanical energy therebetween. Each of the accumulator pneumatic sides is in fluid communication with the compressed gas storage system via the first control valve arrangement, and each accumulator hydraulic side is in fluid communication with the third control valve arrangement. The system can also include a second intensifier having a second intensifier pneumatic side and a second intensifier hydraulic side. The second intensifier pneumatic side and the second intensifier hydraulic side are separated by a second intensifier boundary mechanism that transfers mechanical energy therebetween. Each of the intensifier pneumatic sides is in fluid communication with each accumulator pneumatic side and with the gas vent via the second control valve arrangement, and each intensifier hydraulic side is in fluid communication with the fourth control valve arrangement. Additionally, the gas from the compressed gas storage system can be expanded first within each accumulator pneumatic side and then from each accumulator pneumatic side into each intensifier pneumatic side in a staged manner.

In additional embodiments, the control system can open and close each of the control valve arrangements so that, when gas expands in either one of the first accumulator pneumatic side or the second accumulator pneumatic side, the second accumulator pneumatic side or the first accumulator pneumatic side is vented by the gas vent to low pressure. In this way, fluid is driven from either one of the first accumulator hydraulic side or the second accumulator hydraulic side by the expanding gas through the motor/pump, and into the second accumulator hydraulic side and the first accumulator hydraulic side. The control system can also open and close each of the control valve arrangements so that, when gas expands in either one of the first intensifier pneumatic side or the second intensifier pneumatic side, that intensifier pneumatic side is vented by the gas vent to low pressure. In this way, fluid is driven either from the first intensifier hydraulic side into the second intensifier hydraulic side, or from the second intensifier hydraulic side into the first intensifier hydraulic side, by the expanding gas through the motor/pump. The gas expansion can occur substantially isothermally. The substantially isothermal gas expansion can be free of the application of any external heating source other than thermal exchange with the system's surroundings. In one embodiment, the substantially isothermal gas expansion is achieved via heat transfer from outside the accumulator and the intensifier therethrough, and to the gas within the accumulator pneumatic side and the intensifier pneumatic side.

In another aspect, the invention relates to a method of energy storage in a compressed gas storage system that includes an accumulator and an intensifier. The method includes the steps of transferring mechanical energy from a pneumatic side of the accumulator to a hydraulic side of the accumulator at a first pressure ratio, transferring mechanical energy from a pneumatic side of the intensifier to a hydraulic side of the intensifier at a second pressure ratio greater than the first pressure ratio, and operating the compressed gas storage system, the accumulator, and the intensifier in a staged manner to provide a predetermined pressure profile at least one outlet.

In various embodiments of the foregoing aspect, the method includes the step of operating a control valve arrangement for interconnecting the compressed gas storage system, the accumulator, the intensifier, and outlet(s). In one embodiment, the step of operating the control valve arrangement includes opening and closing the valve arrangements in response to at least one signal from a control system.

In yet another aspect, the invention relates to a compressed gas-based energy storage system including a staged hydraulic-pneumatic energy conversion system that includes a compressed gas storage system, at least four hydraulic-pneumatic devices, and a control system that operates the compressed gas storage system and the hydraulic-pneumatic devices in a staged manner, such that at least two of the hydraulic-pneumatic devices are always in an expansion phase. In various embodiments, the hydraulic-pneumatic devices include a first accumulator, a second accumulator, a third accumulator, and at least one intensifier. The accumulators each have an accumulator pneumatic side and an accumulator hydraulic side separated by an accumulator boundary mechanism that transfers mechanical energy therebetween. The intensifier(s) may have an intensifier pneumatic side and an intensifier hydraulic side separated by an intensifier boundary mechanism that transfers mechanical energy therebetween.

In various embodiments of the foregoing aspect, the system includes a first hydraulic motor/pump having an input side and an output side and a second hydraulic motor/pump having an input side and an output side. In one embodiment, at least one of the hydraulic motors/pumps is always being driven by at least one of the at least two hydraulic-pneumatic devices in the expansion phase. In another embodiment, both hydraulic motors/pumps are being driven by the at least two hydraulic-pneumatic devices during the expansion phase, and each hydraulic motor/pump is driven at a different point during the expansion phase, such that the overall power remains relatively constant. The system can also include an electric generator/motor mechanically coupled to the first hydraulic motor/pump and the second hydraulic motor/pump on a single shaft. The generator/motor is driven by the hydraulic motors/pumps to generate electricity. In an alternative embodiment, the system includes a first electric generator/motor mechanically coupled to the first hydraulic motor/pump and a second electric generator/motor mechanically coupled to the second hydraulic motor/pump. Each generator/motor is driven by its respective hydraulic motor/pump to generate electricity In addition, the system can include a control valve arrangement responsive to the control system for variably interconnecting the compressed gas storage system, the hydraulic-pneumatic devices, and the hydraulic motors/pumps. For example, in one configuration of the control valve arrangement, the first accumulator can be put in fluid communication with the compressed gas storage system and the input side of the first motor/pump, the second accumulator can be put in fluid communication with the output side of the first motor/pump and its air chamber vented to atmosphere, the third accumulator can be put in fluid communication with the input side of the second motor/pump, and the intensifier can be put in fluid communication with the output side of the second motor/pump and its air chamber vented to atmosphere. The control valve arrangement can vary the interconnections between components, such that essentially any of the hydraulic-pneumatic components and the hydraulic motors/pumps can be in fluid communication with each other.

In another embodiment, the system can include a fifth hydraulic-pneumatic device. The fifth device can be at least one of a fourth accumulator or a second intensifier. The fifth accumulator has an accumulator pneumatic side and an accumulator hydraulic side separated by an accumulator boundary mechanism that transfers mechanical energy therebetween. The second intensifier has an intensifier pneumatic side and an intensifier hydraulic side separated by an intensifier boundary mechanism that transfers mechanical energy therebetween. In this embodiment, the control system operates the compressed gas storage system, the accumulators, and the intensifiers in a staged manner such that at least three of the hydraulic-pneumatic devices are always in the expansion phase.

In still another aspect, the invention relates to a compressed-gas based energy storage system having a staged hydraulic-pneumatic energy conversion system. The energy conversion system can include a compressed gas storage system that can be constructed from one or more pressure vessels, a first accumulator and a second accumulator, each having an accumulator pneumatic side and an accumulator hydraulic side; and a first intensifier and a second intensifier, each having an intensifier pneumatic side and an intensifier hydraulic side. The accumulator pneumatic side and the accumulator hydraulic side may be separated by an accumulator boundary mechanism that can be a piston of predetermined diameter, which transfers mechanical energy therebetween. Each accumulator pneumatic side may be in fluid communication with the compressed gas storage system via a first gas valve assembly. Each intensifier pneumatic side and intensifier hydraulic side may be separated by an intensifier boundary mechanism that transfers mechanical energy therebetween. This boundary can be a piston with a larger area on the pneumatic side than on the hydraulic side. Each intensifier pneumatic side may be in fluid communication with each accumulator pneumatic side and with a gas vent via a second gas valve assembly. Additional intensifiers (such as third and fourth intensifiers) can also be provided in additional stages, in communication with the first and second intensifiers, respectively. A hydraulic motor/pump may also be provided; the motor/pump has an input side in fluid communication via a first fluid valve assembly with each accumulator hydraulic side and each intensifier hydraulic side, and an output side in fluid communication via a second fluid valve assembly with each accumulator hydraulic side and each intensifier hydraulic side. An electric generator/motor is mechanically coupled to the hydraulic motor/pump so that rotation of the motor/pump generates electricity during discharge (i.e., gas expansion-energy recovery) and electricity drives the motor/pump during recharge (i.e., gas compression-energy storage). A sensor system can be provided to monitor at least one of (a) a fluid state related to each accumulator pneumatic side, each intensifier pneumatic side, each accumulator hydraulic side, and each intensifier hydraulic side (b) a flow in hydraulic fluid, or (c) a position of each accumulator boundary mechanism and intensifier boundary mechanism. In addition, a controller, responsive to the sensor system, can control the opening and closing of the first gas valve assembly, the second gas valve assembly, the first fluid valve assembly and the second fluid valve assembly.

In one embodiment, gas from the compressed gas storage system expands first within each accumulator pneumatic side and then from each accumulator pneumatic side into each intensifier pneumatic side in a staged manner. The controller is constructed and arranged to open and close each of the first gas valve assembly, the second gas valve assembly, the first fluid valve assembly and the second fluid valve assembly so that, when gas expands in the first accumulator pneumatic side, the second accumulator pneumatic side is vented by the gas vent to low pressure; and when gas expands in the second accumulator pneumatic side, the first accumulator pneumatic side is vented by the gas vent to low pressure. In this manner, fluid is driven by the expanding gas through the motor/pump either from first accumulator fluid side into the second accumulator hydraulic side, or from the second accumulator fluid side and into the first accumulator hydraulic side.

In addition, the controller can open and close each of the valve assemblies so that, when gas expands in the first intensifier pneumatic side, the second intensifier pneumatic side is vented by the gas vent to low pressure so that fluid is driven by the expanding gas through the motor/pump from the first intensifier fluid side into the second intensifier hydraulic side, and when gas expands in the second intensifier pneumatic side, the first intensifier pneumatic side is vented by the gas vent to low pressure so that fluid is driven by the expanding gas through the motor/pump from the second intensifier fluid side into the first intensifier hydraulic side.

In another embodiment, the controller can open and close the valve assemblies to expand gas in a final stage in the pneumatic side of each of the first intensifier and the second intensifier to near atmospheric pressure. The pressure of the hydraulic fluid exiting the hydraulic side of each of the first intensifier and the second intensifier during gas expansion is of a similar pressure range as the hydraulic fluid exiting the hydraulic side of the first accumulator and the hydraulic side of the second accumulator during gas expansion.

The expansion and compression of gas desirably occurs isothermally or nearly isothermally, and this substantially isothermal gas expansion or compression is free of any external heating source other than thermal exchange with the surroundings. The controller can monitor sensor data to ensure isothermal or near-isothermal expansion and compression. The substantially isothermal gas expansion is achieved via heat transfer from outside the first accumulator, the second accumulator, the first intensifier, and the second intensifier therethrough, and to the gas within each accumulator pneumatic side and intensifier pneumatic side. Staged expansion and compression, using accumulators and one or more intensifiers in a circuit to expand/compress the gas more evenly, at varied pressures also helps to ensure that a fluid pressure range at which the motor/pump operates efficiently and most optimally is continuously provided to or from the motor/pump.

Generally, during the gas expansion cycle of one embodiment of the staged hydraulic/pneumatic system, the gas is first expanded in one or more accumulators from a high pressure to a mid-pressure, thereby driving a hydraulic motor, and at the same time, filling either other accumulators or intensifiers with hydraulic fluid. If only a single accumulator is used, following the expansion in the single accumulator to mid-pressure, the gas is then further expanded from mid-pressure to low pressure in a single intensifier connected to the accumulator. The intensifier boosts the pressure (to the original high to mid-pressure range), drives the hydraulic motor, and refills either another intensifier or the accumulator with fluid. This method of system cycling provides one means of system expansion, but many other combinations of accumulators and intensifiers may be employed, changing the characteristics of the expansion. Likewise, the compression process is the expansion process in reverse and any change in system cycling for the expansion can be employed for compression.

Many other system staging schemes are within the scope of the invention, each with similar trade-offs (e.g., increased power density, but decreased energy density). For example, a four accumulator-two intensifier system may also be cycled to provide a substantially higher and smoother power output than the described two accumulator-two intensifier system, while maintaining the ability to compress and expand below the mid system pressure. Likewise, a single accumulator-single intensifier system may be cycled in such a way as to provide a similar power output to the two accumulator-two intensifier system for system pressures above the mid pressure.

By way of background, it should be noted that the intensifier in the staged hydraulic/pneumatic system described above essentially has two cycles (analogous to the two cycles or four cycles of an internal combustion engine) and the accumulator has three cycles. The two cycles in the intensifier during expansion are essentially (i) intensifier driving: expansion from mid to low pressure (driving the motor from high to mid pressure, and, (ii) intensifier refilling: refilling with hydraulic fluid (while the air in the intensifier is at atmospheric pressure). The three cycles in the accumulator during expansion are (i) accumulator driving: expansion from high to mid pressure (driving the motor from high to mid pressure; (ii) accumulator to intensifier: expansion from mid to low pressure while connected to the intensifier; and, (iii) accumulator refilling: refilling with hydraulic fluid (while the air in the accumulator is at atmospheric pressure).

These and other objects, along with the advantages and features of the present invention herein disclosed, will become apparent through reference to the following description, the accompanying drawings, and the claims. Furthermore, it is to be understood that the features of the various embodiments described herein are not mutually exclusive and can exist in various combinations and permutations.

BRIEF DESCRIPTION OF THE DRAWINGS

In the drawings, like reference characters generally refer to the same parts throughout the different views. In addition, the drawings are not necessarily to scale, emphasis instead generally being placed upon illustrating the principles of the invention. In the following description, various embodiments of the present invention are described with reference to the following drawings, in which:

FIG. 8 is a table illustrating the expansion phase for the system of FIGS. 7A-7F;

FIG. 10 is a table illustrating an expansion phase for a variation of the system of FIGS. 7A-7F using four accumulators and two intensifiers;

DETAILED DESCRIPTION

In the following, various embodiments of the present invention are generally described with reference to a single accumulator and a single intensifier or an arrangement with two accumulators and two intensifiers and simplified valve arrangements. It is, however, to be understood that the present invention can include any number and combination of accumulators, intensifiers, and valve arrangements. In addition, any dimensional values given are exemplary only, as the systems according to the invention are scalable and customizable to suit a particular application. Furthermore, the terms pneumatic, gas, and air are used interchangeably and the terms hydraulic and fluid are also used interchangeably.

Figure 1:
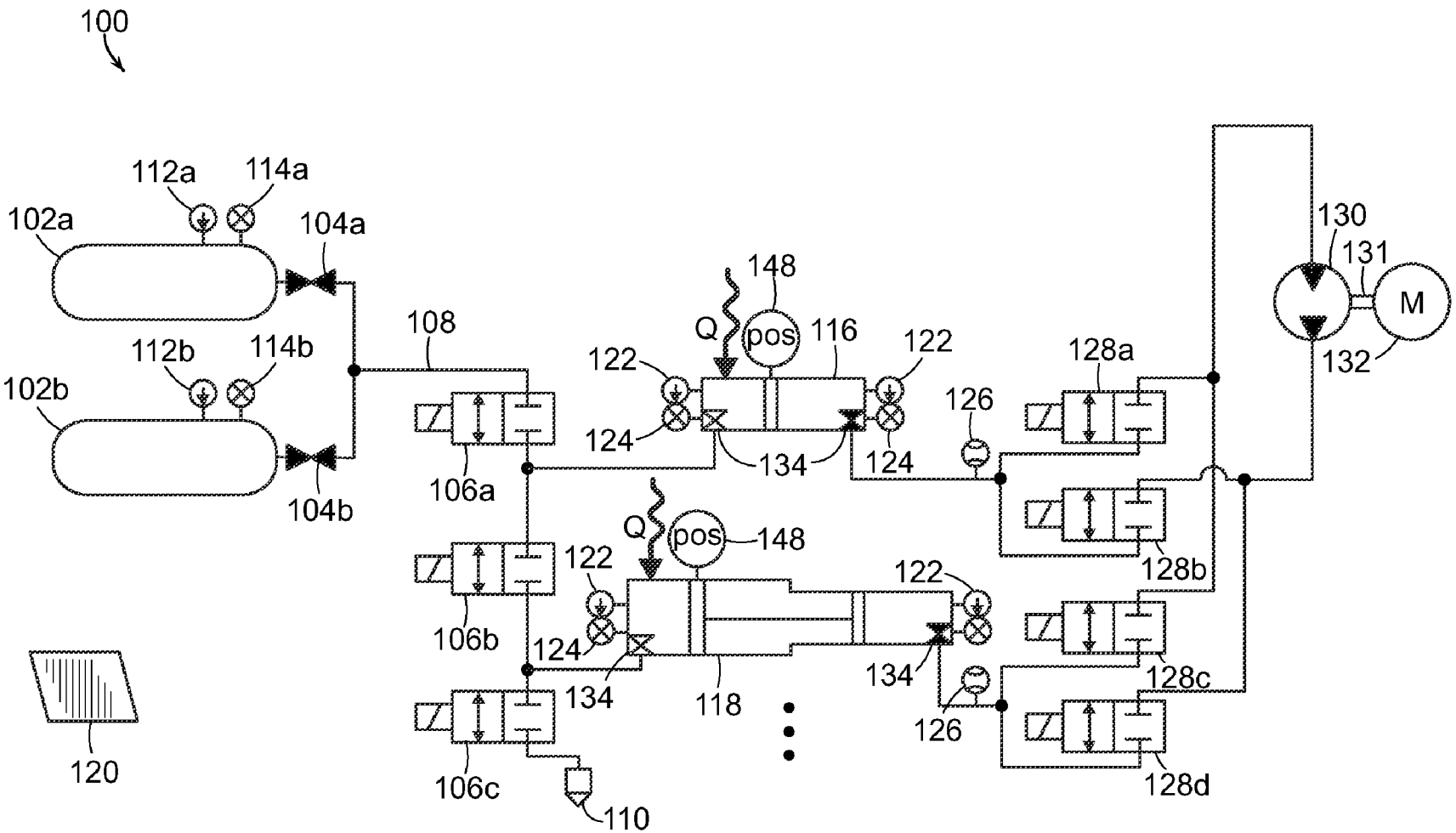
FIG. 1 is a schematic diagram of an open-air hydraulic-pneumatic energy storage and recovery system in accordance with one embodiment of the invention.

FIG. 1 depicts one embodiment of an open-air hydraulic-pneumatic energy storage and recovery system 100 in accordance with the invention in a neutral state (i.e., all of the valves are closed and energy is neither being stored nor recovered. The system 100 includes one or more high-pressure gas/air storage tanks 102*a*, 102*b*, . . . 102*n*. Each tank 102 is joined in parallel via a manual valve(s) 104*a*, 104*b*, . . . 104*n*, respectively, to a main air line 108. The valves 104 are not limited to manual operation, as the valves can be electrically, hydraulically, or pneumatically actuated, as can all of the valves described herein. The tanks 102 are each provided with a pressure sensor 112*a*, 112*b* . . . 112*n* and a temperature sensor 114*a*, 114*b* . . . 114*n*. These sensors 112, 114 can output electrical signals that can be monitored by a control system 120 via appropriate wired and wireless connections/communications. Additionally, the sensors 112, 114 could include visual indicators.

Figure 4:
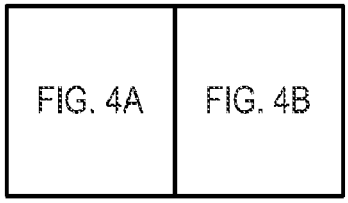
FIGS. 4-4B is a schematic diagram of an open-air hydraulic-pneumatic energy storage and recovery system in accordance with an alternative embodiment of the invention.
Figure 4A:
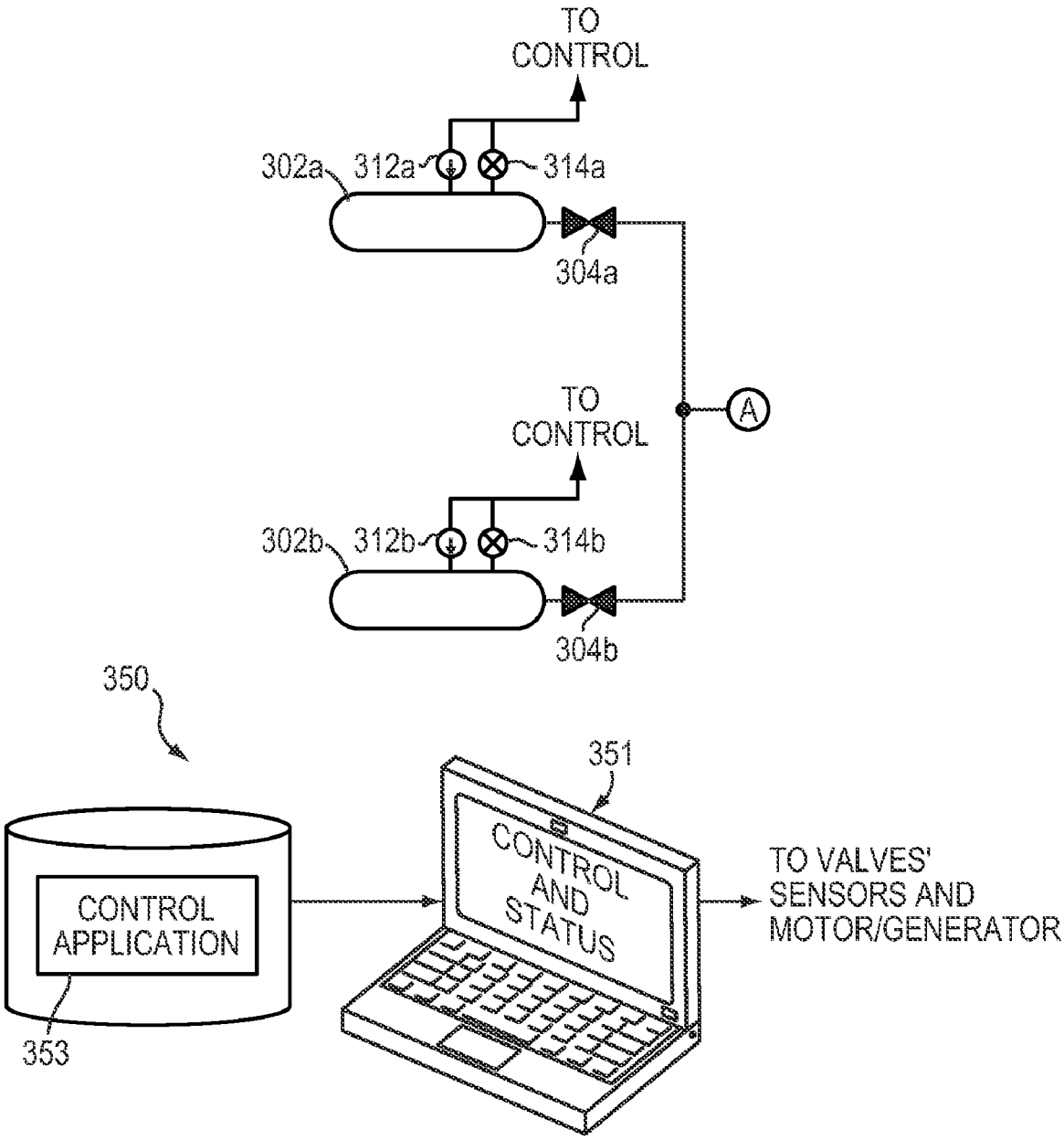

The control system 120, which is described in greater detail with respect to FIG. 4, can be any acceptable control device with a human-machine interface. For example, the control system 120 could include a computer (for example a PC-type) that executes a stored control application in the form of a computer-readable software medium. The control application receives telemetry from the various sensors to be described below, and provides appropriate feedback to control valve actuators, motors, and other needed electromechanical/electronic devices.

The system 100 further includes pneumatic valves 106*a*, 106*b*, 106*c*, . . . 106*n* that control the communication of the main air line 108 with an accumulator 116 and an intensifier 118. As previously stated, the system 100 can include any number and combination of accumulators 116 and intensifiers 118 to suit a particular application. The pneumatic valves 106 are also connected to a vent 110 for exhausting air/gas from the accumulator 116, the intensifier 118, and/or the main air line 108.

Figure 1A:
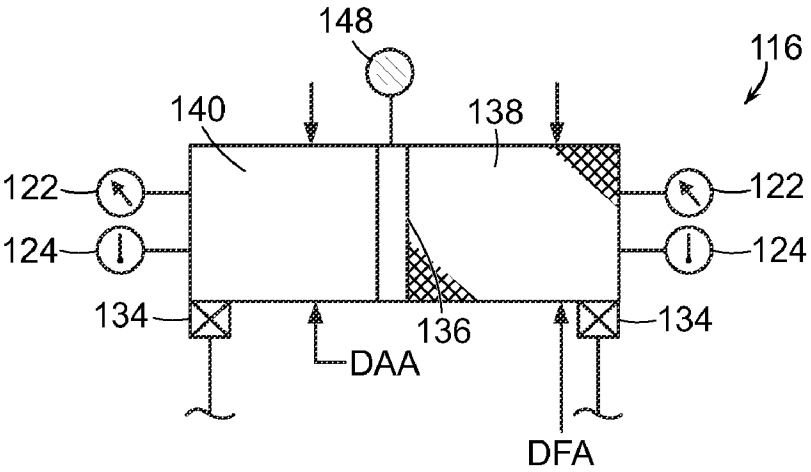
FIGS. 1A and 1B are enlarged schematic views of the accumulator and intensifier components of the system of FIG. 1.

As shown in FIG. 1A, the accumulator 116 includes an air chamber 140 and a fluid chamber 138 divided by a movable piston 136 having an appropriate sealing system using sealing rings and other components (not shown) that are known to those of ordinary skill in the art. Alternatively, a bladder type barrier could be used to divide the air and fluid chambers 140, 138 of the accumulator 116. The piston 136 moves along the accumulator housing in response to pressure differentials between the air chamber 140 and the opposing fluid chamber 138. In this example, hydraulic fluid (or another liquid, such as water) is indicated by a shaded volume in the fluid chamber 138. The accumulator 116 can also include optional shut-off valves 134 that can be used to isolate the accumulator 116 from the system 100. The valves 134 can be manually or automatically operated.

Figure 1B:
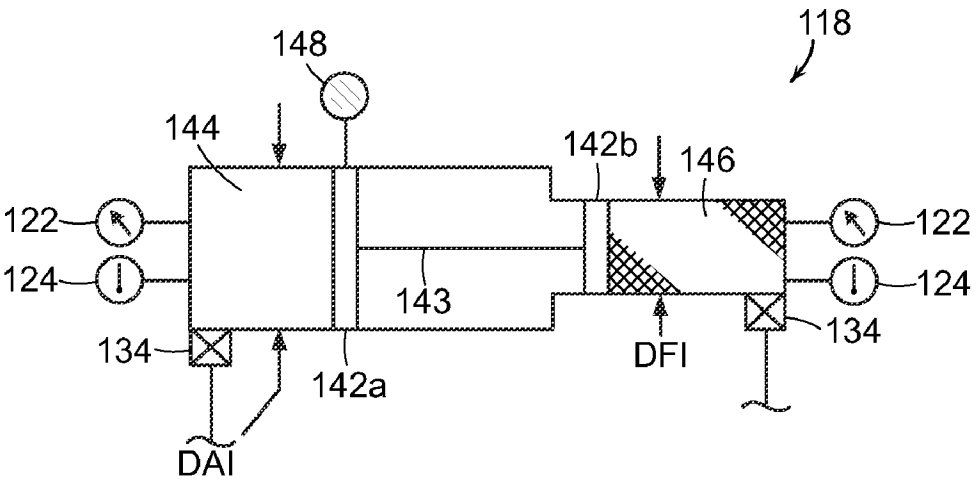

As shown in FIG. 1B, the intensifier 118 includes an air chamber 144 and a fluid chamber 146 divided by a movable piston assembly 142 having an appropriate sealing system using sealing rings and other components that are known to those of ordinary skill in the art. Similar to the accumulator piston 136, the intensifier piston 142 moves along the intensifier housing in response to pressure differentials between the air chamber 144 and the opposing fluid chamber 146.

However, the intensifier piston assembly 142 is actually two pistons: an air piston 142*a* connected by a shaft, rod, or other coupling means 143 to a respective fluid piston 142*b*. The fluid piston 142*b* moves in conjunction with the air piston 142*a*, but acts directly upon the associated intensifier fluid chamber 146. Notably, the internal diameter (and/or volume) (DAI) of the air chamber for the intensifier 118 is greater than the diameter (DAA) of the air chamber for the accumulator 116. In particular, the surface of the intensifier piston 142*a* is greater than the surface area of the accumulator piston 136. The diameter of the intensifier fluid piston (DFI) is approximately the same as the diameter of the accumulator piston 136 (DFA). Thus in this manner, a lower air pressure acting upon the intensifier piston 142*a* generates a similar pressure on the associated fluid chamber 146 as a higher air pressure acting on the accumulator piston 136. As such, the ratio of the pressures of the intensifier air chamber 144 and the intensifier fluid chamber 146 is greater than the ratio of the pressures of the accumulator air chamber 140 and the accumulator fluid chamber 138. In one example, the ratio of the pressures in the accumulator could be 1:1, while the ratio of pressures in the intensifier could be 10:1. These ratios will vary depending on the number of accumulators and intensifiers used and the particular application. In this manner, and as described further below, the system 100 allows for at least two stages of air pressure to be employed to generate similar levels of fluid pressure. Again, a shaded volume in the fluid chamber 146 indicates the hydraulic fluid and the intensifier 118 can also include the optional shut-off valves 134 to isolate the intensifier 118 from the system 100.

As also shown in FIGS. 1A and 1B, the accumulator 116 and the intensifier 118 each include a temperature sensor 122 and a pressure sensor 124 in communication with each air chamber 140, 144 and each fluid chamber 138, 146. These sensors are similar to sensors 112, 114 and deliver sensor telemetry to the control system 120, which in turn can send signals to control the valve arrangements. In addition, the pistons 136, 142 can include position sensors 148 that report the present position of the pistons 136, 142 to the control system 120. The position and/or rate of movement of the pistons 136, 142 can be used to determine relative pressure and flow of both the gas and the fluid.

Referring back to FIG. 1, the system 100 further includes hydraulic valves 128*a*, 128*b*, 128*c*, 128*d* . . . 128*n* that control the communication of the fluid connections of the accumulator 116 and the intensifier 118 with a hydraulic motor 130. The specific number, type, and arrangement of the hydraulic valves 128 and the pneumatic valves 106 are collectively referred to as the control valve arrangements. In addition, the valves are generally depicted as simple two way valves (i.e., shut-off valves); however, the valves could essentially be any configuration as needed to control the flow of air and/or fluid in a particular manner. The hydraulic line between the accumulator 116 and valves 128*a*, 128*b* and the hydraulic line between the intensifier 118 and valves 128*c*, 128*d* can include flow sensors 126 that relay information to the control system 120.

The motor/pump 130 can be a piston-type assembly having a shaft 131 (or other mechanical coupling) that drives, and is driven by, a combination electrical motor and generator assembly 132. The motor/pump 130 could also be, for example, an impeller, vane, or gear type assembly. The motor/generator assembly 132 is interconnected with a power distribution system and can be monitored for status and output/input level by the control system 120.

One advantage of the system depicted in FIG. 1, as opposed, for example, to the system of FIGS. 4 and 5, is that it achieves approximately double the power output in, for example, a 3000-300 psig range without additional components. Shuffling the hydraulic fluid back and forth between the intensifier 118 and the accumulator 116 allows for the same power output as a system with twice the number of intensifiers and accumulators while expanding or compressing in the 250-3000 psig pressure range. In addition, this system arrangement can eliminate potential issues with self-priming for certain the hydraulic motors/pumps when in the pumping mode (i.e., compression phase).

Figure 2A:
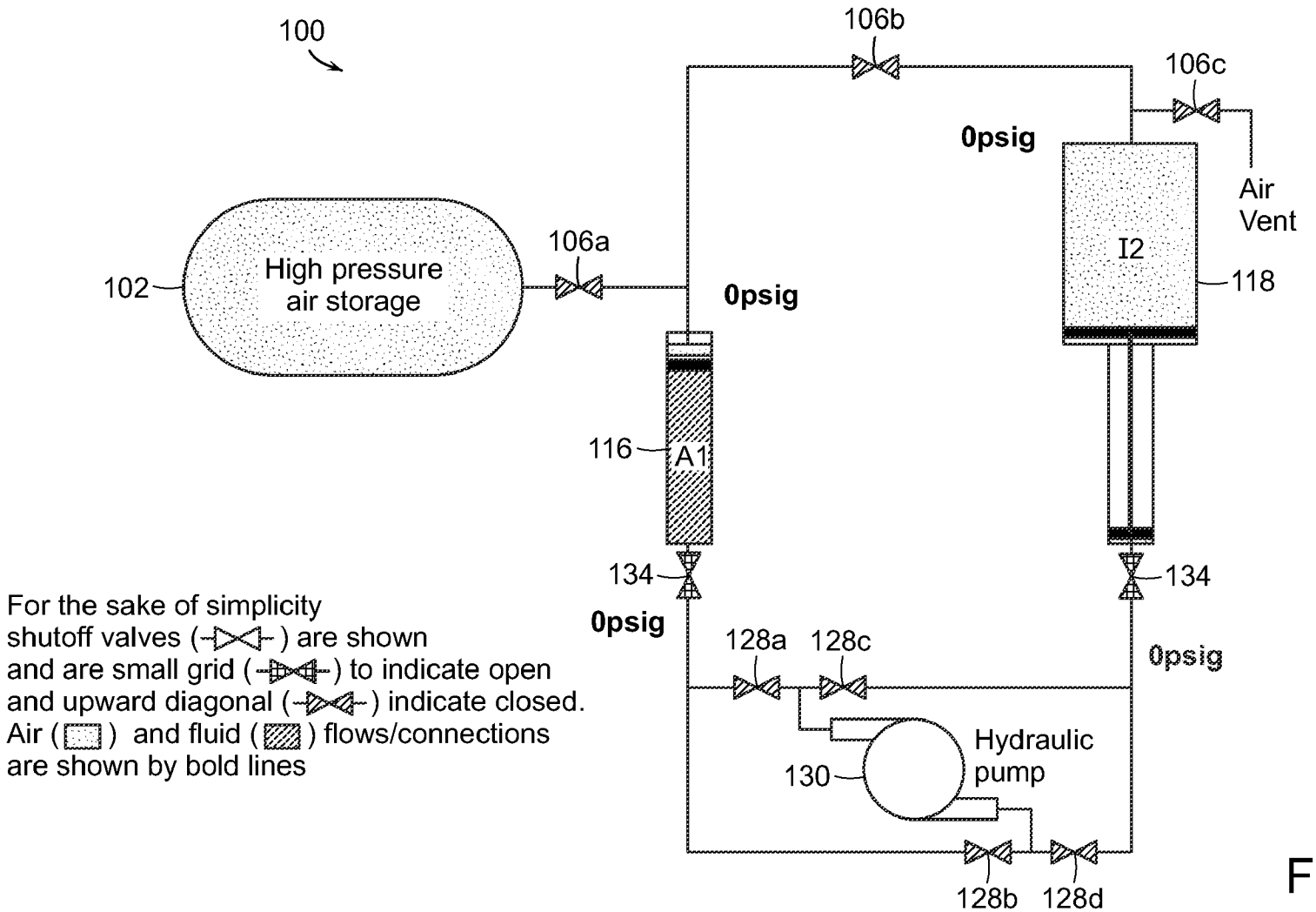
FIGS. 2A-2Q are simplified graphical representations of the system of FIG. 1 illustrating the various operational stages of the system during compression.
Figure 2B:
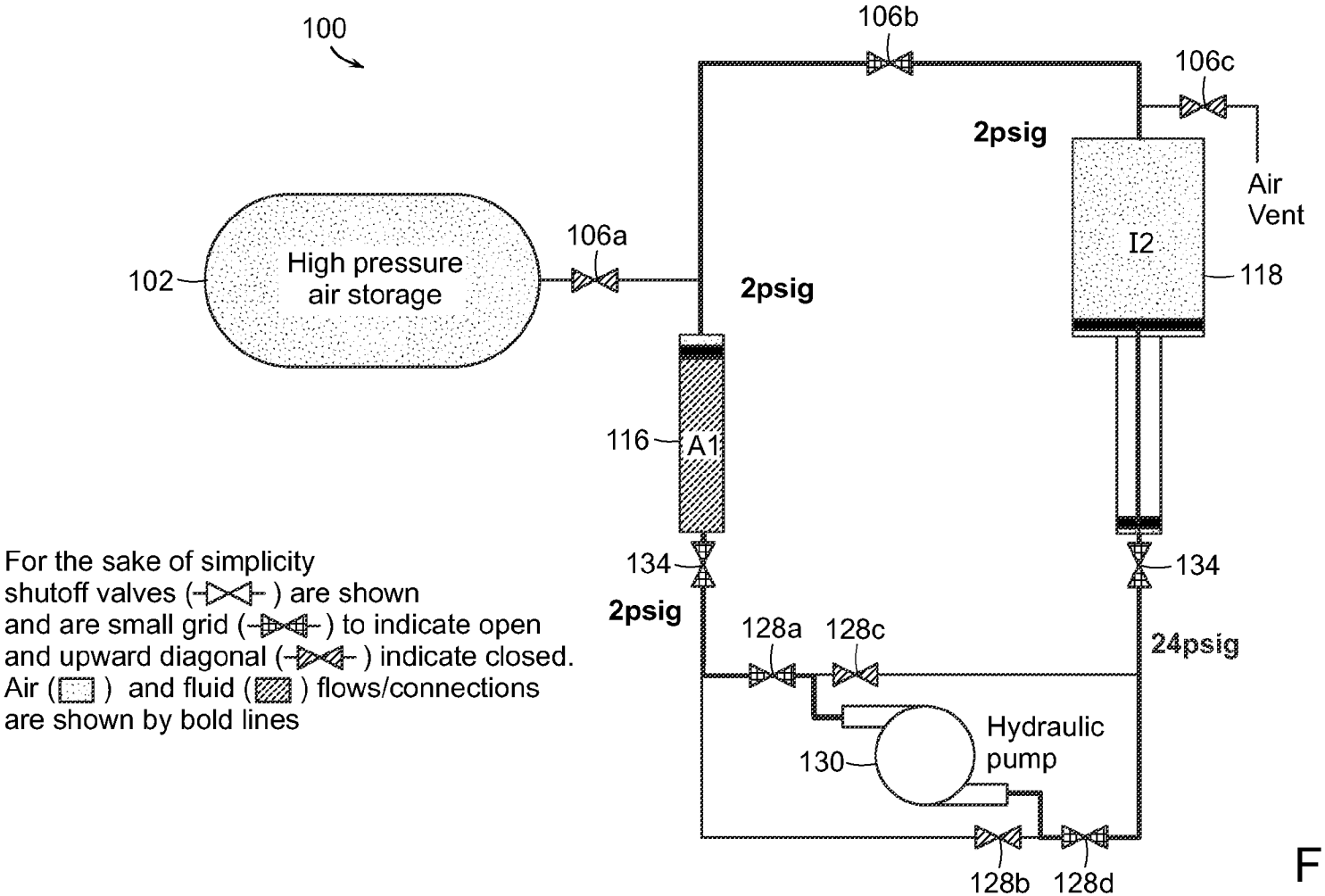
Figure 2C:
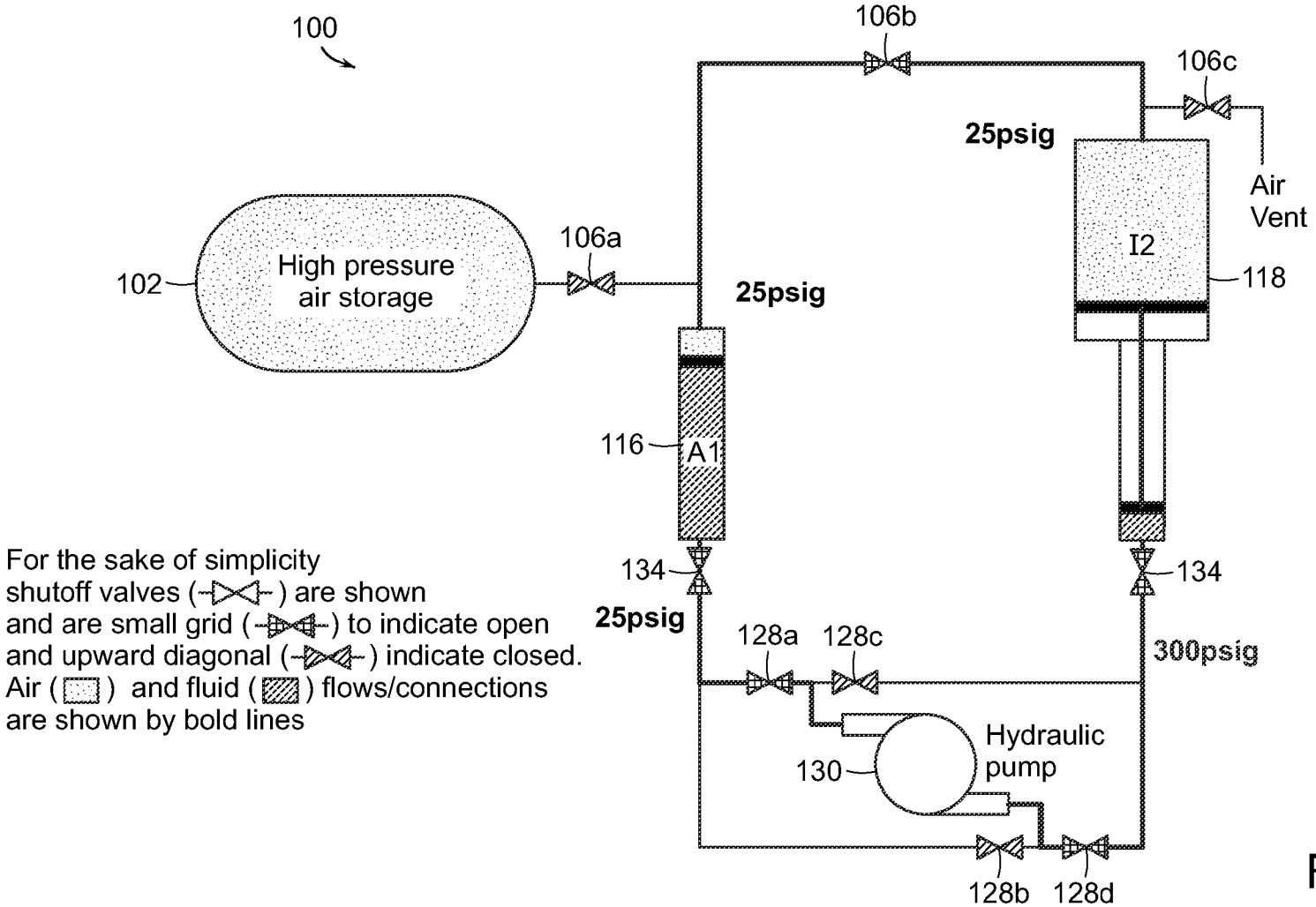
Figure 2D:
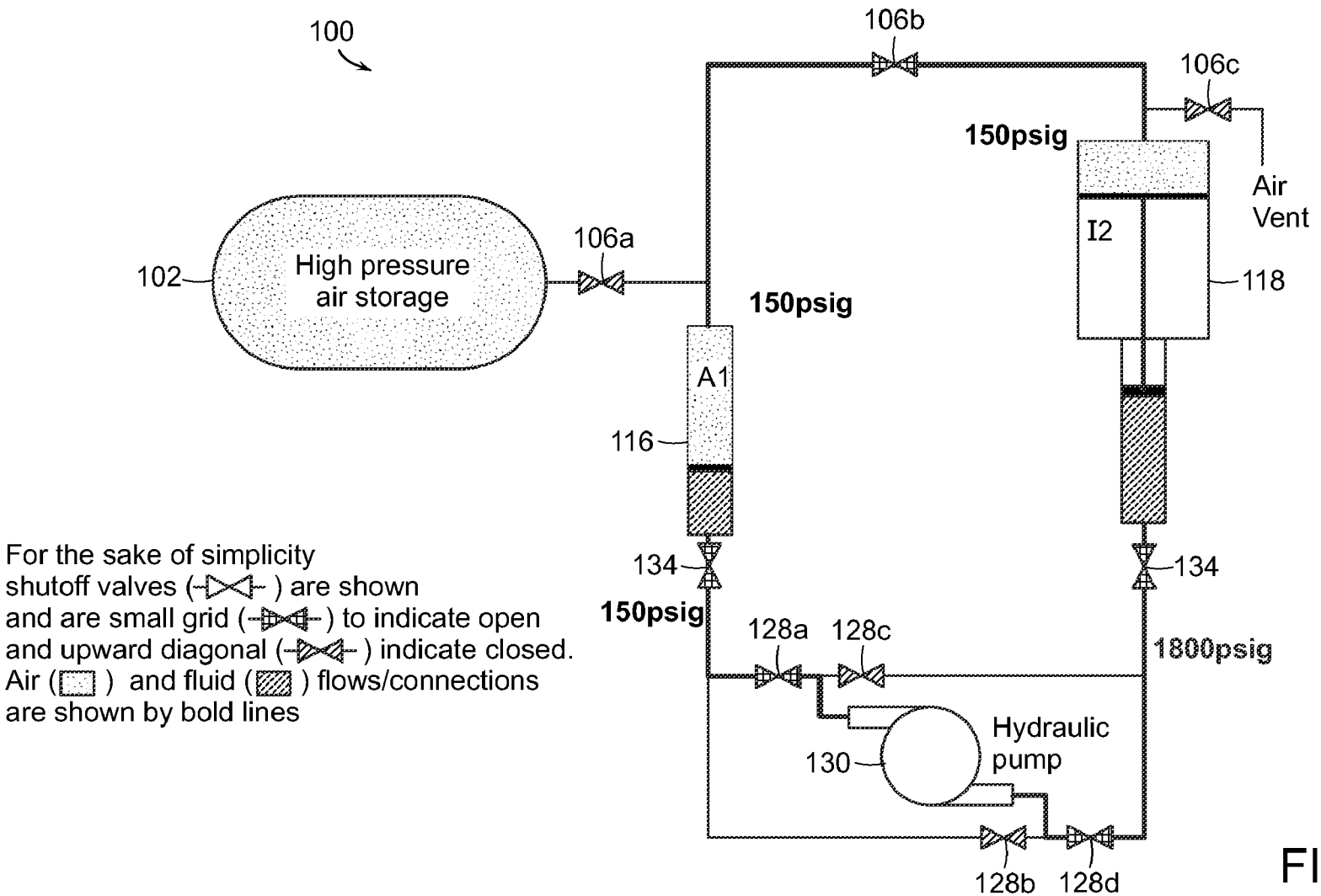
Figure 2E:
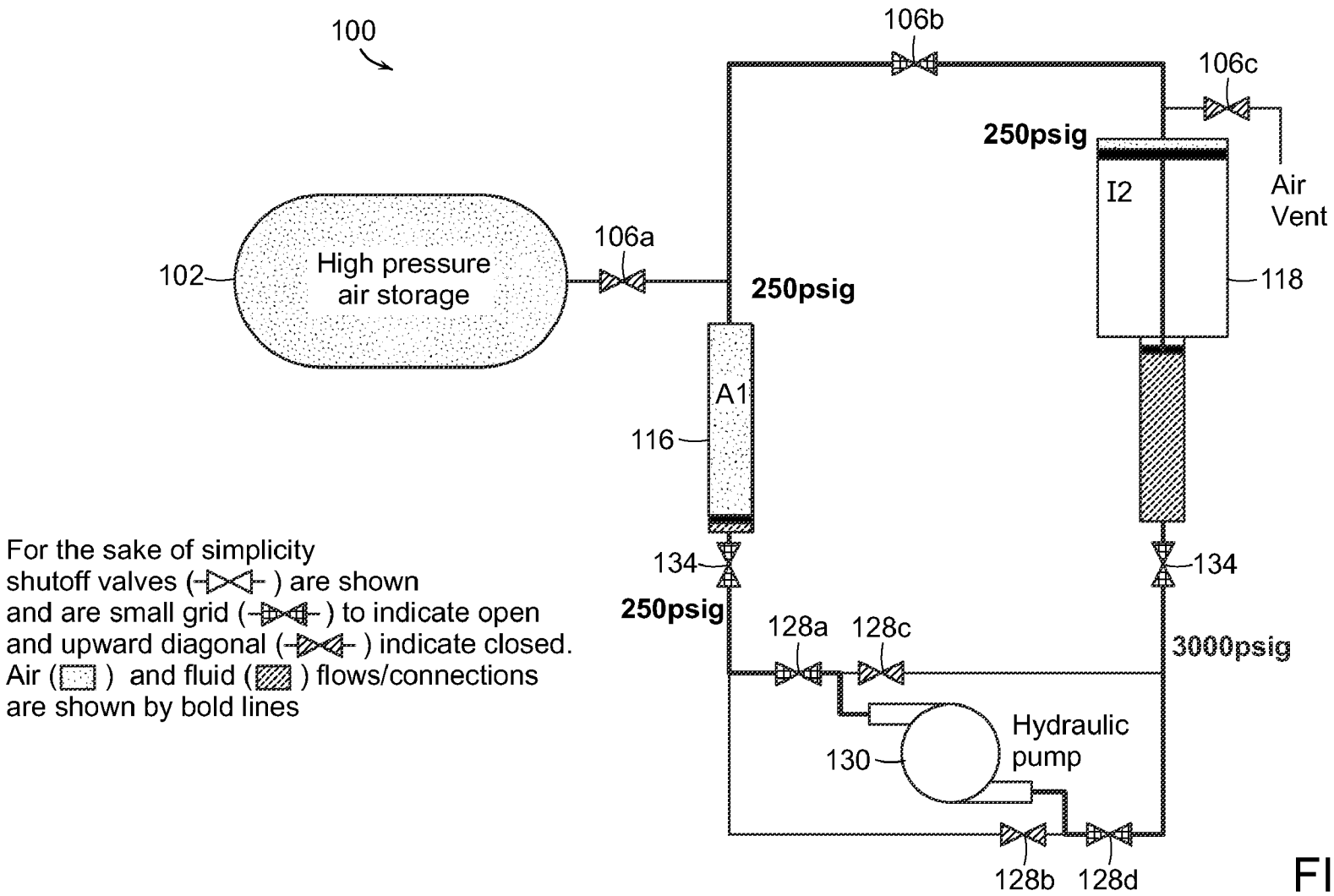
Figure 2F:
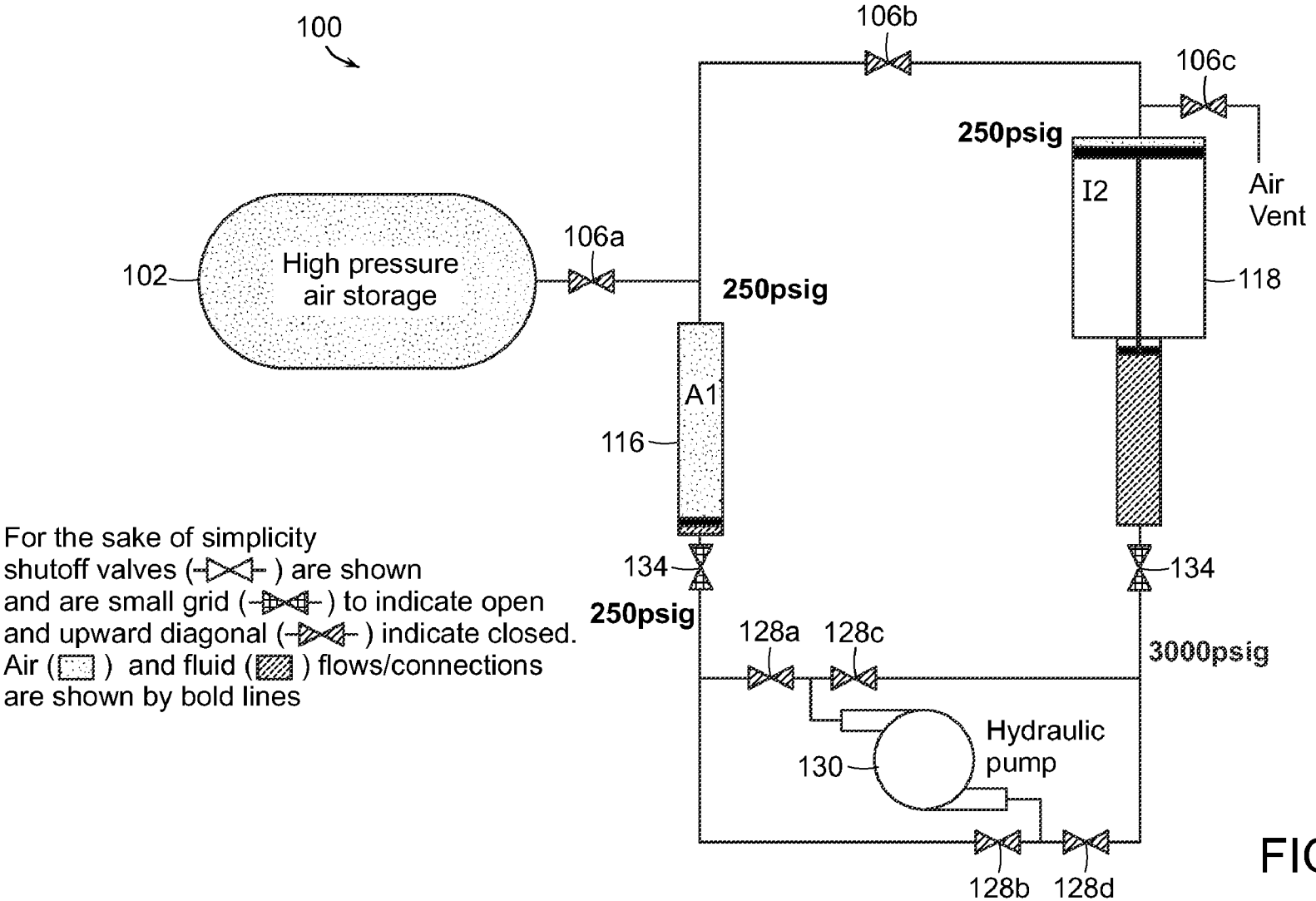
Figure 2G:
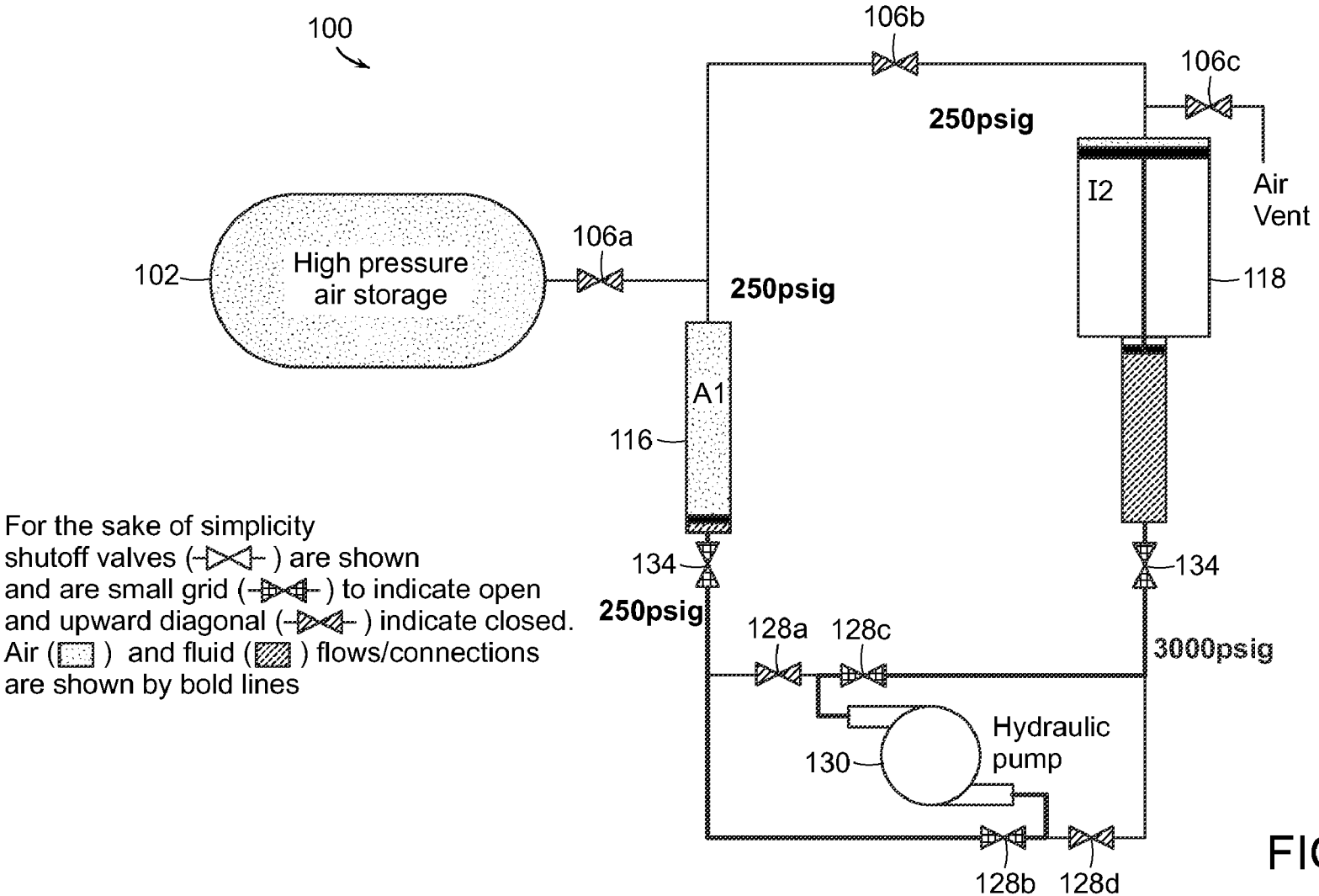
Figure 2H:
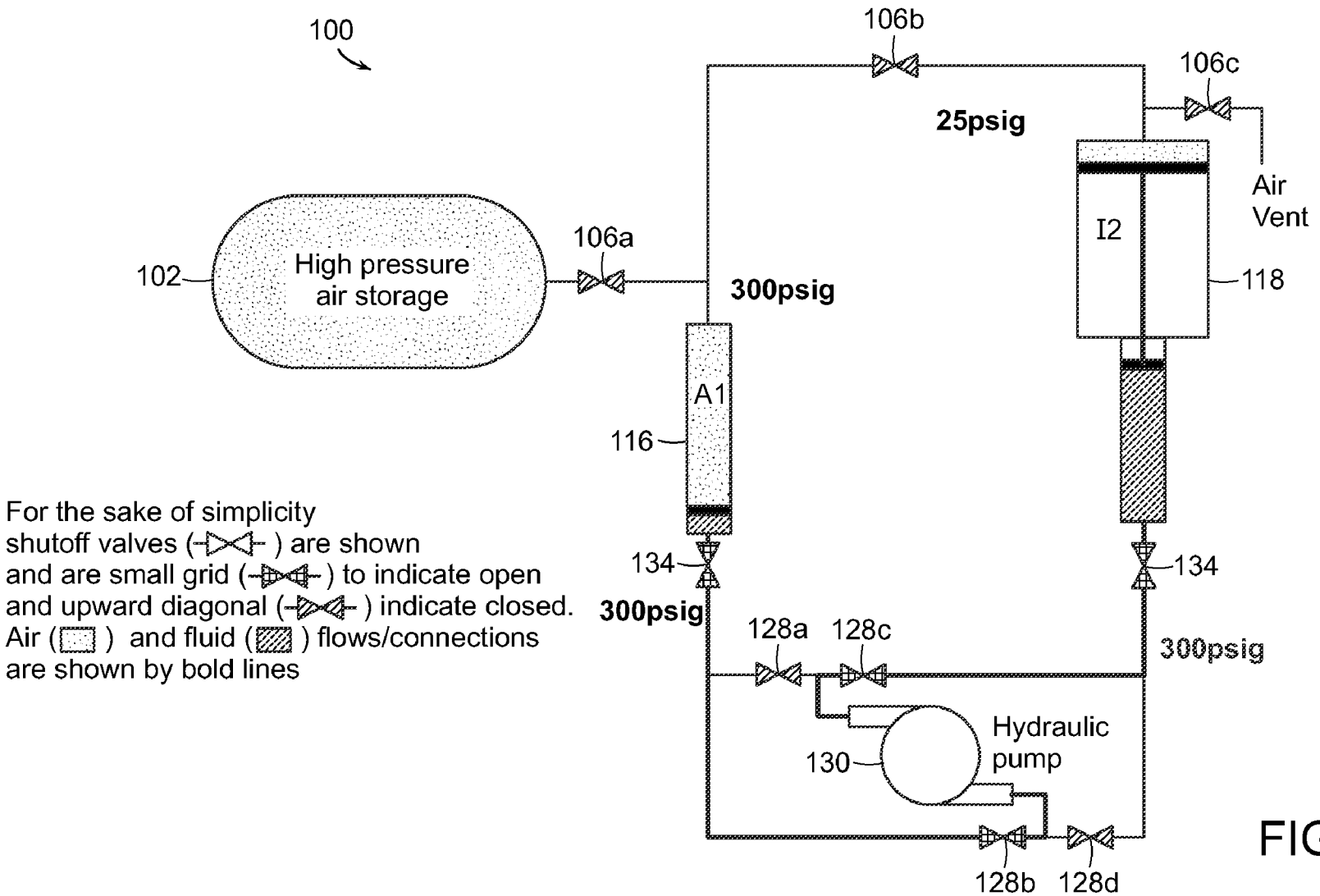
Figure 2I:
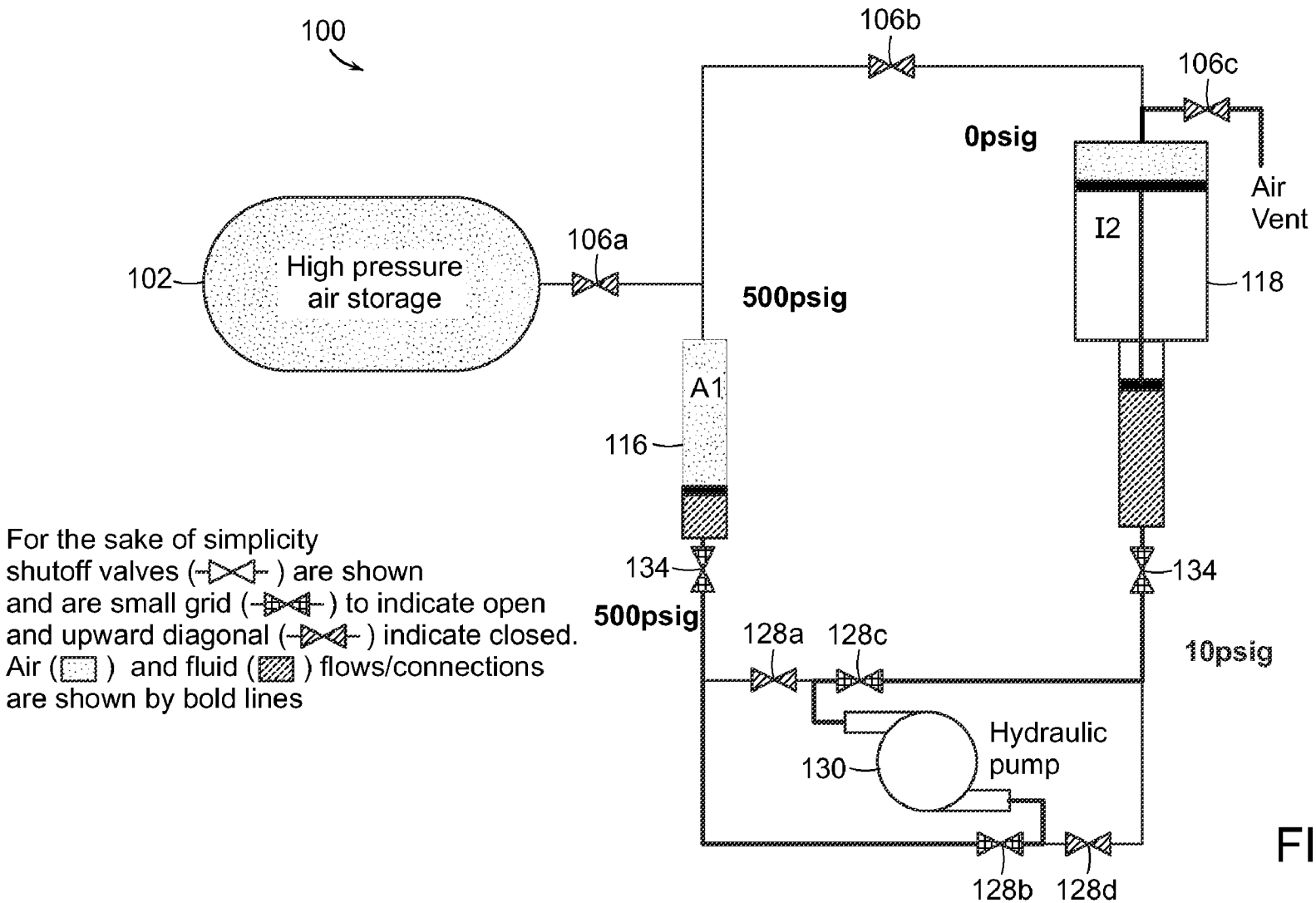
Figure 2J:
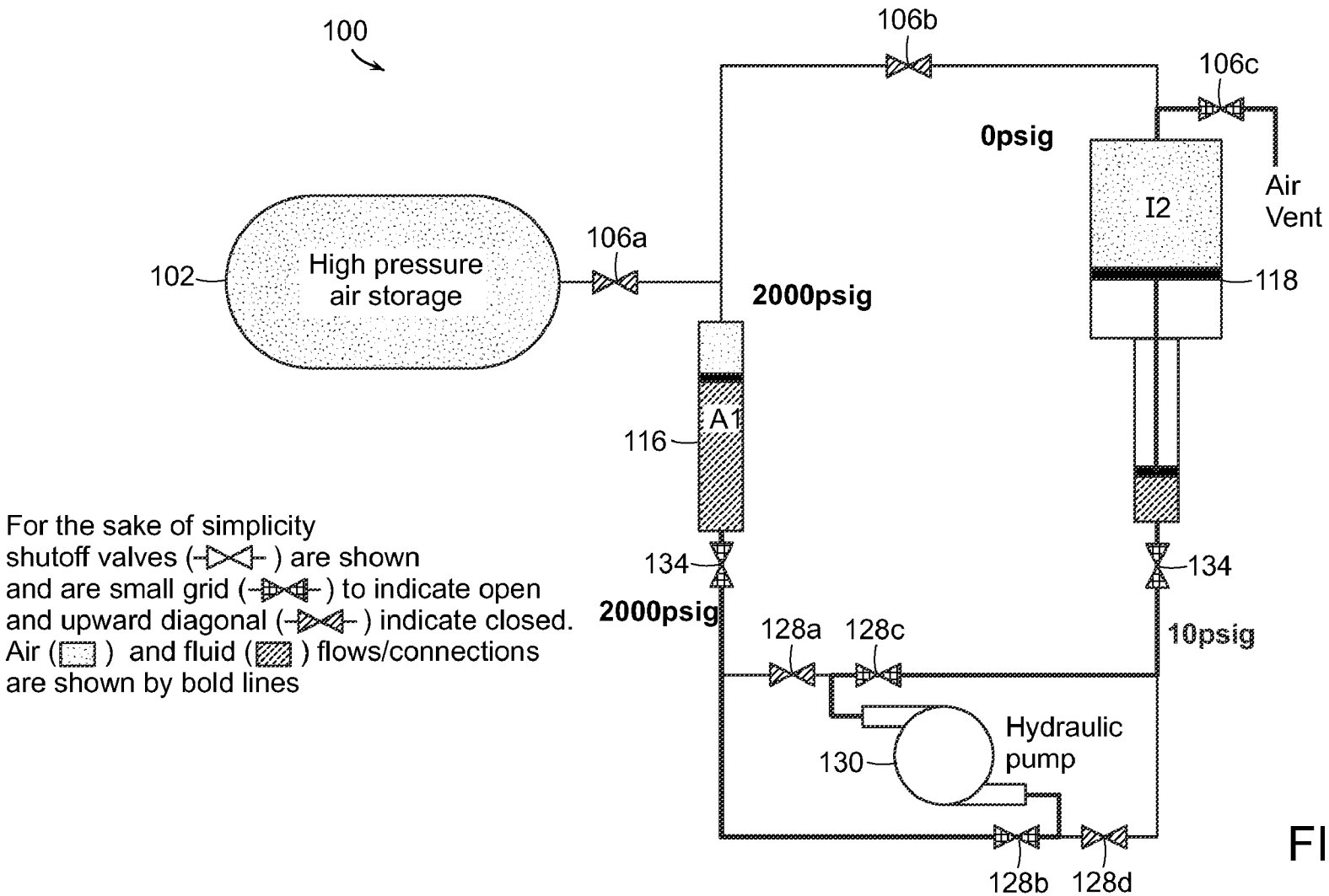
Figure 2K:
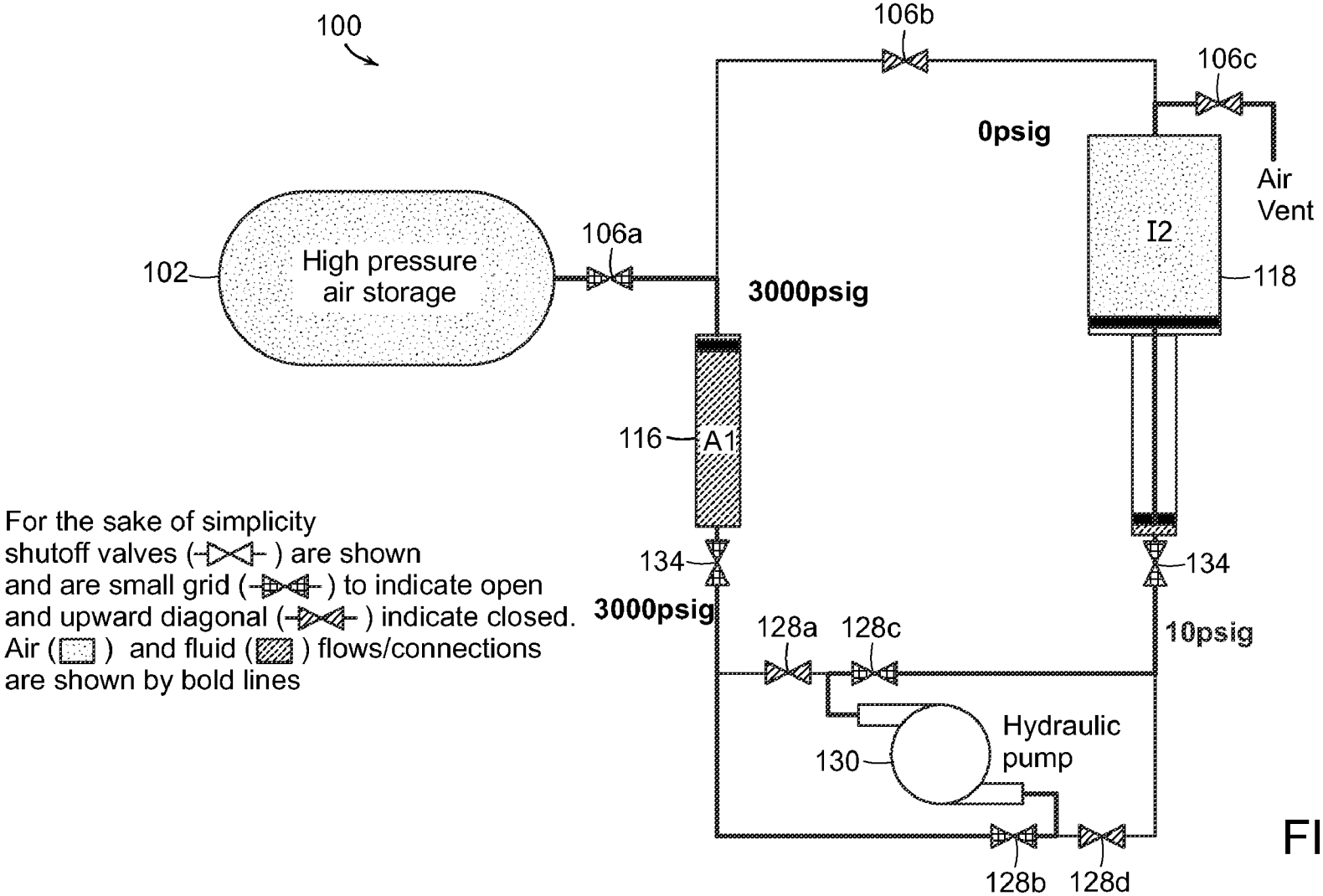
Figure 2L:
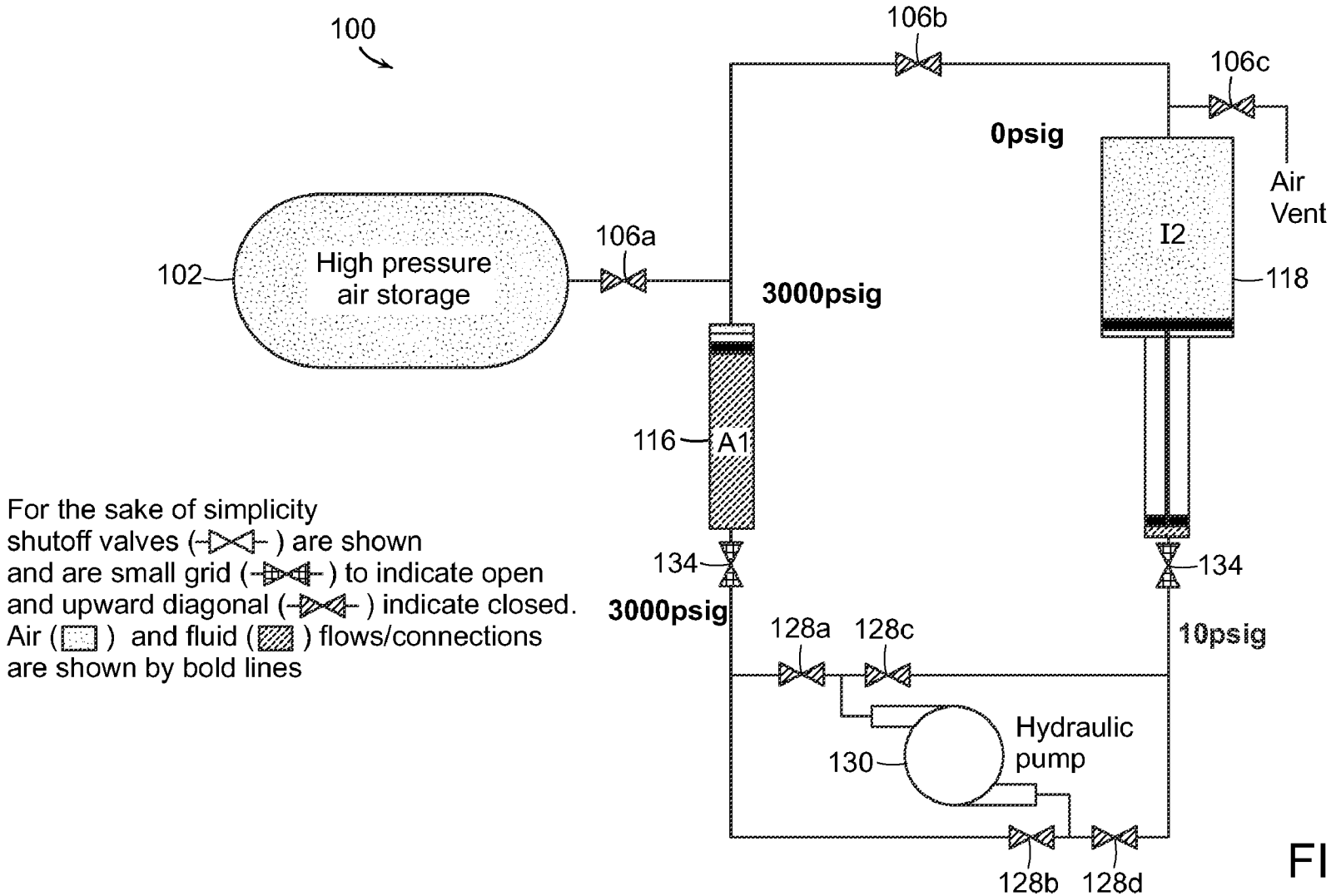
Figure 2M:
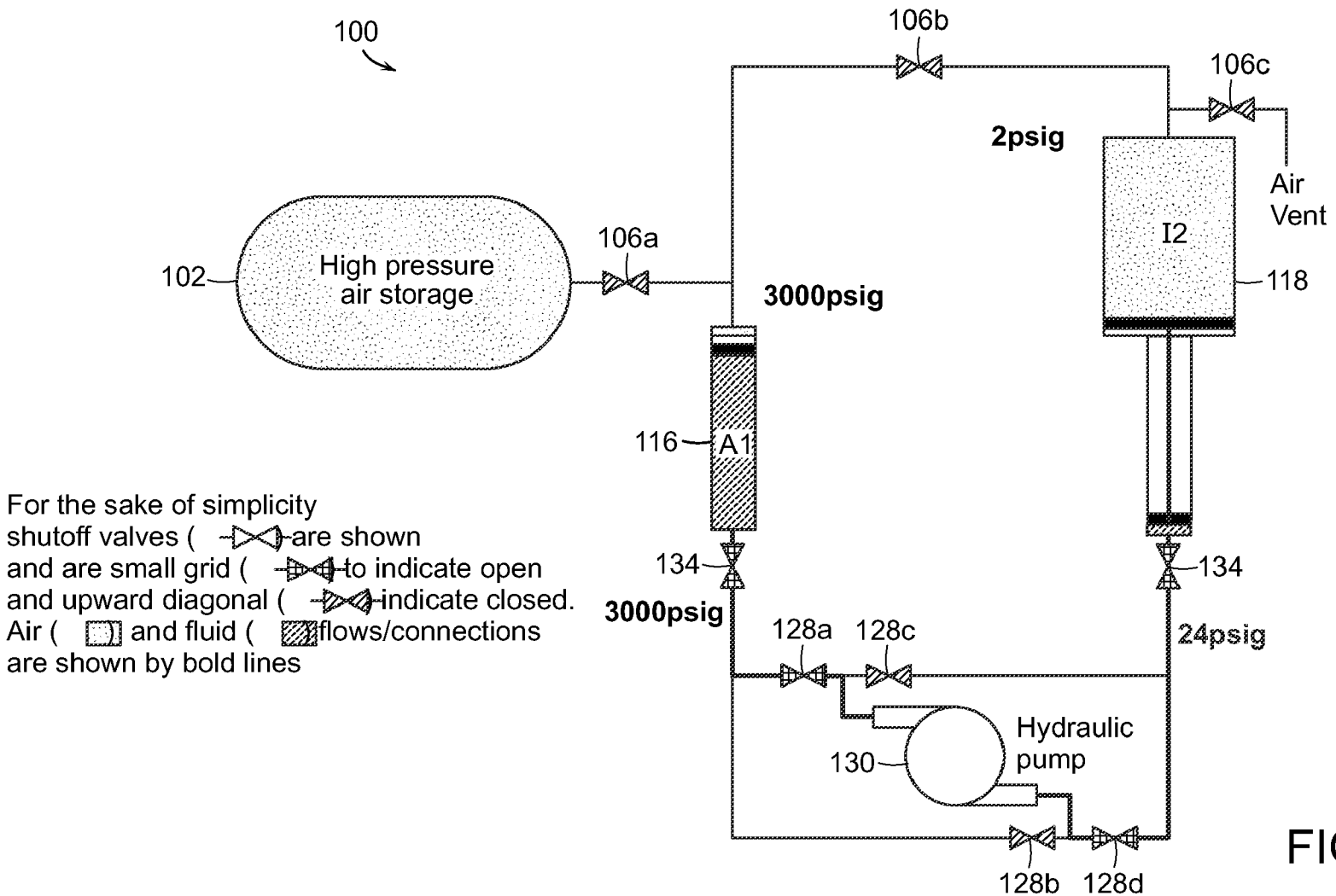
Figure 2N:
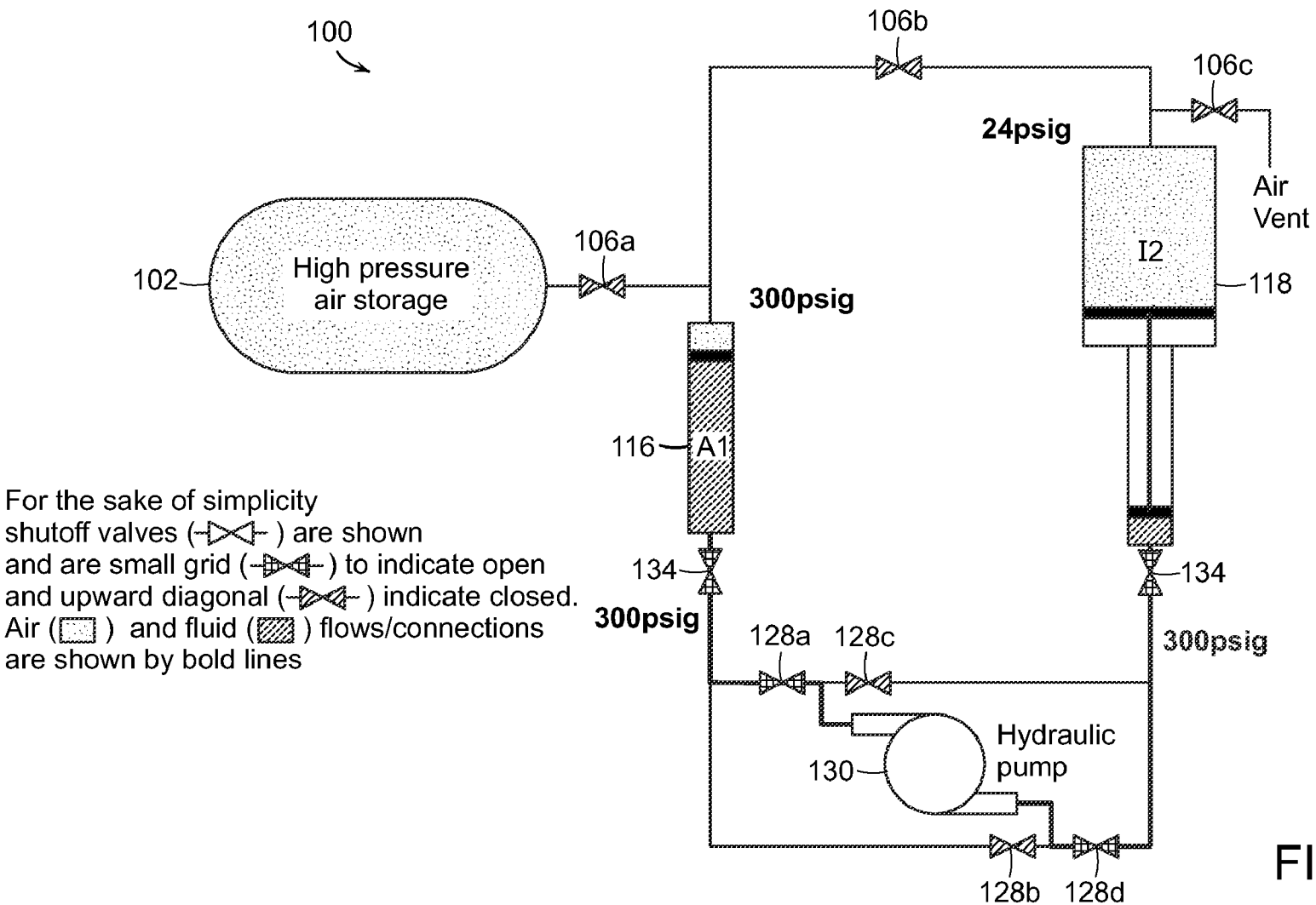
Figure 2O:
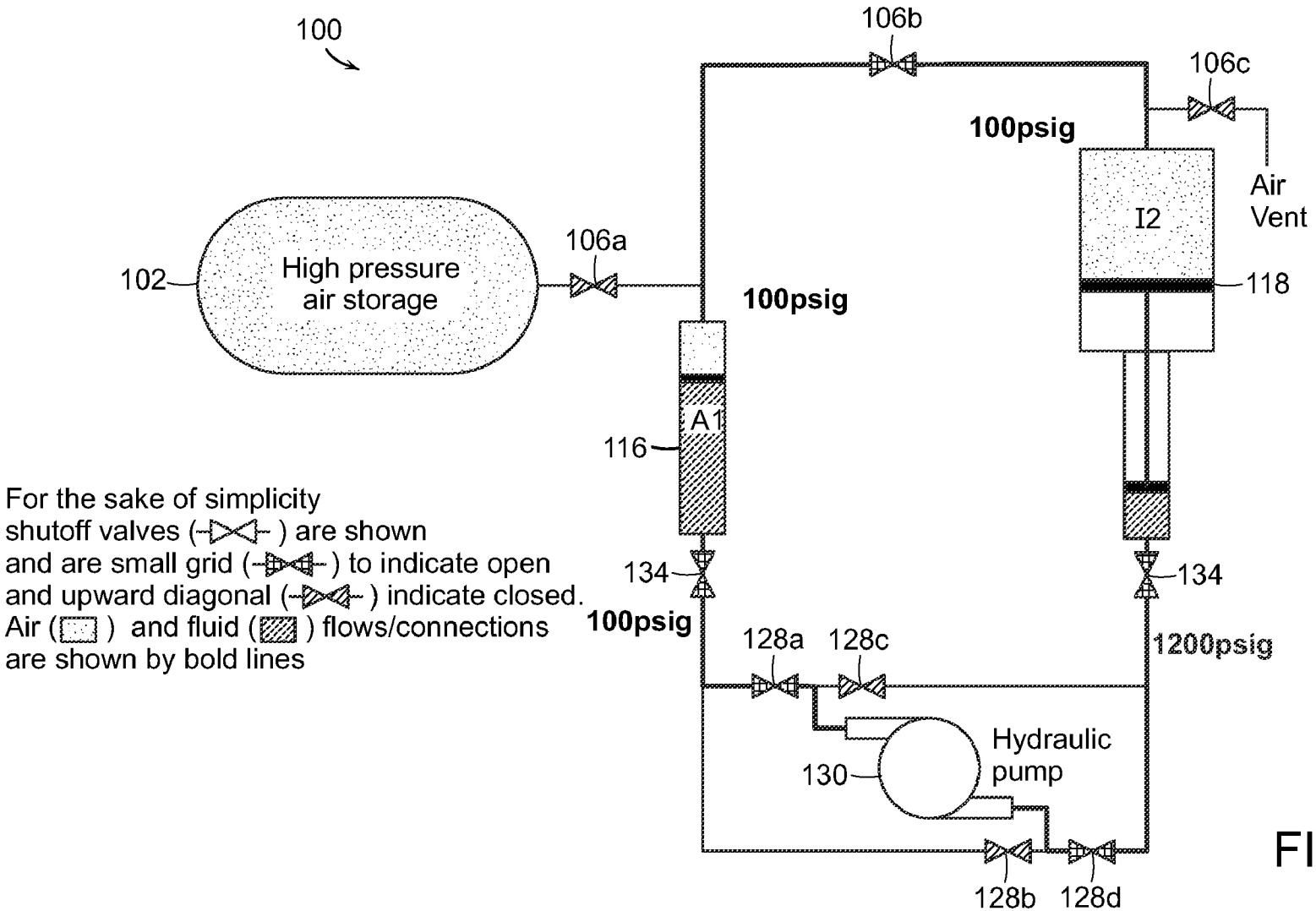
Figure 2P:
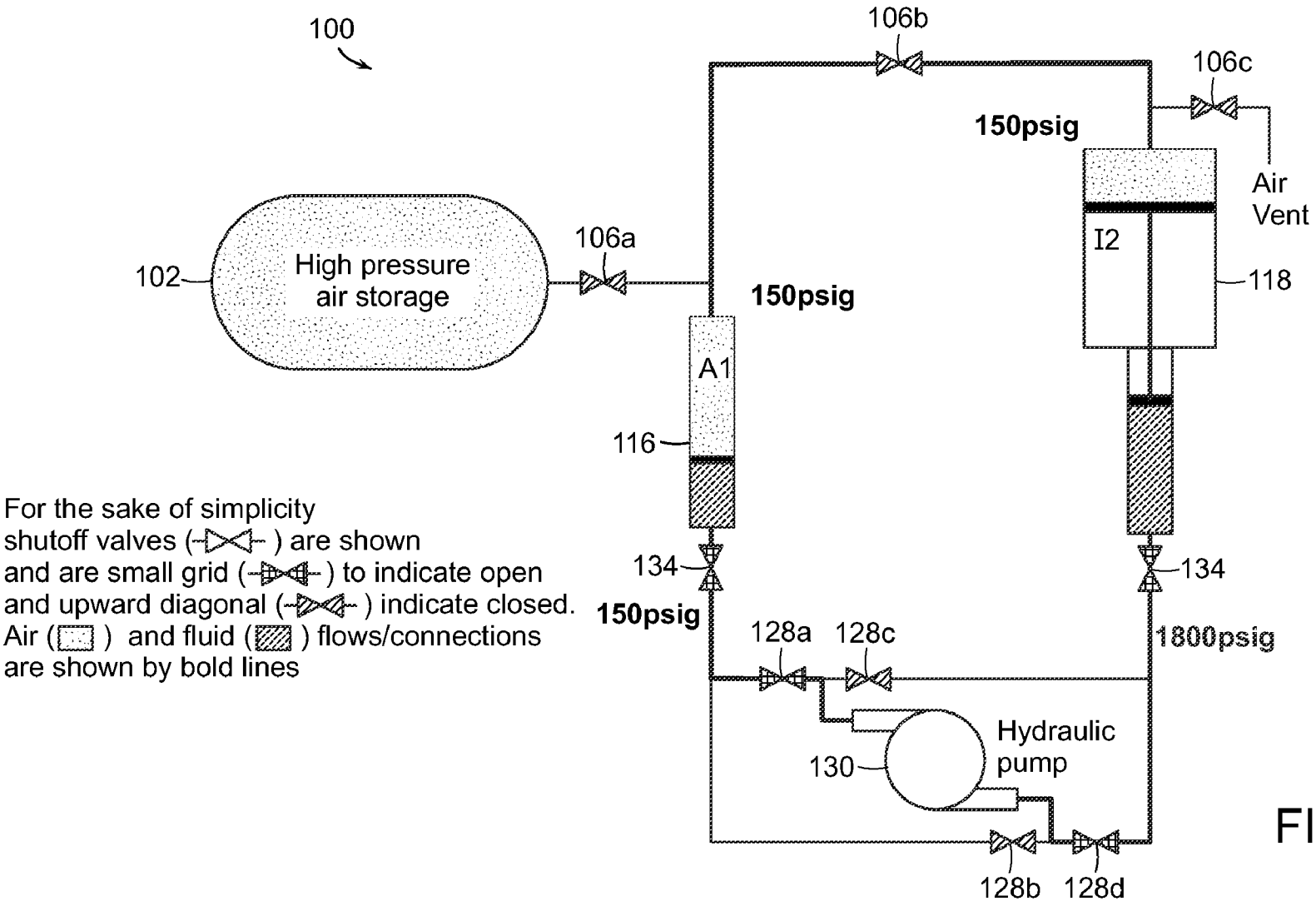
Figure 2Q:
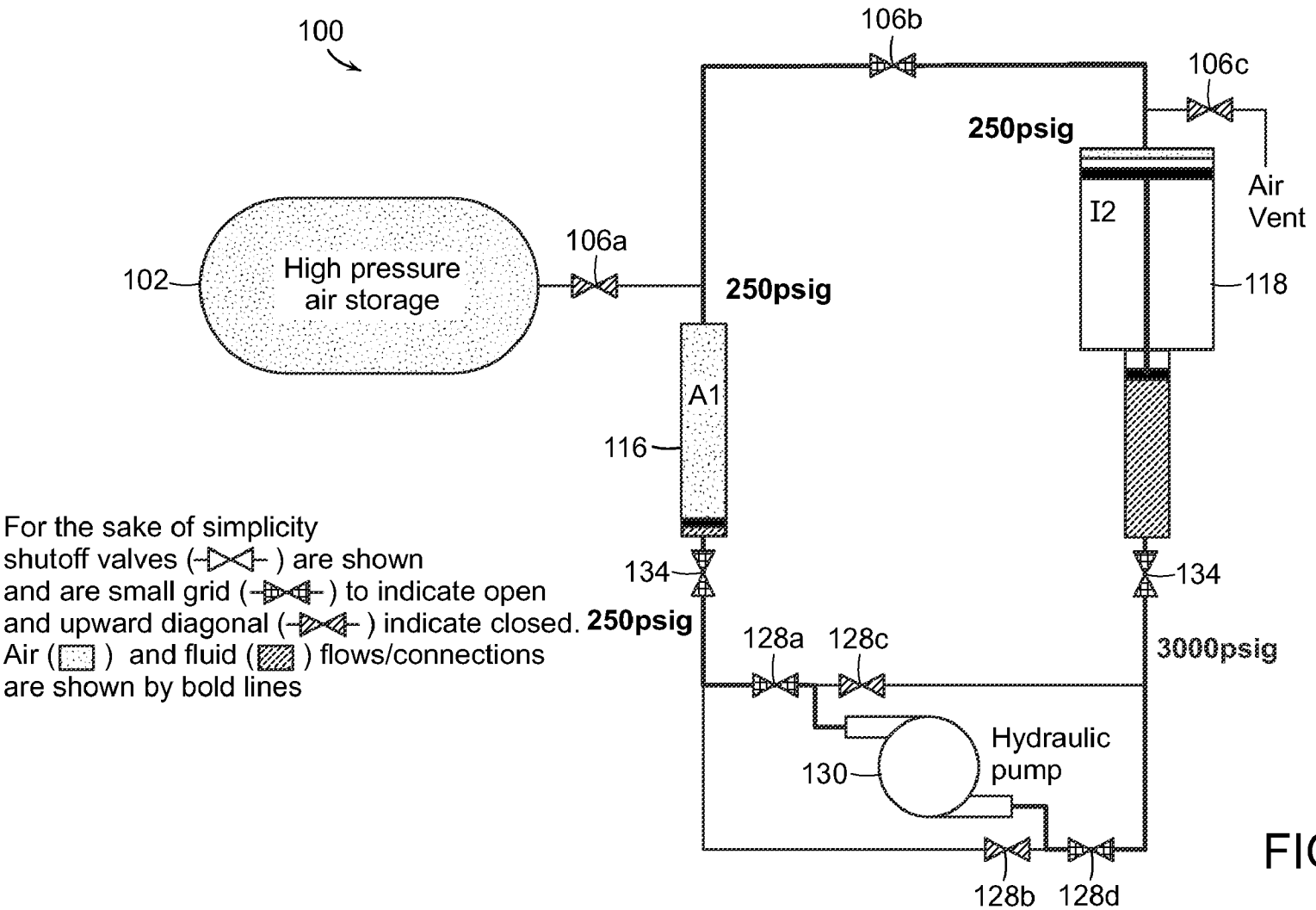

FIGS. 2A-2Q represent, in a simplified graphical manner, the various operational stages of the system 100 during a compression phase, where the storage tanks 102 are charged with high pressure air/gas (i.e., energy is stored). In addition, only one storage tank 102 is shown and some of the valves and sensors are omitted for clarity. Furthermore, the pressures shown are for reference only and will vary depending on the specific operating parameters of the system 100.

As shown in FIG. 2A, the system 100 is in a neutral state, where the pneumatic valves 106 and the hydraulic valves 128 are closed. Shut-off valves 134 are open in every operational stage to maintain the accumulator 116 and intensifier 118 in communication with the system 100. The accumulator fluid chamber 138 is substantially filled, while the intensifier fluid chamber is substantially empty. The storage tank 102 is typically at a low pressure (approximately 0 psig) prior to charging and the hydraulic motor/pump 130 is stationary.

As shown in FIGS. 2B and 2C, as the compression phase begins, pneumatic valve 106*b* is open, thereby allowing fluid communication between the accumulator air chamber 140 and the intensifier air chamber 144, and hydraulic valves 128*a*, 128*d* are open, thereby allowing fluid communication between the accumulator fluid chamber 138 and the intensifier fluid chamber 146 via the hydraulic motor/pump 130. The motor/generator 132 (see FIG. 1) begins to drive the motor/pump 130, and the air pressure between the intensifier 118 and the accumulator 116 begins to increase, as fluid is driven to the intensifier fluid chamber 144 under pressure. The pressure or mechanical energy is transferred to the air chamber 146 via the piston 142. This increase of air pressure in the accumulator air chamber 140 pressurizes the fluid chamber 138 of the accumulator 116, thereby providing pressurized fluid to the motor/pump 130 inlet, which can eliminate self-priming concerns.

As shown in FIGS. 2D, 2E, and 2F, the motor/generator 132 continues to drive the motor/pump 130, thereby transferring the hydraulic fluid from the accumulator 116 to the intensifier 118, which in turn continues to pressurize the air between the accumulator and intensifier air chamber 140, 146. FIG. 2F depicts the completion of the first stage of the compression phase. The pneumatic and hydraulic valves 106, 128 are all closed. The fluid chamber 144 of the intensifier 118 is substantially filled with fluid at a high pressure (for example, about 3000 psig) and the accumulator fluid chamber 138 is substantially empty and maintained at a mid-range pressure (for example, about 250 psig). The pressures in the accumulator and intensifier air chambers 140, 146 are maintained at the mid-range pressure.

The beginning of the second stage of the compression phase is shown in FIG. 2G, where hydraulic valves 128*b*, 128*c* are open and the pneumatic valves 106 are all closed, thereby putting the intensifier fluid chamber 144 at high pressure in communication with the motor/pump 130. The pressure of any gas remaining in the intensifier air chamber 146 will assist in driving the motor/pump 130. Once the hydraulic pressure equalizes between the accumulator and intensifier fluid chambers 138, 144 (as shown in FIG. 2H) the motor/generator will draw electricity to drive the motor/pump 130 and further pressurize the accumulator fluid chamber 138.

As shown in FIGS. 2I and 2J, the motor/pump 130 continues to pressurize the accumulator fluid chamber 138, which in turn pressurizes the accumulator air chamber 140. The intensifier fluid chamber 146 is at a low pressure and the intensifier air chamber 144 is at substantially atmospheric pressure. Once the intensifier air chamber 144 reaches substantially atmospheric pressure, pneumatic vent valve 106*c* is opened. For a vertical orientation of the intensifier, the weight of the intensifier piston 142 can provide the necessary back-pressure to the motor/pump 130, which would overcome potential self-priming issues for certain motors/pumps.

As shown in FIG. 2K, the motor/pump 130 continues to pressurize the accumulator fluid chamber 138 and the accumulator air chamber 140, until the accumulator air and fluid chambers are at the high pressure for the system 100. The intensifier fluid chamber 146 is at a low pressure and is substantially empty. The intensifier air chamber 144 is at substantially atmospheric pressure. FIG. 2K also depicts the change-over in the control valve arrangement when the accumulator air chamber 140 reaches the predetermined high pressure for the system 100. Pneumatic valve 106*a* is opened to allow the high pressure gas to enter the storage tanks 102.

FIG. 2L depicts the end of the second stage of one compression cycle, where all of the hydraulic and the pneumatic valves 128, 106 are closed. The system 100 will now begin another compression cycle, where the system 100 shuttles the hydraulic fluid back to the intensifier 118 from the accumulator 116.

FIG. 2M depicts the beginning of the next compression cycle. The pneumatic valves 106 are closed and hydraulic valves 128*a*, 128*d* are open. The residual pressure of any gas remaining in the accumulator fluid chamber 138 drives the motor/pump 130 initially, thereby eliminating the need to draw electricity. As shown in FIG. 2N, and described with respect to FIG. 2G, once the hydraulic pressure equalizes between the accumulator and intensifier fluid chambers 138, 144 the motor/generator 132 will draw electricity to drive the motor/pump 130 and further pressurize the intensifier fluid chamber 144. During this stage, the accumulator air chamber 140 pressure decreases and the intensifier air chamber 146 pressure increases.

As shown in FIG. 2O, when the gas pressures at the accumulator air chamber 140 and the intensifier air chamber 146 are equal, pneumatic valve 106*b* is opened, thereby putting the accumulator air chamber 140 and the intensifier air chamber 146 in fluid communication. As shown in FIGS. 2P and 2Q, the motor/pump 130 continues to transfer fluid from the accumulator fluid chamber 138 to the intensifier fluid chamber 146 and pressurize the intensifier fluid chamber 146. As described above with respect to FIGS. 2D-2F, the process continues until substantially all of the fluid has been transferred to the intensifier 118 and the intensifier fluid chamber 146 is at the high pressure and the intensifier air chamber 144 is at the mid-range pressure. The system 100 continues the process as shown and described in FIGS. 2G-2K to continue storing high pressure air in the storage tanks 102. The system 100 will perform as many compression cycles (i.e., the shuttling of hydraulic fluid between the accumulator 116 and the intensifier 118) as necessary to reach a desired pressure of the air in the storage tanks 102 (i.e., a full compression phase).

FIGS. 3A-3M represent, in a simplified graphical manner, the various operational stages of the system 100 during an expansion phase, where energy (i.e., the stored compressed gas) is recovered. FIGS. 3A-3M use the same designations, symbols, and exemplary numbers as shown in FIGS. 2A-2Q. It should be noted that while the system 100 is described as being used to compress the air in the storage tanks 102, alternatively, the tanks 102 could be charged (for example, an initial charge) by a separate compressor unit.

Figure 3A:
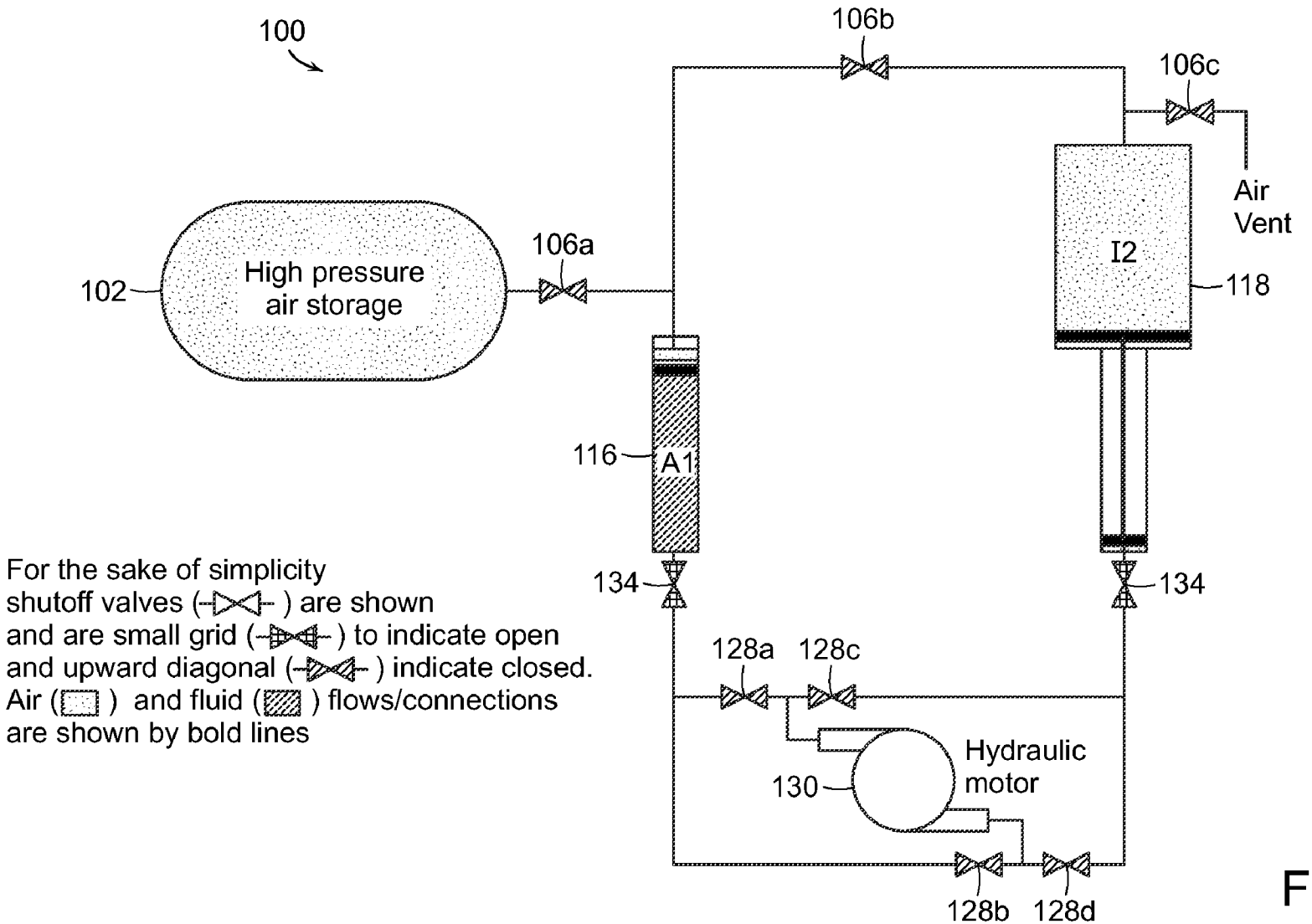
FIGS. 3A-3M are simplified graphical representations of the system of FIG. 1 illustrating the various operational stages of the system during expansion.

As shown in FIG. 3A, the system 100 is in a neutral state, where the pneumatic valves 106 and the hydraulic valves 128 are all closed. The same as during the compression phase, the shut-off valves 134 are open to maintain the accumulator 116 and intensifier 118 in communication with the system 100. The accumulator fluid chamber 138 is substantially filled, while the intensifier fluid chamber 146 is substantially empty.

The storage tank 102 is at a high pressure (for example, 3000 psig) and the hydraulic motor/pump 130 is stationary.

Figure 3B:
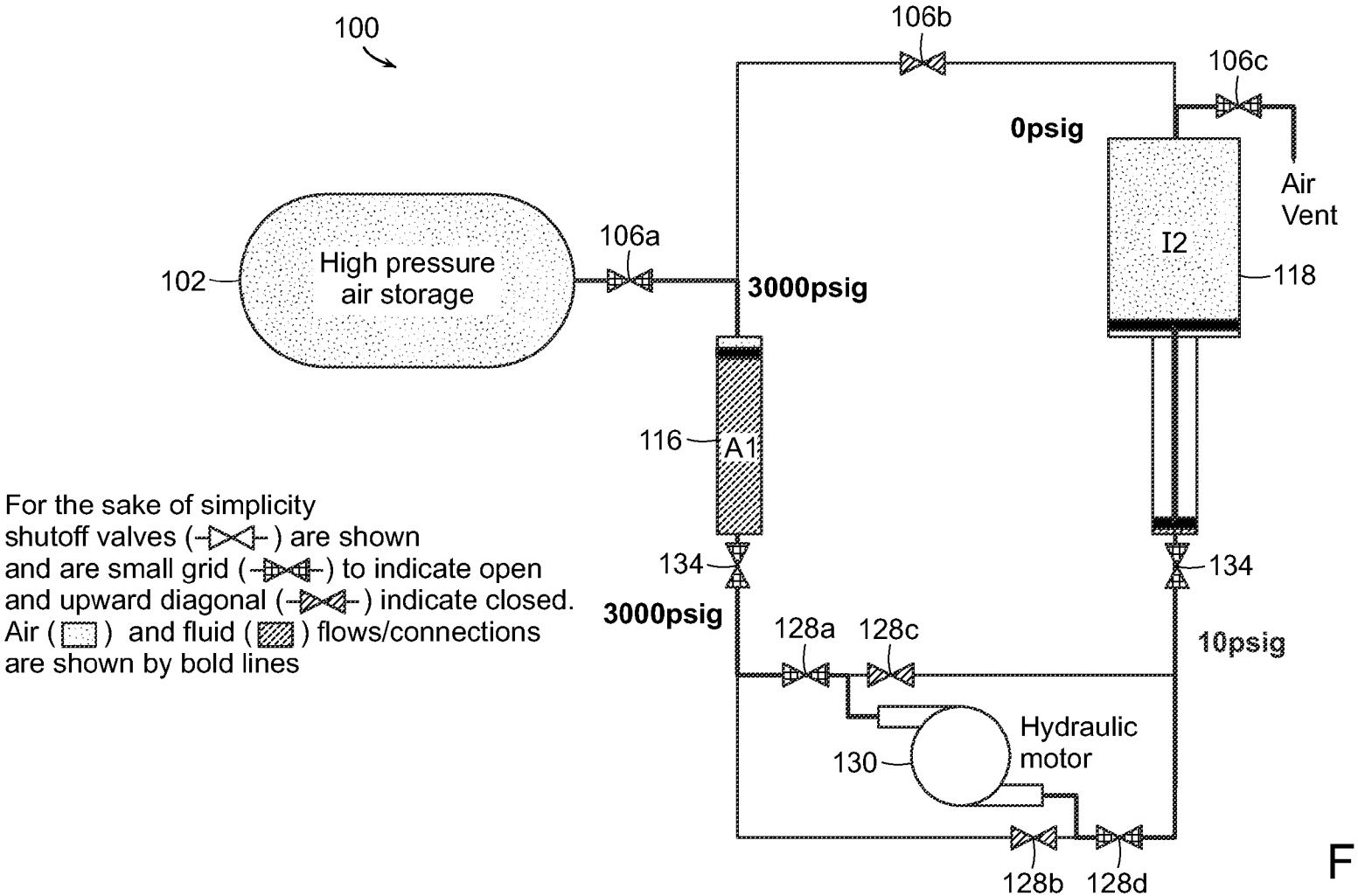

FIG. 3B depicts a first stage of the expansion phase, where pneumatic valves 106*a*, 106*c* are open. Open pneumatic valve 106*a* connects the high pressure storage tanks 102 in fluid communication with the accumulator air chamber 140, which in turn pressurizes the accumulator fluid chamber 138. Open pneumatic valve 106*c* vents the intensifier air chamber 146 to atmosphere. Hydraulic valves 128*a*, 128*d* are open to allow fluid to flow from the accumulator fluid chamber 138 to drive the motor/pump 130, which in turn drives the motor/generator 132, thereby generating electricity. The generated electricity can be delivered directly to a power grid or stored for later use, for example, during peak usage times.

Figure 3C:
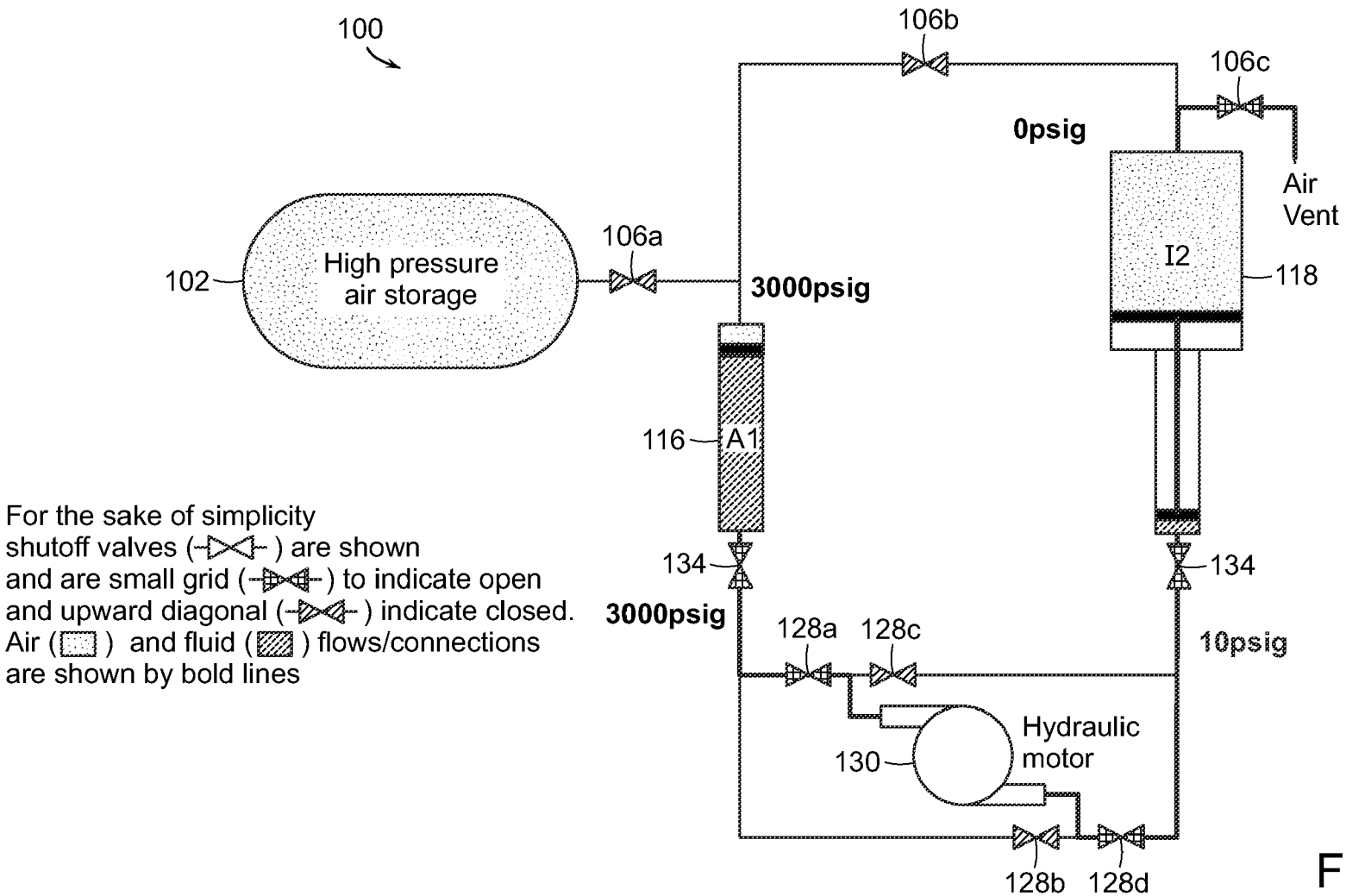
Figure 3D:
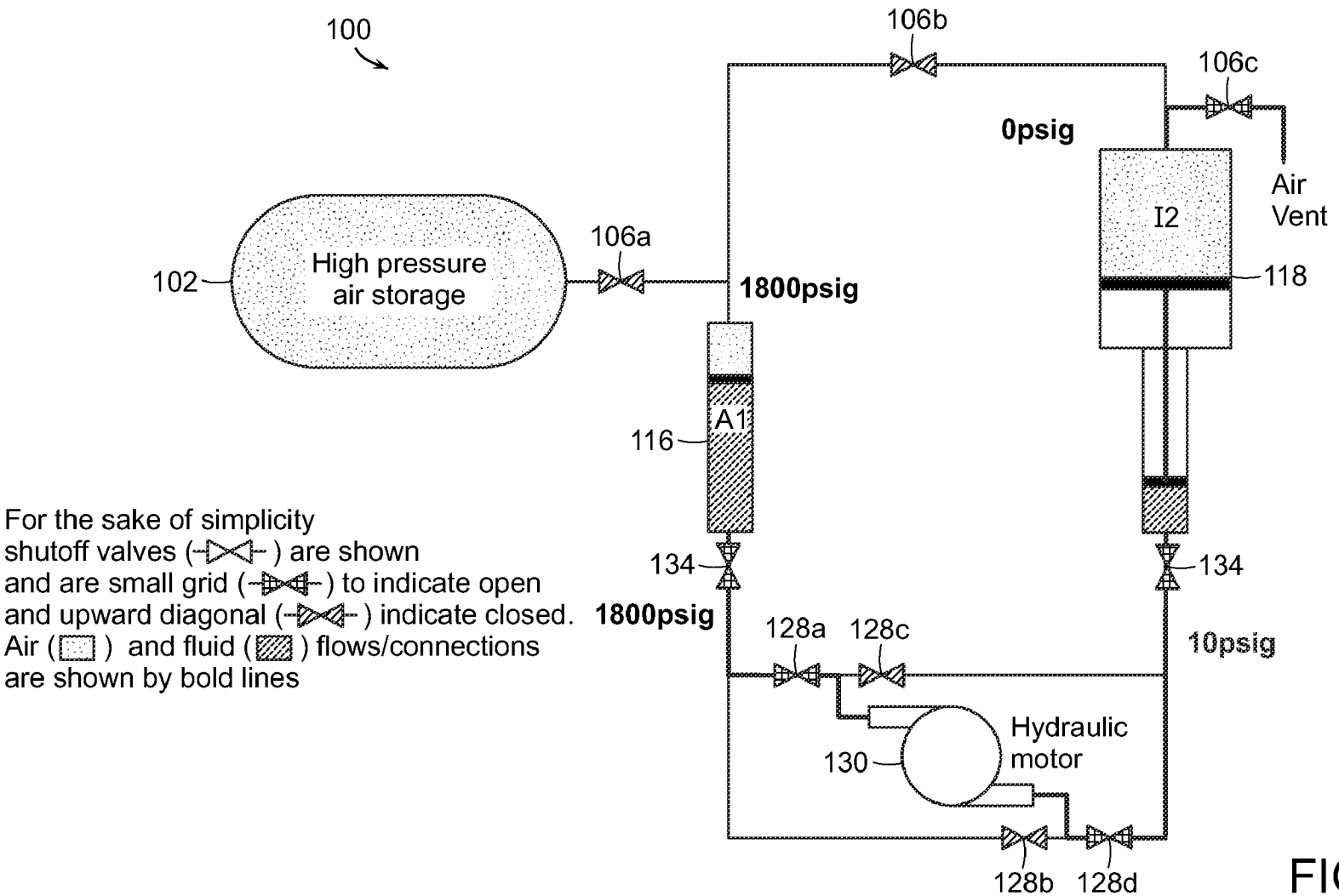
Figure 3E:
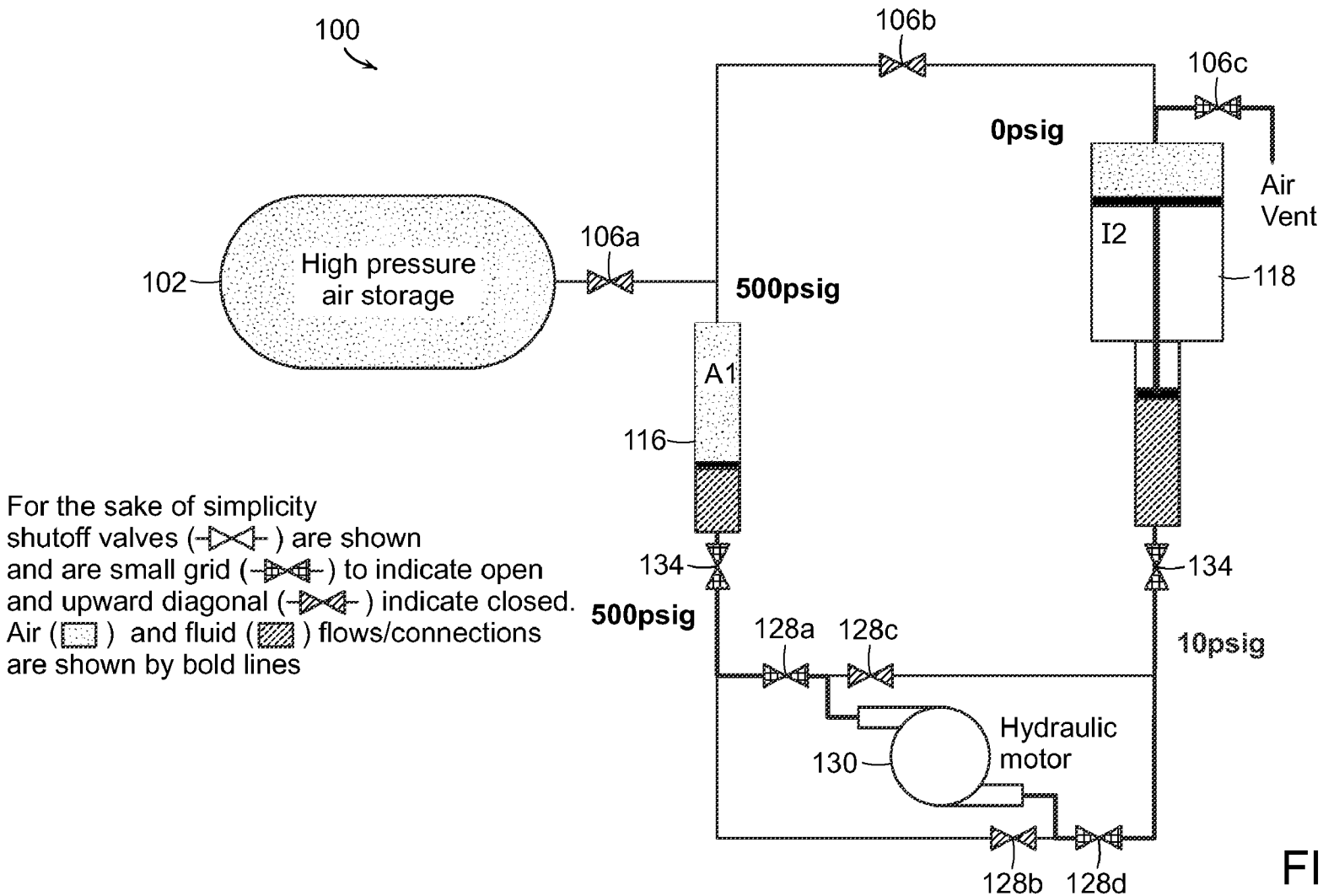
Figure 3F:
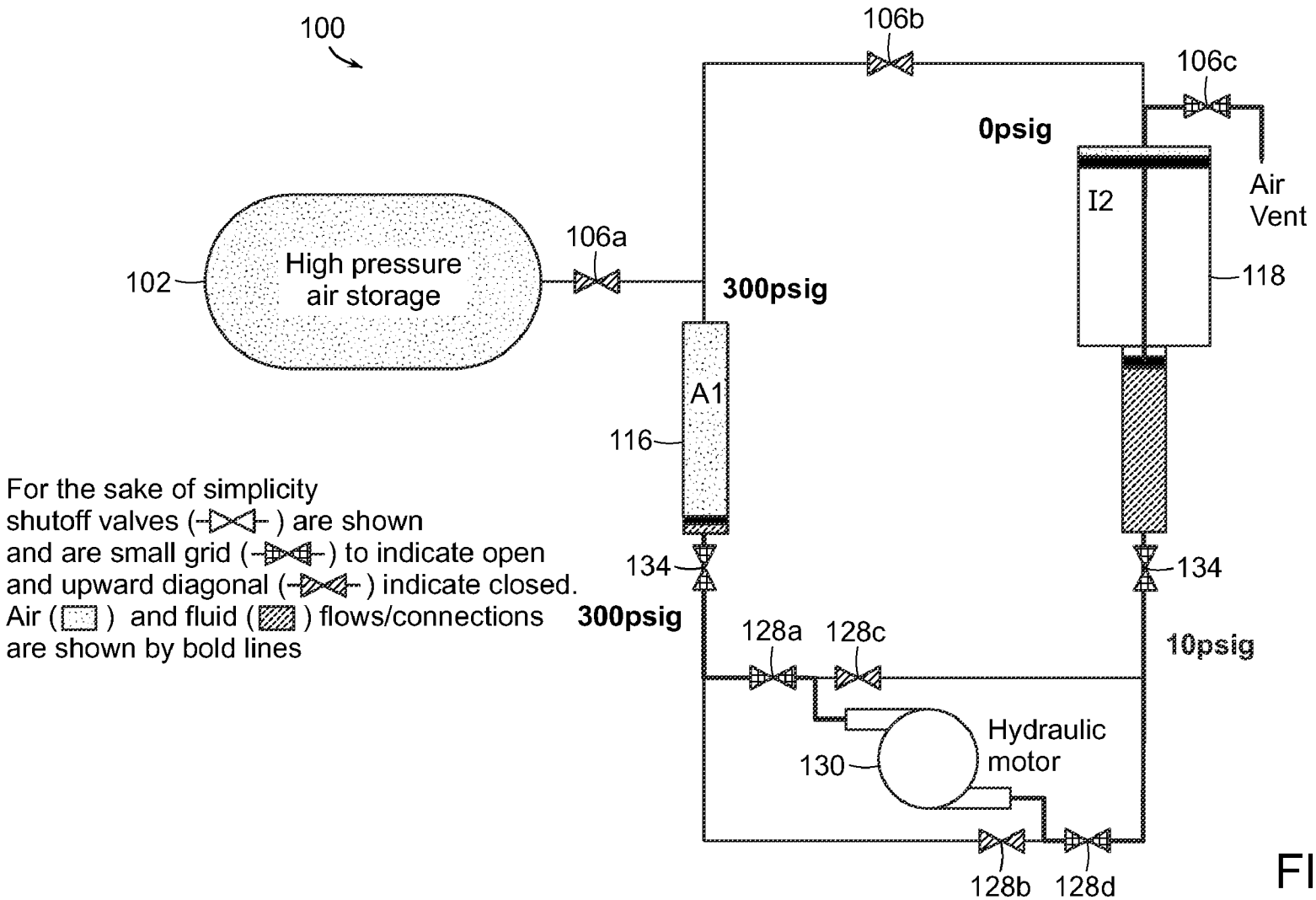

As shown in FIG. 3C, once the predetermined volume of pressurized air is admitted to the accumulator air chamber 140 (for example, 3000 psig), pneumatic valve 106*a* is closed to isolate the storage tanks 102 from the accumulator air chamber 140. As shown in FIGS. 3C-3F, the high pressure in the accumulator air chamber 140 continues to drive the hydraulic fluid from the accumulator fluid chamber 138 through the motor/pump 130 and to the intensifier fluid chamber 146, thereby continuing to drive the motor/generator 132 and generate electricity. As the hydraulic fluid is transferred from the accumulator 116 to the intensifier 118, the pressure in the accumulator air chamber 140 decreases and the air in the intensifier air chamber 144 is vented through pneumatic valve 106C.

Figure 3G:
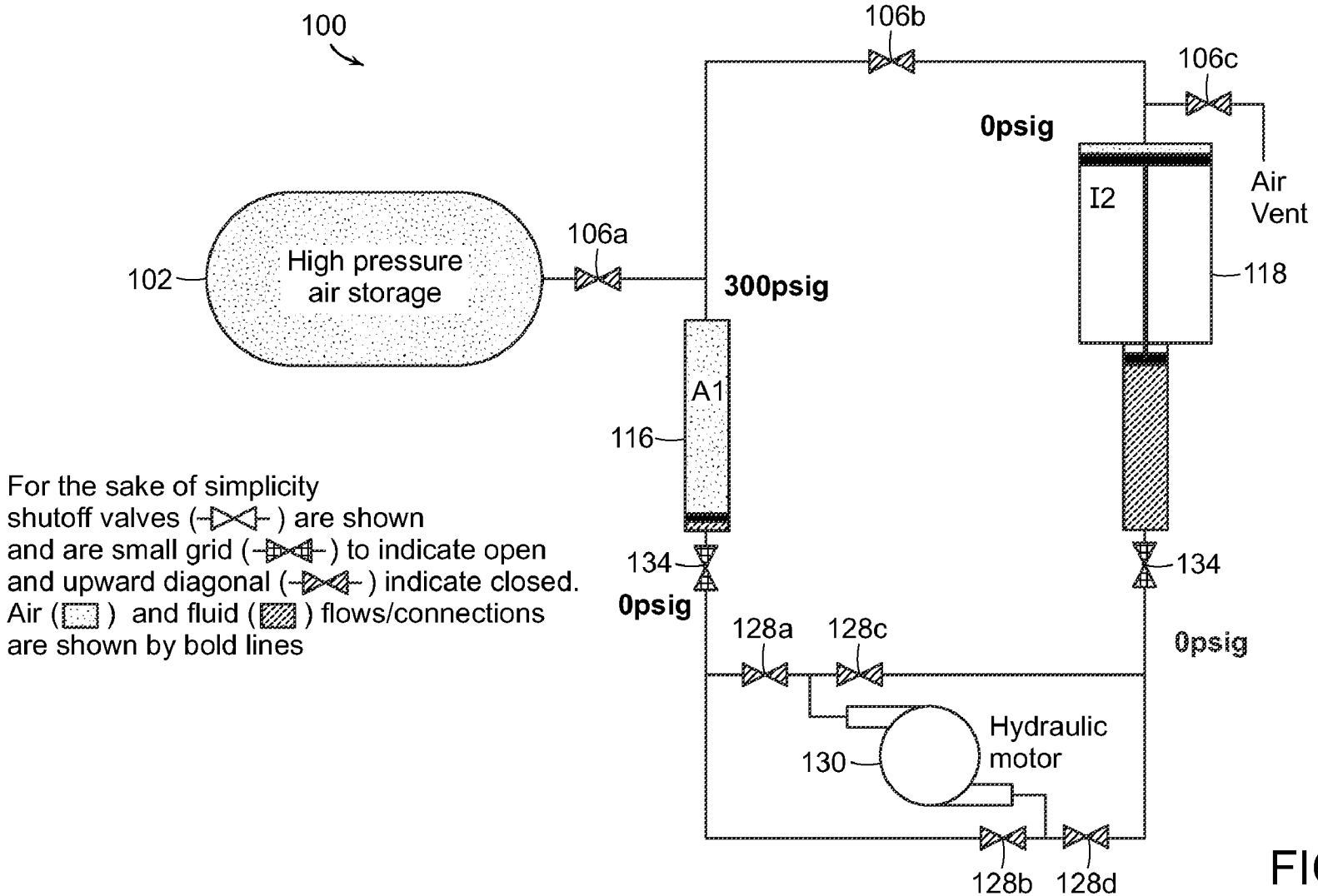

FIG. 3G depicts the end of the first stage of the expansion phase. Once the accumulator air chamber 140 reaches a second predetermined mid-pressure (for example, about 300 psig), all of the hydraulic and pneumatic valves 128, 106 are closed. The pressure in the accumulator fluid chamber 138, the intensifier fluid chamber 146, and the intensifier air chamber 144 are at approximately atmospheric pressure. The pressure in the accumulator air chamber 140 is maintained at the predetermined mid-pressure.

Figure 3H:
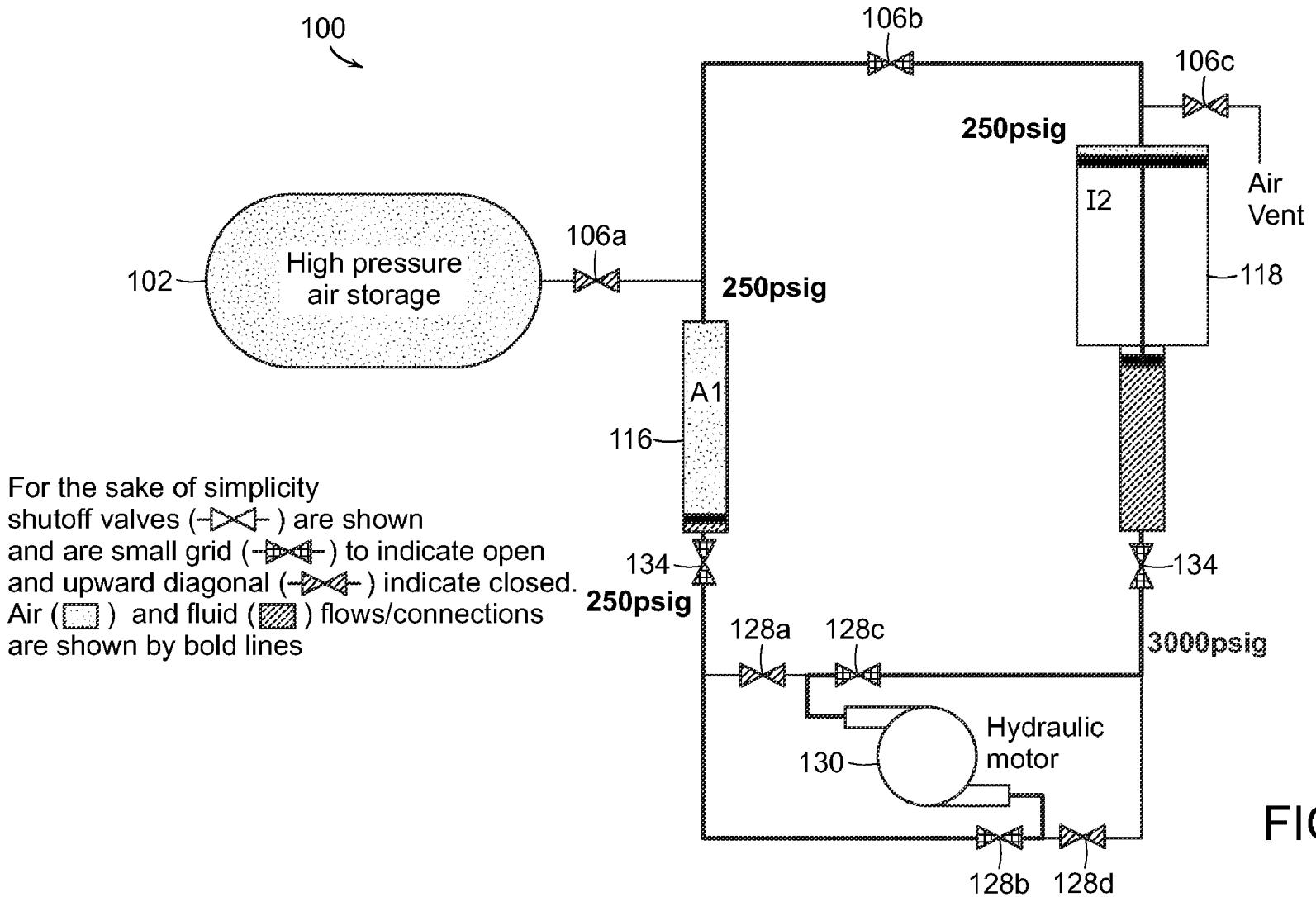

FIG. 3H depicts the beginning of the second stage of the expansion phase. Pneumatic valve 106*b* is opened to allow fluid communication between the accumulator air chamber 140 and the intensifier air chamber 144. The predetermined pressure will decrease slightly when the valve 106*b* is opened and the accumulator air chamber 140 and the intensifier air chamber 144 are connected. Hydraulic valves 128*b*, 128*d* are opened, thereby allowing the hydraulic fluid stored in the intensifier to transfer to the accumulator fluid chamber 138 through the motor/pump 130, which in turn drives the motor/generator 132 and generates electricity. The air transferred from the accumulator air chamber 140 to the intensifier air chamber 144 to drive the fluid from the intensifier fluid chamber 146 to the accumulator fluid chamber 138 is at a lower pressure than the air that drove the fluid from the accumulator fluid chamber 138 to the intensifier fluid chamber 146. The area differential between the air piston 142*a* and the fluid piston 142*b* (for example, 10:1) allows the lower pressure air to transfer the fluid from the intensifier fluid chamber 146 at a high pressure.

Figure 3I:
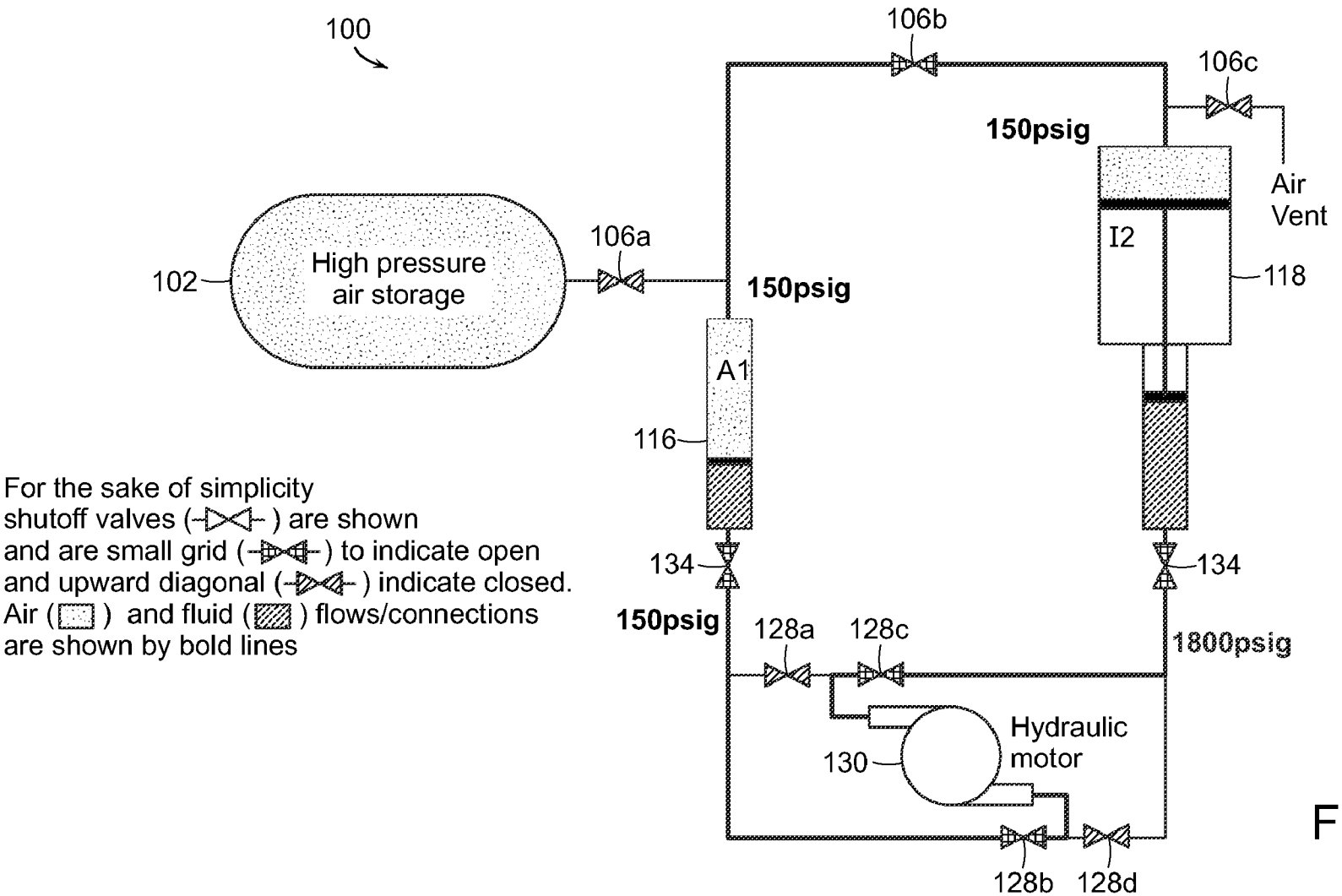
Figure 3J:
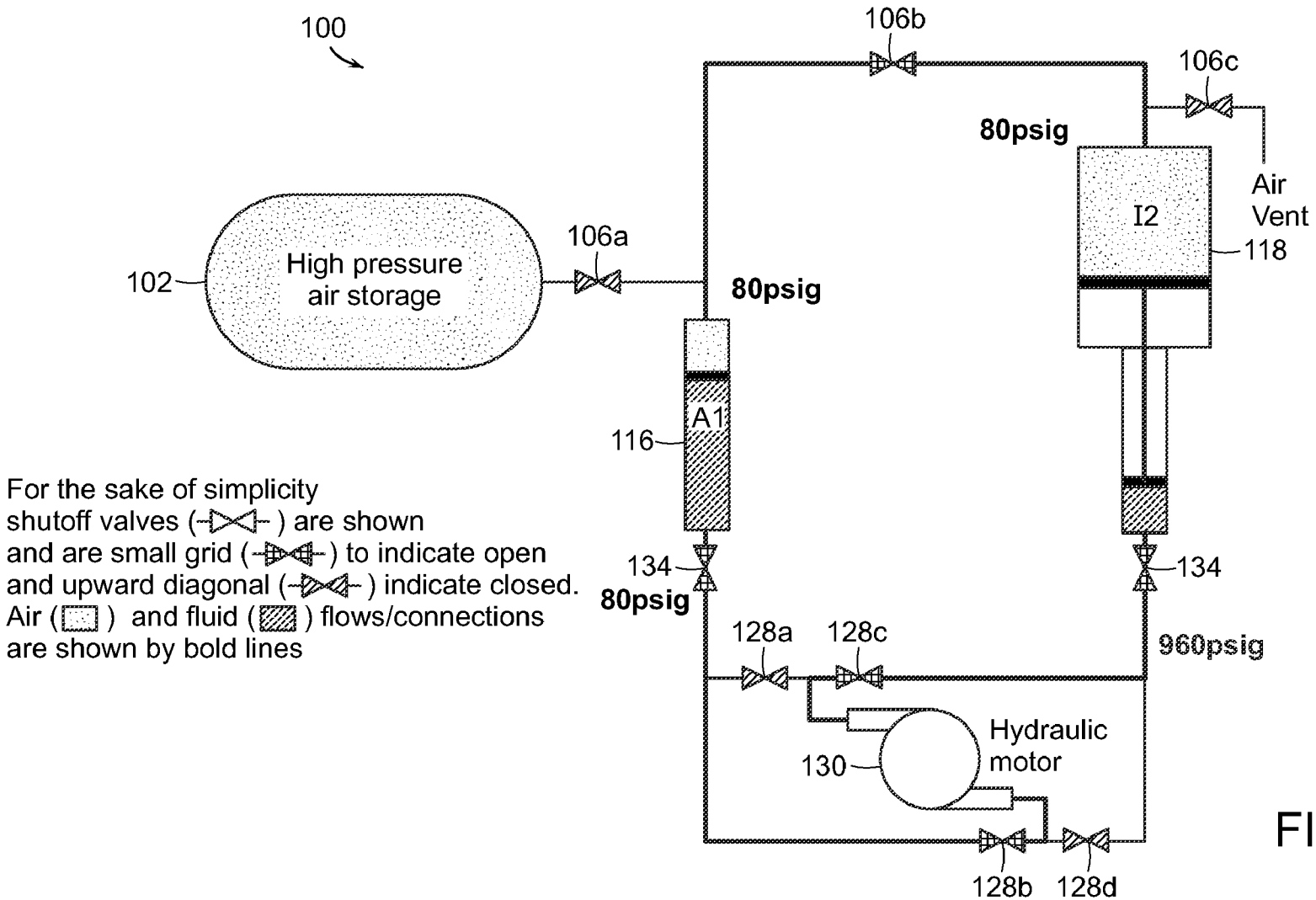
Figure 3K:
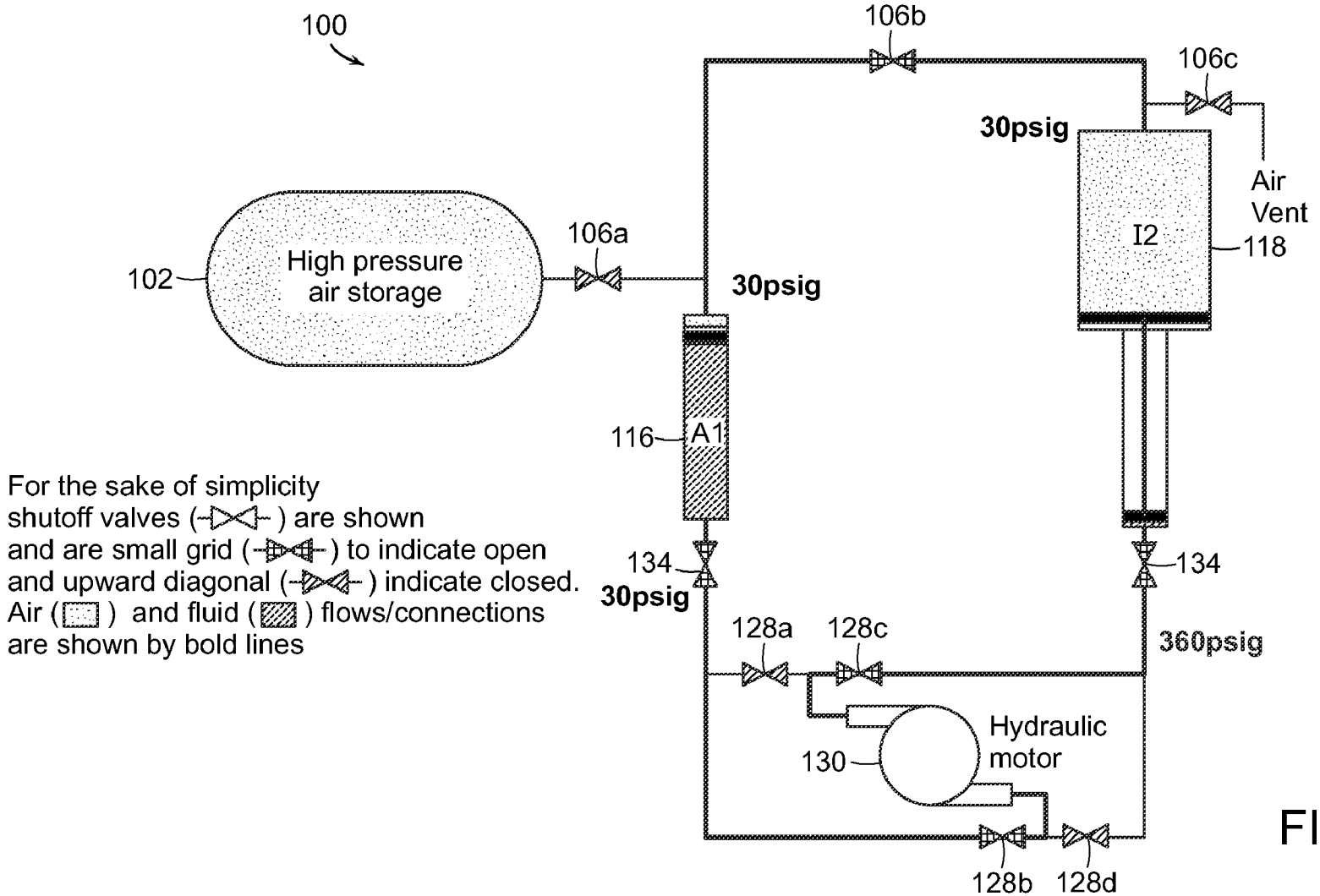

As shown in FIGS. 3I-3K, the pressure in the intensifier air chamber 144 continues to drive the hydraulic fluid from the intensifier fluid chamber 146 through the motor/pump 130 and to the accumulator fluid chamber 138, thereby continuing to drive the motor/generator 132 and generate electricity. As the hydraulic fluid is transferred from the intensifier 118 to the accumulator 116, the pressures in the intensifier air chamber 144, the intensifier fluid chamber 146, the accumulator air chamber 140, and the accumulator fluid chamber 138 decrease.

Figure 3L:
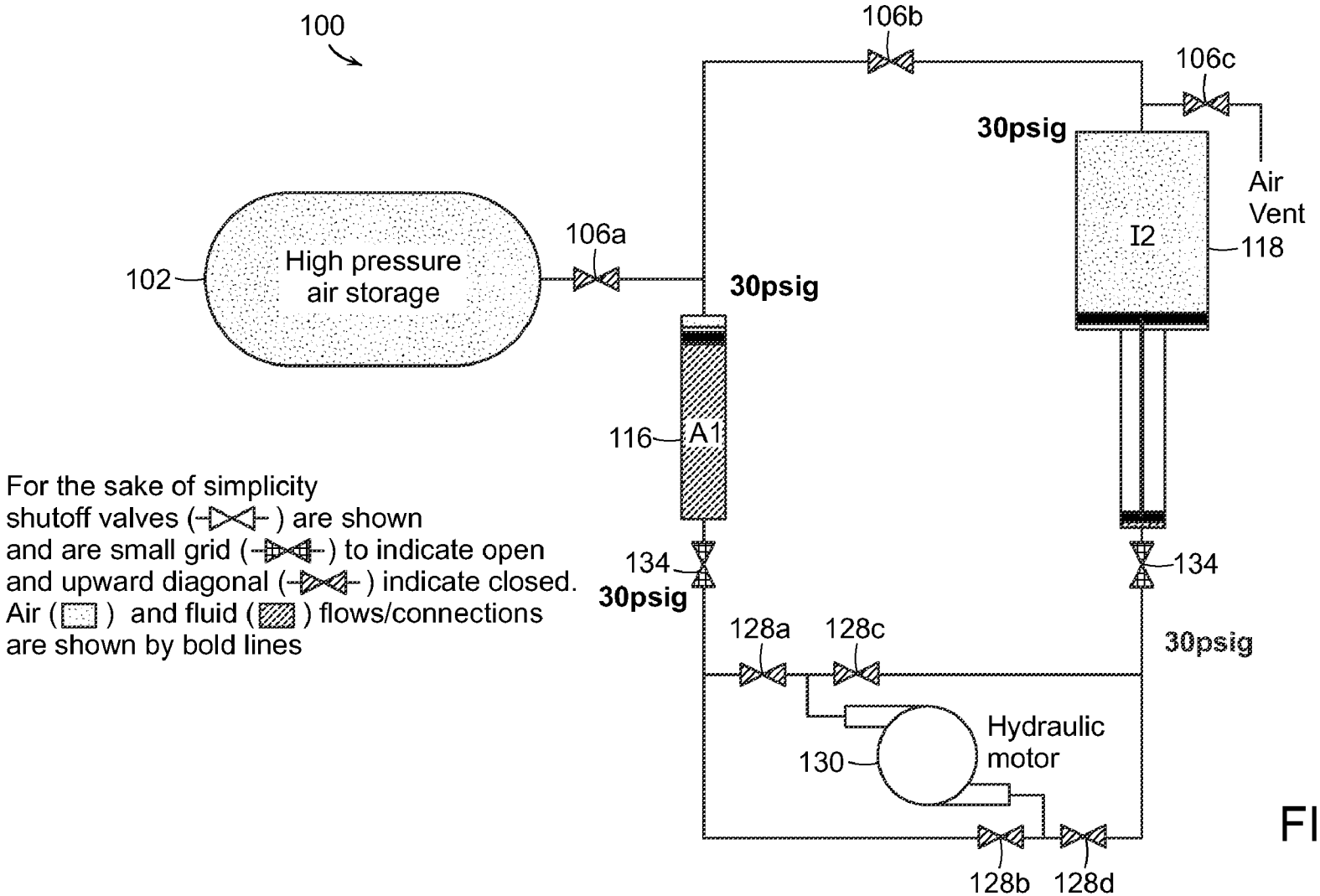

FIG. 3L depicts the end of the second stage of the expansion cycle, where substantially all of the hydraulic fluid has been transferred to the accumulator 116 and all of the valves 106, 128 are closed. In addition, the accumulator air chamber 140, the accumulator fluid chamber 138, the intensifier air chamber 144, and the intensifier fluid chamber 146 are all at low pressure. In an alternative embodiment, the hydraulic fluid can be shuffled back and forth between two intensifiers for compressing and expanding in the low pressure (for example, about 0-250 psig) range. Using a second intensifier and appropriate valving to utilize the energy stored at the lower pressures can produce additional electricity.

Figure 3M:
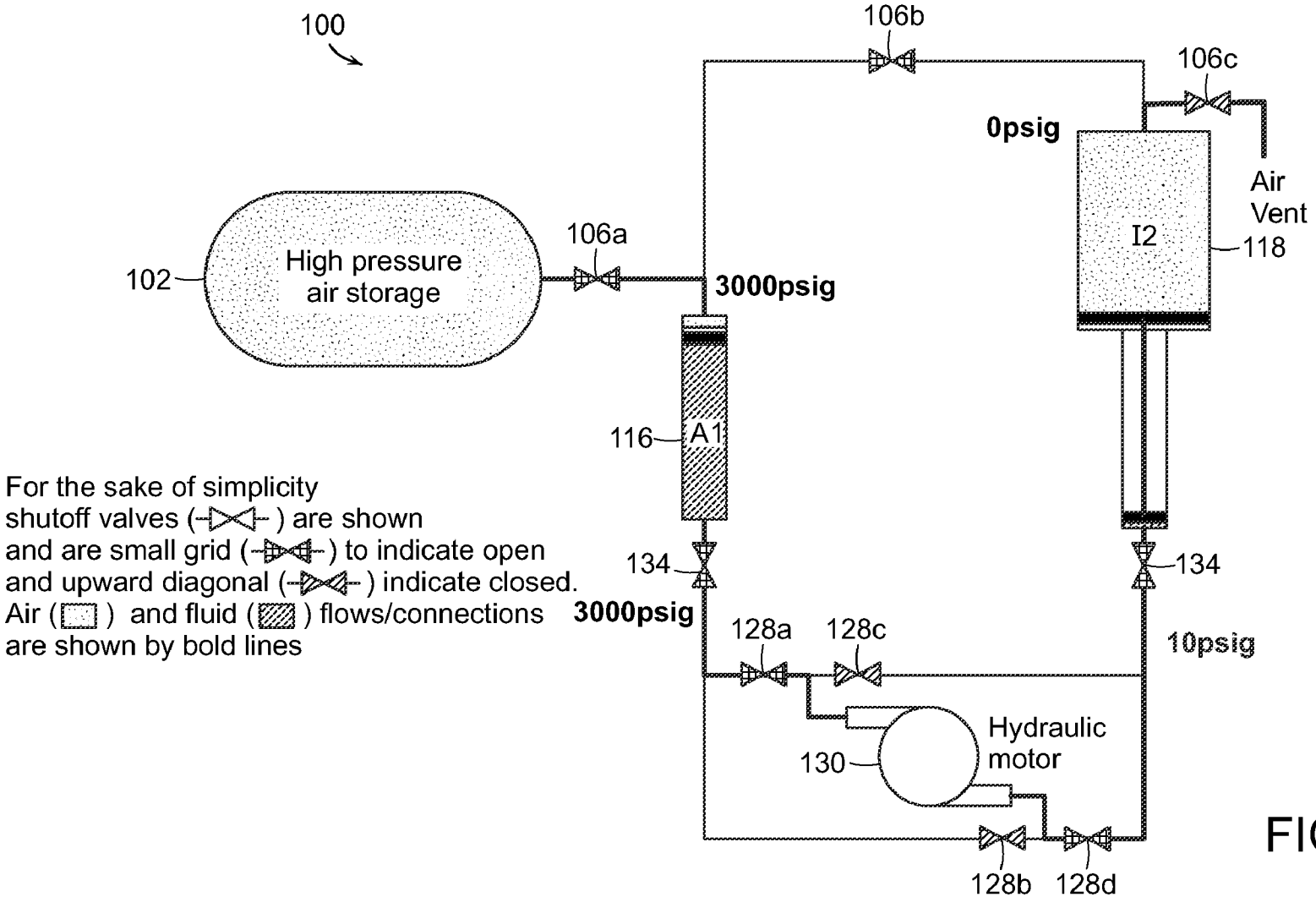

FIG. 3M depicts the start of another expansion phase, as described with respect to FIG. 3B. The system 100 can continue to cycle through expansion phases as necessary for the production of electricity, or until all of the compressed air in the storage tanks 102 has been exhausted.

Figure 4B:
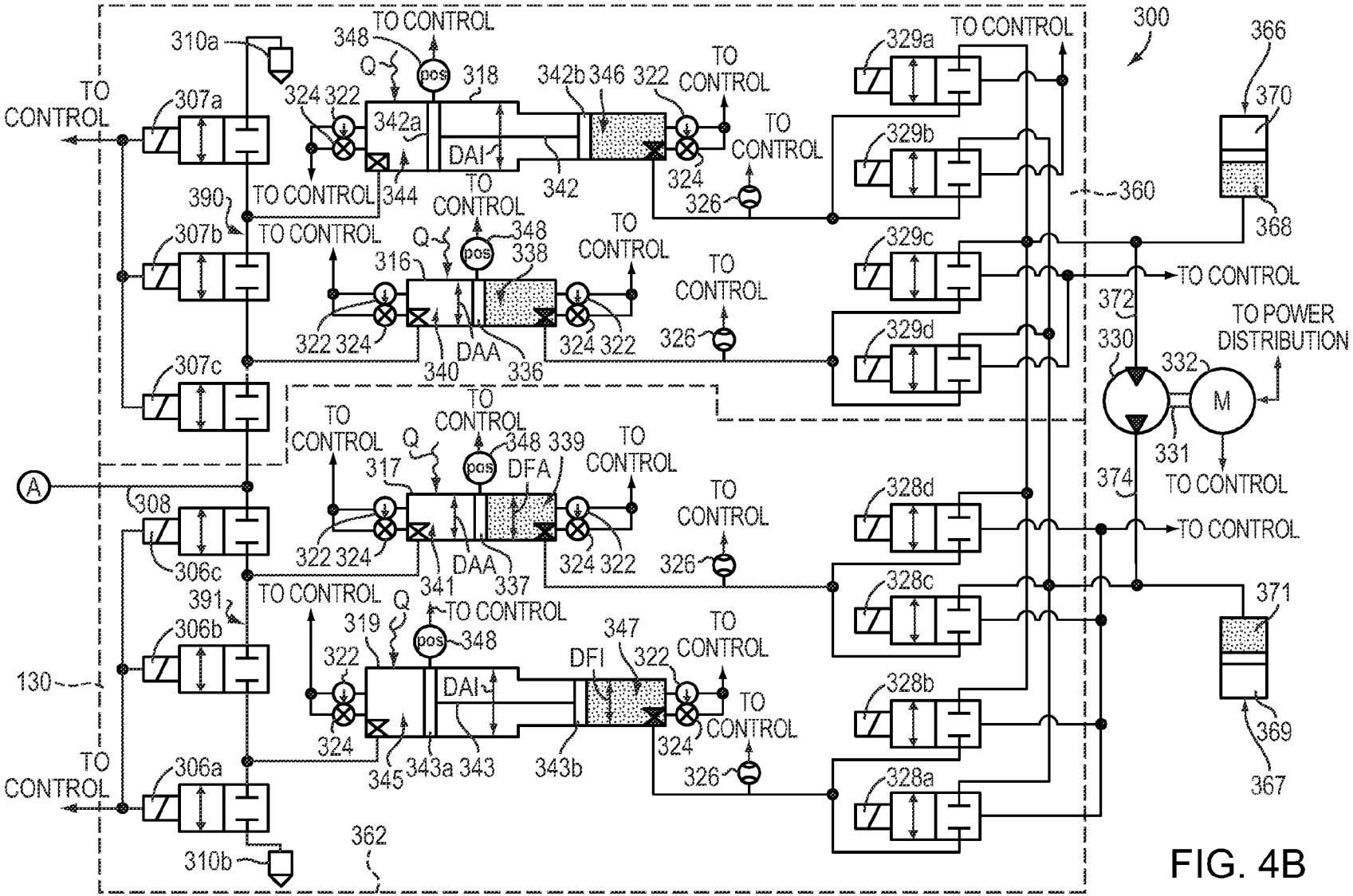

FIGS. 4-4B are is a schematic diagram of an energy storage system 300, employing open-air hydraulic-pneumatic principles according to one embodiment of this invention. The system 300 consists of one or more high-pressure gas/air storage tanks 302*a*, 302*b*, . . . 302*n* (the number being highly variable to suit a particular application). Each tank 302*a*, 302*b* is joined in parallel via a manual valve(s) 304*a*, 304*b*, . . . 304*n* respectively to a main air line 308. The tanks 302*a*, 302*b* are each provided with a pressure sensor 312*a*, 312*b* . . . 312*n* and a temperature sensor 314*a*, 314*b* . . . 314*n* that can be monitored by a system controller 350 via appropriate connections (shown generally herein as arrows indicating "TO CONTROL"). The controller 350, the operation of which is described in further detail below, can be any acceptable control device with a human-machine interface. In an one embodiment, the controller 350 includes a computer 351 (for example a PC-type) that executes a stored control application 353 in the form of a computer-readable software medium. The control application 353 receives telemetry from the various sensors and provides appropriate feedback to control valve actuators, motors, and other needed electromechanical/electronic devices. An appropriate interface can be used to convert data from sensors into a form readable by the computer controller 351 (such as RS-232 or network-based interconnects). Likewise, the interface converts the computer's control signals into a form usable by valves and other actuators to perform an operation. The provision of such interfaces should be clear to those of ordinary skill in the art.

The main air line 308 from the tanks 302*a*, 302*b* is coupled to a pair of multi-stage (two stages in this example) accumulator/intensifier circuits (or hydraulic-pneumatic cylinder circuits) (dashed boxes 360, 362) via automatically controlled (via controller 350), two-position valves 307*a*, 307*b*, 307*c* and 306*a*, 306*b* and 306*c*. These valves are coupled to respective accumulators 316 and 317 and intensifiers 318 and 319 according to one embodiment of the system. Pneumatic valves 306*a* and 307*a* are also coupled to a respective atmospheric air vent 310*b* and 310*a*. In particular, valves 306*c* and 307*c* connect along a common air line 390, 391 between the main air line 308 and the accumulators 316 and 317, respectively. Pneumatic valves 306*b* and 307*b* connect between the respective accumulators 316 and 317, and intensifiers 318 and 319. Pneumatic valves 306*a*, 307*a* connect along the common lines 390, 391 between the intensifiers 318 and 319, and the atmospheric vents 310*b* and 310*a*.

The air from the tanks 302, thus, selectively communicates with the air chamber side of each accumulator and intensifier (referenced in the drawings as air chamber 340 for accumulator 316, air chamber 341 for accumulator 317, air chamber 344 for intensifier 318, and air chamber 345 for intensifier 319). An air temperature sensor 322 and a pressure sensor 324 communicate with each air chamber 341, 344, 345, 322, and deliver sensor telemetry to the controller 350.

The air chamber 340, 341 of each accumulator 316, 317 is enclosed by a movable piston 336, 337 having an appropriate sealing system using sealing rings and other components that are known to those of ordinary skill in the art. The piston 336, 337 moves along the accumulator housing in response to pressure differentials between the air chamber 340, 341 and an opposing fluid chamber 338, 339, respectively, on the opposite side of the accumulator housing. In this example, hydraulic fluid (or another liquid, such as water) is indicated by a shaded volume in the fluid chamber. Likewise, the air chambers 344, 345 of the respective intensifiers 318, 319 are enclosed by a moving piston assembly 342, 343. However, the intensifier air piston 342*a*, 343*a* is connected by a shaft, rod, or other coupling to a respective fluid piston, 342*b*, 343*b*. This fluid piston 342*b*, 343*b* moves in conjunction with the air piston 342*a*, 343*a*, but acts directly upon the associated intensifier fluid chamber 346, 347. Notably, the internal diameter (and/or volume) of the air chamber (DAI) for the intensifier 318, 319 is greater than the diameter of the air chamber (DAA) for the accumulator 316, 317 in the same circuit 360, 362. In particular, the surface area of the intensifier pistons 342*a*, 343*a* is greater than the surface area of the accumulator pistons 336, 337. The diameter of each intensifier fluid piston (DFI) is approximately the same as the diameter of each accumulator (DFA). Thus in this manner, a lower air pressure acting upon the intensifier piston generates a similar pressure on the associated fluid chamber as a higher air pressure acting on the accumulator piston. In this manner, and as described further below, the system allows for at least two stages of pressure to be employed to generate similar levels of fluid pressure.

In one example, assuming that the initial gas pressure in the accumulator is at 200 atmospheres (ATM) (high-pressure), with a final mid-pressure of 20 ATM upon full expansion, and that the initial gas pressure in the intensifier is then 20 ATM (with a final pressure of 1.5-2 ATM), then the area of the gas piston in the intensifier would be approximately 10 times the area of the piston in the accumulator (or 3.16 times the radius). However, the precise values for initial high-pressure, mid-pressure and final low-pressure are highly variable, depending in part upon the operating specifications of the system components, scale of the system and output requirements. Thus, the relative sizing of the accumulators and the intensifiers is variable to suit a particular application.

Each fluid chamber 338, 339, 346, 347 is interconnected with an appropriate temperature sensor 322 and pressure sensor 324, each delivering telemetry to the controller 350. In addition, each fluid line interconnecting the fluid chambers can be fitted with a flow sensor 326, which directs data to the controller 350. The pistons 336, 337, 342 and 343 can include position sensors 348 that report their present position to the controller 350. The position of the piston can be used to determine relative pressure and flow of both gas and fluid. Each fluid connection from a fluid chamber 338, 339, 346, 347 is connected to a pair of parallel, automatically controlled valves. As shown, fluid chamber 338 (accumulator 316) is connected to valve pair 328*c* and 328*d*; fluid chamber 339 (accumulator 317) is connected to valve pair 329*a* and 329*b*; fluid chamber 346 (intensifier 318) is connected to valve pair 328*a* and 328*b*; and fluid chamber 347 (intensifier 319) is connected to valve pair 329*c* and 329*d*. One valve from each chamber 328*b*, 328*d*, 329*a* and 329*c* is connected to one connection side 372 of a hydraulic motor/pump 330. This motor/pump 330 can be piston-type (or other suitable type, including vane, impeller, and gear) assembly having a shaft 331 (or other mechanical coupling) that drives, and is driven by, a combination electrical motor/generator assembly 332. The motor/generator assembly 332 is interconnected with a power distribution system and can be monitored for status and output/input level by the controller 350. The other connection side 374 of the hydraulic motor/pump 330 is connected to the second valve in each valve pair 328*a*, 328*c*, 329*b* and 329*d*. By selectively toggling the valves in each pair, fluid is connected between either side 372, 374 of the hydraulic motor/pump 330. Alternatively, some or all of the valve pairs can be replaced with one or more three position, four way valves or other combinations of valves to suit a particular application.

The number of circuits 360, 362 can be increased as necessary. Additional circuits can be interconnected to the tanks 302 and each side 372, 374 of the hydraulic motor/pump 330 in the same manner as the components of the circuits 360, 362. Generally, the number of circuits should be even so that one circuit acts as a fluid driver while the other circuit acts as a reservoir for receiving the fluid from the driving circuit.

An optional accumulator 366 is connected to at least one side (e.g., inlet side 372) of the hydraulic motor/pump 330. The optional accumulator 366 can be, for example, a closed-air-type accumulator with a separate fluid side 368 and precharged air side 370. As will be described below, the accumulator 366 acts as a fluid capacitor to deal with transients in fluid flow through the motor/pump 330. In another embodiment, a second optional accumulator or other low-pressure reservoir 371 is placed in fluid communication with the outlet side 374 of the motor/pump 330 and can also include a fluid side 371 and a precharged air side 369. The foregoing optional accumulators can be used with any of the systems described herein.

Having described the general arrangement of one embodiment of an open-air hydraulic-pneumatic energy storage system 300 in FIGS. 4-4B, the exemplary functions of the system 300 during an energy recovery phase will now be described with reference to FIGS. 5A-5N. For the purposes of this operational description, the illustrations of the system 300 in FIGS. 5A-5N have been simplified, omitting the controller 350 and interconnections with valves, sensors, etc. It should be understood, that the steps described are under the control and monitoring of the controller 350 based upon the rules established by the application 353.

Figure 5A:
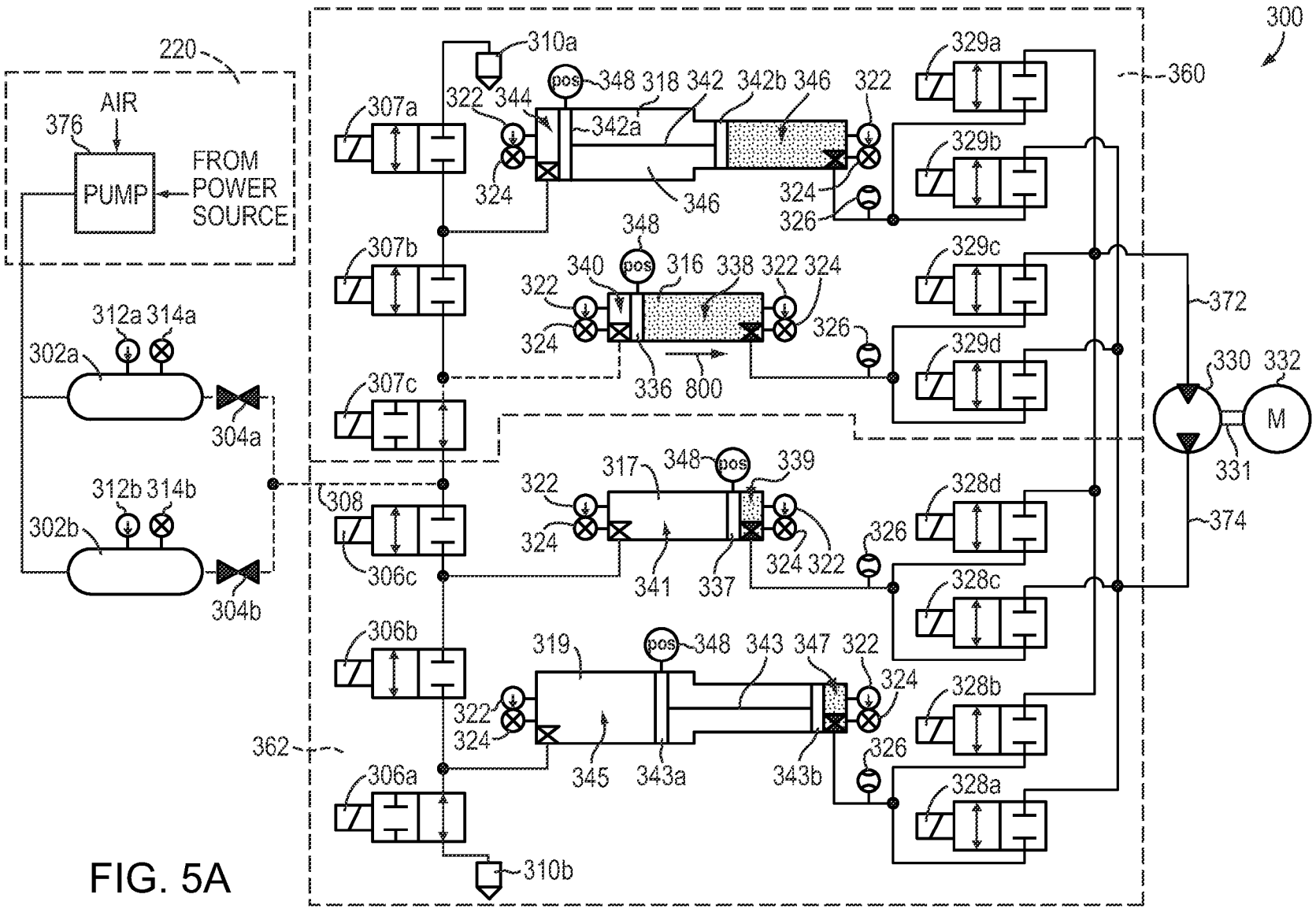
FIGS. 5A-5N are schematic diagrams of the system of FIG. 5 illustrating the cycling of the various components during an expansion phase of the system.

FIG. 5A is a schematic diagram of the energy storage and recovery system of FIGS. 4-4B showing an initial physical state of the system 300 in which an accumulator 316 of a first circuit is filled with high-pressure gas from the high-pressure gas storage tanks 302. The tanks 302 have been filled to full pressure, either by the cycle of the system 300 under power input to the hydraulic motor/pump 330, or by a separate high-pressure air pump 376. This air pump 376 is optional, as the air tanks 302 can be filled by running the recovery cycle in reverse. The tanks 302 in this embodiment can be filled to a pressure of 200 ATM (3000 psi) or more. The overall, collective volume of the tanks 302 is highly variable and depends in part upon the amount of energy to be stored.

In FIG. 5A, the recovery of stored energy is initiated by the controller 350. To this end, pneumatic valve 307*c* is opened allowing a flow of high-pressure air- to pass into the air chamber 340 of the accumulator 316. Note that where a flow of compressed gas or fluid is depicted, the connection is indicated as a dashed line. The level of pressure is reported by the sensor 324 in communication with the chamber 340. The pressure is maintained at the desired level by valve 307*c*. This pressure causes the piston 336 to bias (arrow 800) toward the fluid chamber 338, thereby generating a comparable pressure in the incompressible fluid. The fluid is prevented from moving out of the fluid chamber 338 at this time by valves 329*c* and 329*d*).

Figure 5B:
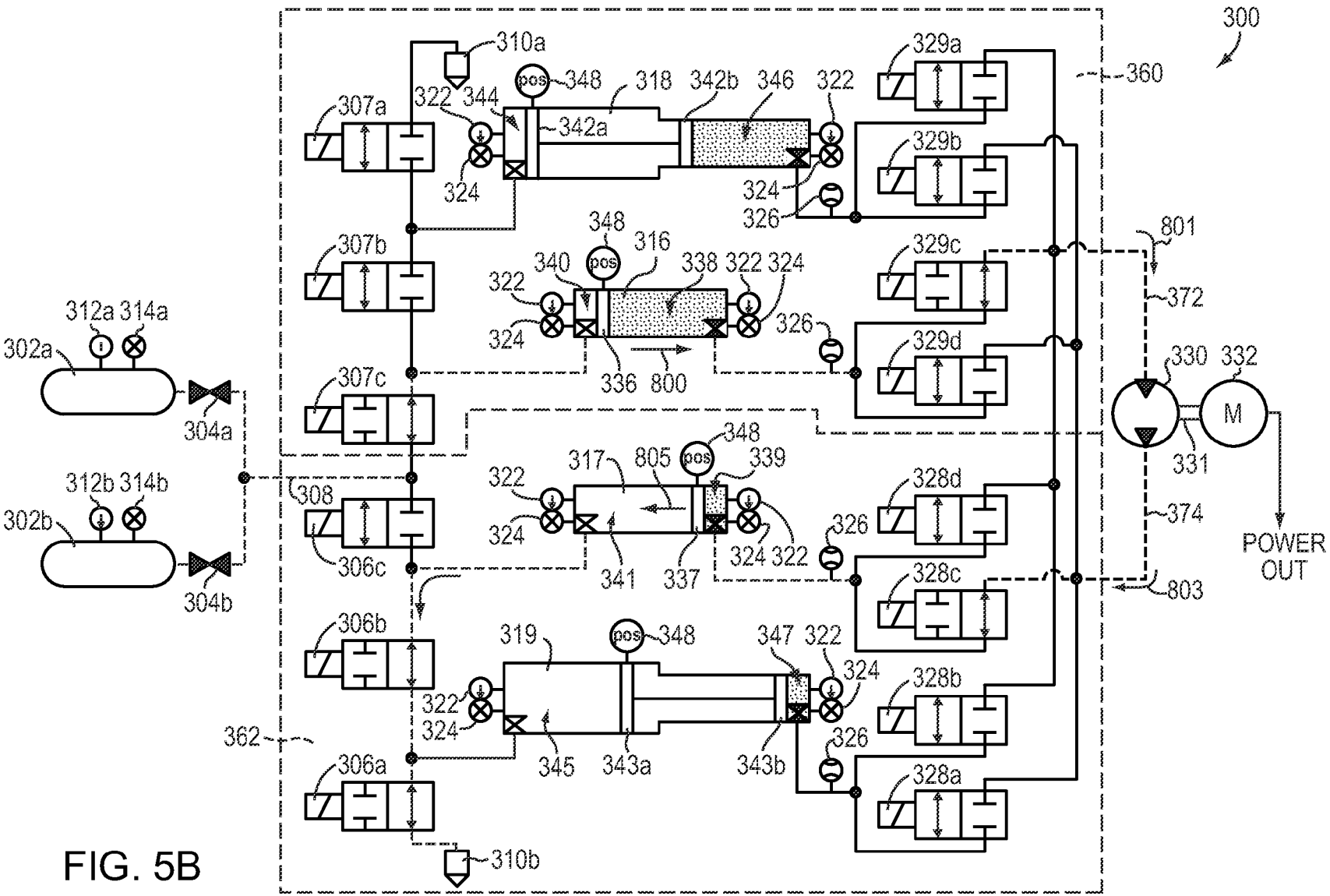

FIG. 5B is a schematic diagram of the energy storage and recovery system of FIGS. 4-4B showing a physical state of the system 300 following the state of FIG. 5A, in which valves are opened to allow fluid to flow from the accumulator 316 of the first circuit to the fluid motor/pump 330 to generate electricity therefrom. As shown in FIG. 5B, pneumatic valve 307*c* remains open. When a predetermined pressure is obtained in the air chamber 340, the fluid valve 329*c* is opened by the controller, causing a flow of fluid (arrow 801) to the inlet side 372 of the hydraulic motor/pump 330 (which operates in motor mode during the recovery phase). The motion of the motor 330 drives the electric motor/generator 332 in a generation mode, providing power to the facility or grid as shown by the term "POWER OUT." To absorb the fluid flow (arrow 803) from the outlet side 374 of the hydraulic motor/pump 330, fluid valve 328*c* is opened to the fluid chamber 339 by the controller 350 to route fluid to the opposing accumulator 317. To allow the fluid to fill accumulator 317 after its energy has been transferred to the motor/pump 330, the air chamber 341 is vented by opening pneumatic vent valves 306*a*, 306*b*. This allows any air in the chamber 341, to escape to the atmosphere via the vent 310*b* as the piston 337 moves (arrow 805) in response to the entry of fluid.

Figure 5C:
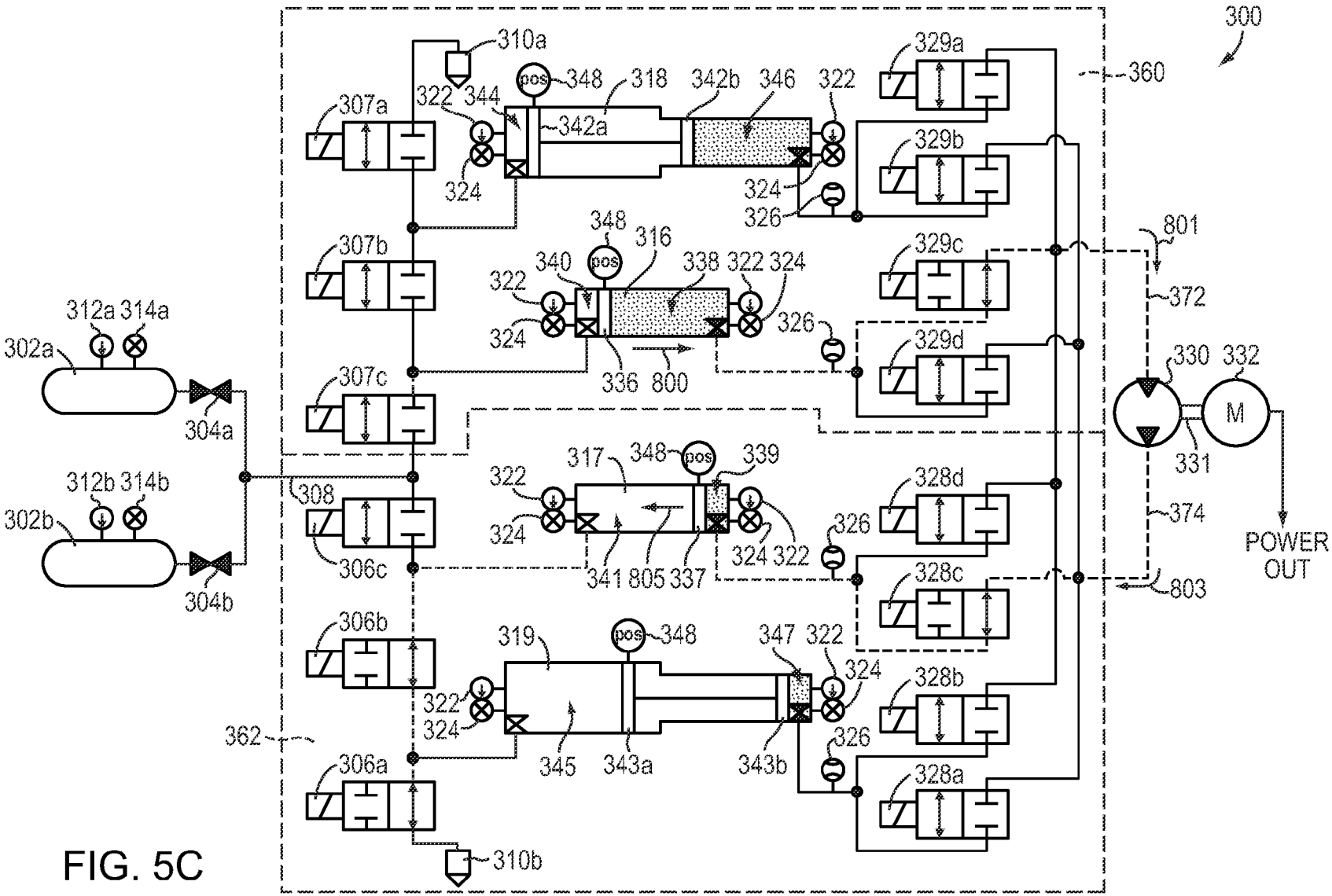

FIG. 5C is a schematic diagram of the energy storage and recovery system of FIGS. 4-4B showing a physical state of the system 300 following the state of FIG. 5B, in which the accumulator 316 of the first circuit directs fluid to the fluid motor/pump 330 while the accumulator 317 of the second circuit receives exhausted fluid from the motor/pump 330, as gas in its air chamber 341 is vented to atmosphere. As shown in FIG. 5C, a predetermined amount of gas has been allowed to flow from the high-pressure tanks 302 to the accumulator 316 and the controller 350 now closes pneumatic valve 307*c*. Other valves remain open so that fluid can continue to be driven by the accumulator 316 through the motor/pump 330.

Figure 5D:
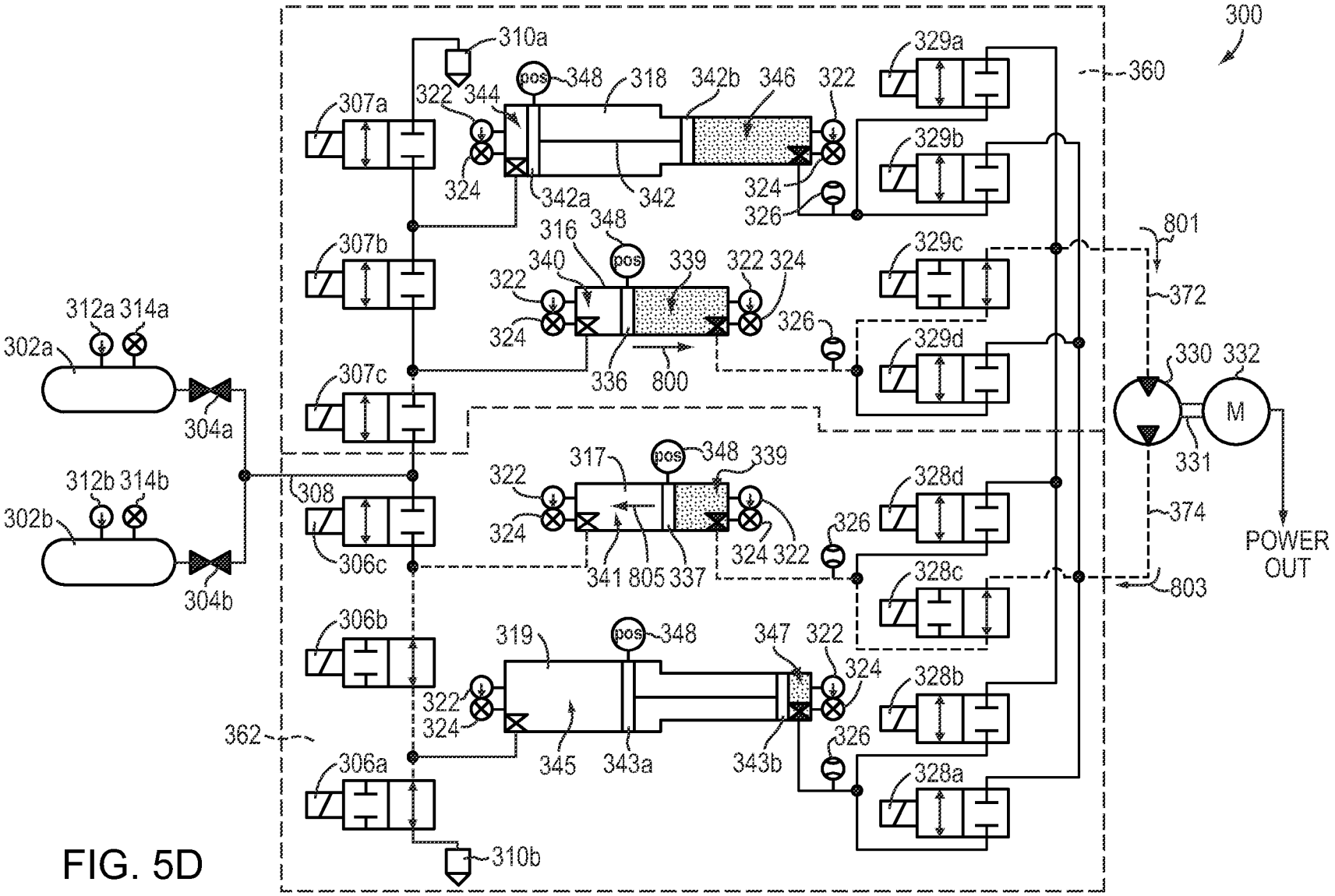

FIG. 5D is a schematic diagram of the energy storage and recovery system of FIGS. 4-4B showing a physical state of the system 300 following the state of FIG. 5C, in which the accumulator 316 of the first circuit continues to direct fluid to the fluid motor/pump 330 while the accumulator 317 of the second circuit continues to receive exhausted fluid from the motor/pump 330, as gas in its air chamber 341 is vented to atmosphere. As shown in FIG. 5D, the operation continues, where the accumulator piston 136 drives additional fluid (arrow 800) through the motor/pump 330 based upon the charge of gas pressure placed in the accumulator air chamber 340 by the tanks 302. The fluid causes the opposing accumulator's piston 337 to move (arrow 805), displacing air through the vent 310*b*.

Figure 5E:
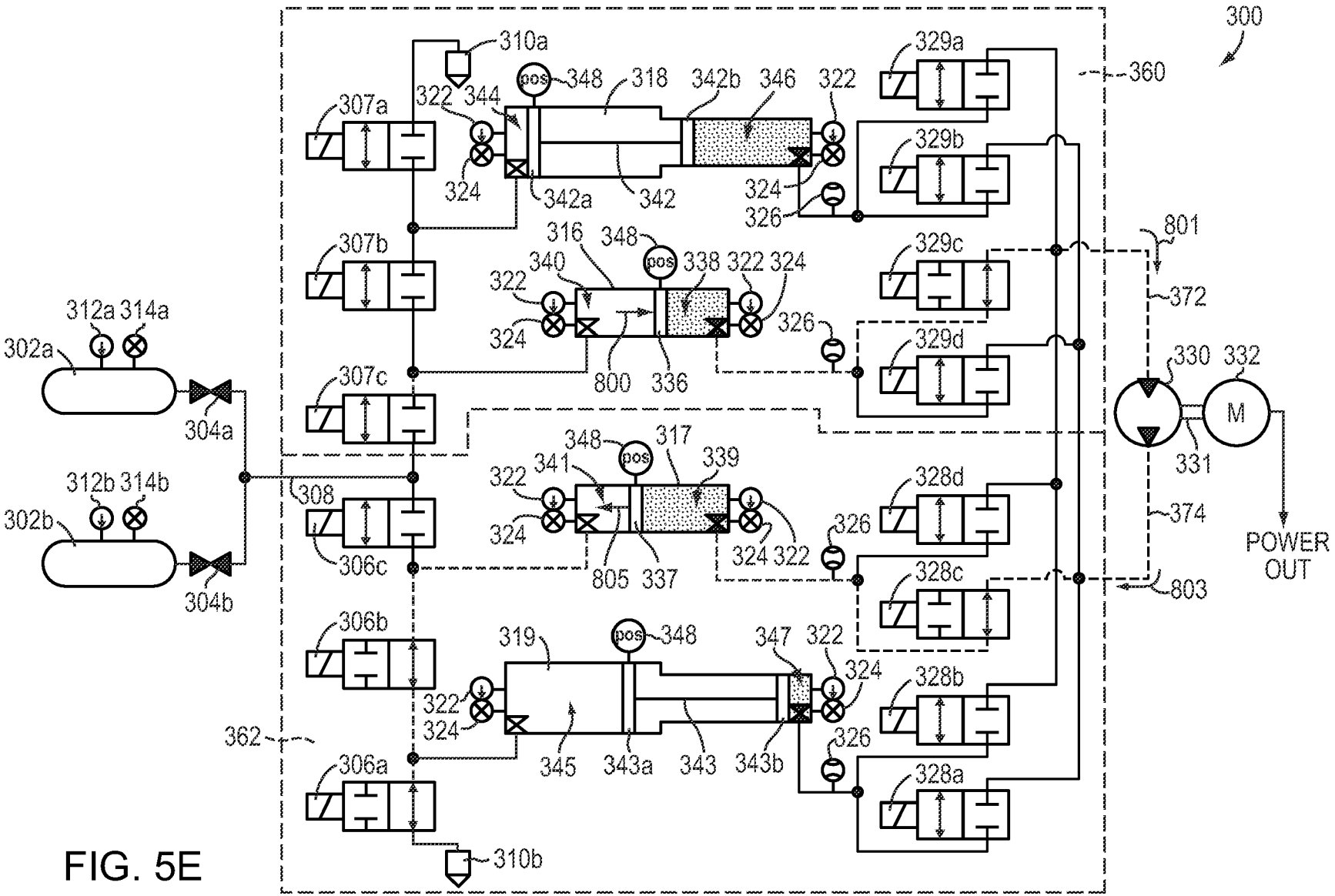

FIG. 5E is a schematic diagram of the energy storage and recovery system of FIGS. 4-4B showing a physical state of the system 300 following the state of FIG. 5D, in which the accumulator 316 of the first circuit has nearly exhausted the fluid in its fluid chamber 338 and the gas in its air chamber 340 has expanded to nearly mid-pressure from high-pressure. As shown in FIG. 5E, the charge of gas in the air chamber 340 of the accumulator 316 has continued to drive fluid (arrows 800, 801) through the motor/pump 330 while displacing air via the air vent 310*b*. The gas has expanded from high-pressure to mid-pressure during this portion of the energy recovery cycle. Consequently, the fluid has ranged from high to mid-pressure. By sizing the accumulators appropriately, the rate of expansion can be controlled.

Figure 15A:
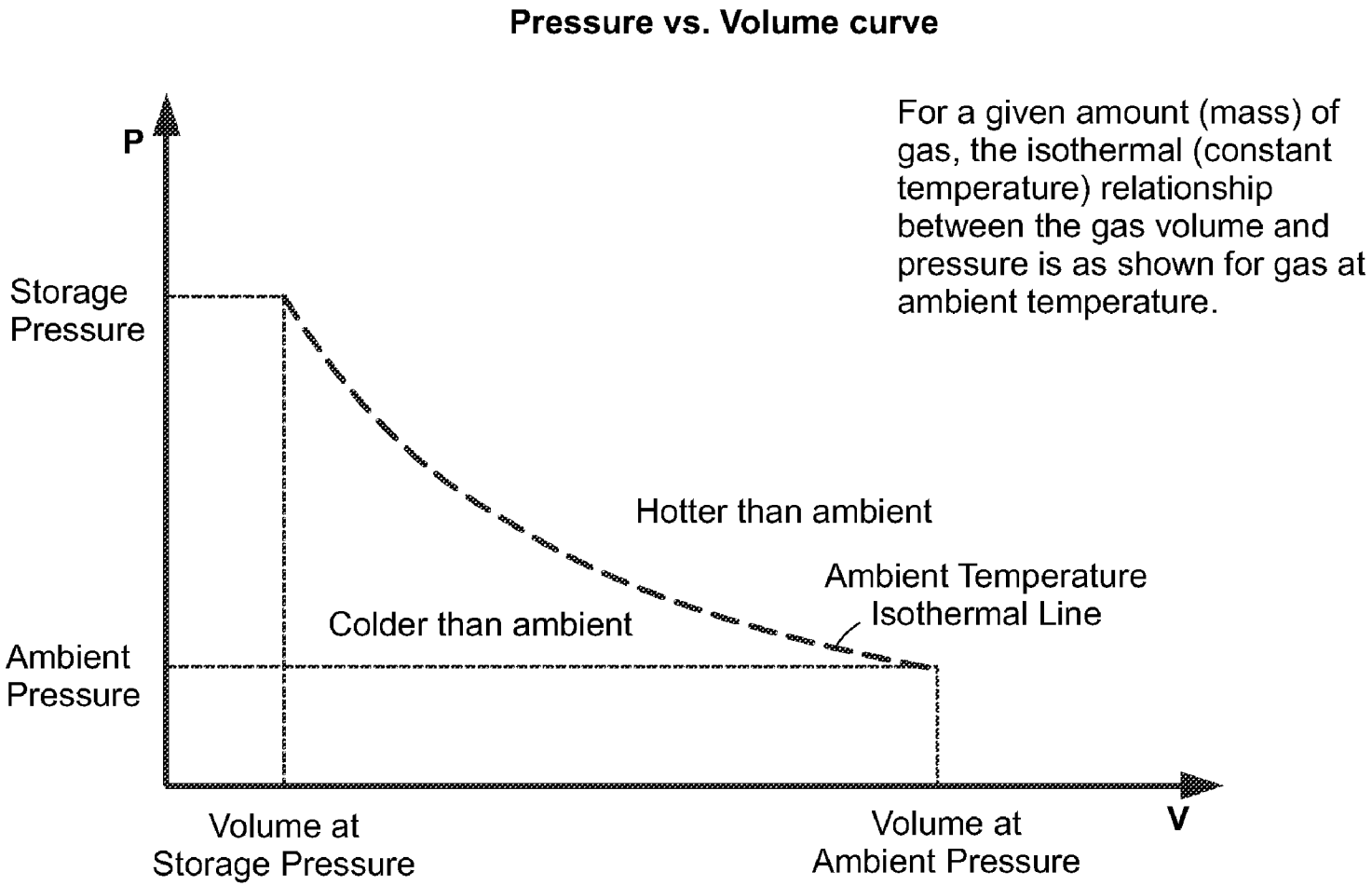
FIGS. 15A-15W are graphical representations of the effects of isothermal versus adiabatic compression and expansion and the advantages of the inventive concepts described in the present application.
Figure 15B:
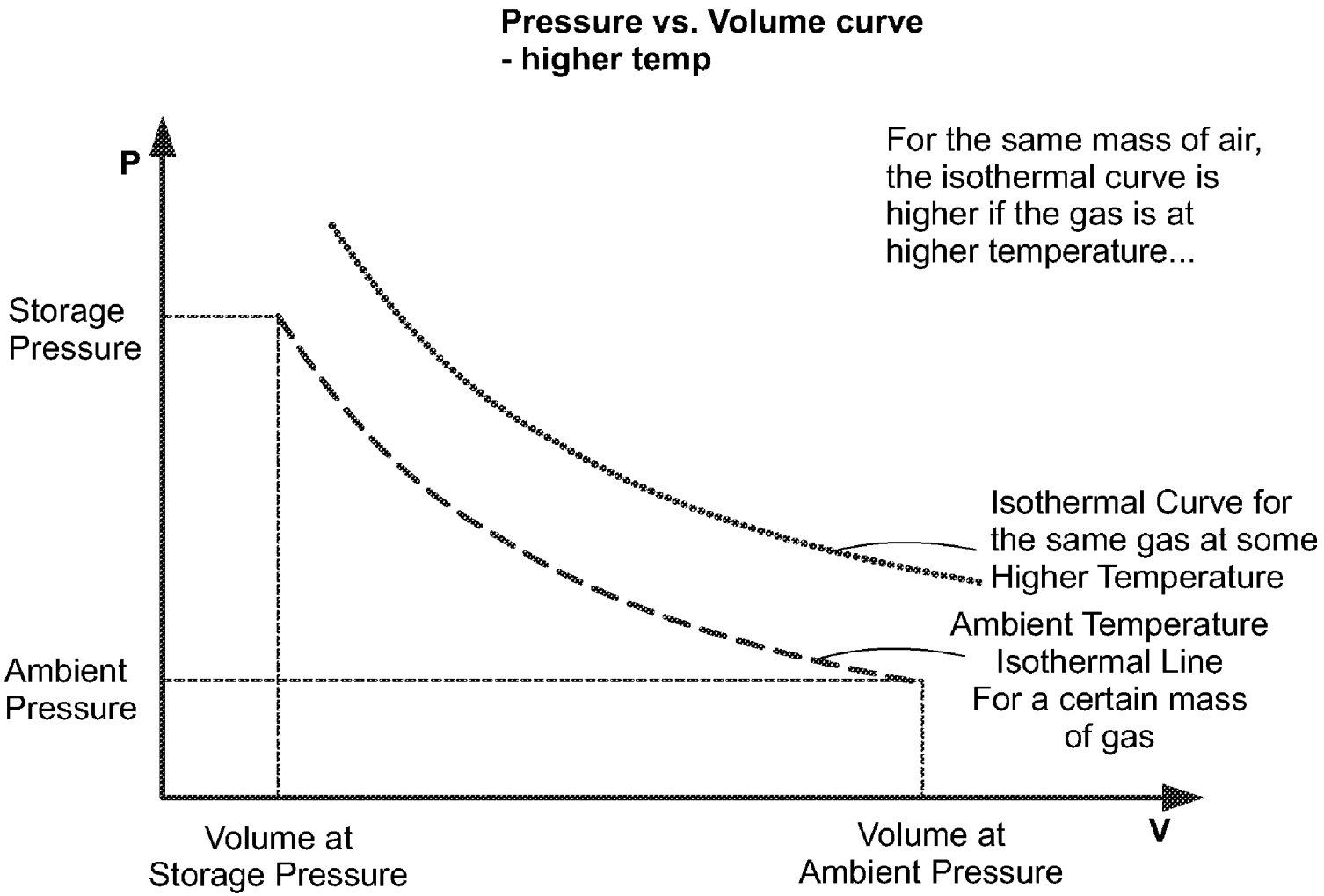
Figure 15C:
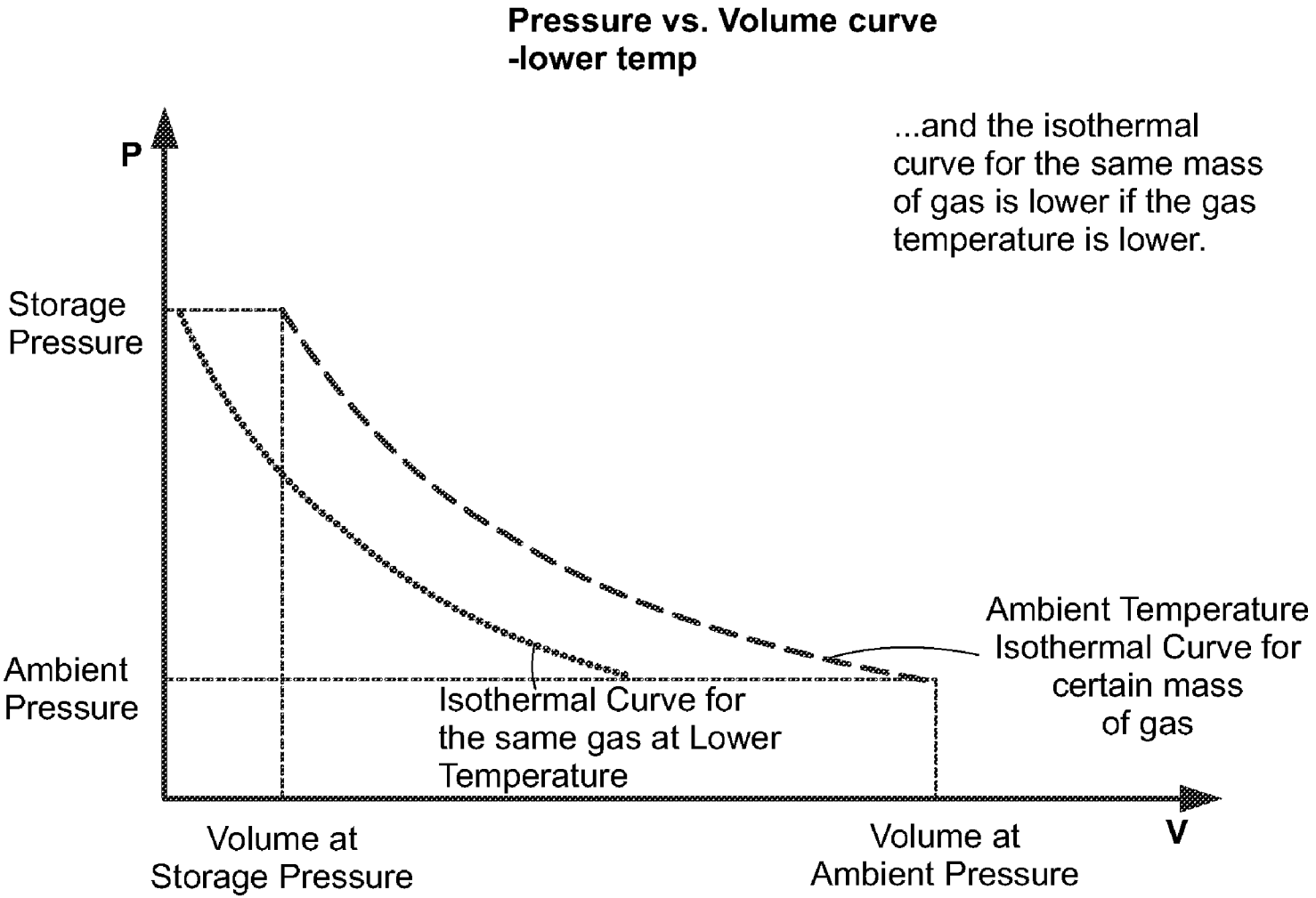
Figure 15D:
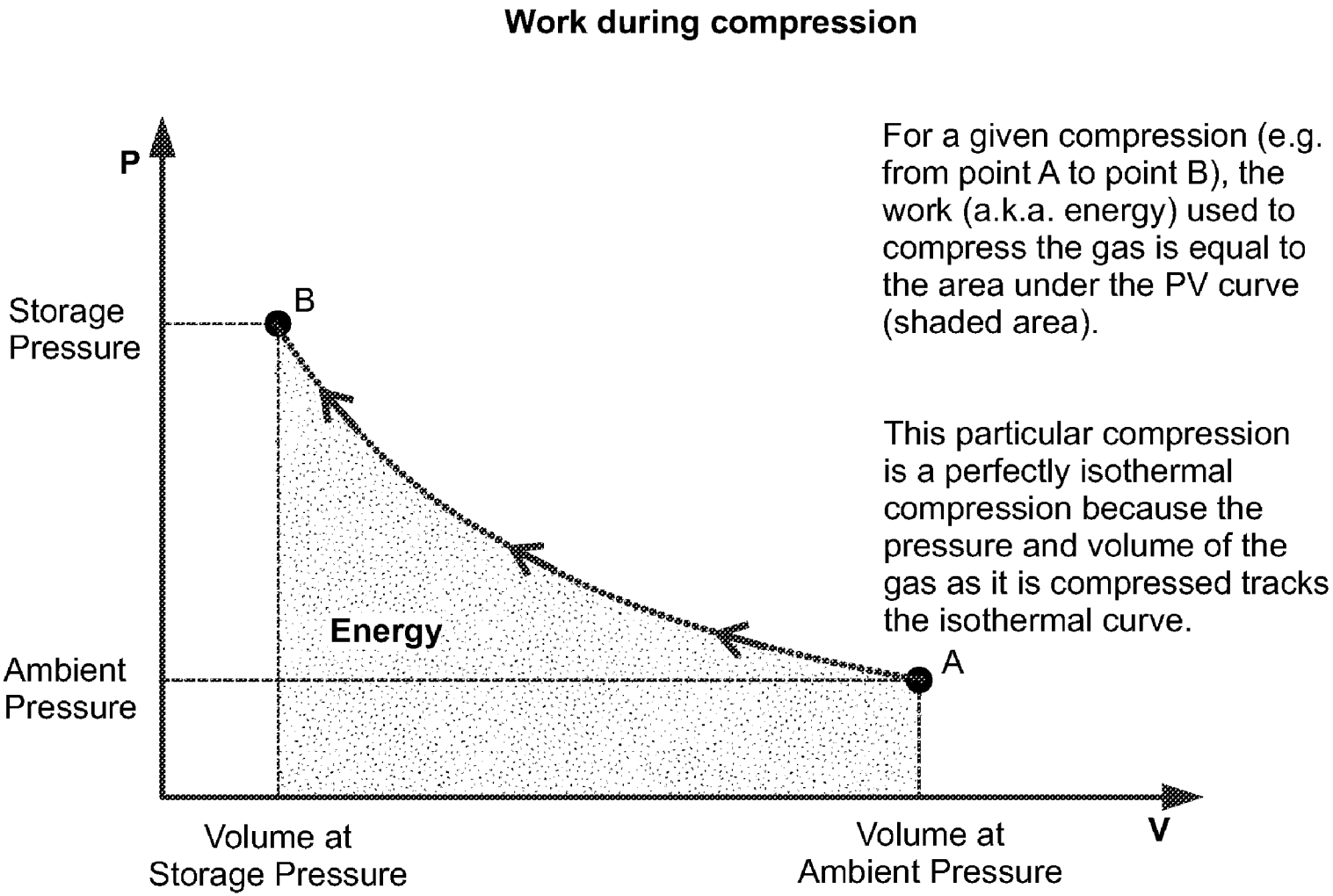
Figure 15E:
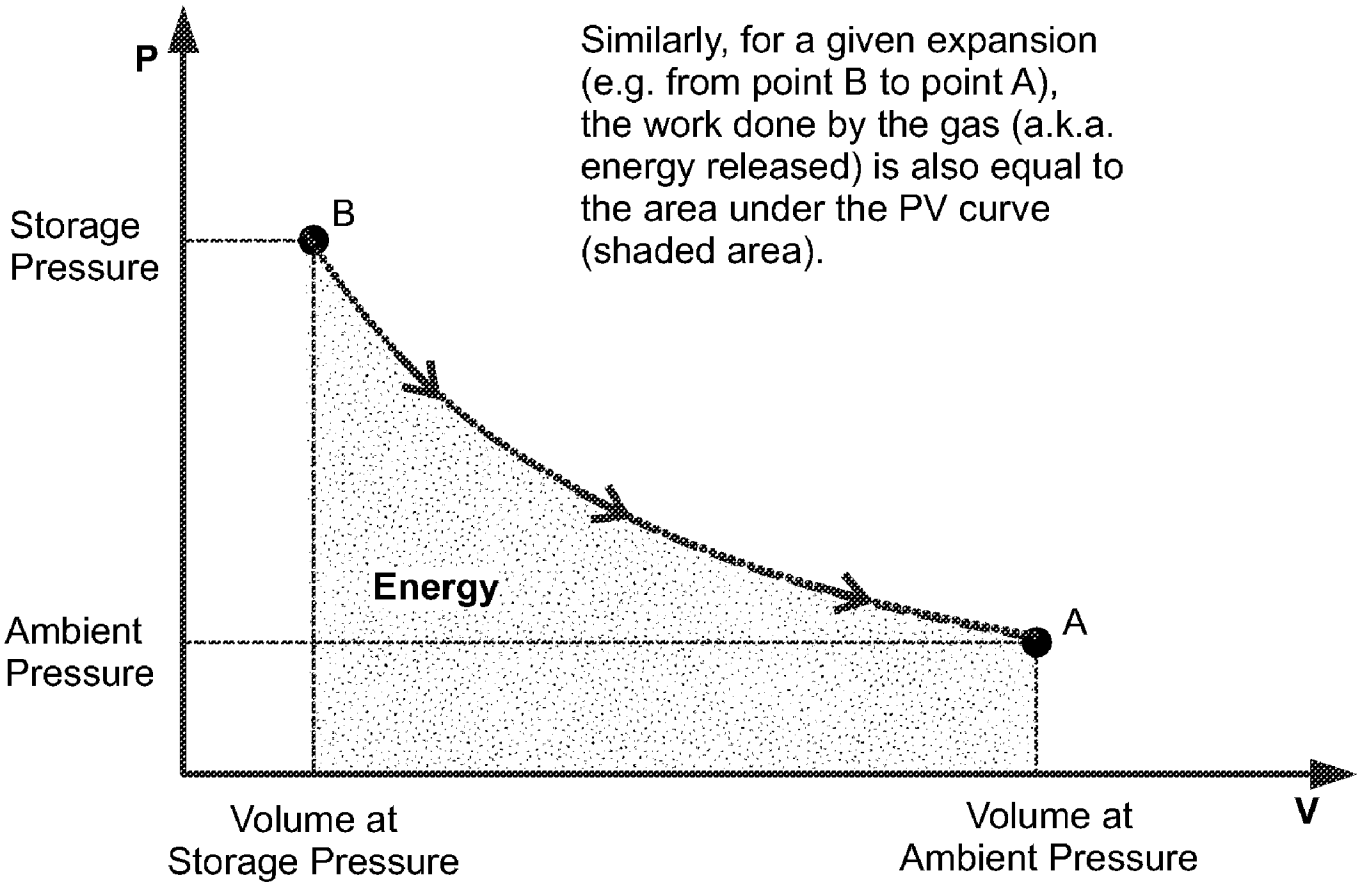
Figure 15F:
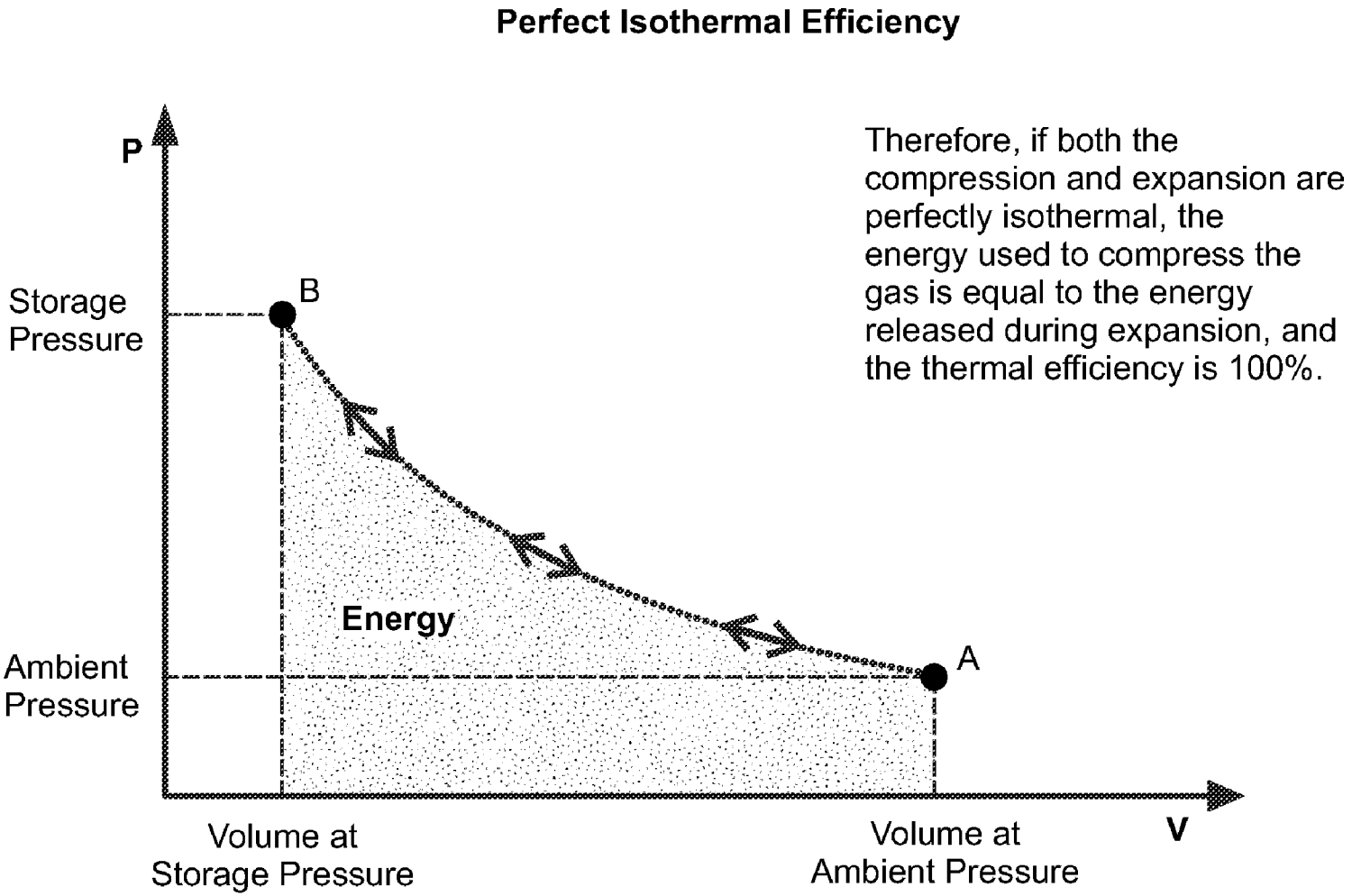
Figure 15G:
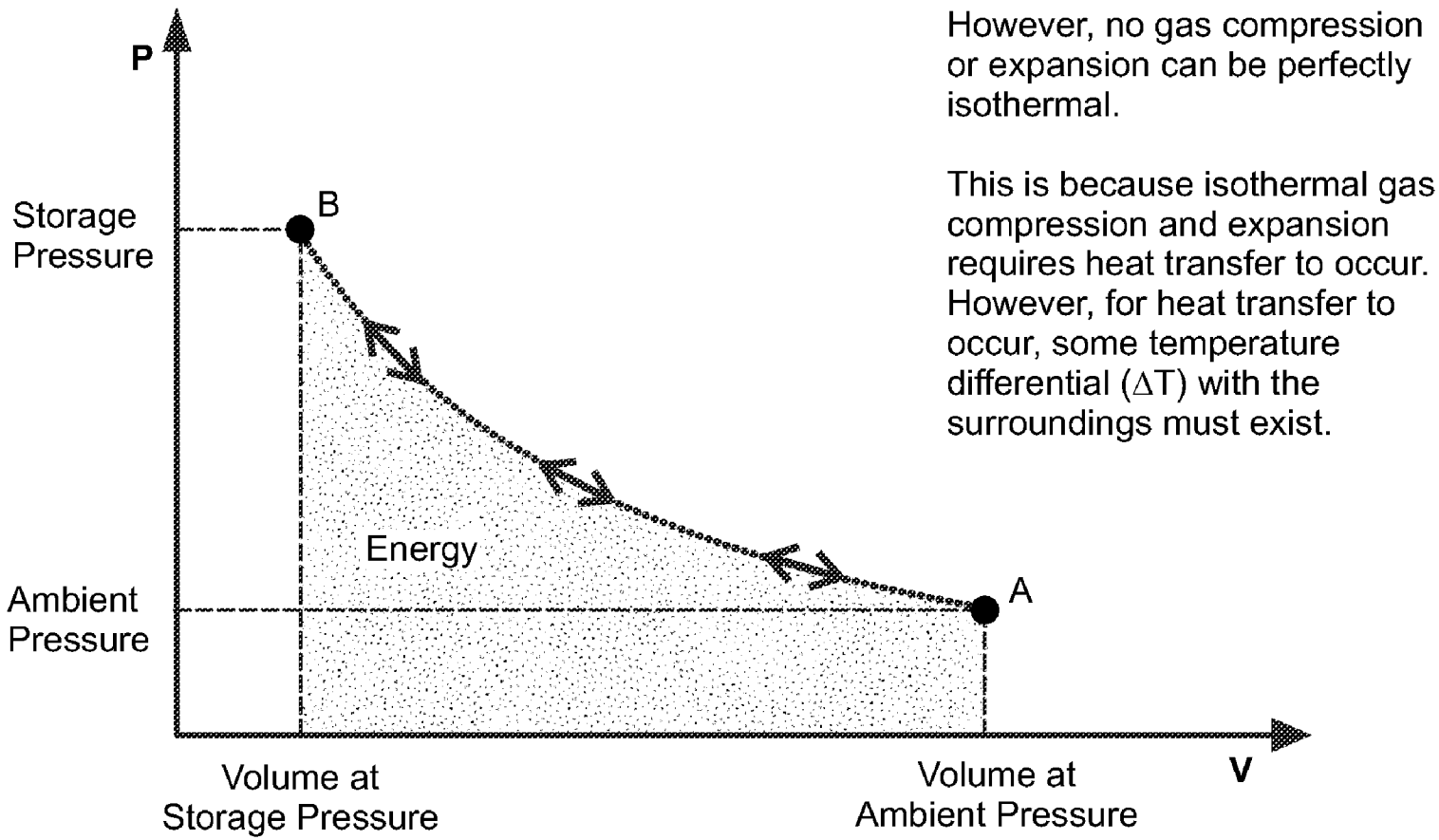
Figure 15H:
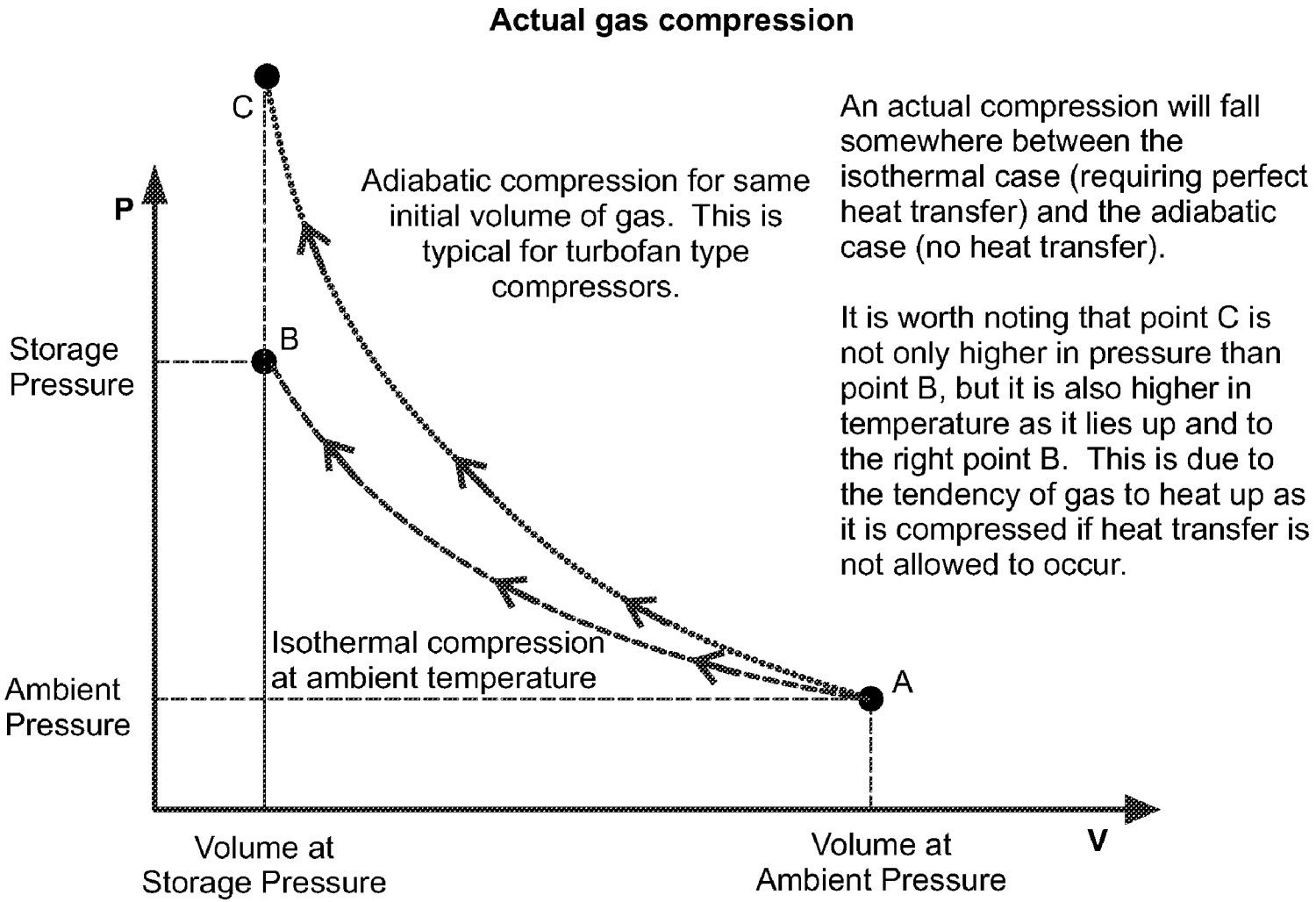
Figure 15I:
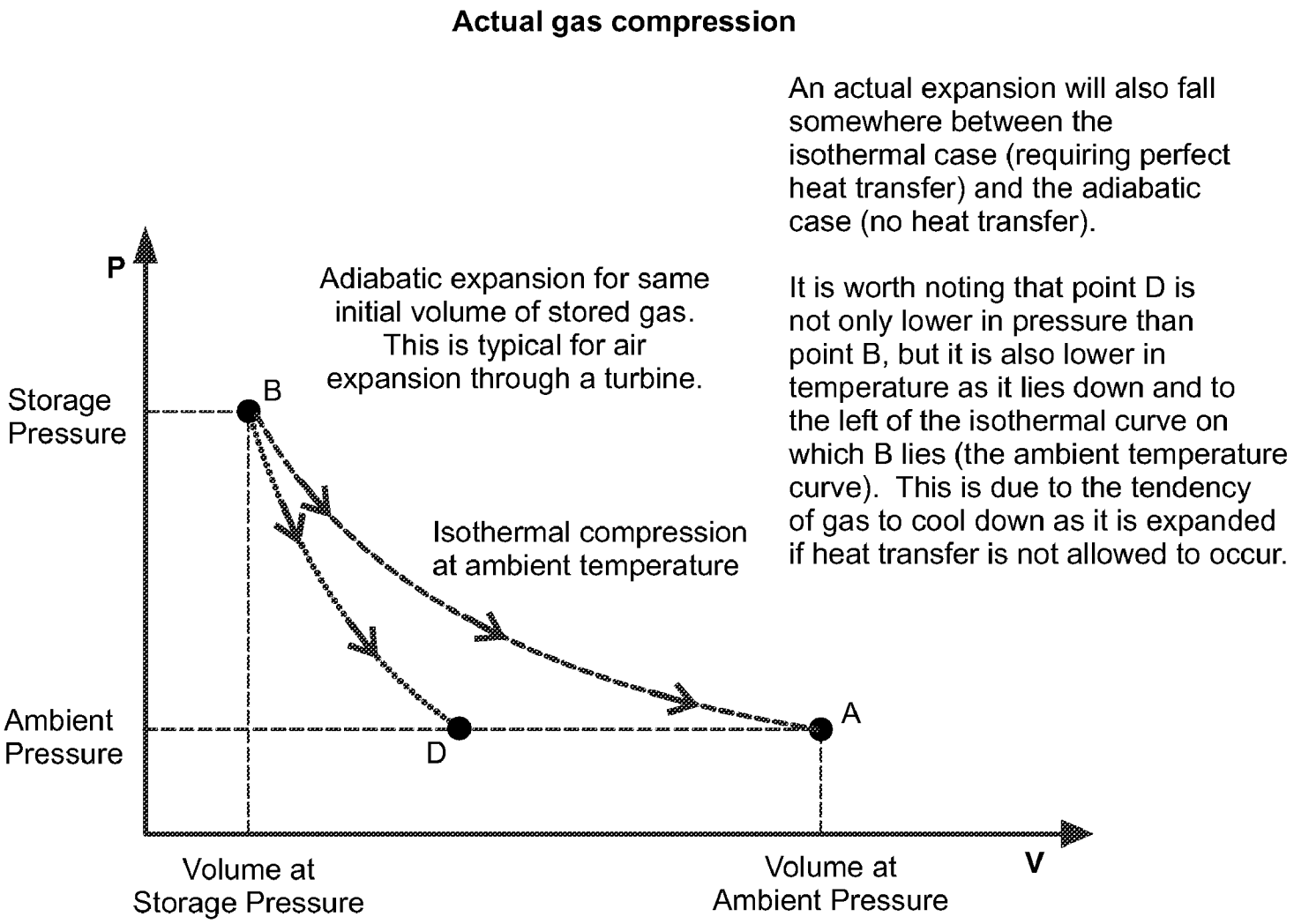
Figure 15J:
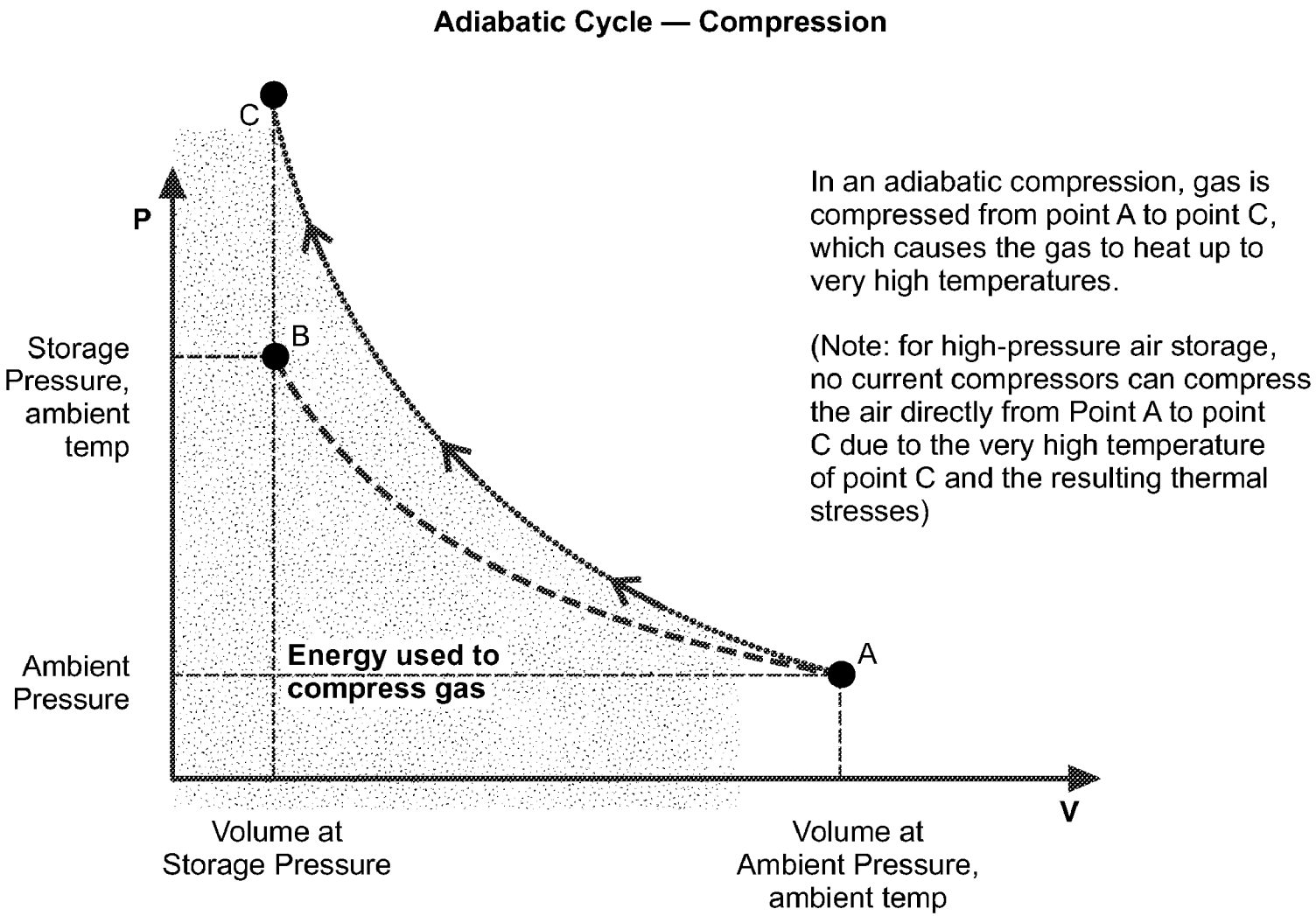
Figure 15K:
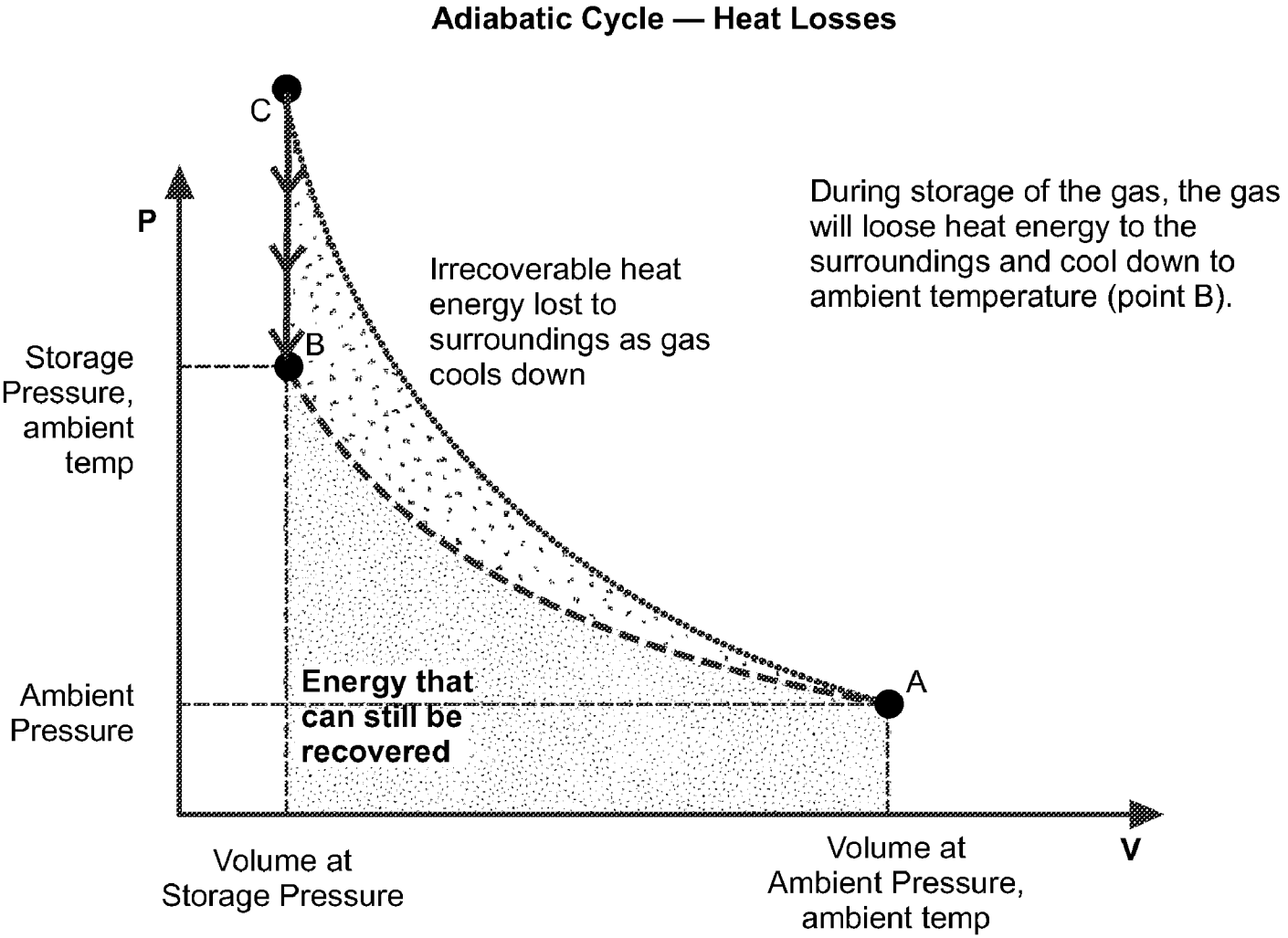
Figure 15L:
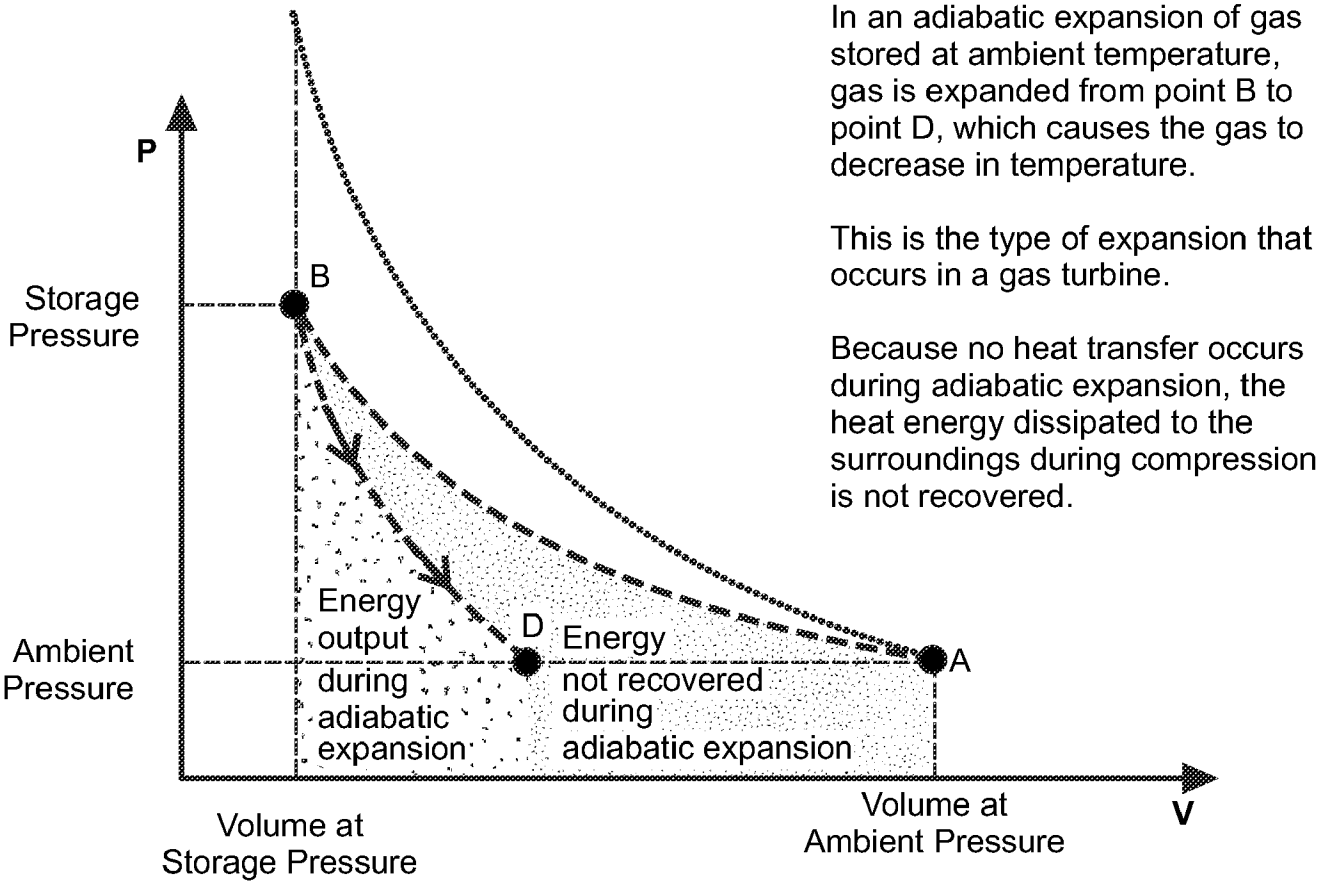
Figure 15P:
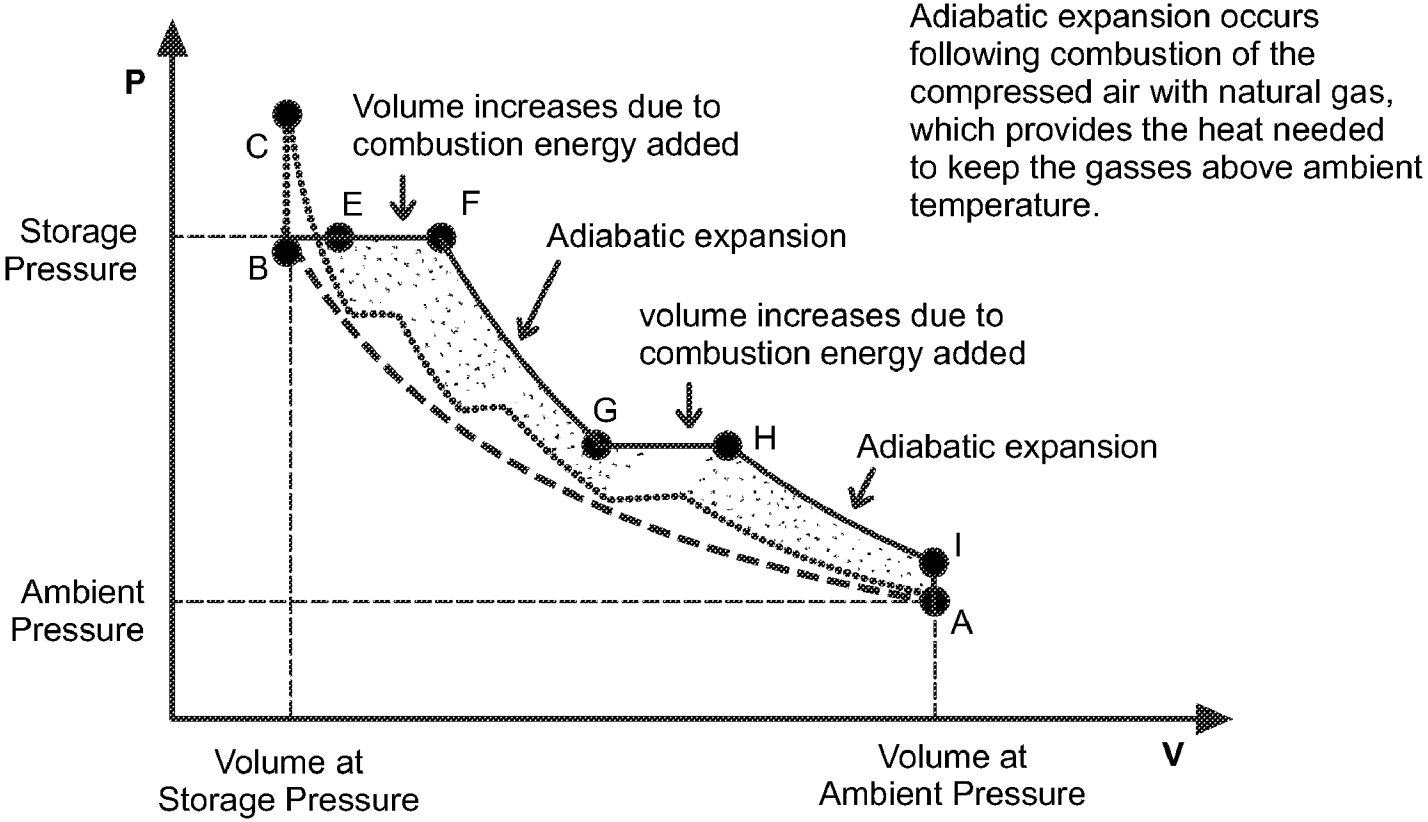
Figure 15S:
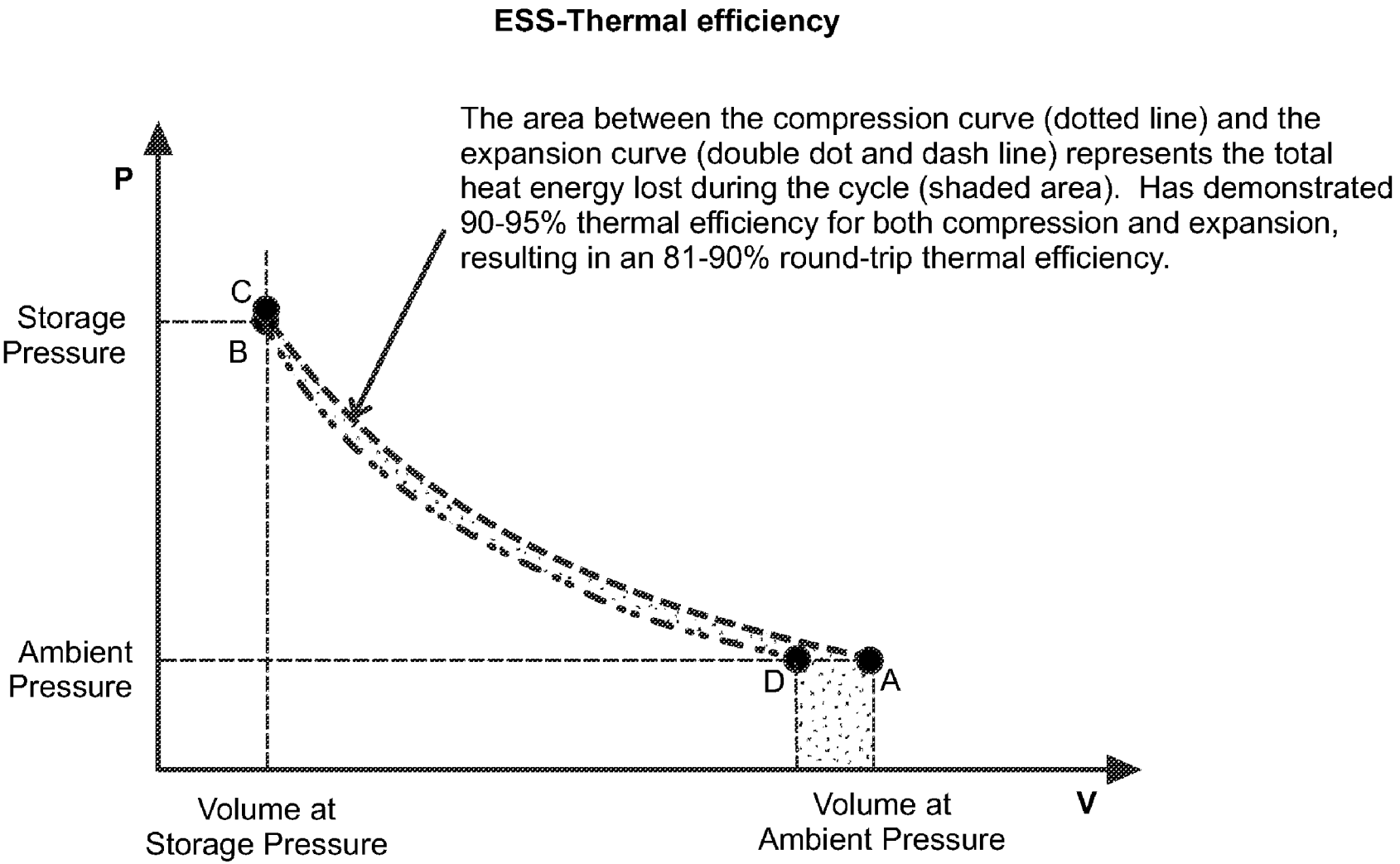
Figure 15T:
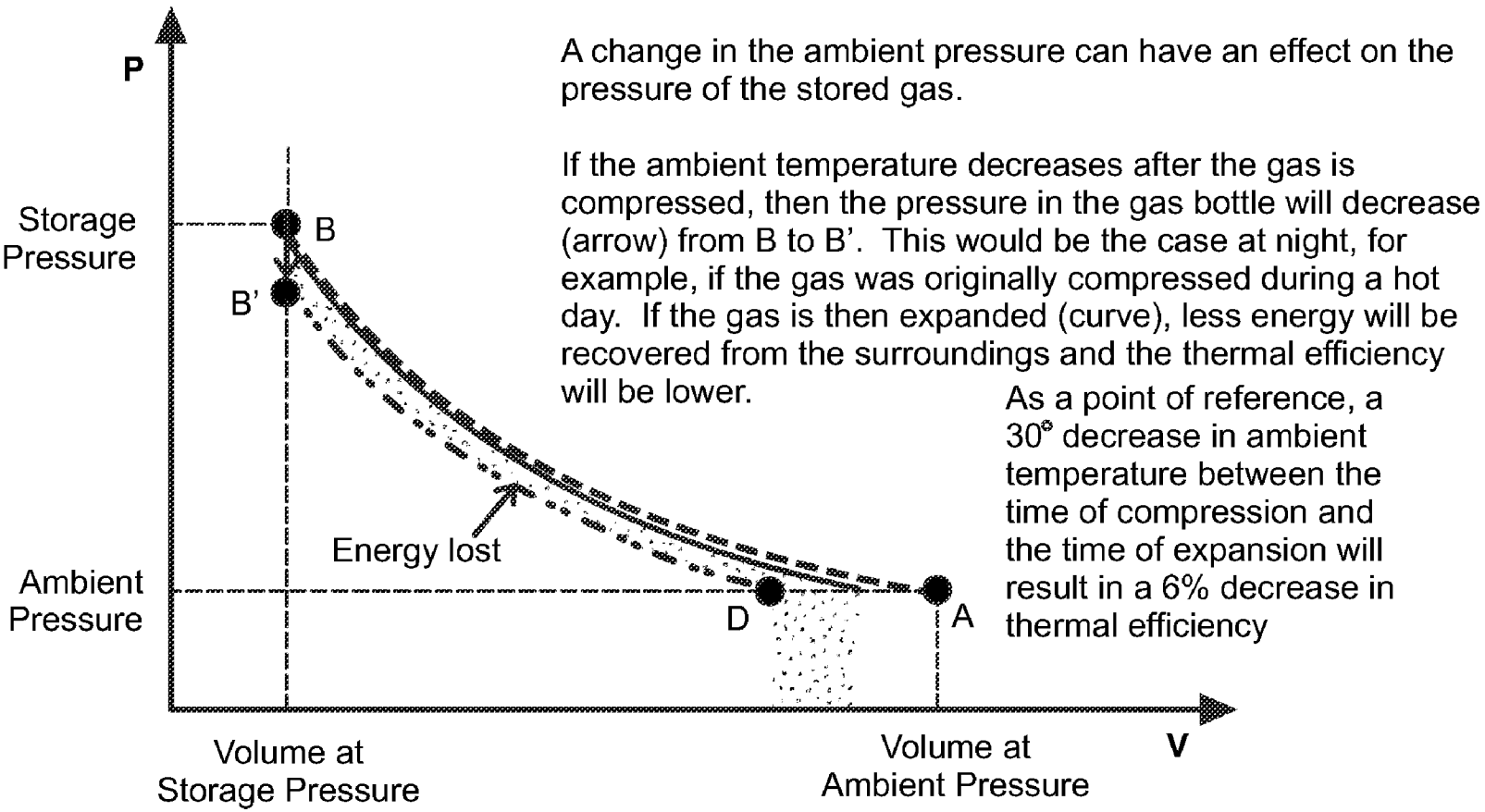
Figure 15W:
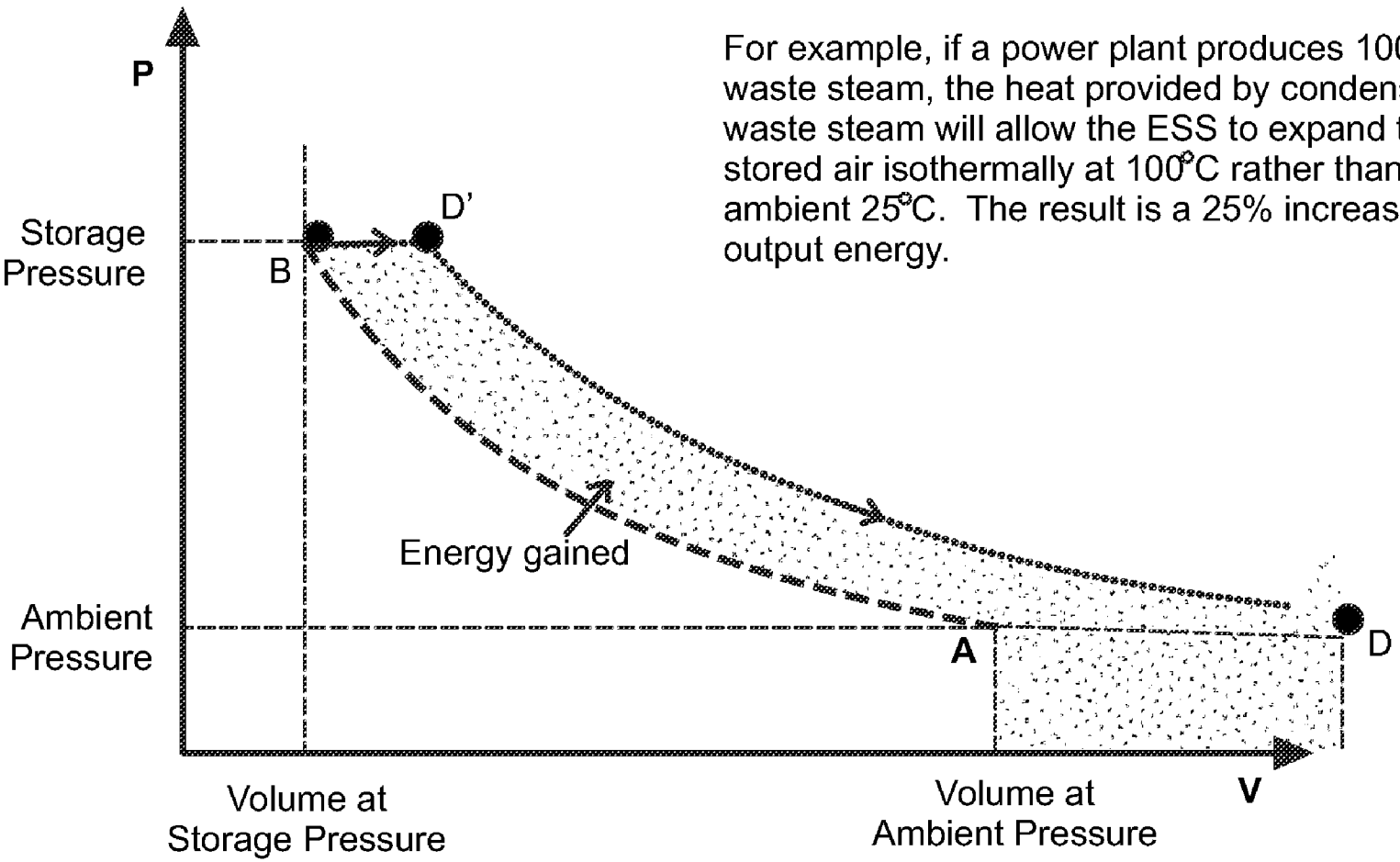

This is part of the significant parameter of heat transfer. For maximum efficiency, the expansion should remain substantially isothermal. That is heat from the environment replaces the heat lost by the expansion. In general, isothermal compression and expansion is critical to maintaining high round-trip system efficiency, especially if the compressed gas is stored for long periods. In various embodiments of the systems described herein, heat transfer can occur through the walls of the accumulators and/or intensifiers, or heat-transfer mechanisms can act upon the expanding or compressing gas to absorb or radiate heat from or to an environmental or other source. The rate of this heat transfer is governed by the thermal properties and characteristics of the accumulators/intensifiers, which can be used to determine a thermal time constant. If the compression of the gas in the accumulators/intensifiers occurs slowly relative to the thermal time constant, then heat generated by compression of the gas will transfer through the accumulator/intensifier walls to the surroundings, and the gas will remain at approximately constant temperature. Similarly, if expansion of the gas in the accumulators/intensifiers occurs slowly relative to the thermal time constant, then the heat absorbed by the expansion of the gas will transfer from the surroundings through the accumulator/intensifier walls and to the gas, and the gas will remain at approximately constant temperature. If the gas remains at a relatively constant temperature during both compression and expansion, then the amount of heat energy transferred from the gas to the surroundings during compression will equal the amount of heat energy recovered during expansion via heat transfer from the surroundings to the gas. This property is represented by the Q and the arrow in FIGS. 4-4B. As noted, a variety of mechanisms can be employed to maintain an isothermal expansion/compression. In one example, the accumulators can be submerged in a water bath or water/fluid flow can be circulated around the accumulators and intensifiers. The accumulators can alternatively be surrounded with heating/cooling coils or a flow of warm air can be blown past the accumulators/intensifiers. However, any technique that allows for mass flow transfer of heat to and from the accumulators can be employed. For a general explanation of the effects of isothermal versus adiabatic compression and expansion and the advantages of systems and methods in accordance with the invention (ESS), see FIGS. 15A-15W.

Figure 5F:
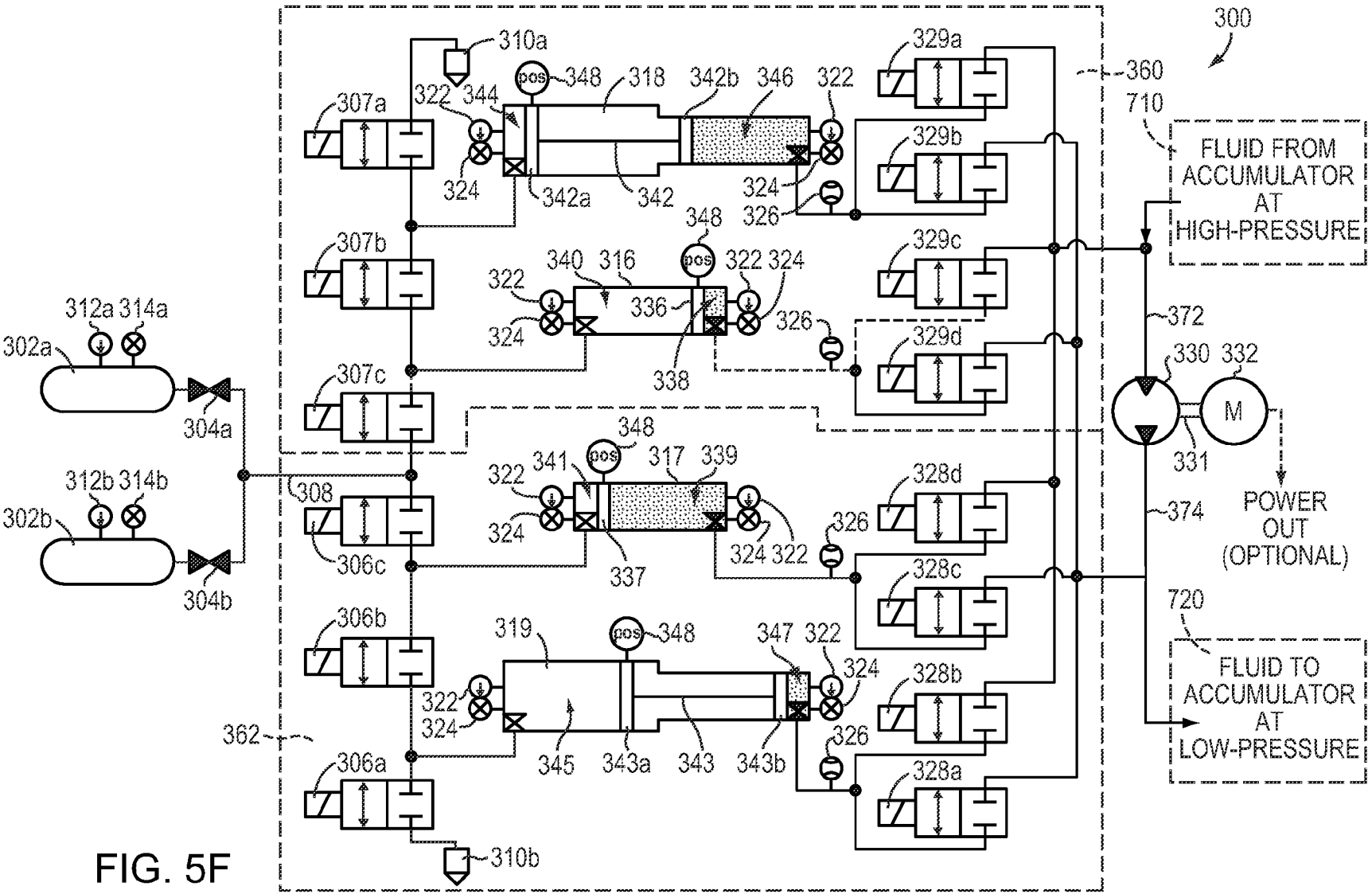

FIG. 5F is a schematic diagram of the energy storage and recovery system of FIGS. 4-4B, showing a physical state of the system 300 following the state of FIG. 5E in which the accumulator 316 of the first circuit has exhausted the fluid in its fluid chamber 338 and the gas in its air chamber 340 has expanded to mid-pressure from high-pressure, and the valves have been momentarily closed on both the first circuit and the second circuit, while the optional accumulator 366 delivers fluid through the motor/pump 330 to maintain operation of the electric motor/generator 332 between cycles. As shown in FIG. 5F, the piston 336 of the accumulator 316 has driven all fluid out of the fluid chamber 338 as the gas in the air chamber 340 has fully expanded (to mid-pressure of 20 ATM, per the example). Fluid valves 329*c* and 328*c* are closed by the controller 350. In practice, the opening and closing of valves is carefully timed so that a flow through the motor/pump 330 is maintained. However, in an optional implementation, brief interruptions in fluid pressure can be accommodated by pressurized fluid flow 710 from the optional accumulator (366 in FIGS. 4-4B), which is directed through the motor/pump 330 to the second optional accumulator (367 in FIG. 4) at low-pressure as an exhaust fluid flow 720. In one embodiment, the exhaust flow can be directed to a simple low-pressure reservoir that is used to refill the first accumulator 366. Alternatively, the exhaust flow can be directed to the second optional accumulator (367 in FIG. 4) at low-pressure, which is subsequently pressurized by excess electricity (driving a compressor) or air pressure from the storage tanks 302 when it is filled with fluid. Alternatively, where a larger number of accumulator/intensifier circuits (e.g., three or more) are employed in parallel in the system 300, their expansion cycles can be staggered so that only one circuit is closed off at a time, allowing a substantially continuous flow from the other circuits.

Figure 5G:
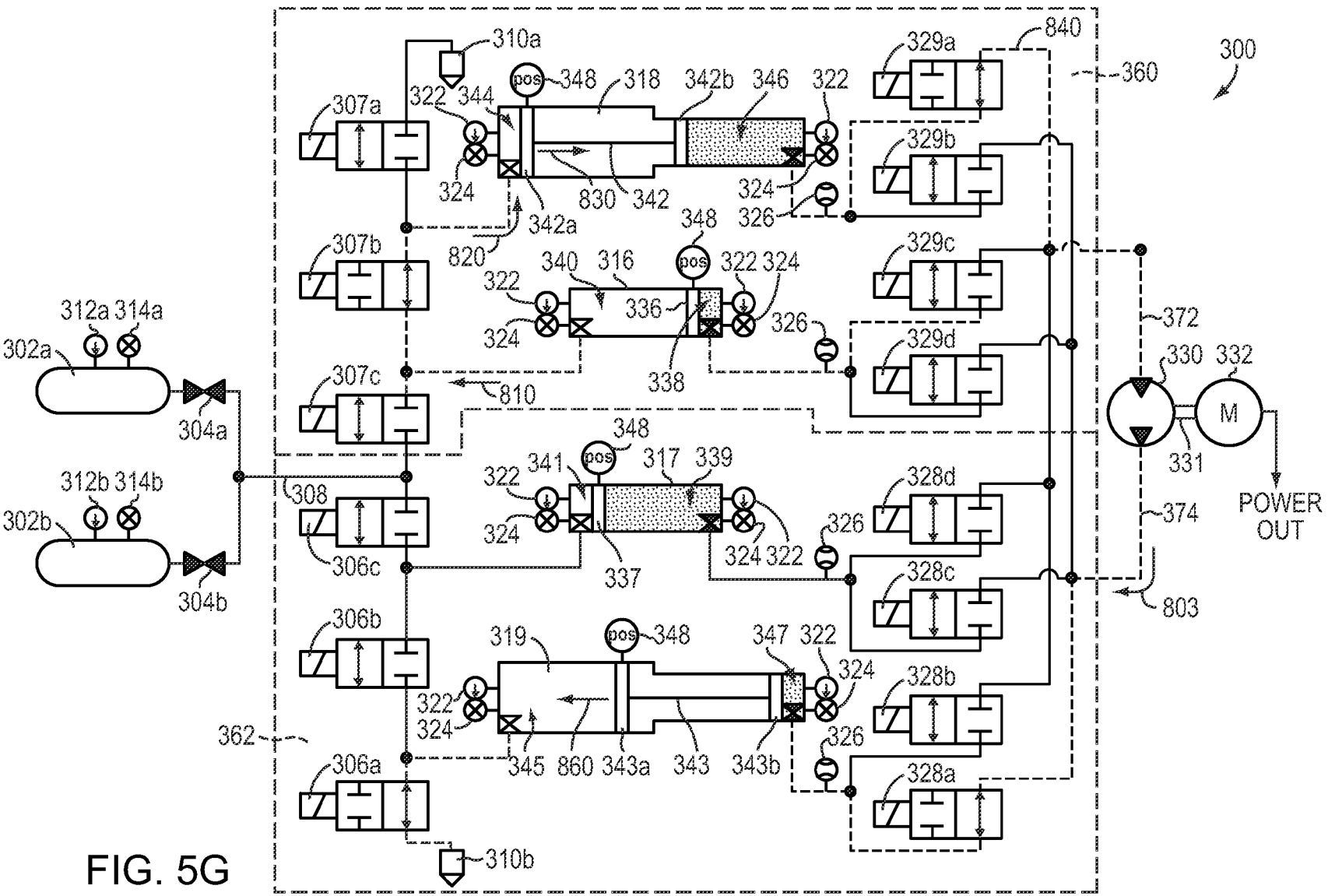

FIG. 5G is a schematic diagram of the energy storage and recovery system of FIGS. 4-4B showing a physical state of the system 300 following the state of FIG. 5F, in which pneumatic valves 307*b*, 306*a* are opened to allow mid-pressure gas from the air chamber 340 of the first circuit's accumulator 316 to flow into the air chamber 344 of the first circuit's intensifier 318, while fluid from the first circuit's intensifier 318 is directed through the motor/pump 330 and exhausted fluid fills the fluid chamber 347 of second circuit's intensifier 319, whose air chamber 345 is vented to atmosphere. As shown in FIG. 5G, pneumatic valve 307*b* is opened, while the tank outlet valve 307*c* remains closed. Thus, the volume of the air chamber 340 of accumulator 316 is coupled to the air chamber 344 of the intensifier 318. The accumulator's air pressure has been reduced to a mid-pressure level, well below the initial charge from the tanks 302. The air, thus, flows (arrow 810) through valve 307*b* to the air chamber 344 of the intensifier 318. This drives the air piston 342*a* (arrow 830). Since the area of the air-contacting piston 342*a* is larger than that of the piston 336 in the accumulator 316, the lower air pressure still generates a substantially equivalent higher fluid pressure on the smaller-area, coupled fluid piston 342*b* of the intensifier 318. The fluid in the fluid chamber 346 thereby flows under pressure through opened fluid valve 329*a* (arrow 840) and into the inlet side 372 of the motor/pump 330. The outlet fluid from the motor pump 330 is directed (arrow 850) through now-opened fluid valve 328*a* to the opposing intensifier 319. The fluid enters the fluid chamber 347 of the intensifier 319, biasing (arrow 860) the fluid piston 343*b* (and interconnected gas piston 343*a*). Any gas in the air chamber 345 of the intensifier 319 is vented through the now opened vent valve 306*a* to atmosphere via the vent 310*b*. The mid-level gas pressure in the accumulator 316 is directed (arrow 820) to the intensifier 318, the piston 342*a* of which drives fluid from the chamber 346 using the coupled, smaller-diameter fluid piston 342*b*. This portion of the recovery stage maintains a reasonably high fluid pressure, despite lower gas pressure, thereby ensuring that the motor/pump 330 continues to operate within a predetermined range of fluid pressures, which is desirable to maintain optimal operating efficiencies for the given motor. Notably, the multi-stage circuits of this embodiment effectively restrict the operating pressure range of the hydraulic fluid delivered to the motor/pump 330 above a predetermined level despite the wide range of pressures within the expanding gas charge provided by the high-pressure tank.

Figure 5H:
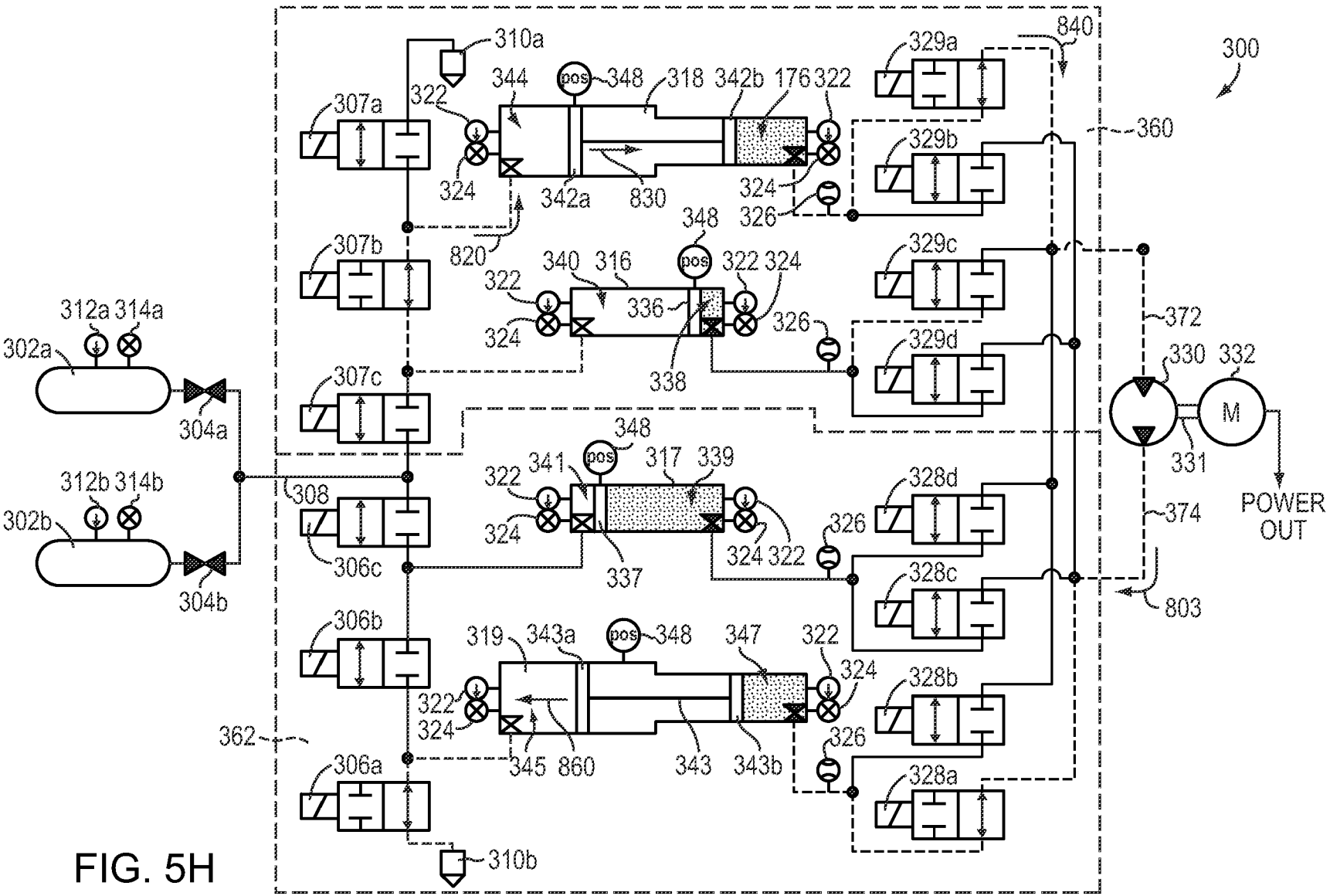

FIG. 5H is a schematic diagram of the energy storage and recovery system of FIGS. 4-4B showing a physical state of the system following the state of FIG. 5G, in which the intensifier 318 of the first circuit directs fluid to the fluid motor/pump 330 based upon mid-pressure gas from the first circuit's accumulator 316 while the intensifier 319 of the second circuit receives exhausted fluid from the motor/pump 330, as gas in its air chamber 345 is vented to atmosphere. As shown in FIG. 5H, the gas in intensifier 318 continues to expand from mid-pressure to low-pressure. Conversely, the size differential between coupled air and fluid pistons 342*a* and 342*b*, respectively, causes the fluid pressure to vary between high and mid-pressure. In this manner, motor/pump operating efficiency is maintained.

Figure 5I:
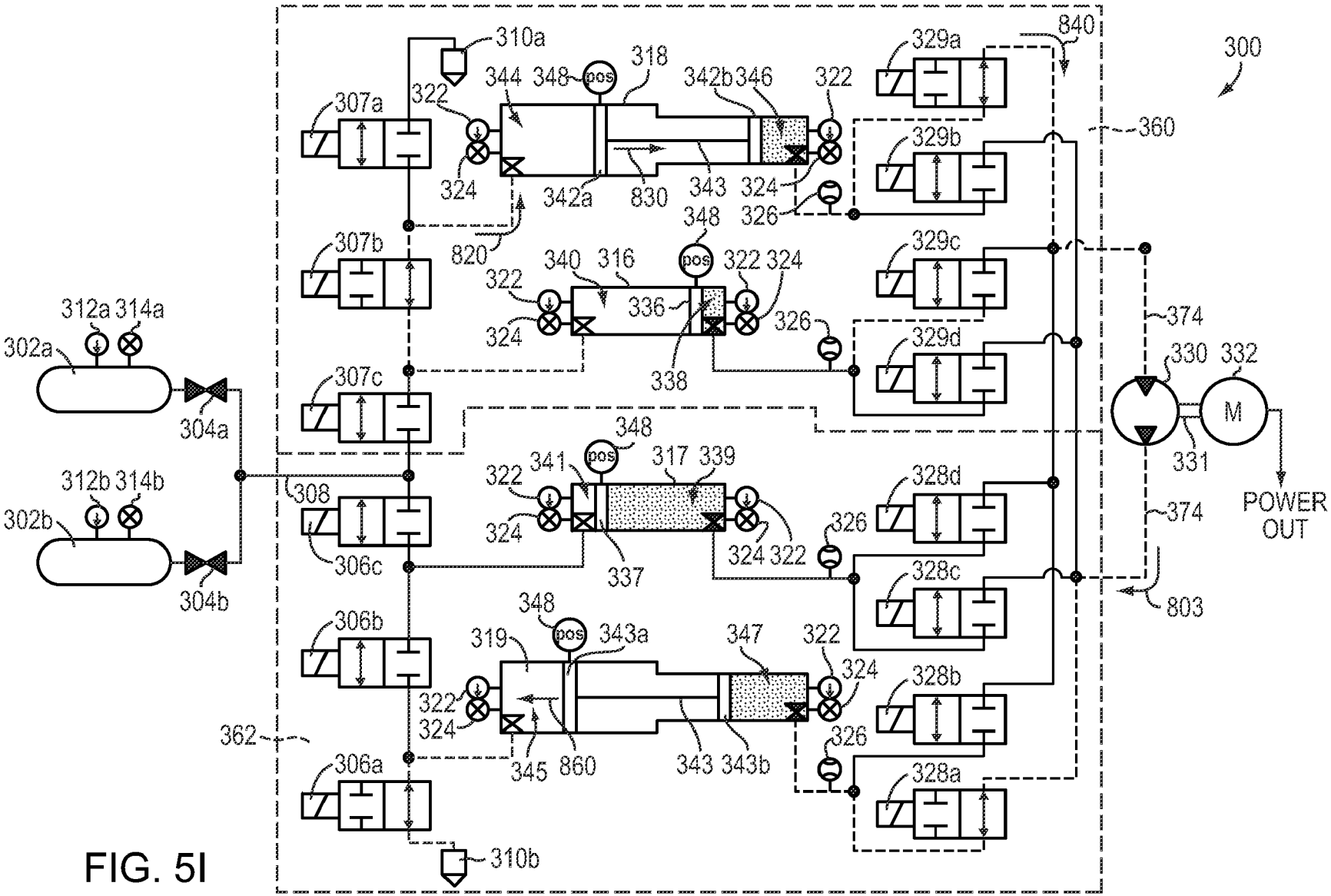

FIG. 5I is a schematic diagram of the energy storage and recovery system of FIGS. 4-4B showing a physical state of the system following the state of FIG. 5H, in which the intensifier 318 of the first circuit has almost exhausted the fluid in its fluid chamber 346 and the gas in its air chamber 344, delivered from the first circuit's accumulator 316, has expanded to nearly low-pressure from the mid-pressure. As discussed with respect to FIG. 5H, the gas in intensifier 318 continues to expand from mid-pressure to low-pressure. Again, the size differential between coupled air and fluid pistons 342*a* and 342*b*, respectively, causes the fluid pressure to vary between high and mid-pressure to maintain motor/pump operating efficiency.

Figure 5J:
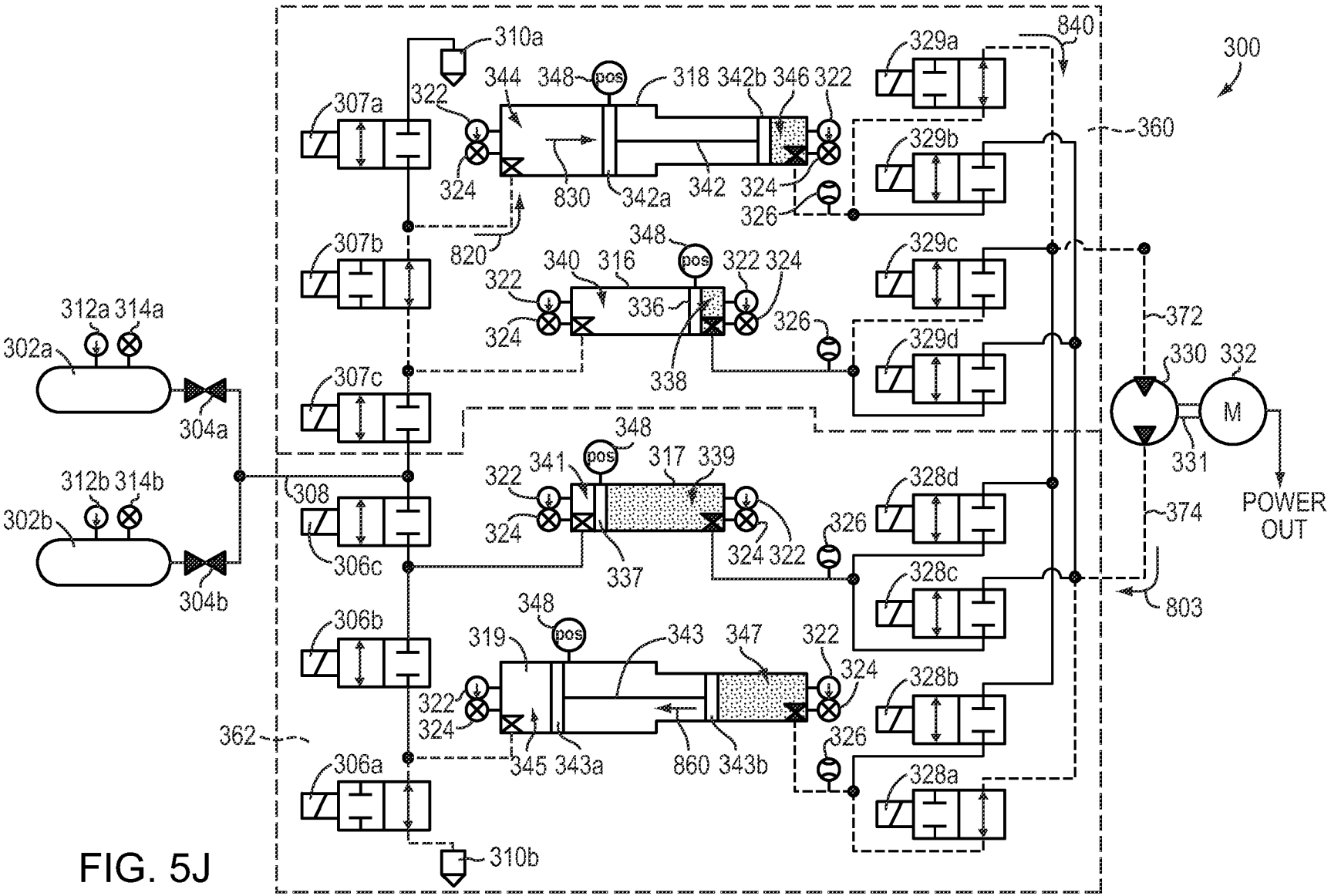

FIG. 5J is a schematic diagram of the energy storage and recovery system of FIGS. 4-4B showing a physical state of the system 300 following the state of FIG. 5I, in which the intensifier 318 of the first circuit has essentially exhausted the fluid in its fluid chamber 346 and the gas in its air chamber 344, delivered from the first circuit's accumulator 316, has expanded to low-pressure from the mid-pressure. As shown in FIG. 5J, the intensifier's piston 342 reaches full stroke, while the fluid is driven fully from high to mid-pressure in the fluid chamber 346. Likewise, the opposing intensifier's fluid chamber 347 has filled with fluid from the outlet side 374 of the motor/pump 330.

Figure 5K:
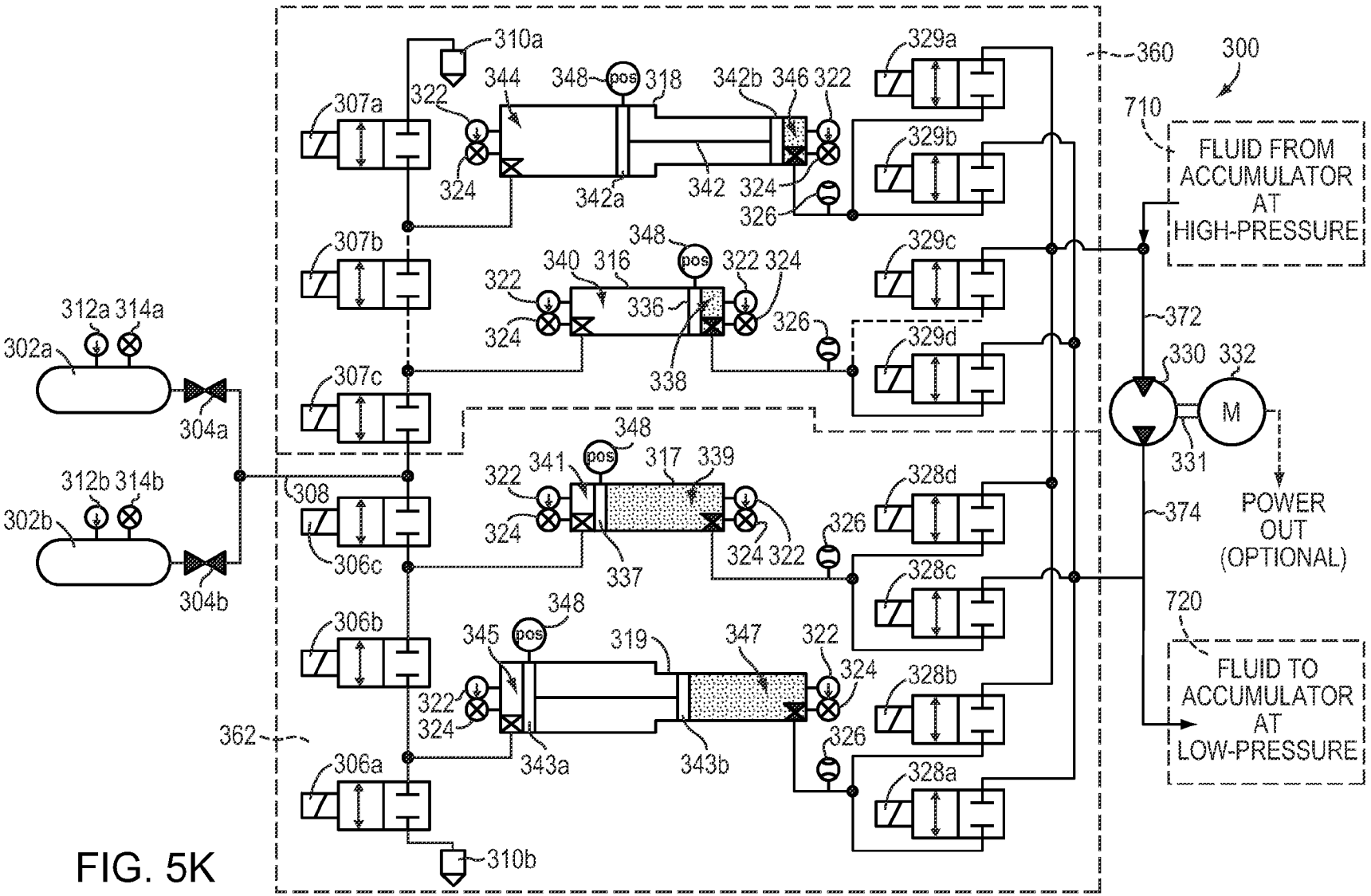

FIG. 5K is a schematic diagram of the energy storage and recovery system of FIGS. 4-4B showing a physical state of the system following the state of FIG. 5J, in which the intensifier 318 of the first circuit has exhausted the fluid in its fluid chamber 346 and the gas in its air chamber 344 has expanded to low-pressure, and the valves have been momentarily closed on both the first circuit and the second circuit in preparation of switching-over to an expansion cycle in the second circuit, whose accumulator and intensifier fluid chambers 339, 347 are now filled with fluid. At this time, the optional accumulator 366 can deliver fluid through the motor/pump 330 to maintain operation of the motor/generator 332 between cycles. As shown in FIG. 5K, pneumatic valve 307*b*, located between the accumulator 316 and the intensifier 318 of the circuit 362, is closed. At this point in the above-described portion of the recovery stage, the gas charge initiated in FIG. 5A has been fully expanded through two stages with relatively gradual, isothermal expansion characteristics, while the motor/pump 330 has received fluid flow within a desirable operating pressure range. Along with pneumatic valve 307*b*, the fluid valves 329*a* and 328*a* (and outlet gas valve 307*a*) are momentarily closed. The above-described optional accumulator 366, and/or other interconnected pneumatic/hydraulic accumulator/intensifier circuits can maintain predetermined fluid flow through the motor/pump 330 while the valves of the subject circuits 360, 362 are momentarily closed. At this time, the optional accumulators and reservoirs 366, 367, as shown in FIG. 4, can provide a continuing flow 710 of pressure through the motor/pump 330, and into the reservoir or low-pressure accumulator (exhaust fluid flow 720). The full range of pressure in the previous gas charge being utilized by the system 300.

Figure 5L:
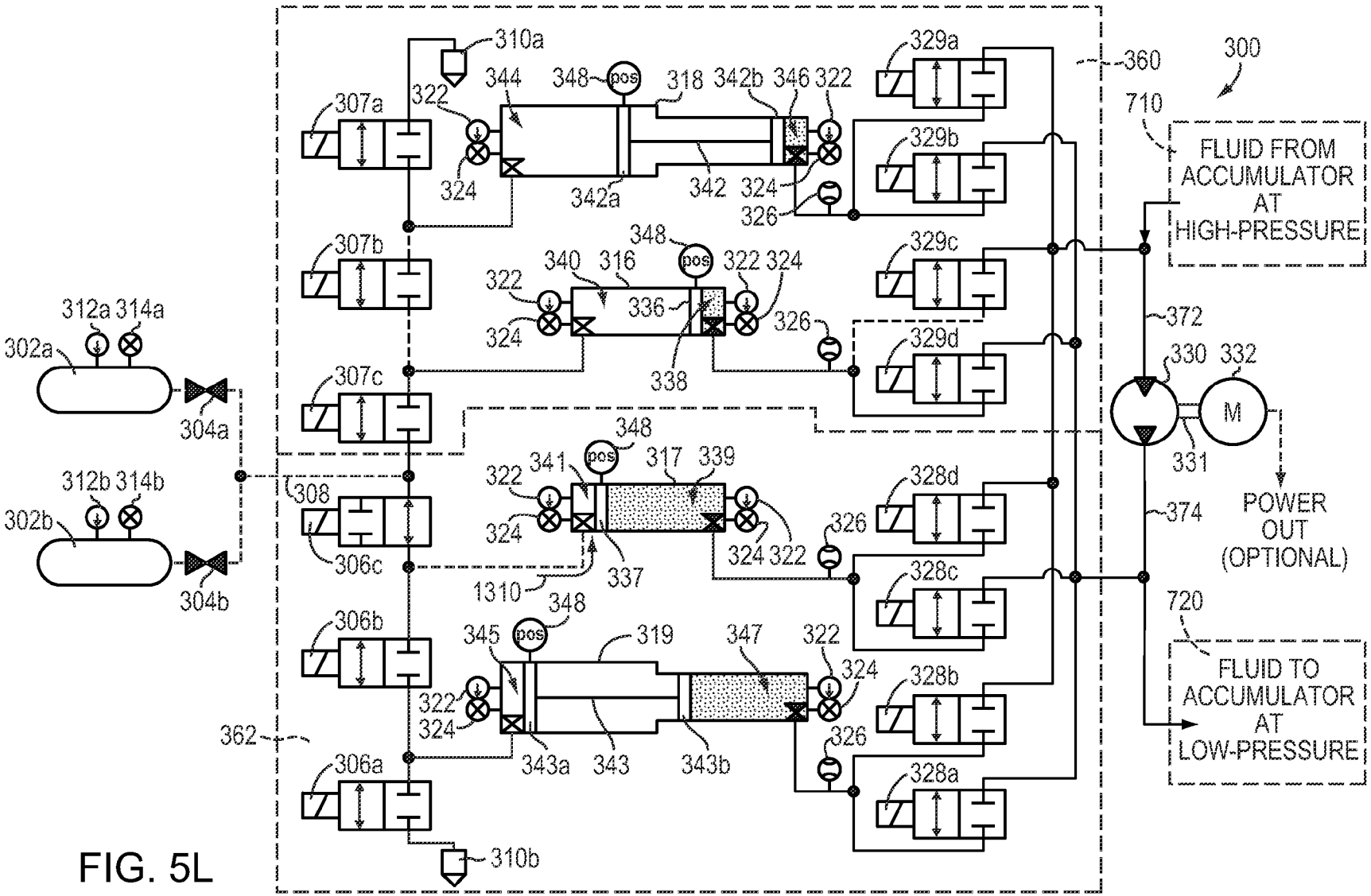

FIG. 5L is a schematic diagram of the energy storage and recovery system of FIGS. 4-4B showing a physical state of the system following the state of FIG. 5K, in which the accumulator 317 of the second circuit is filled with high-pressure gas from the high-pressure tanks 302 as part of the switch-over to the second circuit as an expansion circuit, while the first circuit receives exhausted fluid and is vented to atmosphere while the optional accumulator 366 delivers fluid through the motor/pump 330 to maintain operation of the motor/generator between cycles. As shown in FIG. 5L, the cycle continues with a new charge of high-pressure (slightly lower) gas from the tanks 302 delivered to the opposing accumulator 317. As shown, pneumatic valve 306*c* is now opened by the controller 350, allowing a charge of relatively high-pressure gas to flow (arrow 1310) into the air chamber 341 of the accumulator 317, which builds a corresponding high-pressure charge in the air chamber 341.

Figure 5M:
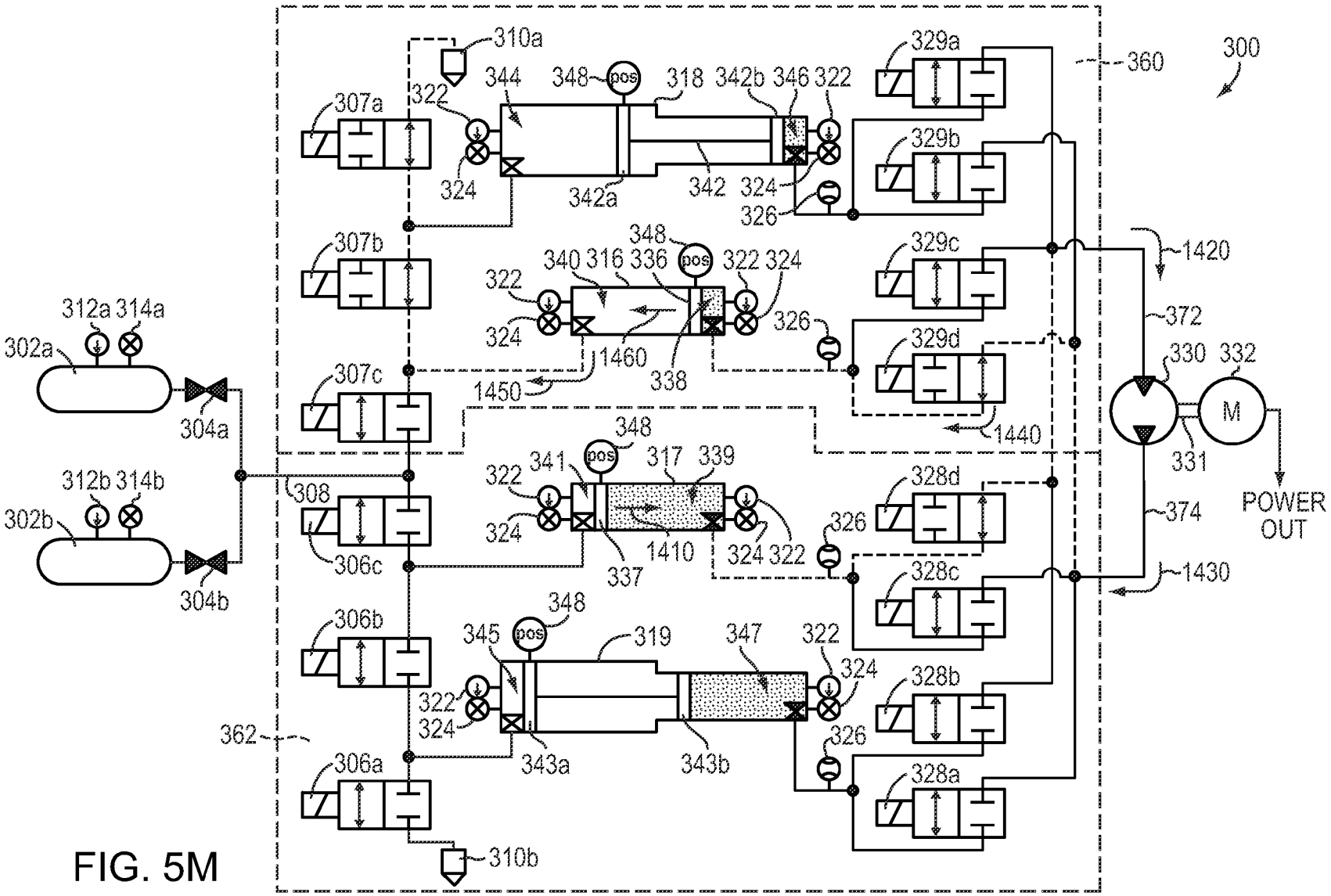

FIG. 5M is a schematic diagram of the energy storage and recovery system of FIGS. 4-4B showing a physical state of the system following the state of FIG. 5L, in which valves are opened to allow fluid to flow from the accumulator 317 of the second circuit to the fluid motor/pump 330 to generate electricity therefrom, while the first circuit's accumulator 316, whose air chamber 340 is vented to atmosphere, receives exhausted fluid from the motor/pump 330. As shown in FIG. 5M, the pneumatic valve 306*c* is closed and the fluid valves 328*d* and 329*d* are opened on the fluid side of the circuits 360, 362, thereby allowing the accumulator piston 337 to move (arrow 1410) under pressure of the charged air chamber 341. This directs fluid under high pressure through the inlet side 372 of the motor/pump 330 (arrow 1420), and then through the outlet 374. The exhausted fluid is directed (arrow 1430) now to the fluid chamber 338 of accumulator 316. Pneumatic valves 307*a* and 307*b* have been opened, allowing the low-pressure air in the air chamber 340 of the accumulator 316 to vent (arrow 1450) to atmosphere via vent 310*a*. In this manner, the piston 336 of the accumulator 316 can move (arrow 1460) without resistance to accommodate the fluid from the motor/pump outlet 374.

Figure 5N:
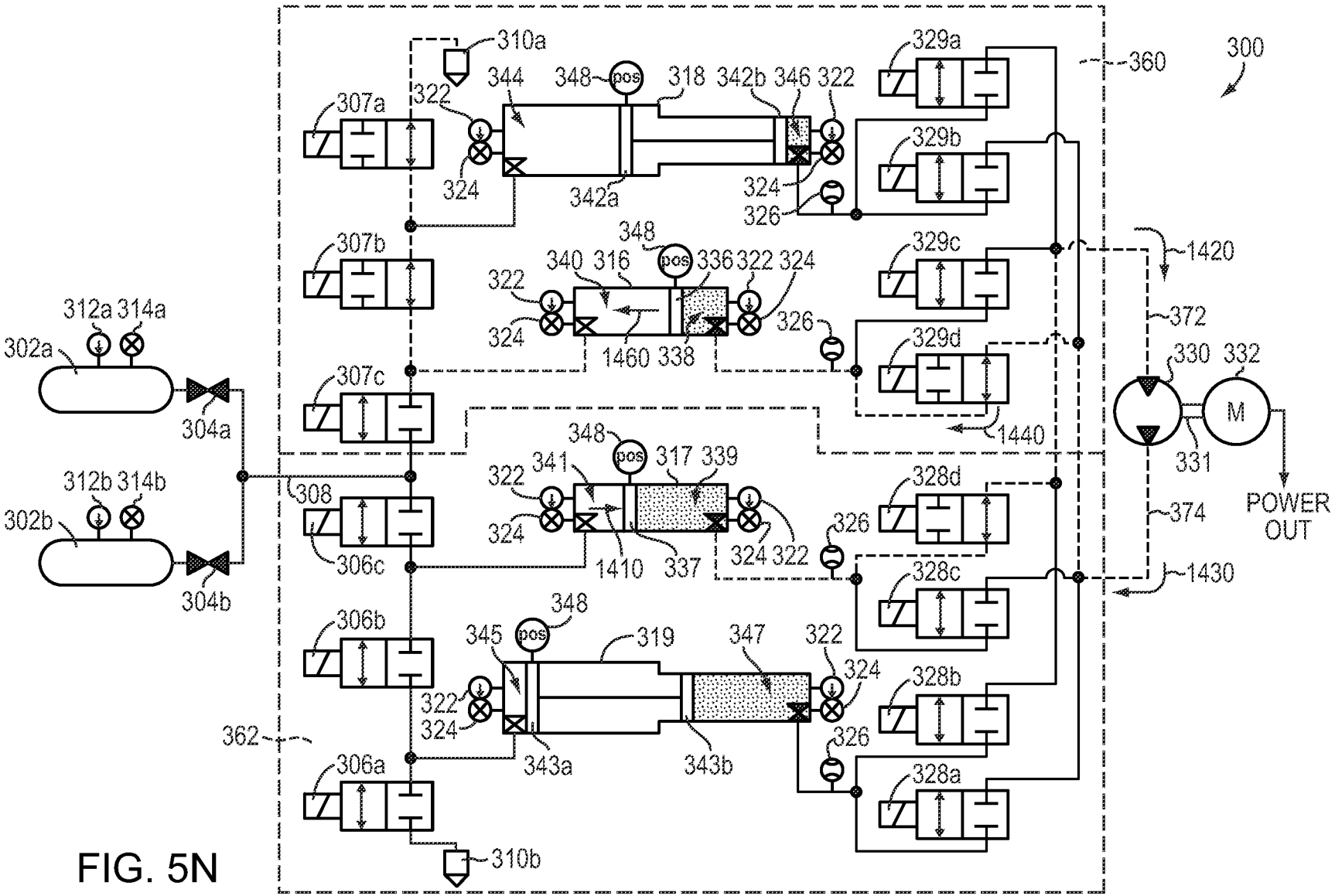

FIG. 5N is a schematic diagram of the energy storage and recovery system of FIGS. 4-4B showing a physical state of the system following the state of FIG. 5M, in which the accumulator 317 of the second circuit 362 continues to direct fluid to the fluid motor/pump 330 while the accumulator 316 of the first circuit continues to receive exhausted fluid from the motor/pump 330, as gas in its air chamber 340 is vented to atmosphere, the cycle eventually directing mid-pressure air to the second circuit's intensifier 319 to drain the fluid therein. As shown in FIG. 5N, the high-pressure gas charge in the accumulator 317 expands more fully within the air chamber 341 (arrow 1410). Eventually, the charge in the air chamber 341 is fully expanded. The mid-pressure charge in the air chamber 341 is then coupled via open pneumatic valve 306*b* to the intensifier 319, which fills the opposing intensifier 318 with spent fluid from the outlet 374. The process repeats until a given amount of energy is recovered or the pressure in the tanks 302 drops below a predetermined level.

It should be clear that the system 300, as described with respect to FIGS. 4-4B and 5A-5N, could be run in reverse to compress gas in the tanks 302 by powering the electric generator/motor 332 to drive the motor/pump 330 in pump mode. In this case, the above-described process occurs in reverse order, with driven fluid causing compression within both stages of the air system in turn. That is, air is first compressed to a mid-pressure after being drawn into the intensifier from the environment. This mid-pressure air is then directed to the air chamber of the accumulator, where fluid then forces it to be compressed to high pressure. The high-pressure air is then forced into the tanks 302. Both this compression/energy storage stage and the above-described expansion/energy recovery stages are discussed with reference to the general system state diagram shown in FIG. 6.

Note that in the above-described systems 100, 300 (one or more stages), the compression and expansion cycle is predicated upon the presence of gas in the storage tanks 302 that is currently at a pressure above the mid-pressure level (e.g. above 20 ATM). For system 300, for example, when the prevailing pressure in the storage tanks 302 falls below the mid-pressure level (based, for example, upon levels sensed by tank sensors 312, 314), then the valves can be configured by the controller to employ only the intensifier for compression and expansion. That is, lower gas pressures are accommodated using the larger-area gas pistons on the intensifiers, while higher pressures employ the smaller-area gas pistons of the accumulators, 316, 317.

Before discussing the state diagram, it should be noted that one advantage of the described systems according to this invention is that, unlike various prior art systems, this system can be implemented using generally commercially available components. In the example of a system having a power output of 10 to 500 kW, for example, high-pressure storage tanks can be implemented using standard steel or composite cylindrical pressure vessels (e.g. Compressed Natural Gas 5500-psi steel cylinders). The accumulators can be implemented using standard steel or composite pressure cylinders with moveable pistons (e.g., a four-inch-inner-diameter piston accumulator). Intensifiers (pressure boosters/multipliers) having characteristics similar to the exemplary accumulator can be implemented (e.g. a fourteen-inch booster diameter and four-inch bore diameter single-acting pressure booster available from Parker-Hannifin of Cleveland, Ohio). A fluid motor/pump can be a standard high-efficiency axial piston, radial piston, or gear-based hydraulic motor/pump, and the associated electrical generator is also available commercially from a variety of industrial suppliers. Valves, lines, and fittings are commercially available with the specified characteristics as well.

Figure 6:
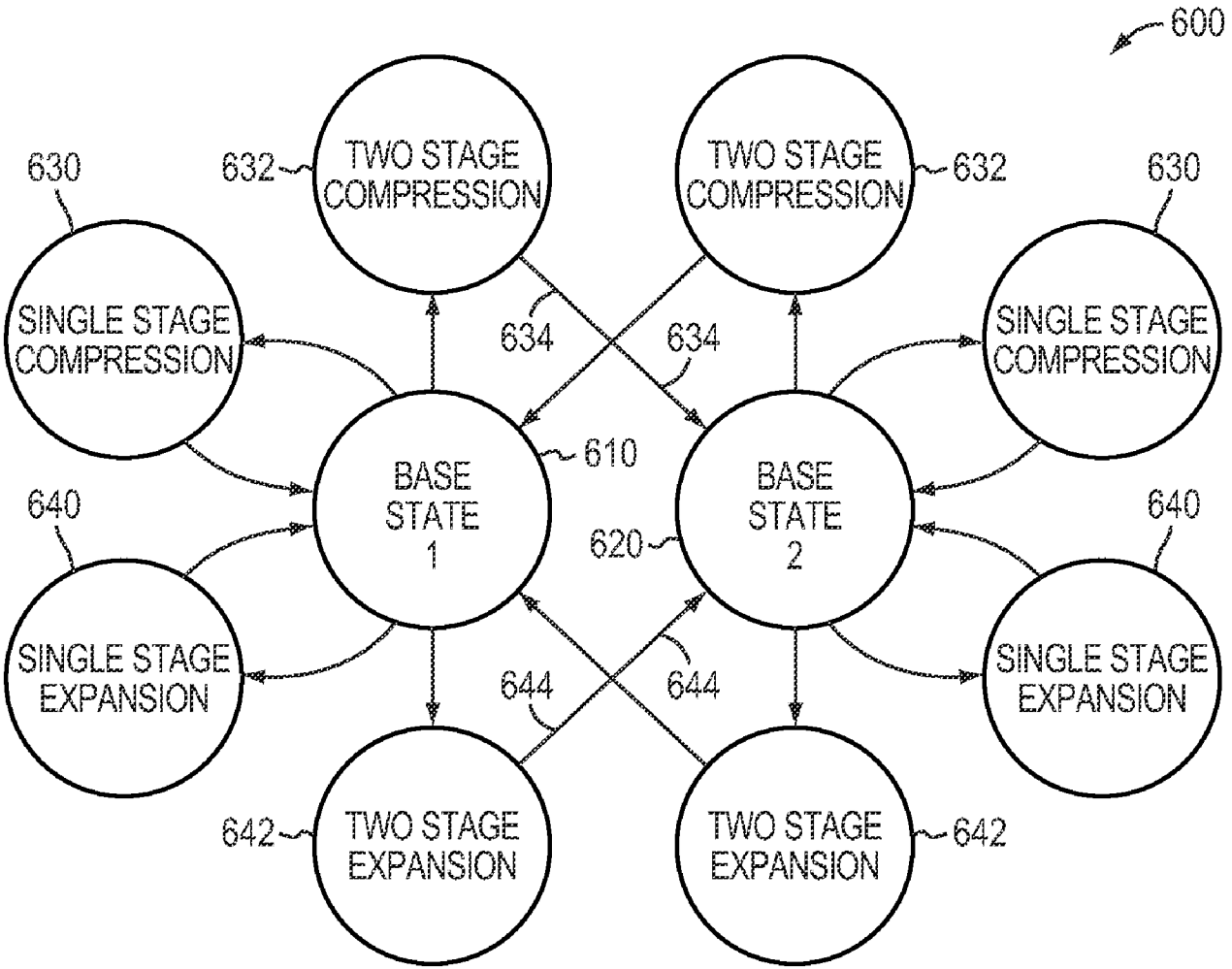
FIG. 6 is a generalized diagram of the various operational states of an open-air hydraulic-pneumatic energy storage and recovery system in accordance with one embodiment of the invention in both an expansion/energy recovery cycle and a compression/energy storage cycle.

Having discussed the exemplary sequence of physical steps in various embodiments of the system, the following is a more general discussion of operating states for the system 300 in both the expansion/energy recovery mode and the compression/energy storage mode. Reference is now made to FIG. 6.

In particular, FIG. 6 details a generalized state diagram 600 that can be employed by the control application 353 to operate the system's valves and motor/generator based upon the direction of the energy cycle (recovery/expansion or storage/compression) based upon the reported states of the various pressure, temperature, piston-position, and/or flow sensors. Base State 1 (610) is a state of the system in which all valves are closed and the system is neither compressing nor expanding gas. A first accumulator and intensifier (e.g., 316, 318) are filled with the maximum volume of hydraulic fluid and second accumulator and intensifier 1 (e.g., 317, 319) are filled with the maximum volume of air, which may or may not be at a pressure greater than atmospheric. The physical system state corresponding to Base State 1 is shown in FIG. 5A. Conversely, Base State 2 (620) of FIG. 6 is a state of the system in which all valves are closed and the system is neither compressing nor expanding gas. The second accumulator and intensifier are filled with the maximum volume of hydraulic fluid and the first accumulator and intensifier are filled with the maximum volume of air, which may or may not be at a pressure greater than atmospheric. The physical system state corresponding to Base State 2 is shown in FIG. 5K.

As shown further in the diagram of FIG. 6, Base State 1 and Base State 2 each link to a state termed Single Stage Compression 630. This general state represents a series of states of the system in which gas is compressed to store energy, and which occurs when the pressure in the storage tanks 302 is less than the mid-pressure level. Gas is admitted (from the environment, for example) into the intensifier (318 or 319-depending upon the current base state), and is then pressurized by driving hydraulic fluid into that intensifier. When the pressure of the gas in the intensifier reaches the pressure in the storage tanks 302, the gas is admitted into the storage tanks 302. This process repeats for the other intensifier, and the system returns to the original base state (610 or 620).

The Two Stage Compression 632 shown in FIG. 6 represents a series of states of the system in which gas is compressed in two stages to store energy, and which occurs when the pressure in the storage tanks 302 is greater than the mid-pressure level. The first stage of compression occurs in an intensifier (318 or 319) in which gas is pressurized to mid-pressure after being admitted at approximately atmospheric (from the environment, for example). The second stage of compression occurs in accumulator (316 or 317) in which gas is compressed to the pressure in the storage tanks 302 and then allowed to flow into the storage tanks 302. Following two stage compression, the system returns to the other base state from the current base state, as symbolized on the diagram by the crossing-over process arrows 634.

The Single State Expansion 640, as shown in FIG. 6, represents a series of states of the system in which gas is expanded to recover stored energy and which occurs when the pressure in the storage tanks 302 is less than the mid-pressure level. An amount of gas from storage tanks 302 is allowed to flow directly into an intensifier (318 or 319). This gas then expands in the intensifier, forcing hydraulic fluid through the hydraulic motor/pump 330 and into the second intensifier, where the exhausted fluid moves the piston with the gas-side open to atmospheric (or another low-pressure environment). The Single Stage Expansion process is then repeated for the second intensifier, after which the system returns to the original base state (610 or 620).

Likewise, the Two Stage Expansion 642, as shown in FIG. 6, represents a series of states of the system in which gas is expanded in two stages to recover stored energy and which occurs when pressure in the storage tanks is greater than the mid-pressure level. An amount of gas from storage tanks 302 is allowed into an accumulator (316 or 317), wherein the gas expands to mid-pressure, forcing hydraulic fluid through the hydraulic motor/pump 330 and into the second accumulator. The gas is then allowed into the corresponding intensifier (318 or 319), wherein the gas expands to near-atmospheric pressure, forcing hydraulic fluid through the hydraulic motor/pump 330 and into the second intensifier. The series of states comprising two-stage expansion are shown in the above-described FIGS. 5A-5N. Following two-stage expansion, the system returns to the other base state (610 or 620) as symbolized by the crossing process arrows 644.

It should be clear that the above-described system for storing and recovering energy is highly efficient in that it allows for gradual expansion of gas over a period that helps to maintain isothermal characteristics. The system particularly deals with the large expansion and compression of gas between high-pressure to near atmospheric (and the concomitant thermal transfer) by providing this compression/expansion in two or more separate stages that allow for more gradual heat transfer through the system components. Thus little or no outside energy is required to run the system (heating gas, etc.), rendering the system more environmentally friendly, capable of being implemented with commercially available components, and scalable to meet a variety of energy storage/recovery needs.

FIGS. 7A-7F depict the major systems of an alternative system/method of expansion/compression cycling an open-air staged hydraulic-pneumatic system, where the system 400 includes at least three accumulators 416*a*, 416*b*, 416*c*, at least one intensifier 418, and two motors/pumps 430*a*, 430*b*. The compressed gas storage tanks, valves, sensors, etc. are not shown for clarity. FIGS. 7A-7F illustrate the operation of the accumulators 416, intensifier 418, and the motors/pumps 430 during various stages of expansion (101-106). The system 400 returns to stage 101 after stage 106 is complete.

As shown in the figures, the designations D, F, AI, and F2 refer to whether the accumulator or intensifier is driving (D) or filling (F), with the additional labels for the accumulators where AI refers to accumulator to intensifier—the accumulator air side attached to and driving the intensifier air side, and F2 refers to filling at twice the rate of the standard filling.

Figure 7B:
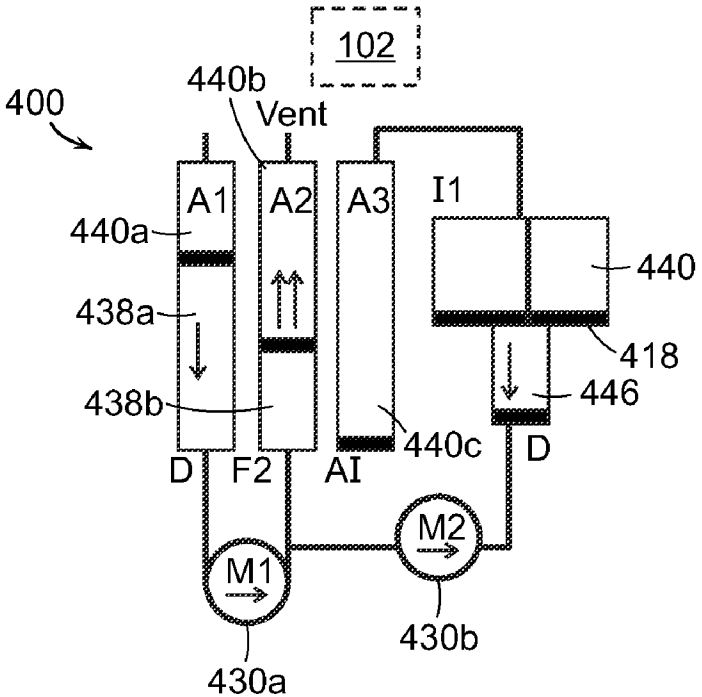
FIGS. 7A-7F are partial schematic diagrams of an open-air hydraulic-pneumatic energy storage and recovery system in accordance with another alternative embodiment of the invention, illustrating the various operational stages of the system during an expansion phase.
Figure 7A:
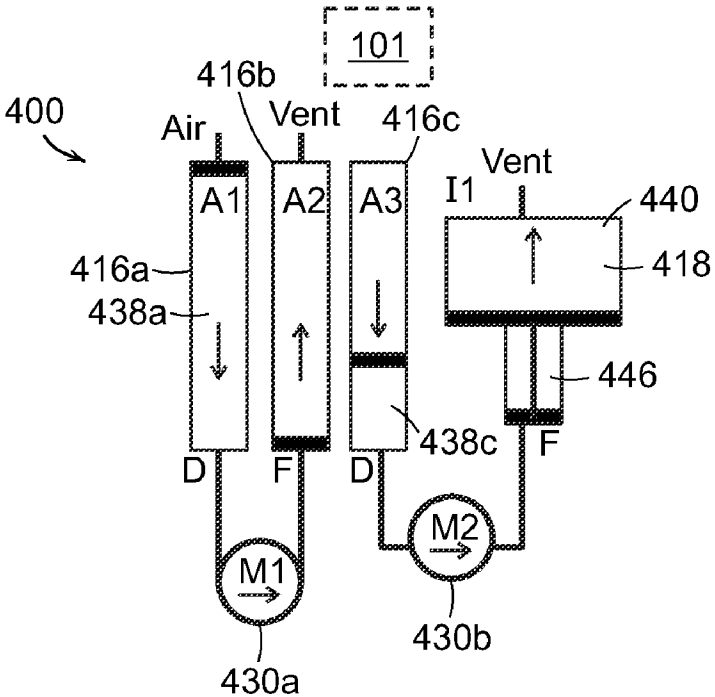

As shown in FIG. 7A the layout consists of three equally sized hydraulic-pneumatic accumulators 416*a*, 416*b*, 416*c*, one intensifier 418 having a hydraulic fluid side 446 with a capacity of about ⅓ of the accumulator capacity, and two hydraulic motor/pumps 430*a*, 430*b*.

FIG. 7A represents stage or time instance 101, where accumulator 416*a* is being driven with high pressure gas from a pressure vessel. After a specific amount of compressed gas is admitted (based on the current vessel pressure), a valve will be closed, disconnecting the pressure vessel and the high pressure gas will continue to expand in accumulator 416*a* as shown in FIGS. 7B and 7C (i.e., stages 102 and 103). Accumulator 416*b* is empty of hydraulic fluid and its air chamber 440*b* is unpressurized and being vented to the atmosphere. The expansion of the gas in accumulator 416*a* drives the hydraulic fluid out of the accumulator, thereby driving the hydraulic motor 430*a*, with the output of the motor 430 refilling accumulator 416*b* with hydraulic fluid. At the time point shown in 101, accumulator 416*c* is at a state where gas has already been expanding for two units of time and is continuing to drive motor 430*b* while filling intensifier 418. Intensifier 418, similar to accumulator 416*b*, is empty of hydraulic fluid and its air chamber 444 is unpressurized and being vented to the atmosphere.

Continuing to time instance 102, as shown in FIG. 7B, the air chamber 440*a* of accumulator 416*a* continues to expand, thereby forcing fluid out of the fluid chamber 438*a* and driving motor/pump 430*a* and filling accumulator 416*b*. Accumulator 416*c* is now empty of hydraulic fluid, but remains at mid-pressure. The air chamber 440*c* of accumulator 416*c* is now connected to the air chamber 444 of intensifier 418. Intensifier 418 is now full of hydraulic fluid and the mid-pressure gas in accumulator 416*c* drives the intensifier 418, which provides intensification of the mid-pressure gas to high pressure hydraulic fluid. The high pressure hydraulic fluid drives motor/pump 430*b* with the output of motor/pump 430*b* also connected to and filling accumulator 416*b* through appropriate valving. Thus, accumulator 416*b* is filled at twice the normal rate when a single expanding hydraulic pneumatic device (accumulator or intensifier) is providing the fluid for filling.

At time instance 103, as shown in FIG. 7C, the system 400 has returned to a state similar to stage 101, but with different accumulators at equivalent stages. Accumulator 416*b* is now full of hydraulic fluid and is being driven with high pressure gas from a pressure vessel. After a specific amount of compressed gas is admitted (based on the current vessel pressure), a valve will be closed, disconnecting the pressure vessel. The high pressure gas will continue to expand in accumulator 416*b* as shown in stages 104 and 105. Accumulator 416*c* is empty of hydraulic fluid and the air chamber 440*c* is unpressurized and being vented to the atmosphere. The expansion of the gas in accumulator 416*b* drives the hydraulic fluid out of the accumulator, driving the hydraulic motor motor/pump

430*b*, with the output of the motor refilling accumulator 416*c* with hydraulic fluid via appropriate valving. At the time point shown in 103, accumulator 416*a* is at a state where gas has already been expanding for two units of time and is continuing to drive motor/pump 430*a* while now filling intensifier 418. Intensifier 418, similar to accumulator 416*c*, is again empty of hydraulic fluid and the air chamber 444 is unpressurized and being vented to the atmosphere.

Figure 7D:
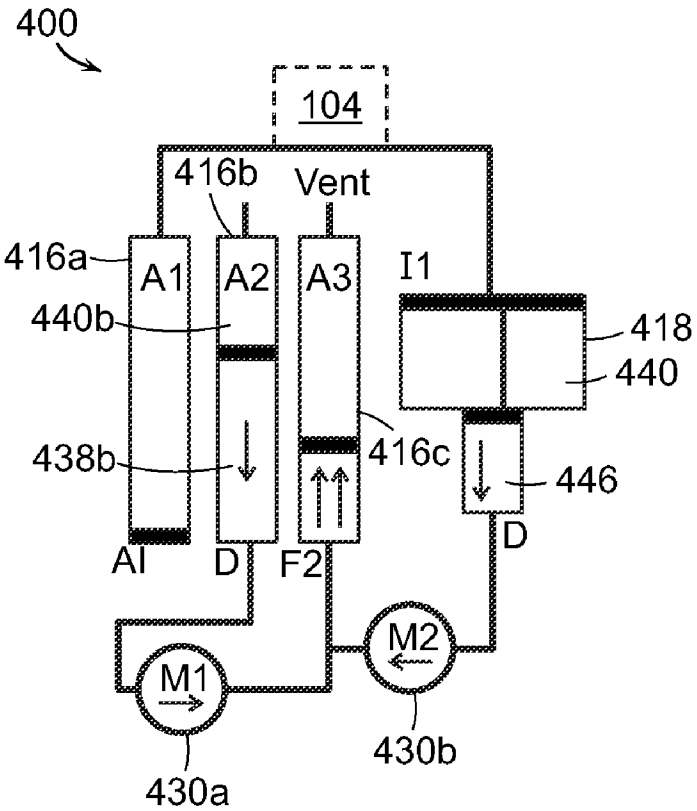
Figure 7C:
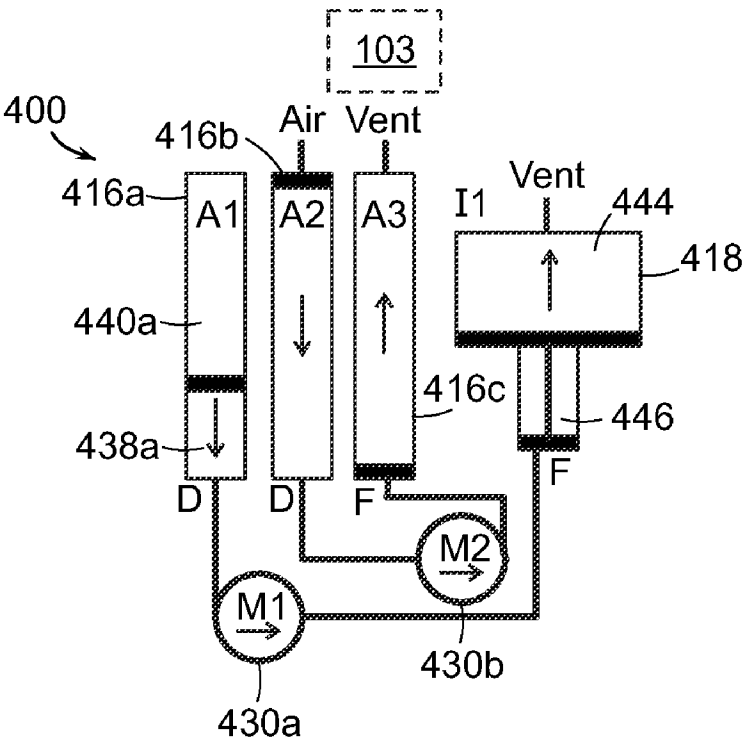

Continuing to time instance 104, as shown in FIG. 7D, the air chamber 440*b* of accumulator 416*b* continues to expand, thereby forcing fluid out of the fluid chamber 438*b* and driving motor/pump 430*a* and filling accumulator 416*c*. Accumulator 416*a* is now empty of hydraulic fluid, but remains at mid-pressure. The air chamber 440*a* of accumulator 416*a* is now connected to the air chamber 444 of intensifier 418. Intensifier 418 is now full of hydraulic fluid and the mid-pressure gas in accumulator 416*a* drives the intensifier 418, which provides intensification of the mid-pressure gas to high pressure hydraulic fluid. The high pressure hydraulic fluid drives motor/pump 430*b* with the output of motor/pump 430*b* also connected to and filling accumulator 416*c* through appropriate valving. Thus, accumulator 416*c* is filled at twice the normal rate when a single expanding hydraulic pneumatic device (accumulator or intensifier) is providing the fluid for filling.

Figure 7F:
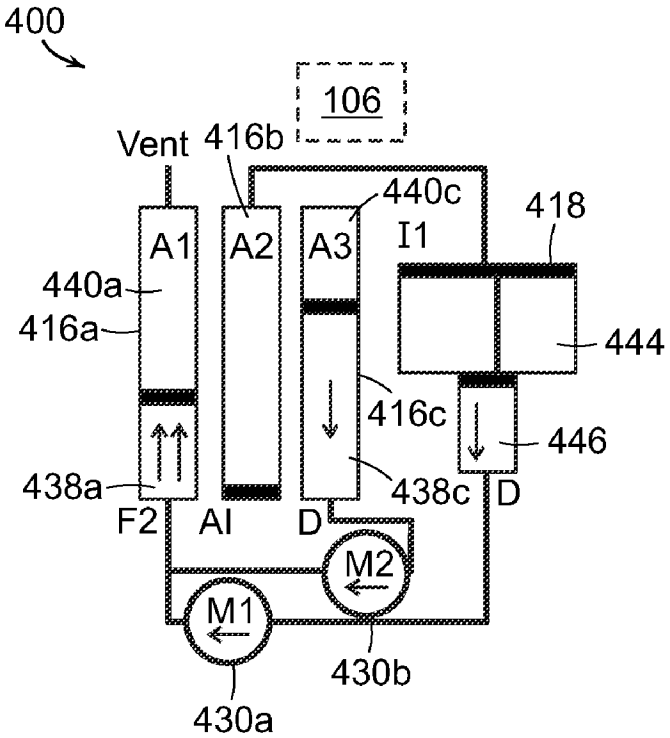
Figure 7E:
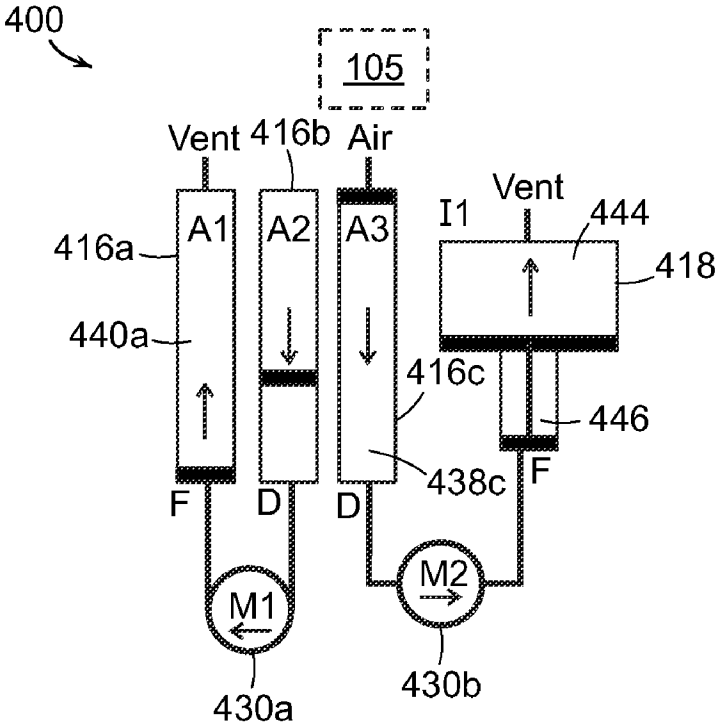

At time instance 105, as shown in FIG. 7E, the system 400 has returned to a state similar to stage 103, but with different accumulators at equivalent stages. Accumulator 416*c* is now full of hydraulic fluid and is being driven with high pressure gas from a pressure vessel. After a specific amount of compressed gas is admitted (based on the current vessel pressure), a valve will be closed, disconnecting the pressure vessel. The high pressure gas will continue to expand in accumulator 416*c*. Accumulator 416*a* is empty of hydraulic fluid and the air chamber 440*a* is unpressurized and being vented to the atmosphere. The expansion of the gas in accumulator 416*c* drives the hydraulic fluid out of the accumulator, driving the hydraulic motor motor/pump 430*b*, with the output of the motor refilling intensifier 418 with hydraulic fluid via appropriate valving. At the time point shown in 105, accumulator 416*b* is at a state where gas has already been expanding for two units of time and is continuing to drive motor/pump 430*a* while filling accumulator 416*a* with hydraulic fluid via appropriate valving. Intensifier 418, similar to accumulator 416*a*, is again empty of hydraulic fluid and the air chamber 444 is unpressurized and being vented to the atmosphere.

Continuing to time instance 106, as shown in FIG. 7F, the air chamber 440*c* of accumulator 416*c* continues to expand, thereby forcing fluid out of the fluid chamber 438*c* and driving motor/pump 430*b* and filling accumulator 416*a*. Accumulator 416*b* is now empty of hydraulic fluid, but remains at mid-pressure. The air chamber 440*b* of accumulator 416*b* is now connected to the air chamber 444 of intensifier 418. Intensifier 418 is now full of hydraulic fluid and the mid-pressure gas in accumulator 416*b* drives the intensifier 418, which provides intensification of the mid-pressure gas to high pressure hydraulic fluid. The high pressure hydraulic fluid drives motor/pump 430*a* with the output of motor/pump 430*a* also connected to and filling accumulator 416*a* through appropriate valving. Thus, accumulator 416*a* is filled at twice the normal rate when a single expanding hydraulic pneumatic device (accumulator or intensifier) is providing the fluid for filling. Following the states shown in 106, the system returns to the states shown in 101 and the cycle continues.

FIG. 8 is a table illustrating the expansion scheme described above and illustrated in FIGS. 7A-7F for a three accumulator, one intensifier system. It should be noted that throughout the cycle, two hydraulic-pneumatic devices (two accumulators or one intensifier plus one accumulator) are always expanding and the two motors are always being driven, but at different points in the expansion, such that the overall power remains relatively constant.

Figure 9:
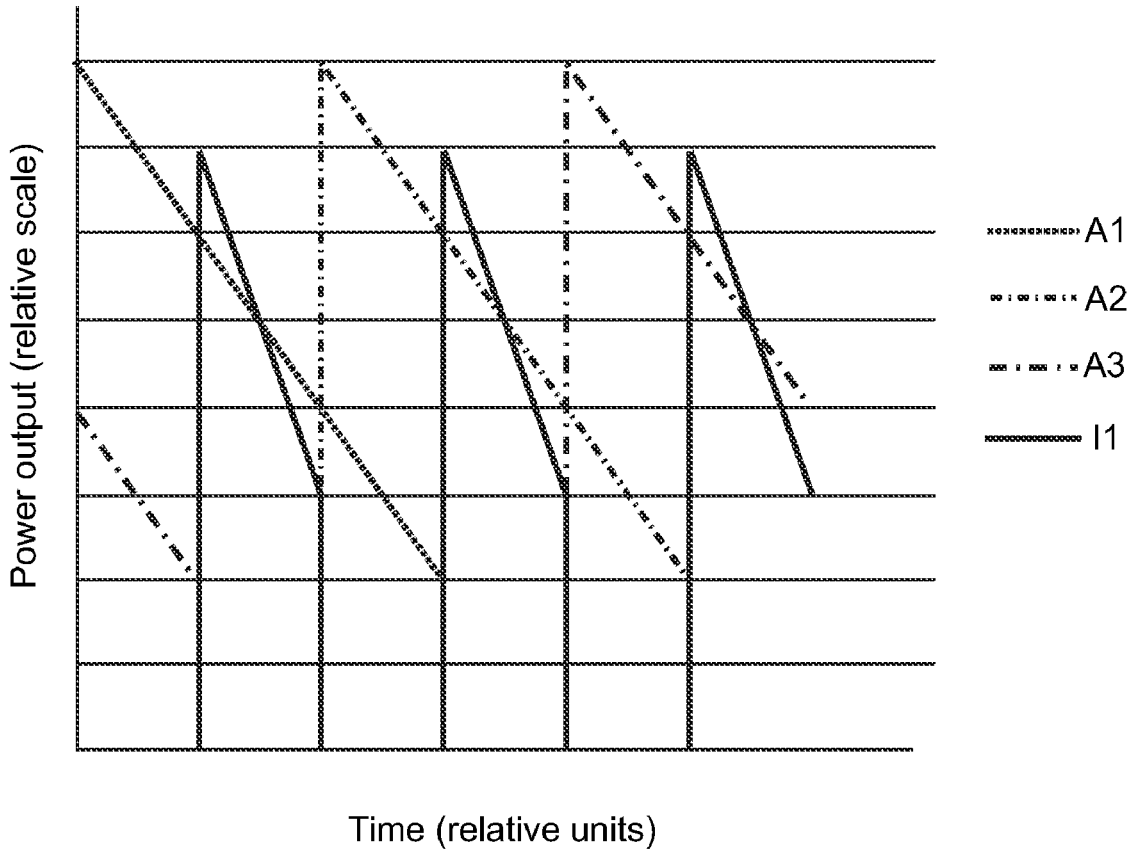
FIG. 9 is a graph illustrating the power versus time profile for the expansion phase of the system of FIGS. 7A-7F.

FIG. 9 is a graph illustrating the power versus time profile for the expansion scheme described above and illustrated in FIGS. 7A-7F for a three accumulator-one intensifier system. The power outputs for accumulator 416*a*, accumulator 416*b*, accumulator 416*c*, and intensifier 418 are represented as linear responses that decrease as the pressure in each device decreases. While this is a relative representation and depends greatly on the actual components and expansion scheme used, the general trend is shown. As shown in FIG. 9, the staging of the expansion allows for a relatively constant power output and an efficient use of resources.

FIG. 10 is a table illustrating an expansion scheme for a four accumulator-two intensifier system. It should be noted that throughout the cycle, at a minimum three hydraulic-pneumatic devices (at least two accumulators and one intensifier) are always expanding, but each starts at different time instances, such that the overall power is high and remains relatively constant.

This alternative system for expansion improves the power output by approximately two times over the systems for expansion described above. The system, while essentially doubling the power output over the alternative systems, only does so for system pressures above the mid-pressure. Thus, the three accumulators-one intensifier scheme reduces the system depth of discharge from nearly atmospheric (e.g., for the two accumulator two intensifier scheme) to the mid-pressure, reducing the system energy density by approximately 10%.

Figure 11:
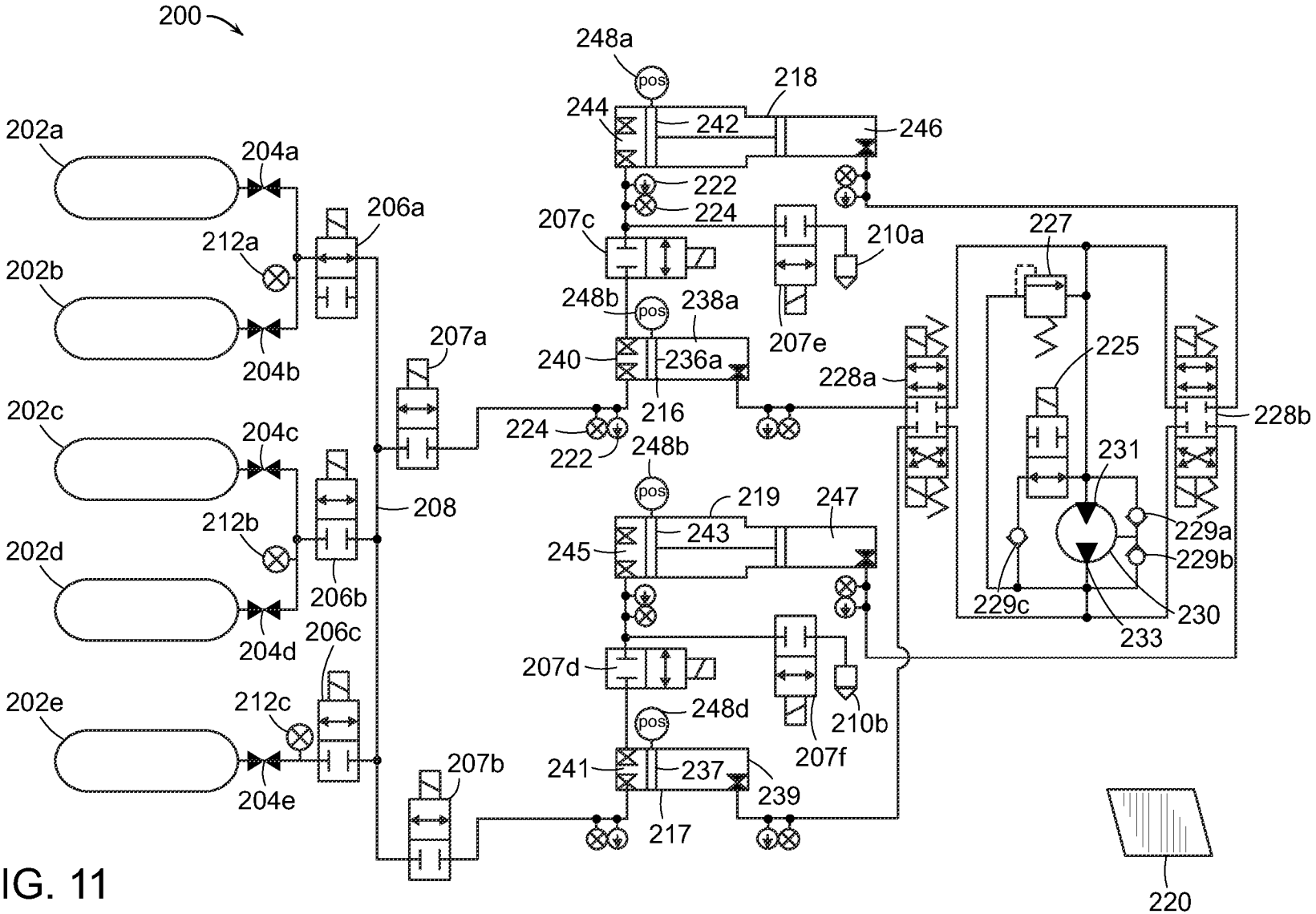
FIG. 11 is a schematic diagram of an open-air hydraulic-pneumatic energy storage and recovery system in accordance with an alternative embodiment of the invention.
Figure 12:
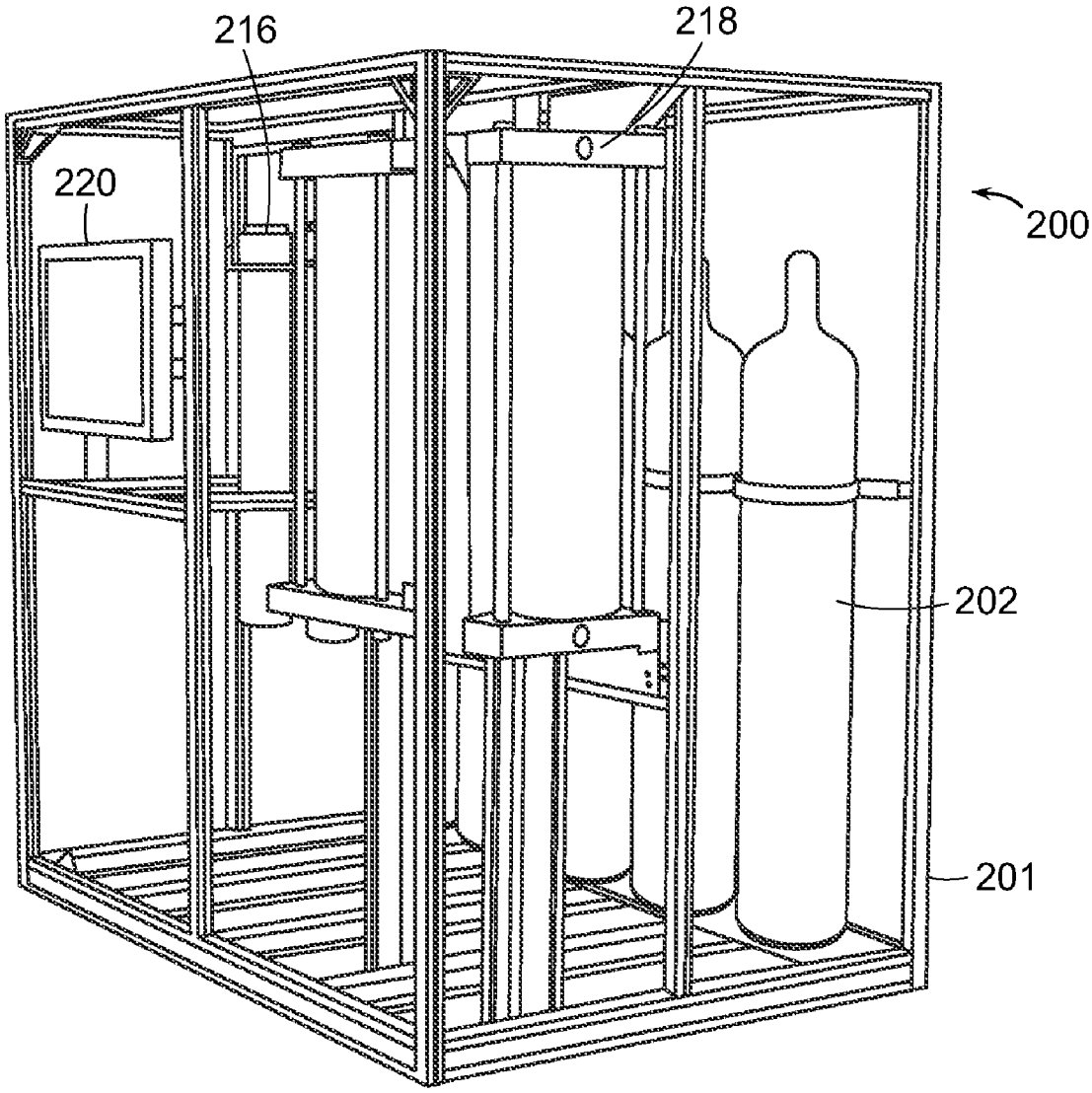
FIG. 12 is a pictorial representation of an exemplary embodiment of an open-air hydraulic-pneumatic energy storage and recovery system as shown in FIG. 11.

FIGS. 11 and 12 are schematic and pictorial representations, respectively, of one exemplary embodiment of a compressed gas-based energy storage system using a staged hydraulic-pneumatic energy conversion system that can provide approximately 5 kW of power. The system 200 is similar to those described with respect to FIGS. 1 and 4, with different control valve arrangements. The operation of the system is also substantially similar to the system 300 described in FIGS. 4-6.

As shown in FIGS. 11 and 12, the system 200 includes five high-pressure gas/air storage tanks 202*a*-202*e*. Tanks 202*a* and 202*b* and tanks 202*c* and 202*d* are joined in parallel via manual valves 204*a*, 204*b* and 204*c*, 204*d*, respectively. Tank 202*e* also includes a manual shut-off valve 204*e*. The tanks 202 are joined to a main air line 208 via automatically controlled pneumatic two-way (i.e., shut-off) valves 206*a*, 206*b*, 206*c* to a main air line 308. The tank output lines include pressure sensors 212*a*, 212*b*, 212*c*. The lines/tanks 202 could also include temperature sensors. The various sensors can be monitored by a system controller 220 via appropriate connections, as described hereinabove. The main air line 208 is coupled to a pair of multi-stage (two stages in this example) accumulator circuits via automatically controlled pneumatic shut-off valves 207*a*, 207*b*. These valves 207*a*, 207*b* are coupled to respective accumulators 216 and 217. The air chambers 240, 241 of the accumulators 216, 217 are connected, via automatically controlled pneumatic shut-offs 207*c*, 207*d*, to the air chambers 244, 245 of the intensifiers 218, 219. Pneumatic shut-off valves 207*e*, 207*f* are also coupled to the air line connecting the respective accumulator and intensifier air chambers and to a respective atmospheric air vent 210*a*, 210*b*. This arrangement allows for air from the various tanks 202 to be selectively directed to either accumulator air chamber 244, 245. In addition, the various air lines and air chambers can include pressure and temperature sensors 222 224 that deliver sensor telemetry to the controller 220.

The air chamber 240, 241 of each accumulator 216, 217 is enclosed by a movable piston 236, 237 having an appropriate sealing system using sealing rings and other components that are known to those of ordinary skill in the art. The piston 236, 237 moves along the accumulator housing in response to pressure differentials between the air chamber 240, 241 and an opposing fluid chamber 238, 239, respectively, on the opposite side of the accumulator housing. Likewise, the air chambers 244, 245 of the respective intensifiers 218, 219 are also enclosed by a moving piston assembly 242, 243. However, as previously discussed, the piston assembly 242, 243 includes an air piston 242*a*, 243*a* connected by a shaft, rod, or other coupling to a respective fluid piston, 242*b*, 243*b* that move in conjunction. The differences between the piston diameters allows a lower air pressure acting upon the air piston to generate a similar pressure on the associated fluid chamber as the higher air pressure acting on the accumulator piston. In this manner, and as previously described, the system allows for at least two stages of pressure to be employed to generate similar levels of fluid pressure.

The accumulator fluid chambers 238, 239 are interconnected to a hydraulic motor/pump arrangement 230 via a hydraulic valve 228*a*. The hydraulic motor/pump arrangement 230 includes a first port 231 and a second port 233. The arrangement 230 also includes several optional valves, including a normally open shut-off valve 225, a pressure relief valve 227, and three check valves 229 that can further control the operation of the motor/pump arrangement 230. For example, check valves 229*a*, 229*b*, direct fluid flow from the motor/pump's leak port to the port 231, 233 at a lower pressure. In addition, valves 225, 229*c* prevent the motor/pump from coming to a hard stop during an expansion cycle.

The hydraulic valve 228*a* is shown as a 3-position, 4-way directional valve that is electrically actuated and spring returned to a center closed position, where no flow through the valve 228*a* is possible in the unactuated state. The directional valve 228*a* controls the fluid flow from the accumulator fluid chambers 238, 239 to either the first port 231 or the second port 233 of the motor/pump arrangement 230. This arrangement allows fluid from either accumulator fluid chamber 238, 239 to drive the motor/pump 230 clockwise or counter-clockwise via a single valve.

The intensifier fluid chambers 246, 247 are also interconnected to the hydraulic motor/pump arrangement 230 via a hydraulic valve 228*b*. The hydraulic valve 228*b* is also a 3-position, 4-way directional valve that is electrically actuated and spring returned to a center closed position, where no flow through the valve 228*b* is possible in the unactuated state. The directional valve 228*b* controls the fluid flow from the intensifier fluid chambers 246, 247 to either the first port 231 or the second port 233 of the motor/pump arrangement 230. This arrangement allows fluid from either intensifier fluid chamber 246, 247 to drive the motor/pump 230 clockwise or counter-clockwise via a single valve.

The motor/pump 230 can be coupled to an electrical generator/motor and that drives, and is driven by the motor/pump 230. As discussed with respect to the previously described embodiments, the generator/motor assembly can be interconnected with a power distribution system and can be monitored for status and output/input level by the controller 220.

In addition, the fluid lines and fluid chambers can include pressure, temperature, or flow sensors and/or indicators 222 224 that deliver sensor telemetry to the controller 220 and/or provide visual indication of an operational state. In addition, the pistons 236, 237, 242*a*, 243*a* can include position sensors 248 that report their present position to the controller 220. The position of the piston can be used to determine relative pressure and flow of both gas and fluid.

As shown in FIG. 12, the system 200 includes a frame or supporting structure 201 that can be used for mounting and/or housing the various components. The high pressure gas storage 202 includes five 10 gallon pressure vessels (for example, standard 3000 psi laboratory compressed air cylinders). The power conversion system includes two 1.5 gallon accumulators 216, 217 (for example, 3,000 psi, 4" bore, 22" stroke, as available from Parker-Hannifin, Cleveland, Ohio) and two 15 gallon intensifiers 218, 219 (for example, air side: 250 psi, 14" bore, 22" stroke; hydraulic side: 3000 psi, 4" bore, 22" stroke, as available from Parker-Hannifin, Cleveland, Ohio). The various sensors can be, for example, transducers and/or analog gauges as available from, for example, Omega Engineering, Inc., Stamford, Conn. for pressure, Nanmac Corporation, Framingham, Mass. for temperature, Temposonic, MTS Sensors, Cary, N.C. for position, CR Magnetics, 5310-50, St. Louis, Mo. for voltage, and LEM, Hass 200, Switzerland for current.

The various valves and valve controls to automate the system will be sized and selected to suit a particular application and can be obtained from Parker-Hannifin, Cleveland, Ohio. The hydraulic motor/pump 230 can be a 10 cc/rev, F11-10, axial piston pump, as available from Parker-Hannifin. The electric generator/motor can be a nominal 24 Volt, 400 Amp high efficiency brushless SolidSlot 24 DC motor with a NPS6000 buck boost regulator, as available from Ecycle, Inc., Temple, Pa. The controller 220 can include an USB data acquisition block (available from Omega Instruments) used with a standard PC running software created using the LabVIEW® software (as available from National Instruments Corporation, Austin Tex.) and via closed loop control of pneumatically actuated valves (available from Parker-Hannifin) driven by 100 psi air that allow 50 millisecond response times to be achieved.

Figure 13A:
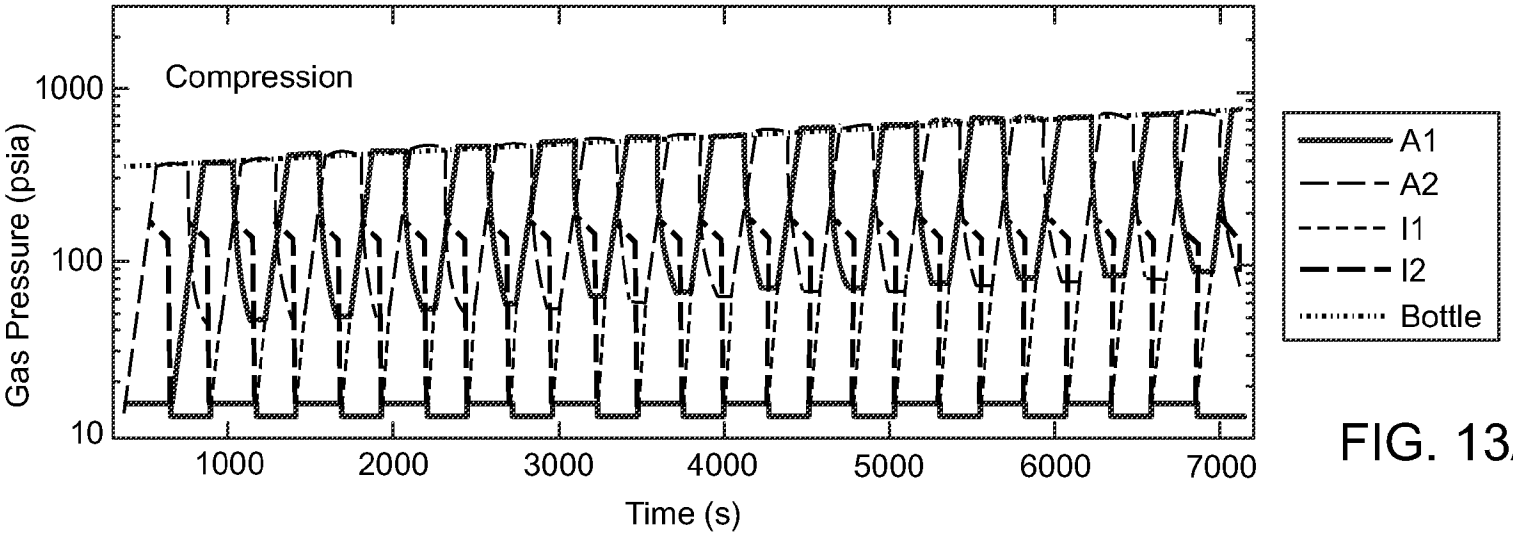
FIG. 13A is a graphical representation of the gas pressures of various components of the system of FIG. 11 during energy storage.
Figure 13B:
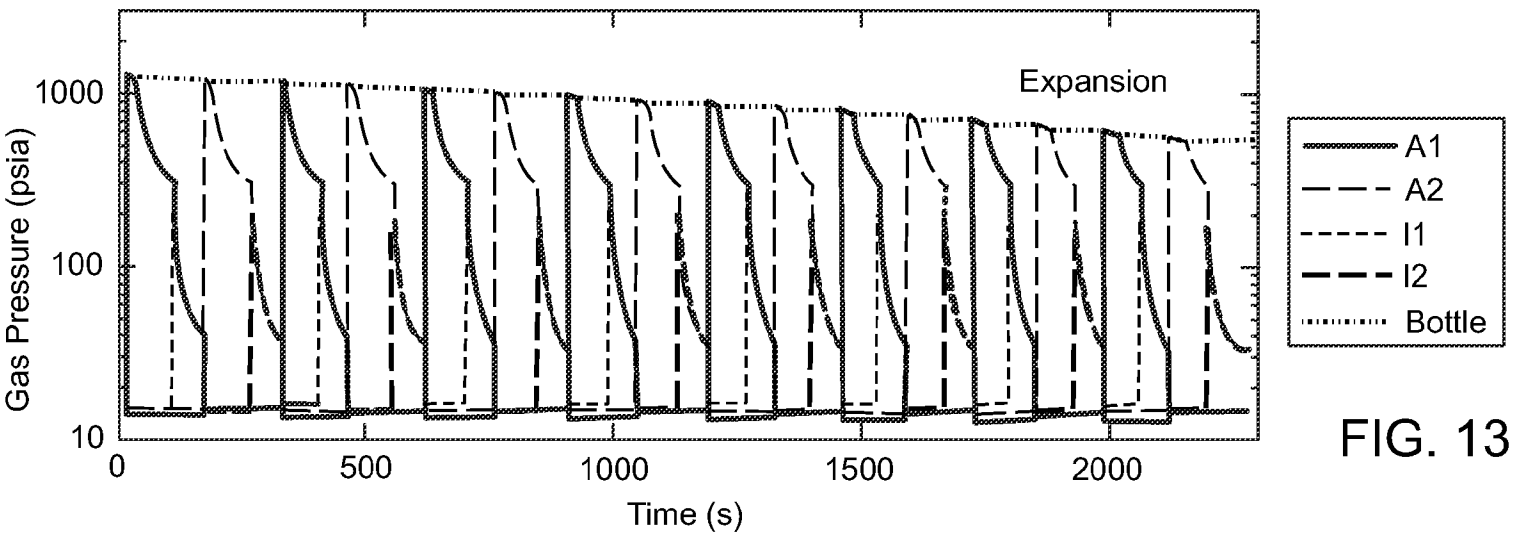
FIG. 13B is a graphical representation of the gas pressures of various components of the system of FIG. 11 during energy recovery.

FIGS. 13A and 13B are graphical representations of the pressures in the various components through 13 energy storage (i.e., compression) cycles (FIG. 13A) and eight energy recovery (i.e., expansion) cycles (FIG. 13B). The accumulators' pressures are shown in solid lines (light and dark solid lines to differentiate between the two accumulators), intensifiers' pressures are shown in dashed lines (light and dark dashed lines to differentiate between the two intensifiers), and the compressed gas storage tank pressures are shown in dotted lines. In the graphs, the accumulators and intensifiers are identified as A1, A2 and I1, I2, respectively, to identify the first accumulator/intensifier cycled and the second accumulator/intensifier cycled. The graphs represent the pressures as they exist in the accumulators and intensifiers as the pressure in the storage tank increases and decreases, corresponding to compression and expansion cycles. The basic operation of the system is described with respect to FIGS. 4-6. Generally, a full expansion cycle, as shown in FIG. 13B, consists of air admitted from a high pressure gas bottle and expanded from high pressure to mid pressure in one accumulator and from mid-pressure to atmospheric pressure in an intensifier, followed by an expansion in a second accumulator and intensifier which returns the system to its original state. Generally, over the course of the compression phase, the pressure and energy stored in the tanks increases, and likewise during expansion decreases, as indicated in the graphs.

Figure 14A:
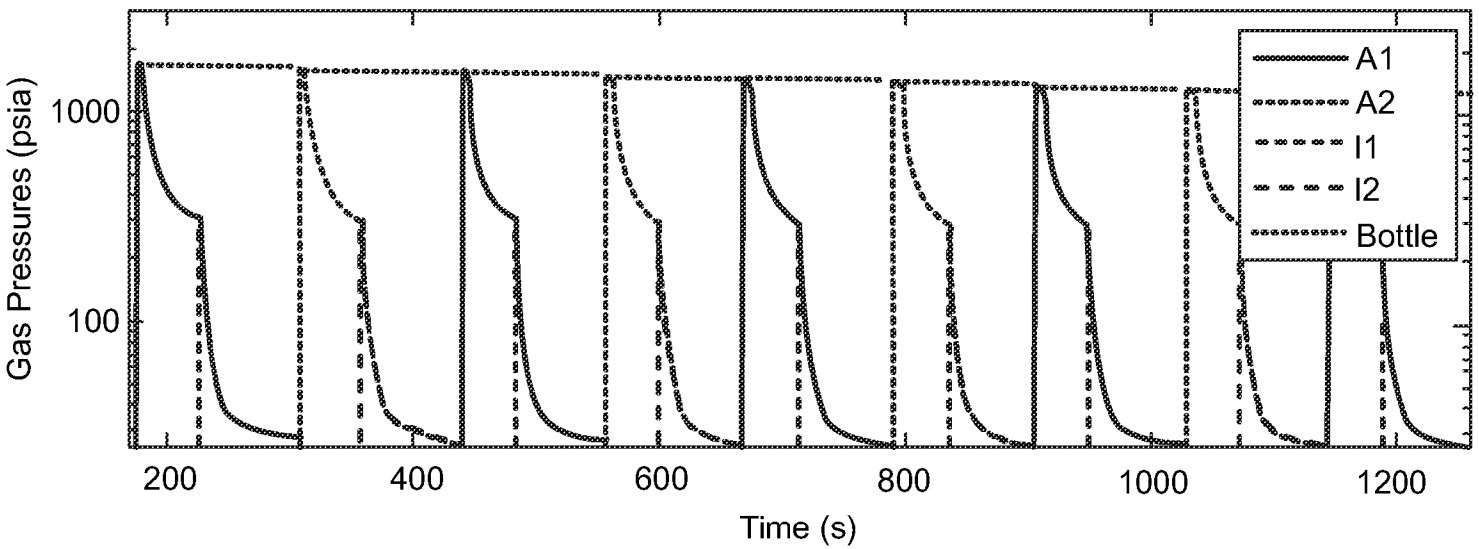
FIG. 14A is another graphical representation of the gas pressures of various components of the system of FIG. 11 during an expansion phase.
Figure 14B:
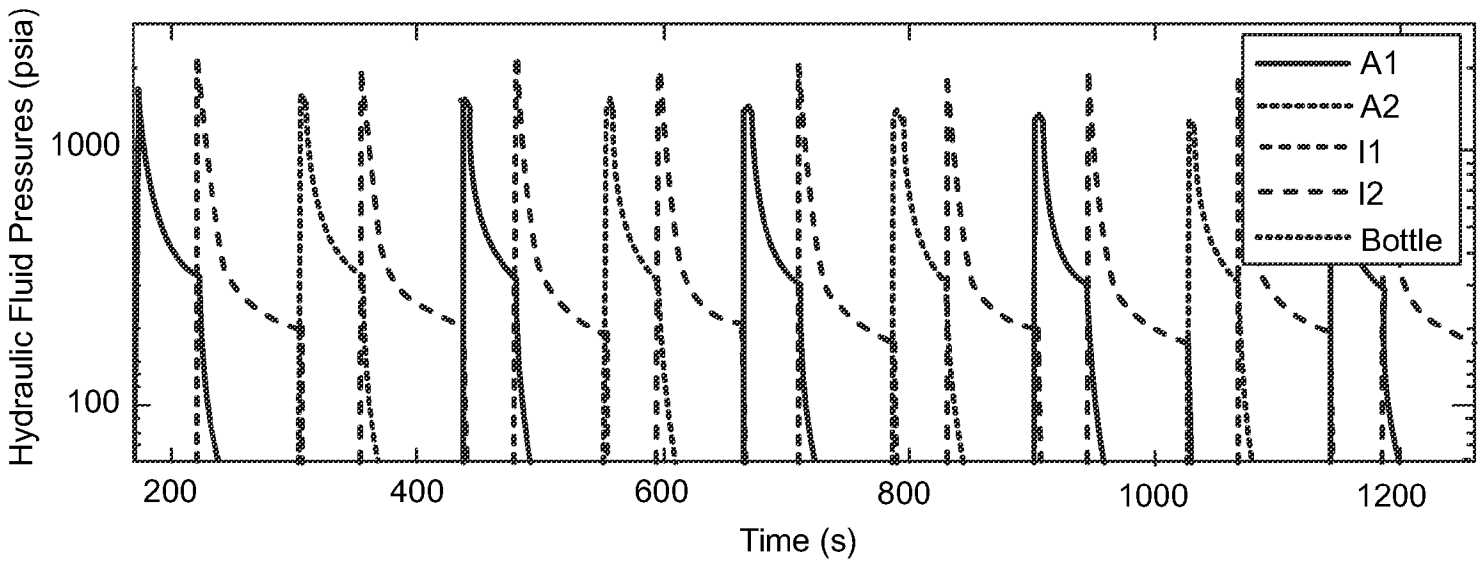
FIG. 14B is a graphical representation of the corresponding hydraulic pressures of various components of the system of FIG. 11 during the expansion phase.

FIGS. 14A and 14B are graphical representations of the corresponding pneumatic and hydraulic pressures in the various components of the system 200 of FIG. 11 through four energy recovery (i.e., expansion) cycles. The accumulators' pressures are shown in solid lines (light and dark solid lines to differentiate between the two accumulators), intensifiers' pressures are shown in dashed lines (light and dark dashed lines to differentiate between the two intensifiers), and the compressed gas storage tank pressures are shown in dotted lines.

The graph of FIG. 14A represents the gas pressures of the accumulators 216, 217, the intensifiers 218, 219, and the tank 202 during expansion. The graph of FIG. 14B represents the corresponding hydraulic pressures of the accumulators 216, 217 and the intensifiers 218, 219 during the same expansion cycles. As can be seen in the graphs, the intensification stage keeps the hydraulic pressures high even when the gas pressures drop towards atmospheric.

The foregoing has been a detailed description of various embodiments of the invention. Various modifications and additions can be made without departing from the spirit and scope if the invention. Each of the various embodiments described above may be combined with other described embodiments in order to provide multiple features. Furthermore, while the foregoing describes a number of separate embodiments of the apparatus and method of the present invention, what has been described herein is merely illustrative of the application of the principles of the present invention. For example, the size, performance characteristics and number of components used to implement the system is highly variable. While two stages of expansion and compression are employed in one embodiment, in alternative embodiments, additional stages of intensifiers, with a larger area differential between gas and fluid pistons can be employed. Likewise, the surface area of the gas piston and fluid piston within an accumulator need not be the same. In any case, the intensifier provides a larger air piston surface area versus fluid piston area than the area differential of the accumulator's air and fluid pistons. Additionally, while the working gas is air herein, it is contemplated that high and low-pressure reservoirs of a different gas can be employed in alternative embodiments to improve heat-transfer or other system characteristics. Moreover, while piston components are used to transmit energy between the fluid and gas in both accumulators and intensifiers, it is contemplated that any separating boundary that prevents mixing of the media (fluid and gas), and that transmits mechanical energy therebetween based upon relative pressures can be substituted. Hence, the term "piston" can be taken broadly to include such energy transmitting boundaries. Accordingly, the described embodiments are to be considered in all respects as only illustrative and not restrictive.

What is claimed is:

1. An energy storage and recovery system suitable for the efficient use and conservation of energy resources, the system comprising:

a cylinder assembly comprising two chambers separated by a movable boundary mechanism;

a plurality of control mechanisms associated with the cylinder assembly for controlling a flow of fluid therethrough; and a control system for actuating the control mechanisms, the control system (i) being responsive to at least one sensor that monitors a system parameter comprising at least one of a fluid state, a fluid flow, a temperature, a pressure, a position of the boundary mechanism, or a rate of movement of the boundary mechanism, (ii) actuating at least one of the plurality of control mechanisms based on the monitored system parameter, and (iii) actuating at least one of the plurality of control mechanisms during at least one of compression or expansion of gas in the cylinder assembly in order to maintain the gas at a substantially constant temperature.

2. The system of claim 1, further comprising a hydraulic motor/pump in fluid communication with the cylinder assembly.

3. The system of claim 2, wherein the control system controls the hydraulic motor/pump based on the monitored system parameter.

4. The system of claim 1, further comprising an electric generator/motor controlled by the control system based on the monitored system parameter.

5. The system of claim 1, wherein at least one of the chambers is a pneumatic chamber.

6. The system of claim 5, wherein the cylinder assembly comprises a pneumatic-hydraulic cylinder.

7. The system of claim 1, further comprising a second cylinder assembly connected to the cylinder assembly, the control system operating the cylinder assembly and the second cylinder assembly in a staged manner to provide a predetermined pressure profile at least one outlet.

8. The system of claim 7, wherein the second cylinder assembly comprises two separated chambers, at least one of which is a pneumatic chamber.

9. The system of claim 8, wherein the second cylinder assembly comprises a pneumatic-hydraulic cylinder.

10. The system of claim 7, wherein (i) the cylinder assembly transfers mechanical energy at a first pressure ratio, and (ii) the second cylinder assembly transfers mechanical energy at a second pressure ratio greater than the first pressure ratio.

11. The system of claim 7, wherein the cylinder assembly and the second cylinder assembly are connected in parallel.

12. An energy storage and recovery system suitable for the efficient use and conservation of energy resources, the system comprising:

a cylinder assembly comprising two chambers separated by a movable boundary mechanism;

a plurality of control mechanisms associated with the cylinder assembly for controlling a flow of fluid therethrough;

a control system for actuating the control mechanisms, the control system (i) being responsive to at least one sensor that monitors a system parameter comprising at least one of a fluid state, a fluid flow, a temperature, a pressure, a position of the boundary mechanism, or a rate of movement of the boundary mechanism, and (ii) actuating at least one of the plurality of control mechanisms based on the monitored system parameter; and a second cylinder assembly connected to the cylinder assembly, the control system operating the cylinder assembly and the second cylinder assembly in a staged manner to provide a predetermined pressure profile at least one outlet.

13. The system of claim 12, wherein the second cylinder assembly comprises two separated chambers, at least one of which is a pneumatic chamber.

14. The system of claim 13, wherein the second cylinder assembly comprises a pneumatic-hydraulic cylinder.

15. The system of claim 12, wherein (i) the cylinder assembly transfers mechanical energy at a first pressure ratio, and (ii) the second cylinder assembly transfers mechanical energy at a second pressure ratio greater than the first pressure ratio.

16. The system of claim 12, wherein the cylinder assembly and the second cylinder assembly are connected in parallel.

17. The system of claim 12, further comprising a hydraulic motor/pump in fluid communication with the cylinder assembly.

18. The system of claim 17, wherein the control system controls the hydraulic motor/pump based on the monitored system parameter.

19. The system of claim 12, further comprising an electric generator/motor controlled by the control system based on the monitored system parameter.

20. The system of claim 12, wherein at least one of the chambers is a pneumatic chamber.

21. The system of claim 20, wherein the cylinder assembly comprises a pneumatic-hydraulic cylinder.

22. For an energy storage and recovery system suitable for the efficient use and conservation of energy resources, comprising (i) a cylinder assembly comprising two chambers separated by a movable boundary mechanism, and (ii) a plurality of control mechanisms associated with the cylinder assembly for controlling a flow of fluid therethrough:

a control system for actuating the control mechanisms, the control system (i) being responsive to at least one sensor that monitors a system parameter comprising at least one of a fluid state, a fluid flow, a temperature, a pressure, a position of the boundary mechanism, or a rate of movement of the boundary mechanism, (ii) actuating at least one of the plurality of control mechanisms based on the monitored system parameter, and (iii) actuating at least one of the plurality of control mechanisms during at least one of compression or expansion of gas in the cylinder assembly in order to maintain the gas at a substantially constant temperature.

23. For an energy storage and recovery system suitable for the efficient use and conservation of energy resources, comprising (i) a cylinder assembly comprising two chambers separated by a movable boundary mechanism, (ii) a second cylinder assembly connected to the cylinder assembly, and (iii) a plurality of control mechanisms associated with the cylinder assembly for controlling a flow of fluid therethrough:

a control system for actuating the control mechanisms, the control system (i) being responsive to at least one sensor that monitors a system parameter comprising at least one of a fluid state, a fluid flow, a temperature, a pressure, a position of the boundary mechanism, or a rate of movement of the boundary mechanism, (ii) actuating at least one of the plurality of control mechanisms based on the monitored system parameter, and (iii) operating the cylinder assembly and the second cylinder assembly in a staged manner to provide a predetermined pressure profile at least one outlet.

* * * * *